US009851679B2

(12) United States Patent
Ikeda

(10) Patent No.: US 9,851,679 B2
(45) Date of Patent: Dec. 26, 2017

(54) PROCESSING CARTRIDGE, PHOTORECEPTOR DRUM UNIT, AND END MEMBER PAIR

(71) Applicant: Mitsubishi Chemical Corporation, Chiyoda-ku (JP)

(72) Inventor: Shuichi Ikeda, Odawara (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 15/157,860

(22) Filed: May 18, 2016

(65) Prior Publication Data

US 2016/0259290 A1 Sep. 8, 2016

Related U.S. Application Data

(63) Continuation of application No. PCT/JP2014/080556, filed on Nov. 18, 2014.

(30) Foreign Application Priority Data

Nov. 19, 2013 (JP) ..... 2013-238840

(51) Int. Cl.
*G03G 15/00* (2006.01)
*G03G 21/18* (2006.01)

(52) U.S. Cl.
CPC ..... *G03G 15/751* (2013.01); *G03G 15/757* (2013.01); *G03G 21/18* (2013.01); *G03G 21/1864* (2013.01)

(58) Field of Classification Search
CPC .... G03G 15/751; G03G 15/757; G03G 21/18; G03G 21/1864; G03G 2221/1606; G03G 2221/1647; G03G 2221/1657
USPC ..... 399/117, 159, 167
See application file for complete search history.

(56) References Cited

U.S. PATENT DOCUMENTS

2008/0260428 A1* 10/2008 Ueno ..... G03G 15/757 399/167
2009/0317129 A1 12/2009 Abe et al.
2009/0317131 A1 12/2009 Morioka et al.
(Continued)

FOREIGN PATENT DOCUMENTS

JP 5-332353 12/1993
JP 9-230654 9/1997
(Continued)

OTHER PUBLICATIONS

International Search Report dated Feb. 3, 2015 in PCT/JP2014/080556, filed on Nov. 18, 2014 ( with English Translation).
(Continued)

*Primary Examiner* — Sophia S Chen
(74) *Attorney, Agent, or Firm* — Oblon, McClelland, Maier & Neustadt, L.L.P.

(57) ABSTRACT

A photoreceptor drum unit is provided with a cylindrical photoreceptor drum, and two end members which are respectively disposed at both ends of the photoreceptor drum in an axial direction. One of the end members is provided with an elastic member, is biased in the axial direction, and is extendable and contractable. The other of the end members is provided with a cylindrical bearing member and a shaft member held in the bearing member.

19 Claims, 185 Drawing Sheets

(56) References Cited

U.S. PATENT DOCUMENTS

| | | | | |
|---|---|---|---|---|
| 2010/0034561 | A1* | 2/2010 | Batori | G03G 15/757 399/167 |
| 2011/0159970 | A1 | 6/2011 | Okabe | |
| 2012/0183331 | A1* | 7/2012 | Huang | G03G 15/757 399/167 |
| 2012/0243905 | A1 | 9/2012 | Uratani et al. | |
| 2014/0037336 | A1 | 2/2014 | Mei Yan | |

FOREIGN PATENT DOCUMENTS

| | | |
|---|---|---|
| JP | 2001-117308 | 4/2001 |
| JP | 2010-2688 | 1/2010 |
| JP | 2010-2690 | 1/2010 |
| JP | 2011-133682 | 7/2011 |
| JP | 2011-145670 | 7/2011 |
| JP | 2012-53402 | 3/2012 |
| WO | WO 2012/113289 A1 | 8/2012 |
| WO | WO 2012/113299 A1 | 8/2012 |
| WO | WO 2013/006996 A1 | 1/2013 |

OTHER PUBLICATIONS

Written Opinion dated Feb. 3, 2015 in PCT/JP2014/080556, filed on Nov. 18, 2014.

* cited by examiner

PROCESSING CARTRIDGE, PHOTORECEPTOR DRUM UNIT, AND END MEMBER PAIR

CROSS REFERENCE TO RELATED APPLICATIONS

This application is a continuation of International Patent Application No. PCT/JP2014/080556 filed on Nov. 18, 2014, claiming priority from Japanese Patent Application No. 2013-238840 filed on Nov. 19, 2013, the contents of which are incorporated herein by reference.

BACKGROUND OF THE INVENTION

1. Field of the Invention

The present invention relates to a processing cartridge, a photoreceptor drum unit, and end member pair, which are used in an image forming apparatus, such as a laser printer or a copier.

2. Description of the Related Art

In an image forming apparatus, such as a laser printer or a copier, a processing cartridge which is attachable to and detachable from a main body (hereinafter, there is a case of being described as "apparatus main body") of the image forming apparatus, is provided.

The processing cartridge is a member which forms content to be expressed, such as characters or figures, in a posture of being mounted on the apparatus main body, and transfers the content to a recording medium, such as a paper sheet. Therefore, in the processing cartridge, a photoreceptor drum in which the content to be transferred is formed, and charging means or developing means for forming the content to be transferred to the photoreceptor drum, are provided.

Regarding the processing cartridge, the same processing cartridge for maintenance is attached to or detached from the apparatus main body, or an old processing cartridge is disengaged from the apparatus main body for replacing a new processing cartridge, and instead of the old processing cartridge, the new processing cartridge is mounted on the apparatus main body. It is desirable that attachment and detachment of the processing cartridge can be performed by a user of the image forming apparatus, and is performed as easy as possible from such a viewpoint.

In addition, it is necessary that the photoreceptor drum included in the processing cartridge is rotated during the operation. Here, a driving shaft of the apparatus main body is engaged with the photoreceptor drum directly or via another member, and accordingly, an end member is provided so that the photoreceptor drum receives a rotating force from the driving shaft and rotates.

In addition, in this manner, in order to attach and detach the processing cartridge to and from the apparatus main body, it is necessary to release (disengage) the engagement of the driving shaft of the apparatus main body and the end member provided in the photoreceptor drum, and to reengage (mount) the driving shaft and the end member.

Here, when the photoreceptor drum (processing cartridge) can be attached and detached by being moved in the shaft direction of the driving shaft of the apparatus main body, it is relatively easy to configure the apparatus for this. However, from the viewpoint of reducing in size of the image forming apparatus and ensuring an attachment and detachment space of the processing cartridge, it is preferable to disengage the processing cartridge from the apparatus main body to be pulled out in the direction different from the axial direction of the driving shaft, or to mount the processing cartridge to the apparatus main body to be pushed in this direction.

In Patent Document 1 (JP-A-2010-002688), a configuration for attaching and detaching the processing cartridge in the direction which is different from the axial direction of the driving shaft of the apparatus main body, is disclosed. Specifically, a coupling member (shaft member) described in PTL 1 is attached to be swingable to a drum flange (shaft member) by providing a spherical portion. Therefore, a part (rotating force receiving member) which is provided in the coupling member and is engaged with the driving shaft of the apparatus main body, can swing around the spherical portion and change an angle with respect to the axis of the photoreceptor drum, and mounting and disengaging of the driving shaft of the apparatus main body and the photoreceptor drum are easily performed.

Accordingly, the photoreceptor drum included in the processing cartridge can be engaged with the apparatus main body via the coupling member, and can rotate following the driving shaft. However, there is a case where the photoreceptor drum moves in the axial direction and a position thereof is not determined when the engagement is performed, and appropriate engagement cannot be performed. Accordingly, there is a concern that the driving shaft idles and the photoreceptor drum does not rotate, or that an image region of a photoreceptor is not stable, or printing position deviation or color deviation is generated even when the photoreceptor drum rotates.

Meanwhile, according to the configuration of Patent Document 1, for example, as illustrated in FIGS. 24A and 24B of Patent Document 1, an end surface of a bearing member and a rib of a drum frame body come into contact with each other, the movement in the axial direction (longitudinal direction) is regulated by nipping the bearing member (drum flange) from both sides, that is, one side and the other side of the axial direction, and the positioning is performed.

Patent Document 1: JP-A-2010-002688

However, when the movement of the photoreceptor drum in the axial direction is strictly regulated in this manner, during the assembly of the processing cartridge, it is necessary to make the photoreceptor drum unit fitted to a part which does not have enough dimension. Therefore, it is necessary to improve precision of the member, management becomes more strict, and this influences productivity.

SUMMARY OF THE INVENTION

Illustrative aspects of the present invention provide a processing cartridge which can easily position a photoreceptor drum in the axial direction. In addition, illustrative aspects of the present invention provide a photoreceptor drum unit and an end member pair.

Hereinafter, the Illustrative aspects of the present invention will be described.

In accordance with an illustrative aspect, a processing cartridge to be attached to and detached from an image forming apparatus main body is provided with: a housing; and a photoreceptor drum unit which is disposed in the housing and held in the housing. The photoreceptor drum unit includes: a cylindrical photoreceptor drum; and two end members which are respectively disposed at both ends of the photoreceptor drum in an axial direction. One of the end members is provided with an elastic member, is biased in the axial direction, and is extendable and contractable. The other of the end members is provided with a cylindrical bearing member and a shaft member held in the bearing member. The one of the end members and the other of the end members come into contact with the housing on surfaces opposite to the photoreceptor drum, and do not come into contact with the housing on surfaces facing the photoreceptor drum side.

In accordance with an illustrative aspect, the other of the end members is held so that the shaft member swings with respect to the bearing member.

In accordance with an illustrative aspect, the shaft member of the other of the end members includes: a rotating shaft which moves in an axial direction of the bearing member, and a rotating force receiving member which is disposed in one end portion of the rotating shaft, swings with respect to an axis of the rotating shaft, and is provided with an engagement claw which is to be engaged with a driving shaft of the image forming apparatus main body.

In accordance with an illustrative aspect, the shaft member of the other of the end members includes: a rotating shaft, a rotating force receiving member which is disposed in one end portion of the rotating shaft, and is provided with an engaging member to be engaged with a driving shaft of the image forming apparatus main body, and a regulating member which is engaged with or disengaged from the rotating shaft or the rotating force receiving member by pressing, and configured to switch a posture in which the engaging member is engaged with the driving shaft and a posture of not being engaged.

In accordance with an illustrative aspect, the shaft member of the other of the end members includes: a shaft-shape rotating shaft which is disposed coaxially to the bearing member, and moves in the axial direction according to a rotation around an axis with respect to the bearing member, and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order.

In accordance with an illustrative aspect, the shaft member of the other of the end members includes: a shaft-shape rotating shaft which is disposed coaxially to the bearing member, and moves in the axial direction according to a rotation around an axis with respect to the bearing member, and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order, and the rotating force receiving member moves to be inclined with respect to the axis.

In accordance with an illustrative aspect, a processing cartridge to be attached to and detached from an image forming apparatus main body is provided with: a housing; and a photoreceptor drum unit which is disposed in the housing and held in the housing. The photoreceptor drum unit includes: a cylindrical photoreceptor drum, and two end members which are respectively disposed at both ends of the photoreceptor drum in an axial direction. One of the end members is provided with an elastic member, is biased in the axial direction, and is extendable and contractable. The other of the end members is provided with a cylindrical bearing member and a shaft member held in the bearing member. A movement of the one of the end members is regulated only in one direction among both directions along an axis of the photoreceptor drum by the housing, and a movement of the other of the end members is regulated only in the other direction among the both directions along the axis of the photoreceptor drum by the housing.

In accordance with an illustrative aspect, the other of the end members is held so that the shaft member swings with respect to the bearing member.

In accordance with an illustrative aspect, the shaft member of the other of the end members includes: a rotating shaft which moves in an axial direction of the bearing member; and a rotating force receiving member which is disposed in one end portion of the rotating shaft, swings with respect to an axis of the rotating shaft, and is provided with an engagement claw which is to be engaged with a driving shaft of the image forming apparatus main body.

In accordance with an illustrative aspect, the shaft member of the other of the end members includes: a rotating shaft; a rotating force receiving member which is disposed in one end portion of the rotating shaft, and is provided with an engaging member which is to be engaged with a driving shaft of the image forming apparatus main body; and a regulating member which is engaged with or disengaged from the rotating shaft or the rotating force receiving member by pressing, and switches a posture in which the engaging member is engaged with the driving shaft, and a posture of not being engaged.

In accordance with an illustrative aspect, the shaft member of the other of the end members includes: a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order.

In accordance with an illustrative aspect, the shaft member of the other of the end members includes: a shaft-shape rotating shaft which is disposed coaxially to the bearing member, and moves in the axial direction according to a rotation around an axis with respect to the bearing member, and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order, and the rotating force receiving member moves to be inclined with respect to the axis.

In accordance with an illustrative aspect, a photoreceptor drum unit is provided with: a cylindrical photoreceptor drum; and two end members which are respectively disposed at both ends of the photoreceptor drum in an axial direction. One of the end members is provided with an elastic member, is biased in the axial direction, and is extendable and contractable. The other of the end members is provided with a cylindrical bearing member and a shaft member held in the bearing member. A gear is formed in an outer circumferential portion of the bearing member of the other of the end members. An outer diameter of the bearing member is equal to or smaller than an outer diameter of the photoreceptor drum except a part at which the gear is formed.

In accordance with an illustrative aspect, the other of the end members is held so that the shaft member swings with respect to the bearing member.

In accordance with an illustrative aspect, the shaft member of the other of the end members includes: a rotating shaft which moves in the axial direction of the bearing member, and a rotating force receiving member which is disposed in one end portion of the rotating shaft, swings with respect to the axis of the rotating shaft, and is provided with an engagement claw which is to be engaged with a driving shaft of the image forming apparatus main body.

In accordance with an illustrative aspect, the shaft member of the other of the end members includes: a rotating shaft; a rotating force receiving member which is disposed in one end portion of the rotating shaft, and is provided with an engaging member which is to be engaged with a driving shaft of the image forming apparatus main body; and a regulating member which is engaged with or disengaged from the rotating shaft or the rotating force receiving member by pressing, and switches a posture in which the engaging member is engaged with the driving shaft, and a posture of not being engaged.

In accordance with an illustrative aspect, the shaft member of the other of the end members includes: a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order.

In accordance with an illustrative aspect, the shaft member of the other of the end members includes: a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order, and the rotating force receiving member moves to be inclined with respect to the axis.

In accordance with an illustrative aspect, in an end member pair which is disposed in an end portion of a photoreceptor drum, one end member is provided with an elastic member, is biased, and is extendable and contractable. The other end member is provided with a cylindrical bearing member and a shaft member held in the bearing member. A gear is formed in an outer circumferential portion of the bearing member, and an outer diameter of the bearing member is formed to be the largest at a part where the gear is formed.

In accordance with an illustrative aspect, the other end member is held so that the shaft member swings with respect to the bearing member.

In accordance with an illustrative aspect, the shaft member of the other end member includes: a rotating shaft which moves in the axial direction of the bearing member; and a rotating force receiving member which is disposed in one end portion of the rotating shaft, swings with respect to an axis of the rotating shaft, and is provided with an engagement claw which is to be engaged with a driving shaft of the image forming apparatus main body.

In accordance with an illustrative aspect, the shaft member of the other end member includes: a rotating shaft; a rotating force receiving member which is disposed in one end portion of the rotating shaft, and is provided with an engaging member which is to be engaged with a driving shaft of the image forming apparatus main body; and a regulating member which is engaged with or disengaged from the rotating shaft or the rotating force receiving member by pressing, and switches a posture in which the engaging member is engaged with the driving shaft, and a posture of not being engaged.

In accordance with an illustrative aspect, the shaft member of the other end member includes: a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order.

In accordance with an illustrative aspect, the shaft member of the other end member includes: a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of the image forming apparatus main body is disposed at a tip end. A rotating force around the axis is transmitted to the rotating force receiving member, the rotating shaft, and the bearing member, in order, and the rotating force receiving member moves to be inclined with respect to the axis.

According to the illustrative aspects, in the end member pair which is respectively disposed in the end portions of the photoreceptor drum, one end member has a biasing force and is extendable and contractable in the axial direction. Therefore, when the photoreceptor drum unit is configured, the length thereof can be easily and finely adjusted. Accordingly, the positional relationship between the other end member and the driving shaft of the apparatus main body becomes appropriate by the biasing force, and defects, such as idling, can be prevented. In addition, according to this, since it is not necessary to strictly regulate the movement of the photoreceptor drum in the axial direction, when assembling the processing cartridge, it is not necessary to provide a regulation part which does not have enough dimension, and to improve precision of the member. Accordingly, the management becomes easy, and productivity is improved.

In addition, since it is possible to allow a difference in the length of the photoreceptor drum in a range where the end member extends and contracts, it is possible to use common components of the photoreceptor drum unit, and reduction in costs can be expected by inventory reduction.

BRIEF DESCRIPTION OF THE DRAWINGS

FIG. 69 is a sectional view of an end member 830.

FIG. 70A is one sectional view illustrating the periphery of the claw member 859 in the end member 830.

FIG. 70B is another sectional view illustrating the periphery of the claw member 859 in the end member 830.

FIG. 71 is a perspective view of the rotating shaft 851 and a tip end member 955.

FIG. 72A is a perspective view of a claw member 1059.

FIG. 72B is a front view of the claw member 1059.

FIG. 72C is a sectional view of the claw member 1059.

FIG. 73A is one sectional view of a shaft member 1050.

FIG. 73B is another sectional view of the shaft member 1050.

FIG. 74A is a perspective view of a shaft member 1150.

FIG. 74B is an exploded perspective view of the shaft member 1150.

FIG. 75 is a perspective view of a rotating shaft 1151 and a tip end member 1155.

Figure 76A:
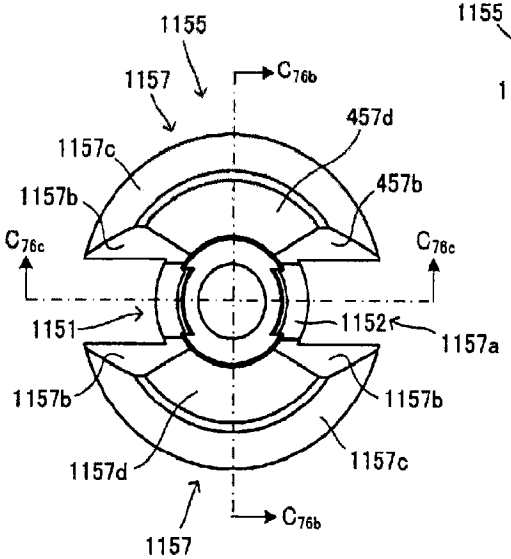

FIG. 76A is a plan view of the rotating shaft 1151 and the tip end member 1155.

Figure 76B:
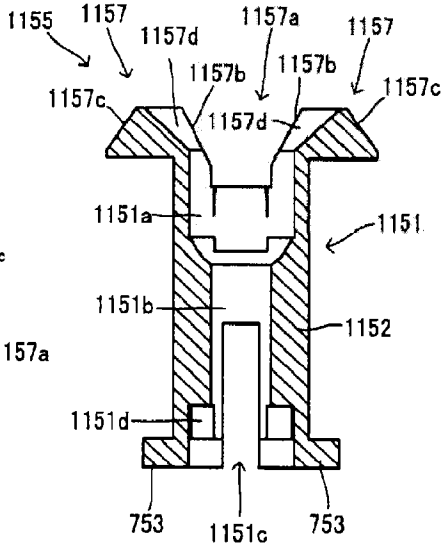

FIG. 76B is one sectional view of the rotating shaft 1151 and the tip end member 1155.

Figure 76C:
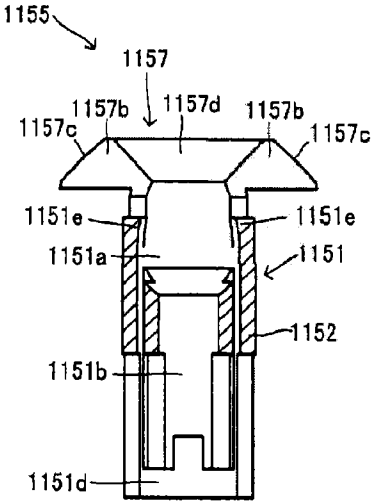

FIG. 76C is another sectional view of the rotating shaft 1151 and the tip end member 1155.

Figure 77A:
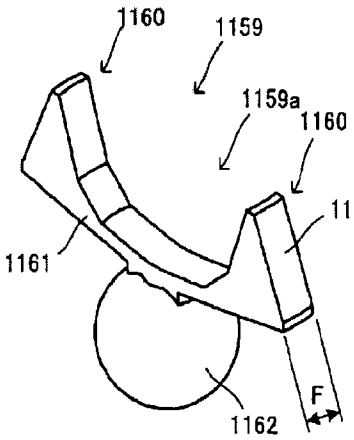

FIG. 77A is a perspective view of a claw member 1159.

Figure 77B:
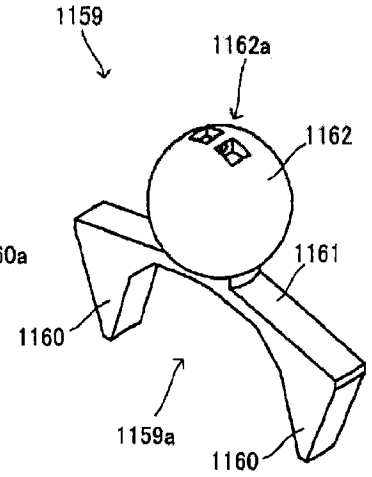

FIG. 77B is a perspective view when viewed from another direction of the claw member 1159.

Figure 77C:
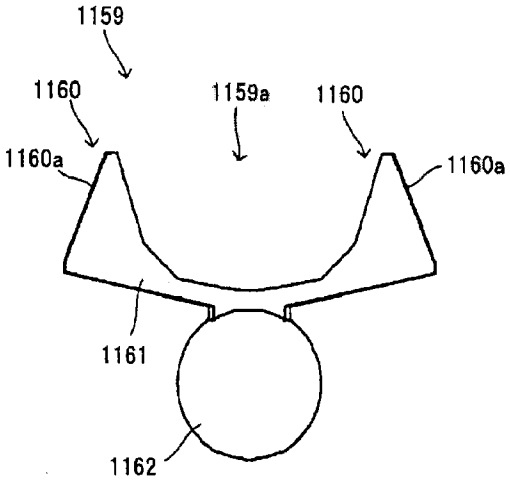

FIG. 77C is a front view of the claw member 1159.

Figure 78B:
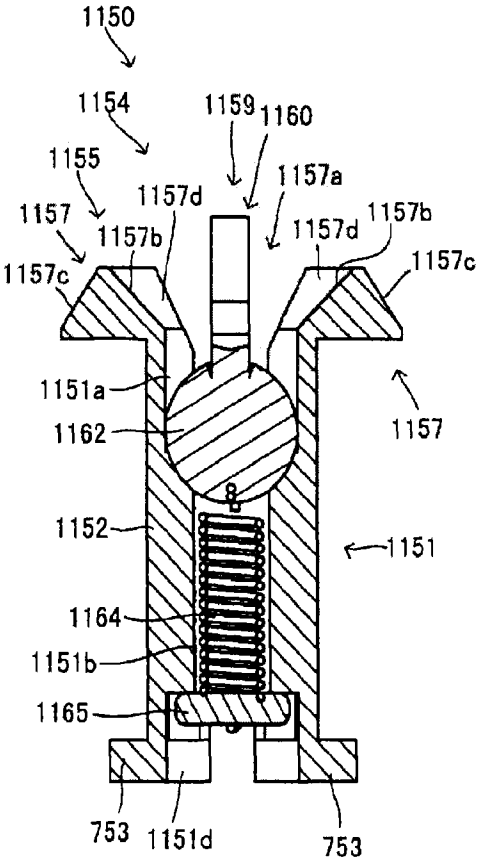
Figure 78A:
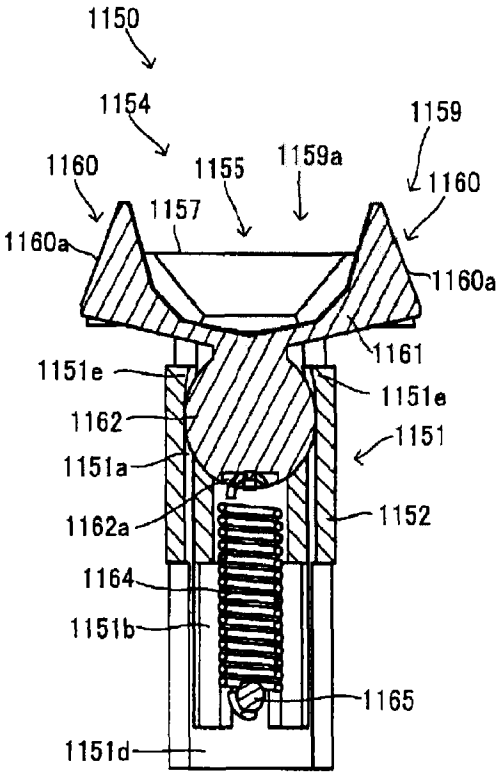

FIG. 78A is one sectional view of the shaft member 1150.

FIG. 78B is another sectional view of the shaft member 1150.

Figure 79:
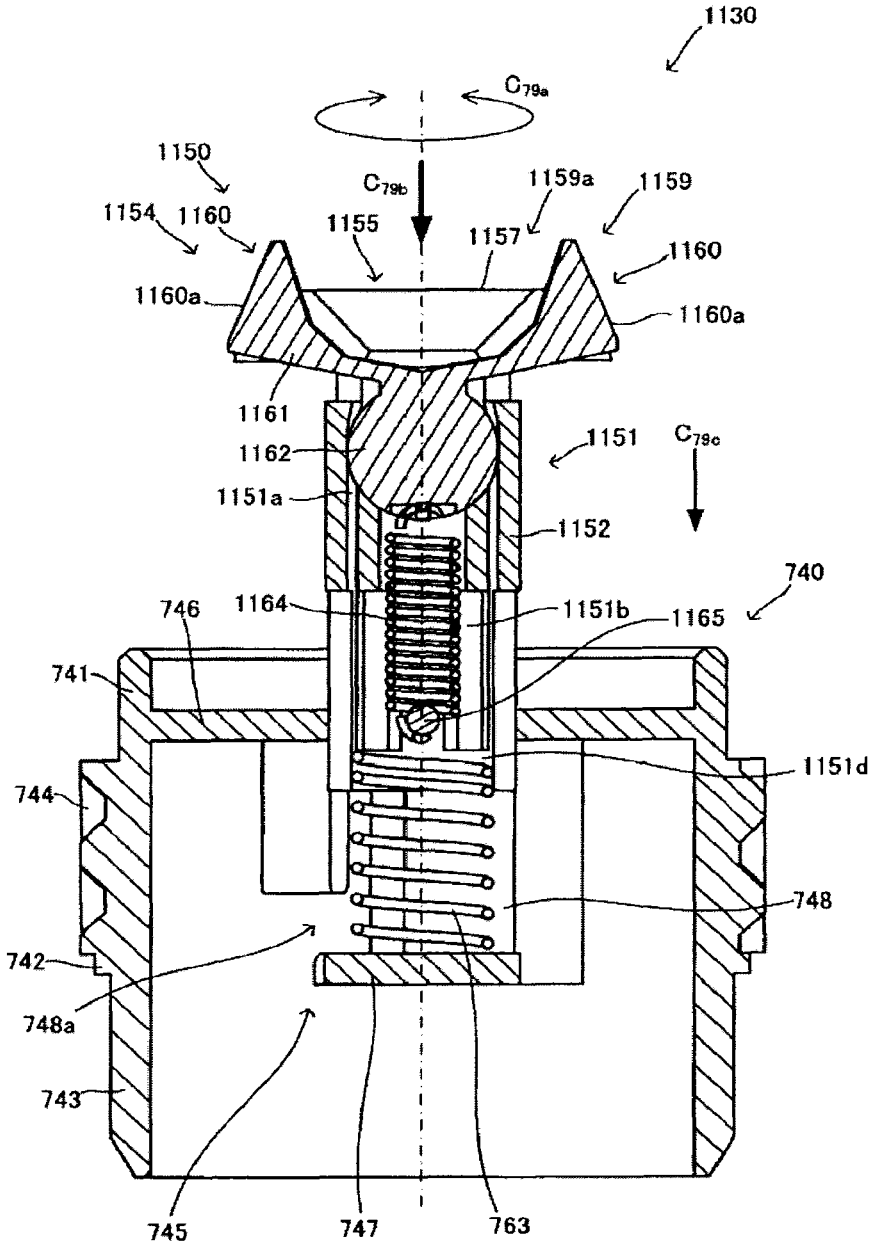

FIG. 79 is a sectional view of an end member 1130.

Figure 80A:
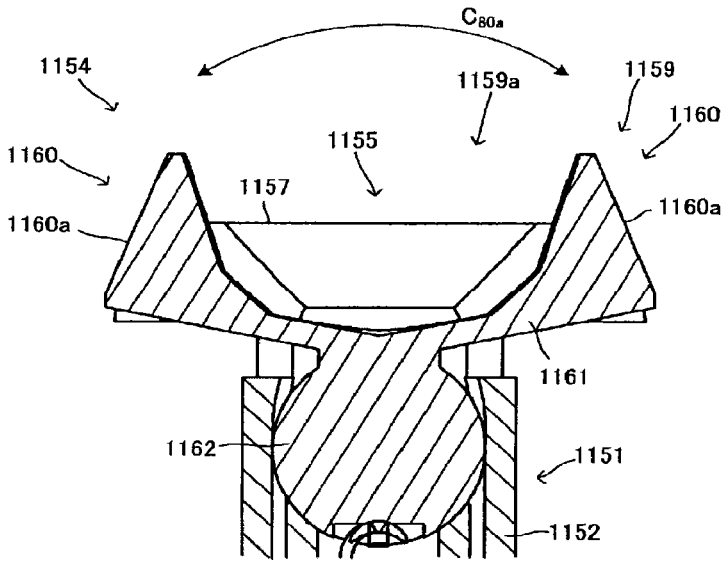

FIG. 80A is one sectional view illustrating the periphery of the claw member 1159 in the end member 1130.

Figure 80B:
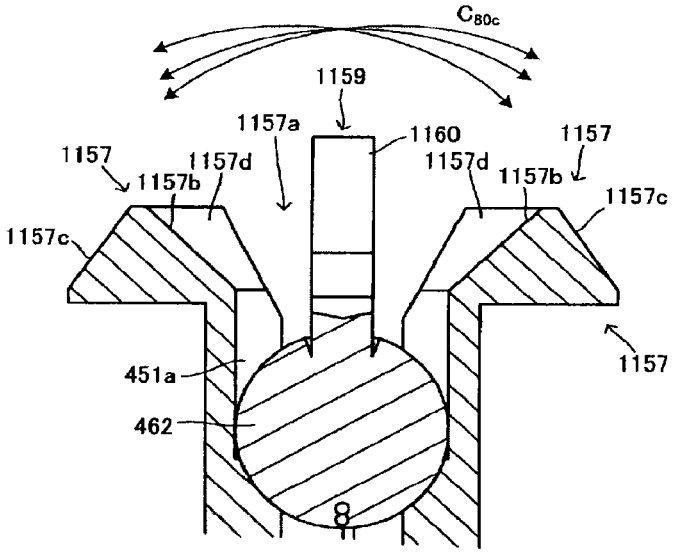

FIG. 80B is another sectional view illustrating the periphery of the claw member 1159 in the end member 1130.

Figure 81A:
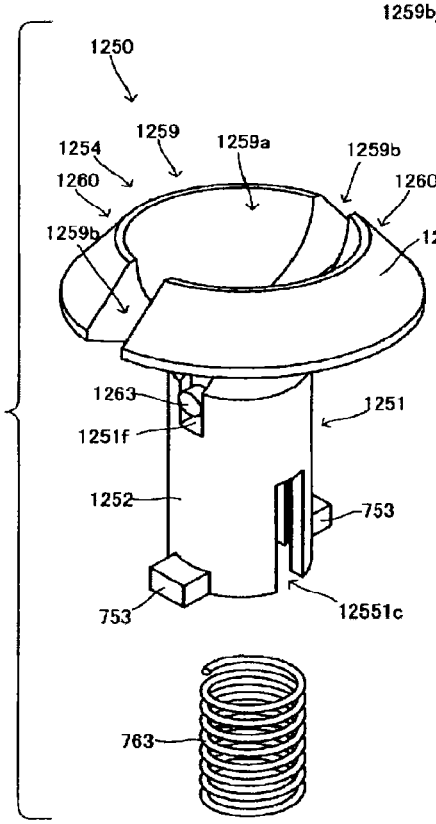

FIG. 81A is a perspective view of a shaft member 1250.

Figure 81B:
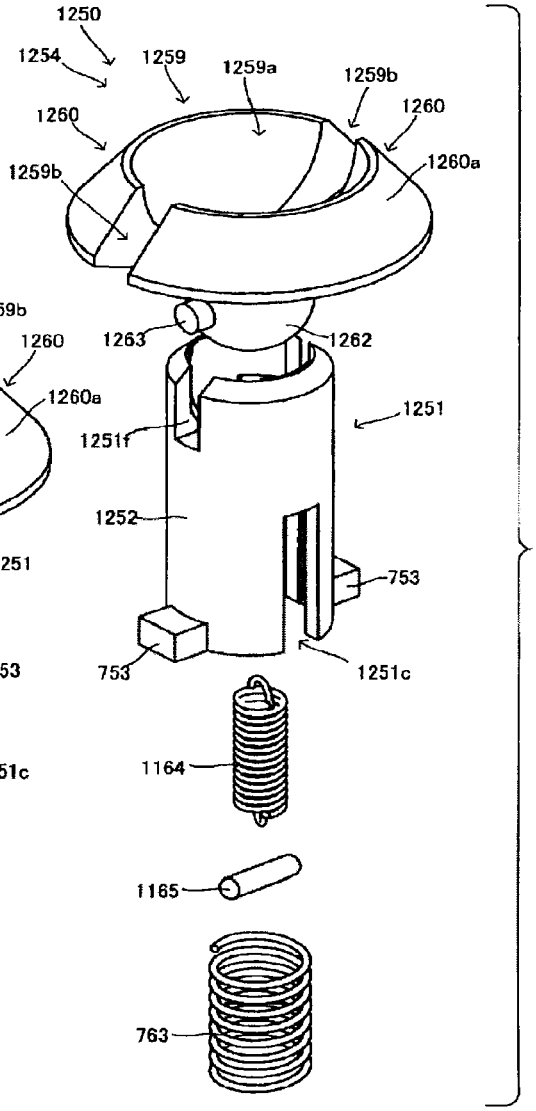

FIG. 81B is an exploded perspective view of the shaft member 1250.

Figure 82C:
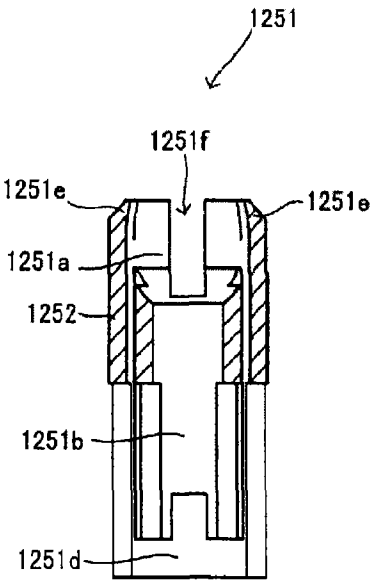
Figure 82B:
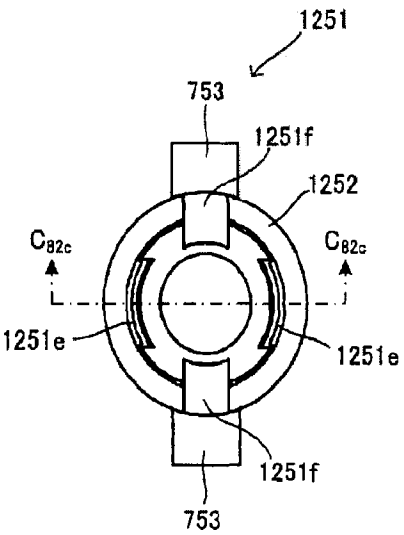
Figure 82A:
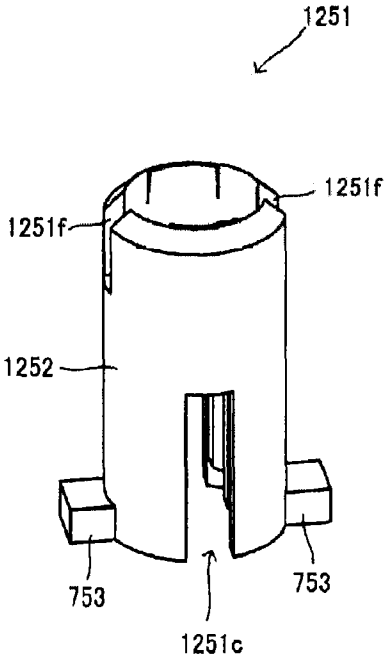

FIG. 82A is a perspective view of a rotating shaft 1251.

FIG. 82B is a plan view of the rotating shaft 1251.

FIG. 82C is a sectional view of the rotating shaft 1251.

Figure 83A:
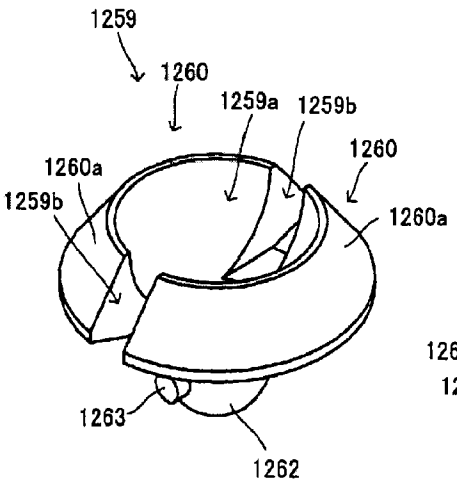

FIG. 83A is a perspective view of a claw member 1259.

Figure 83B:
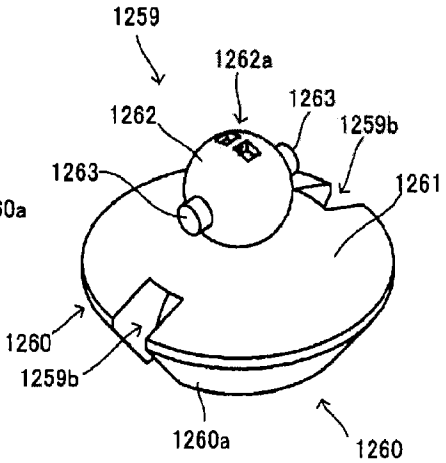

FIG. 83B is a perspective view when viewed from another direction of the claw member 1259.

Figure 83C:
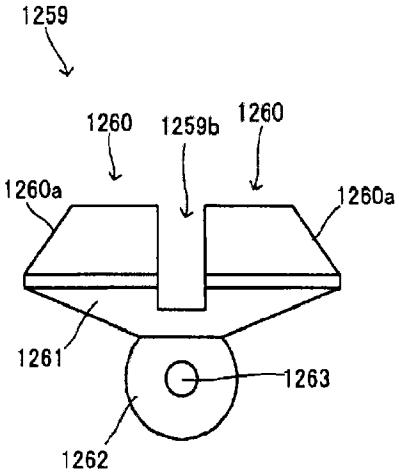

FIG. 83C is a front view of the claw member 1259.

Figure 84A:
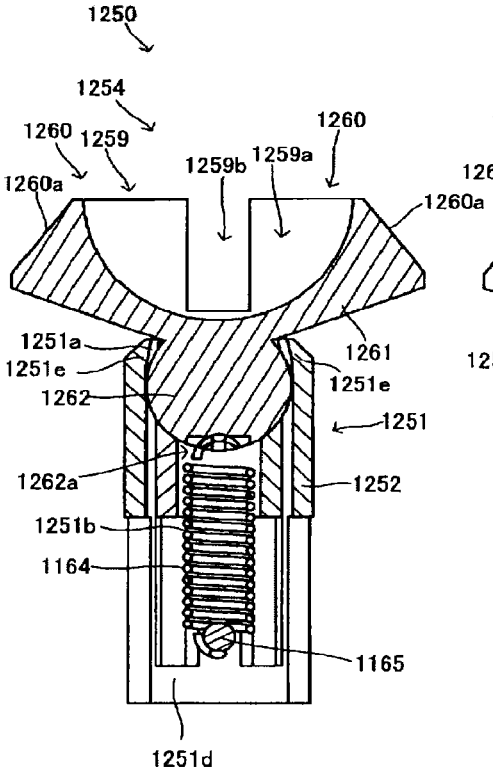

FIG. 84A is one sectional view of the shaft member 1250.

Figure 84B:
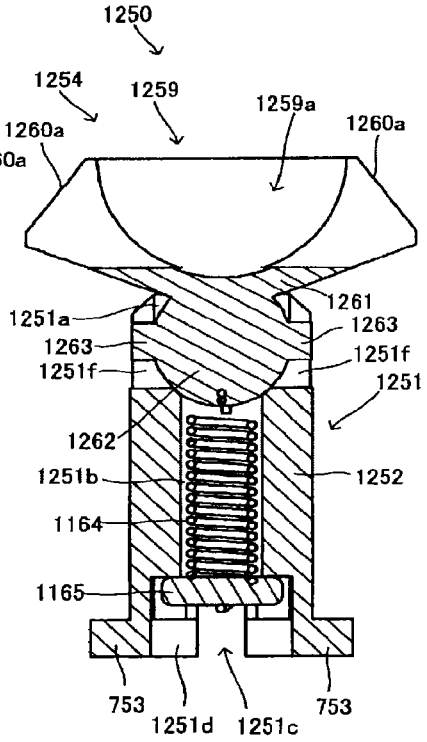

FIG. 84B is another sectional view of the shaft member 1250.

Figure 85:
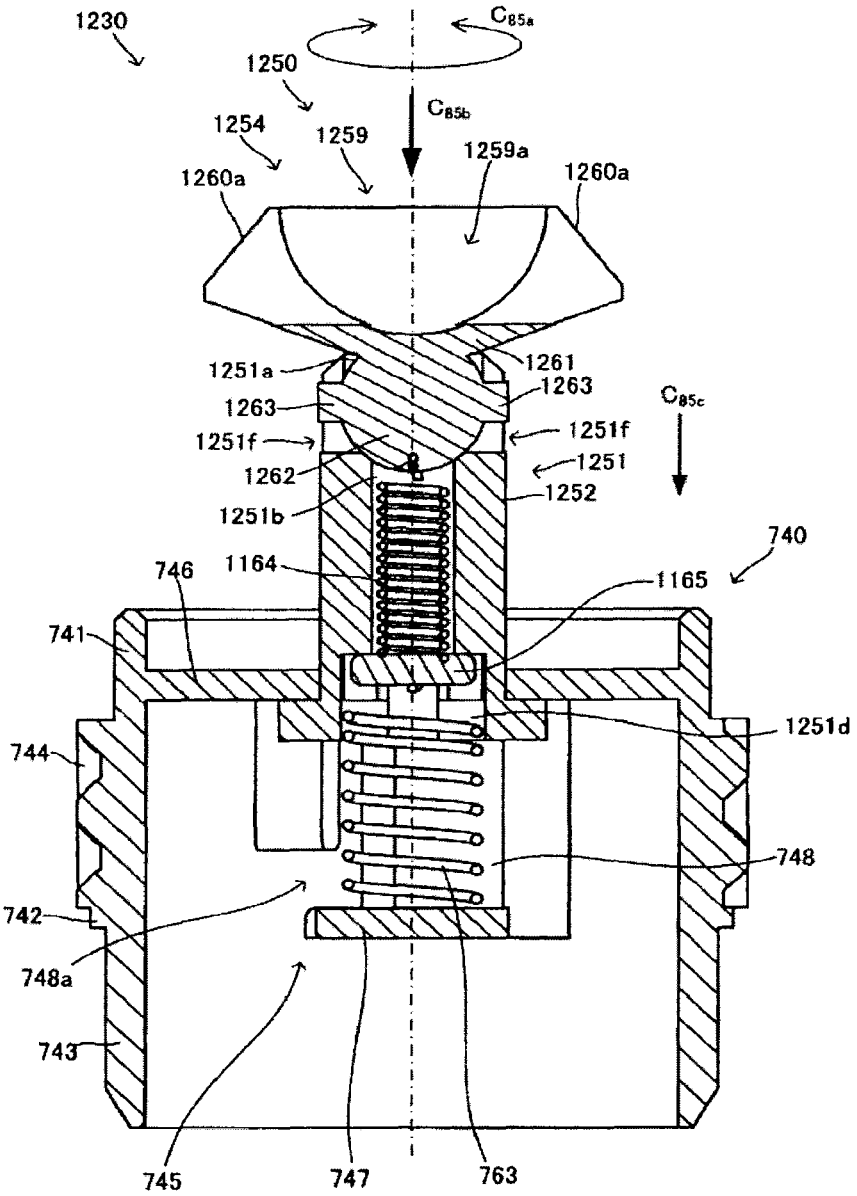

FIG. 85 is a sectional view of an end member 1230.

Figure 86A:
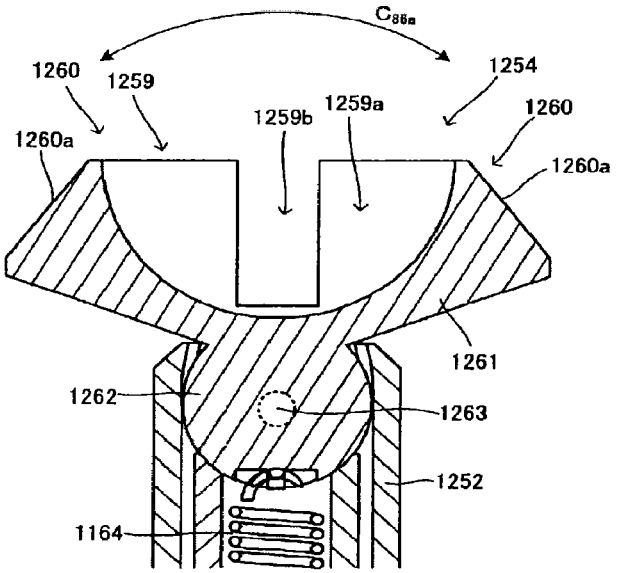

FIG. 86A is one sectional view illustrating the periphery of the claw member 1259 of the end member 1230.

Figure 86B:
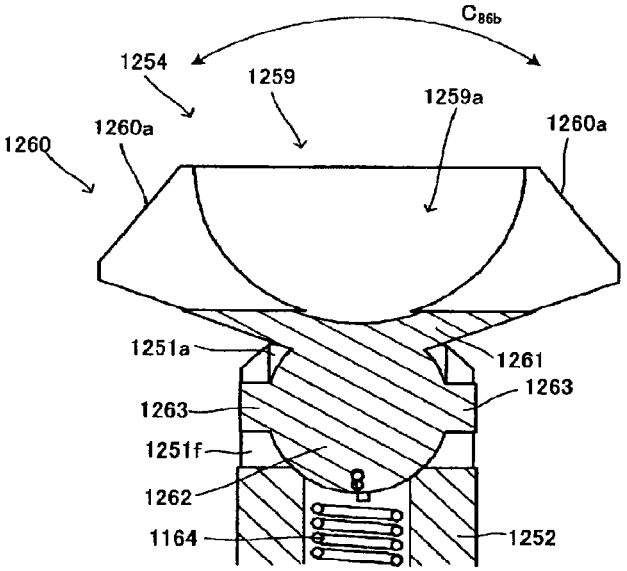

FIG. 86B is another sectional view illustrating the periphery of the claw member 1259 of the end member 1230.

Figure 87:
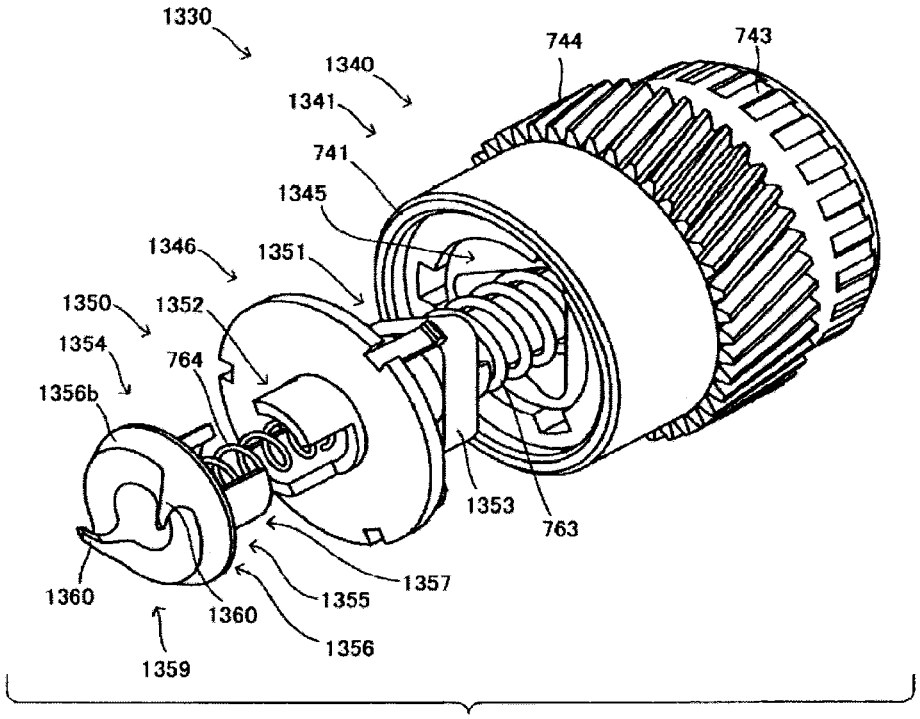

FIG. 87 is an exploded perspective view of an end member 1330.

Figure 88:
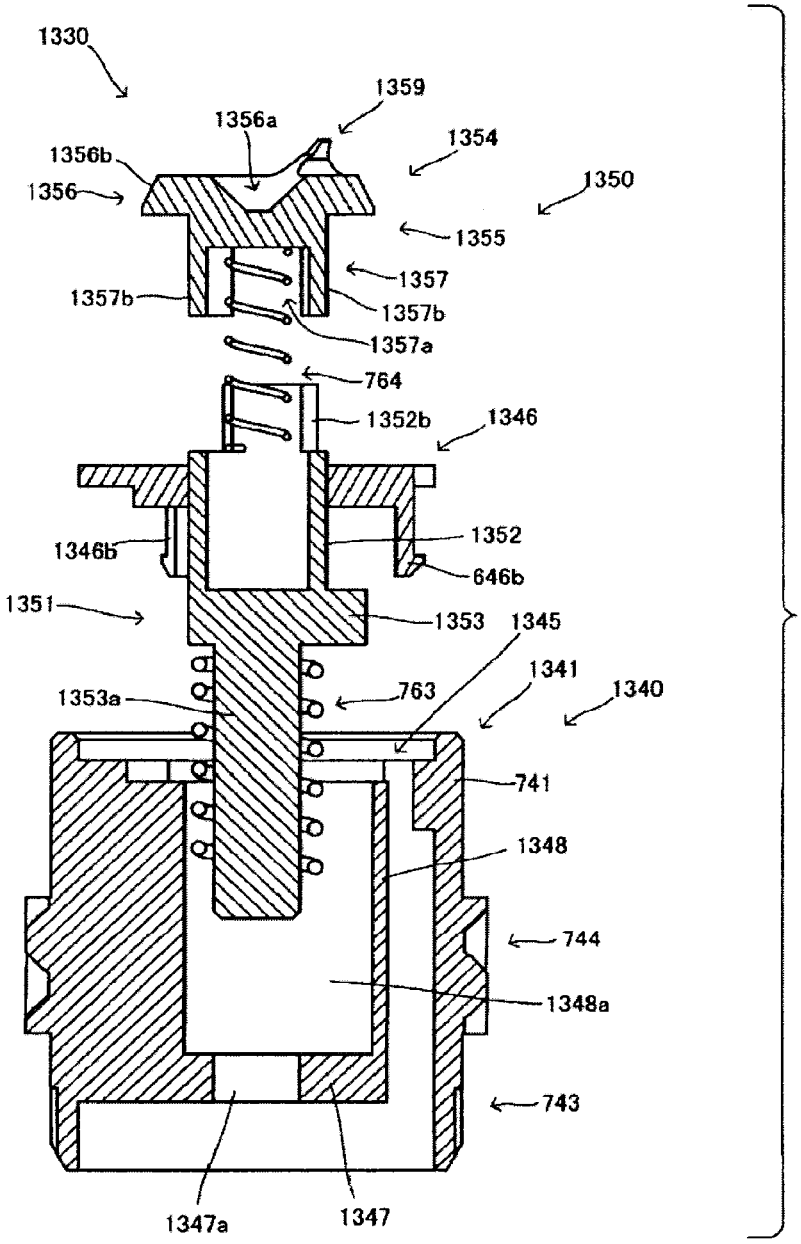

FIG. 88 is an exploded sectional view of the end member 1330.

Figure 89:
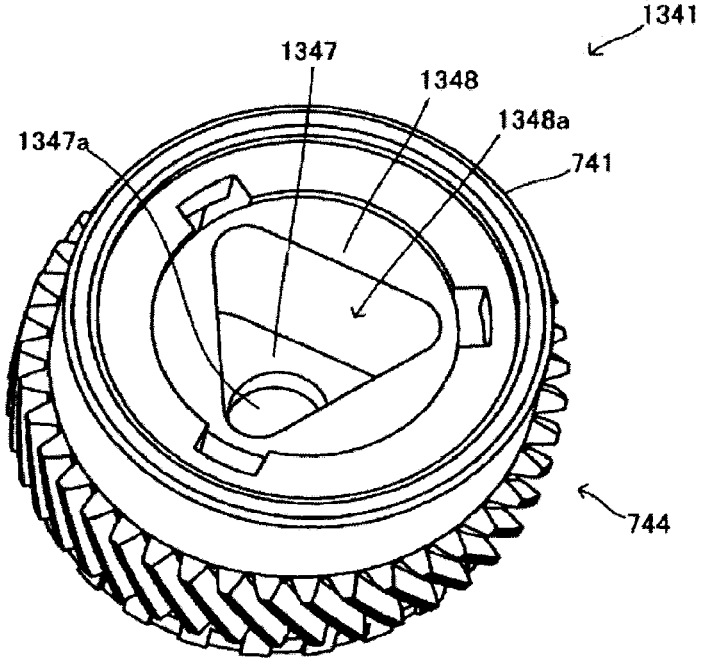

FIG. 89 is a perspective view of a bearing member 1340.

Figure 90A:
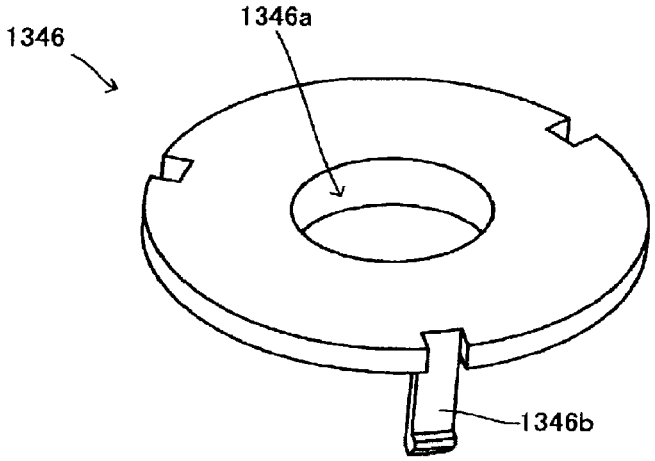

FIG. 90A is one perspective view of a rotating shaft holding member 1346.

Figure 90B:
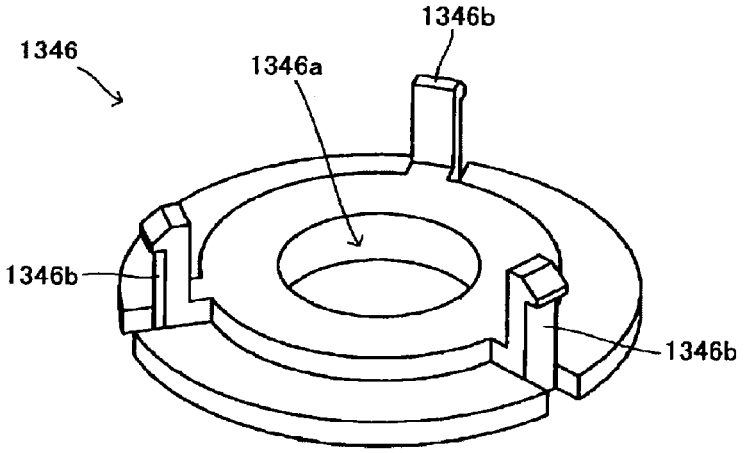

FIG. 90B is another perspective view of the rotating shaft holding member 1346.

Figure 91A:
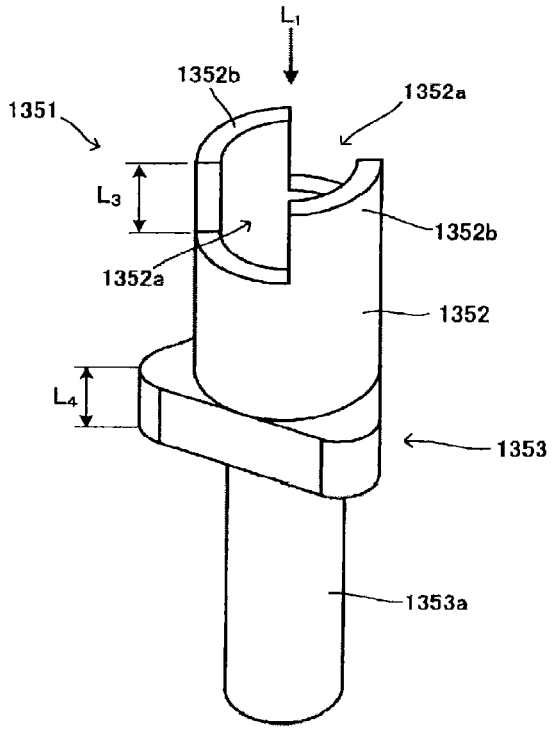

FIG. 91A is a perspective view of a rotating shaft 1351.

Figure 91B:
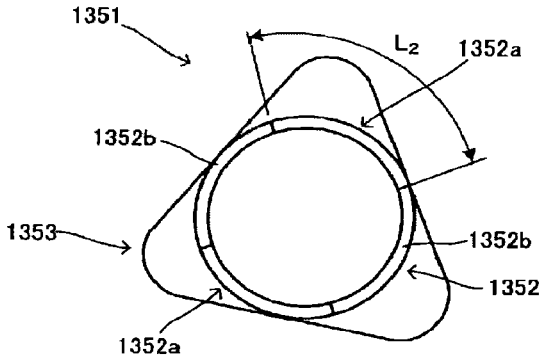

FIG. 91B is a plan view of the rotating shaft 1351.

Figure 92A:
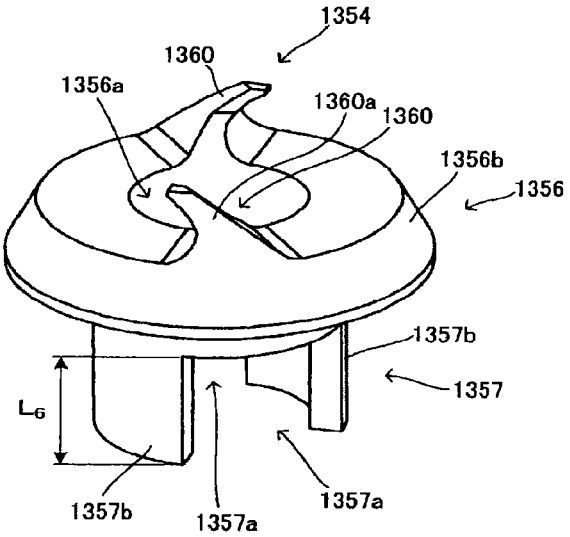

FIG. 92A is a perspective view of a rotating force transmission member 1354.

Figure 92B:
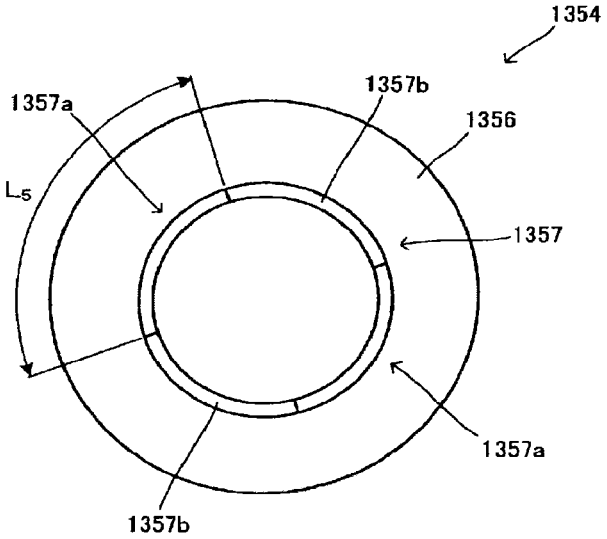

FIG. 92B is a plan view of the rotating force transmission member 1354.

Figure 93:
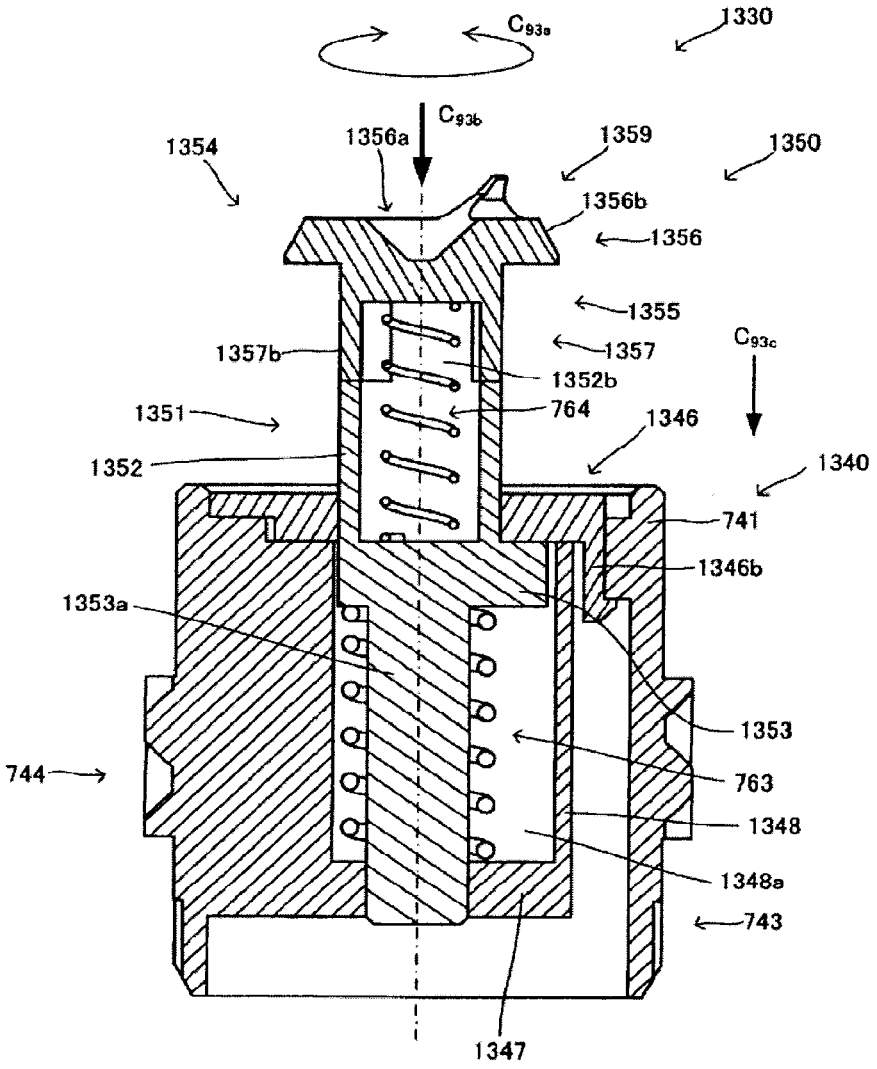

FIG. 93 is a sectional view of the end member 1330.

Figure 94:
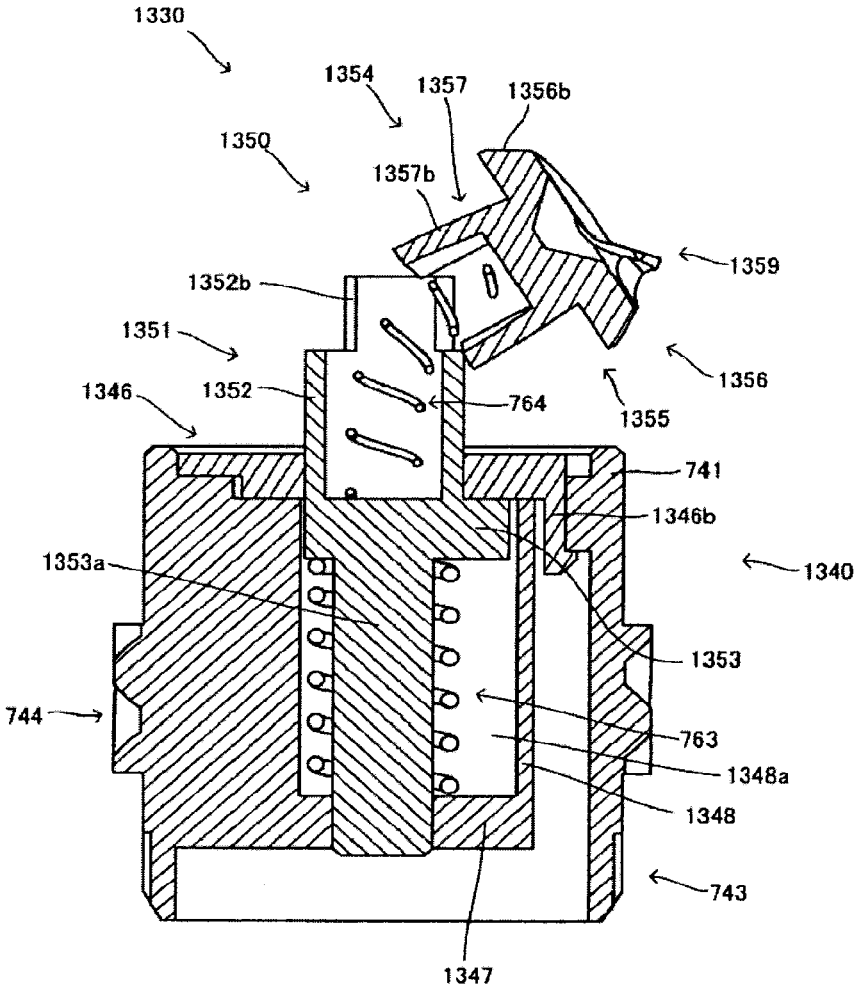

FIG. 94 is another sectional view of the end member 1330.

Figure 95:
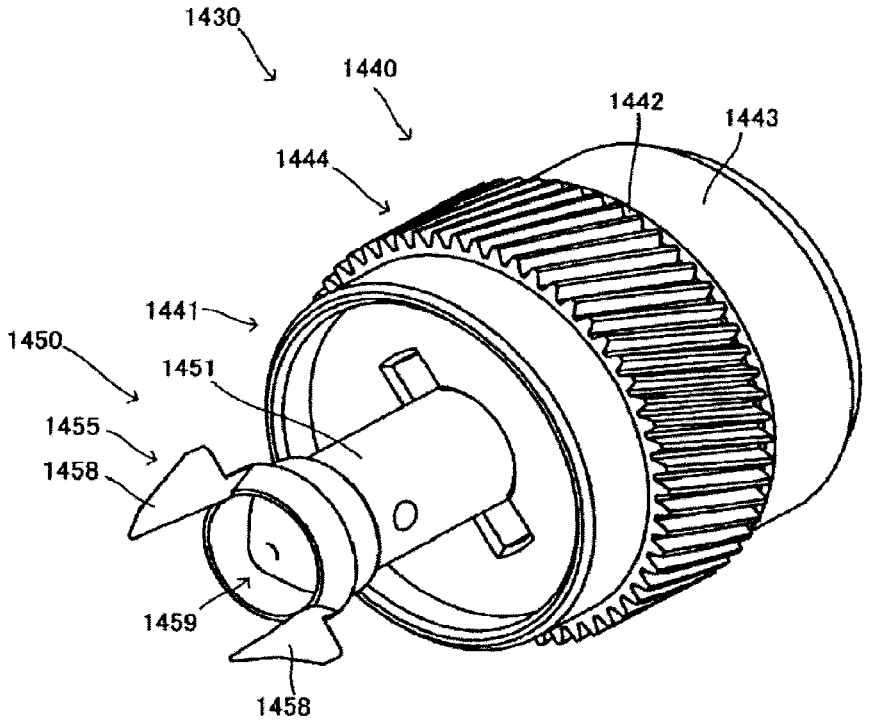

FIG. 95 is a perspective view of an end member 1430.

Figure 96:
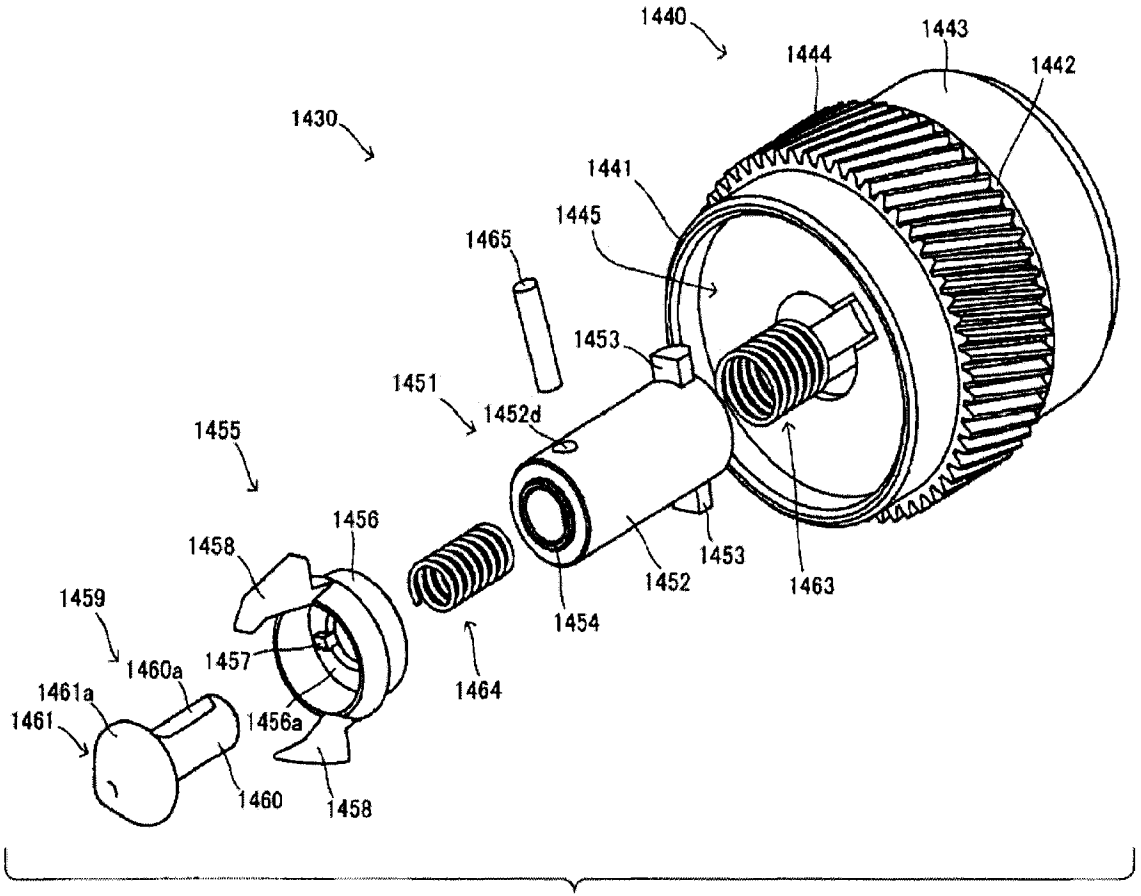

FIG. 96 is an exploded perspective view of the end member 1430.

Figure 97A:
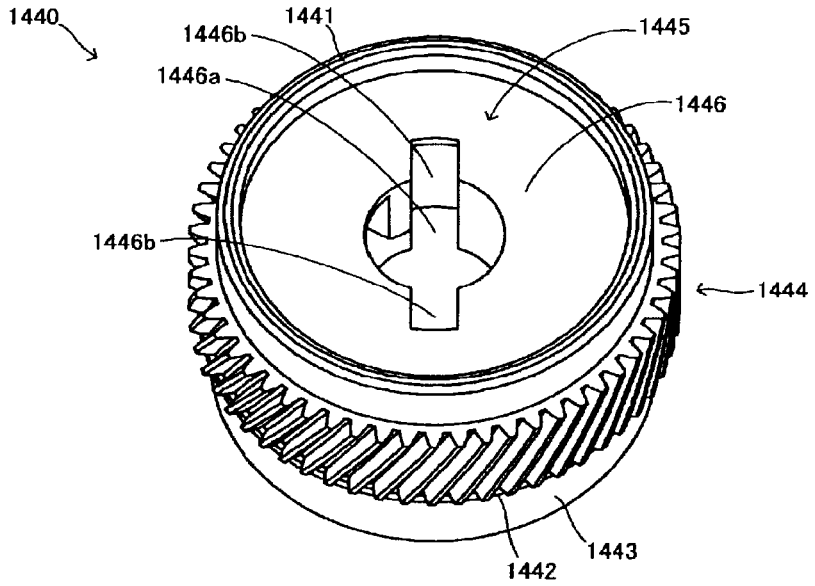

FIG. 97A is a perspective view of a bearing member 1440.

Figure 97B:
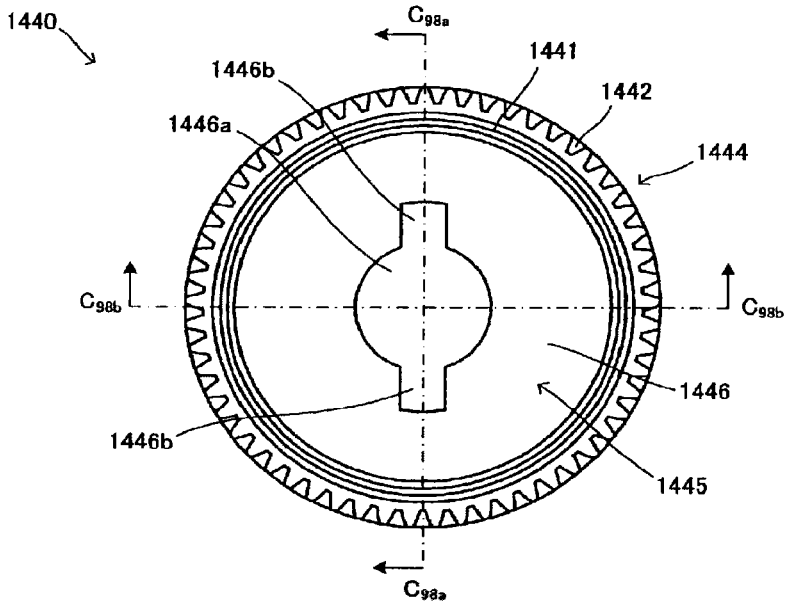

FIG. 97B is a plan view of the bearing member 1440.

Figure 98A:
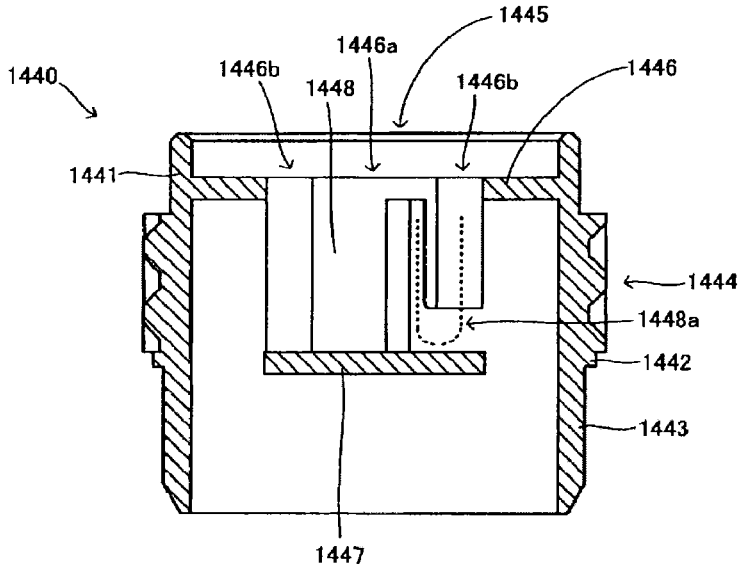

FIG. 98A is a sectional view of the bearing member 1440.

Figure 98B:
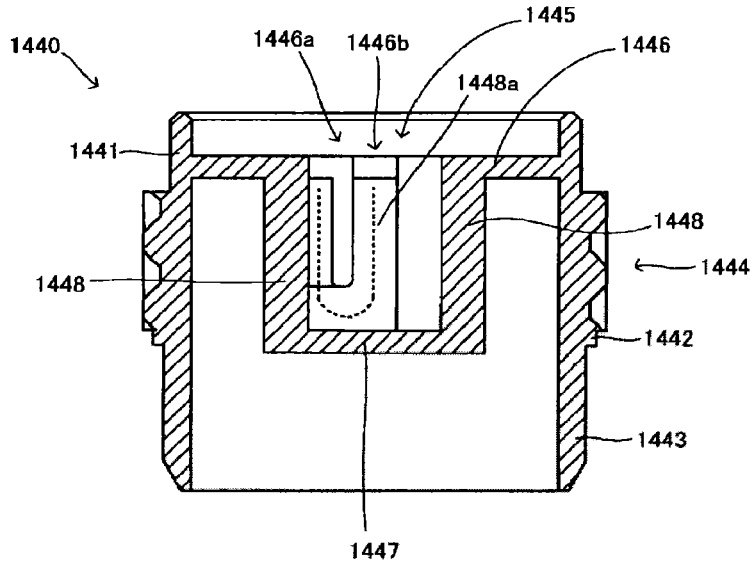

FIG. 98B is another sectional view of the bearing member 1440.

Figure 99A:
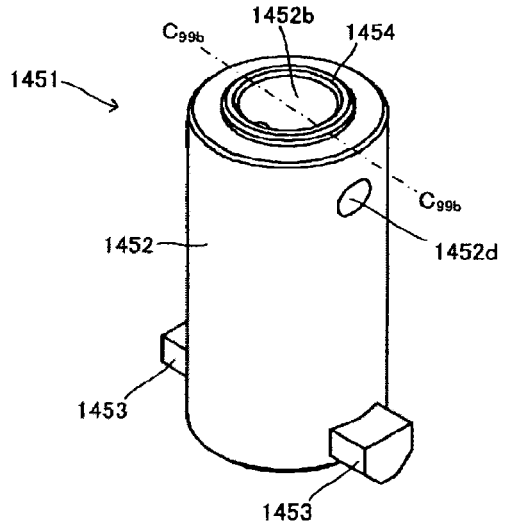

FIG. 99A is a perspective view of a rotating shaft 1451.

Figure 99B:
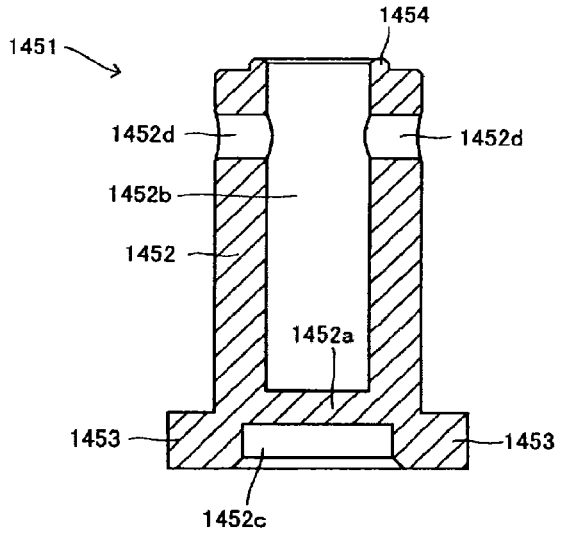

FIG. 99B is a sectional view of the rotating shaft 1451.

Figure 100A:
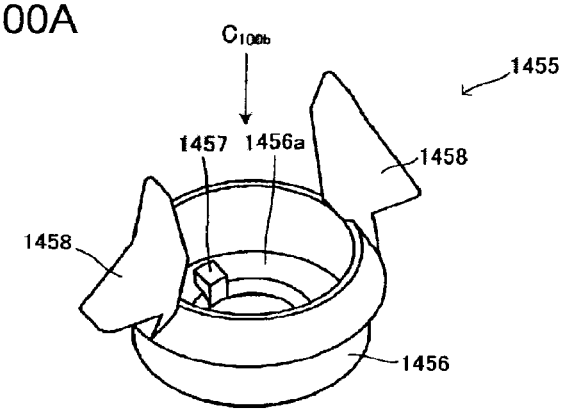

FIG. 100A is a perspective view of a rotating force receiving member 1455.

Figure 100B:
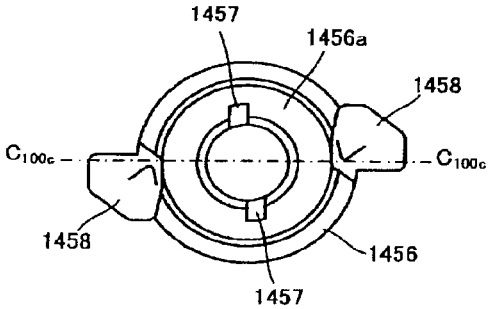

FIG. 100B is a plan view of the rotating force receiving member 1455.

Figure 100C:
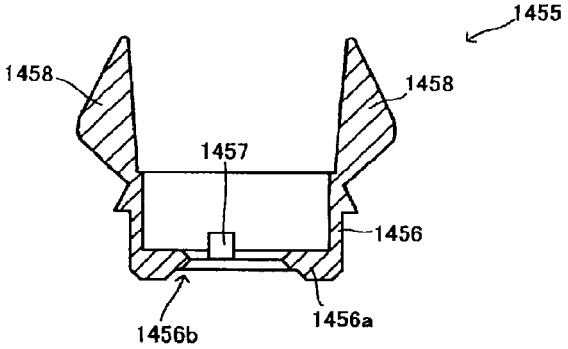

FIG. 100C is a sectional view of the rotating force receiving member 1455.

Figure 101A:
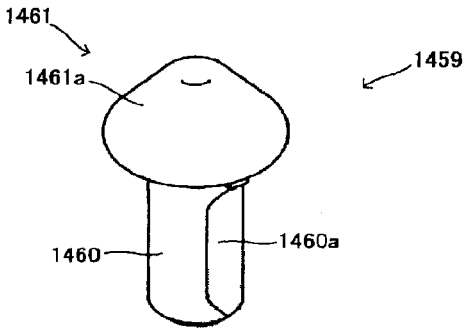

FIG. 101A is a perspective view of a regulating member 1459.

Figure 101B:
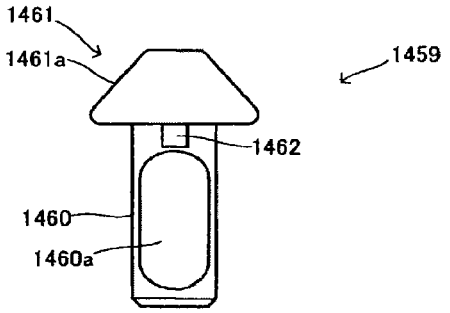

FIG. 101B is a front view of the regulating member 1459.

Figure 101C:
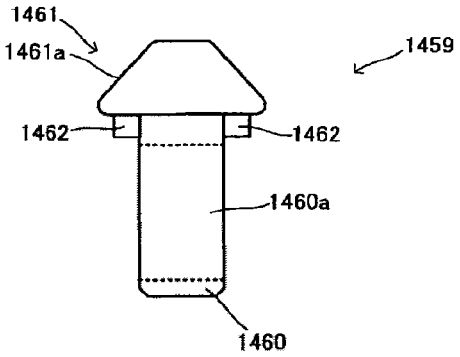

FIG. 101C is a side view of the regulating member 1459.

Figure 102A:
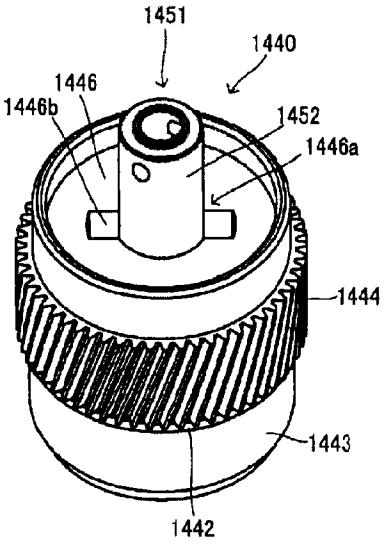

FIG. 102A is a perspective view of combination of the bearing member 1440 and the rotating shaft 1451.

Figure 102B:
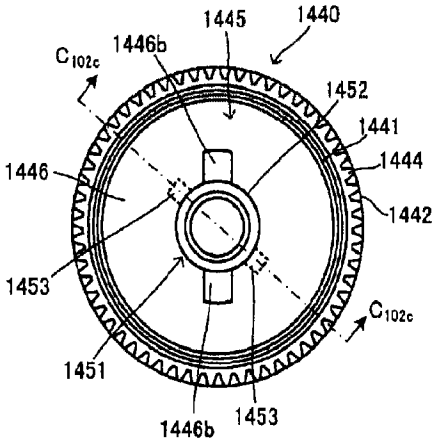

FIG. 102B is a plan view of the combination of the bearing member 1440 and the rotating shaft 1451.

Figure 102C:
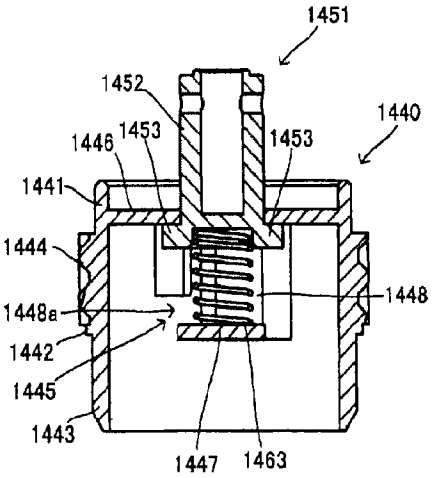

FIG. 102C is a sectional view of the combination of the bearing member 1440 and the rotating shaft 1451.

Figure 103A:
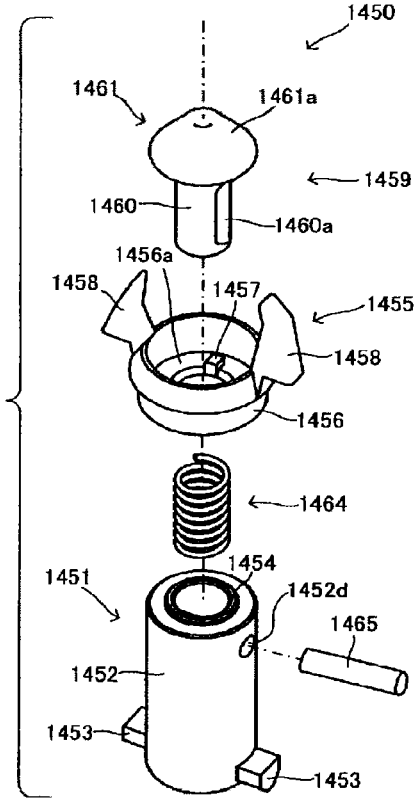

FIG. 103A is an exploded perspective view of a shaft member 1450.

Figure 103B:
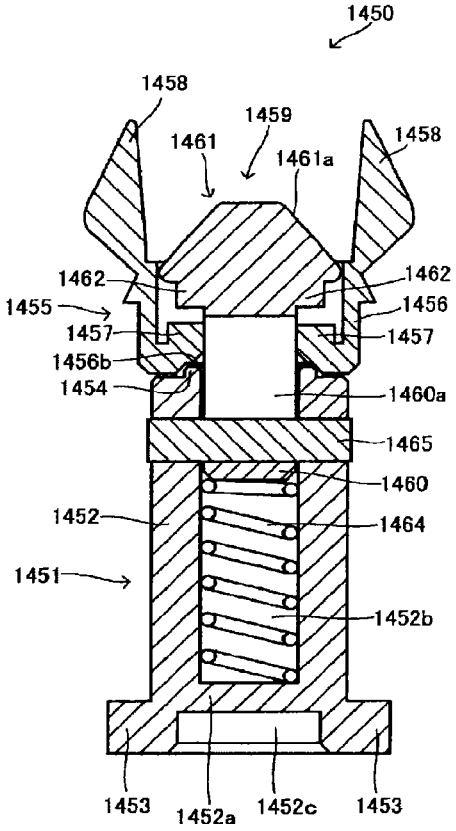

FIG. 103B is a sectional view of the shaft member 1450.

Figure 104:
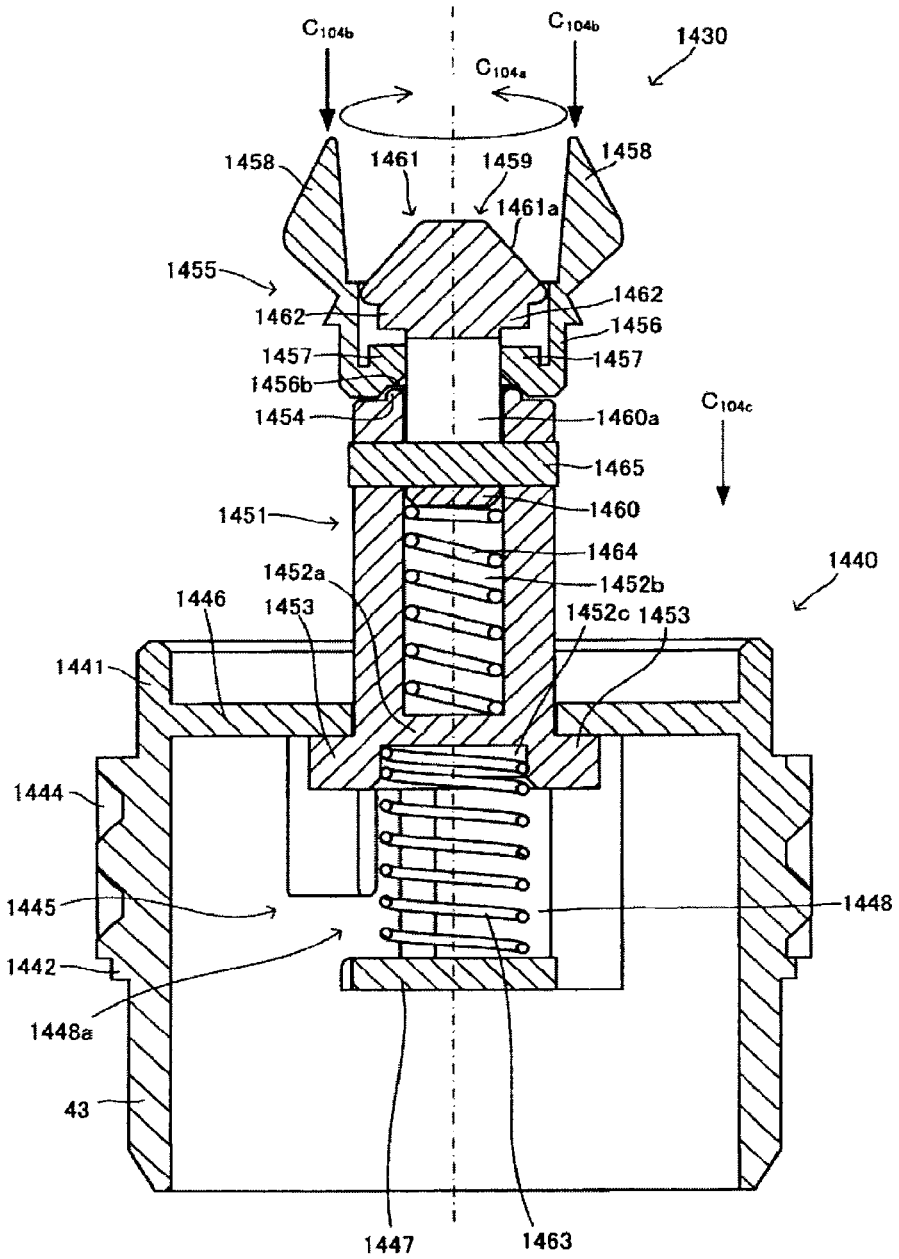

FIG. 104 is a sectional view of the end member 1430.

Figure 105:
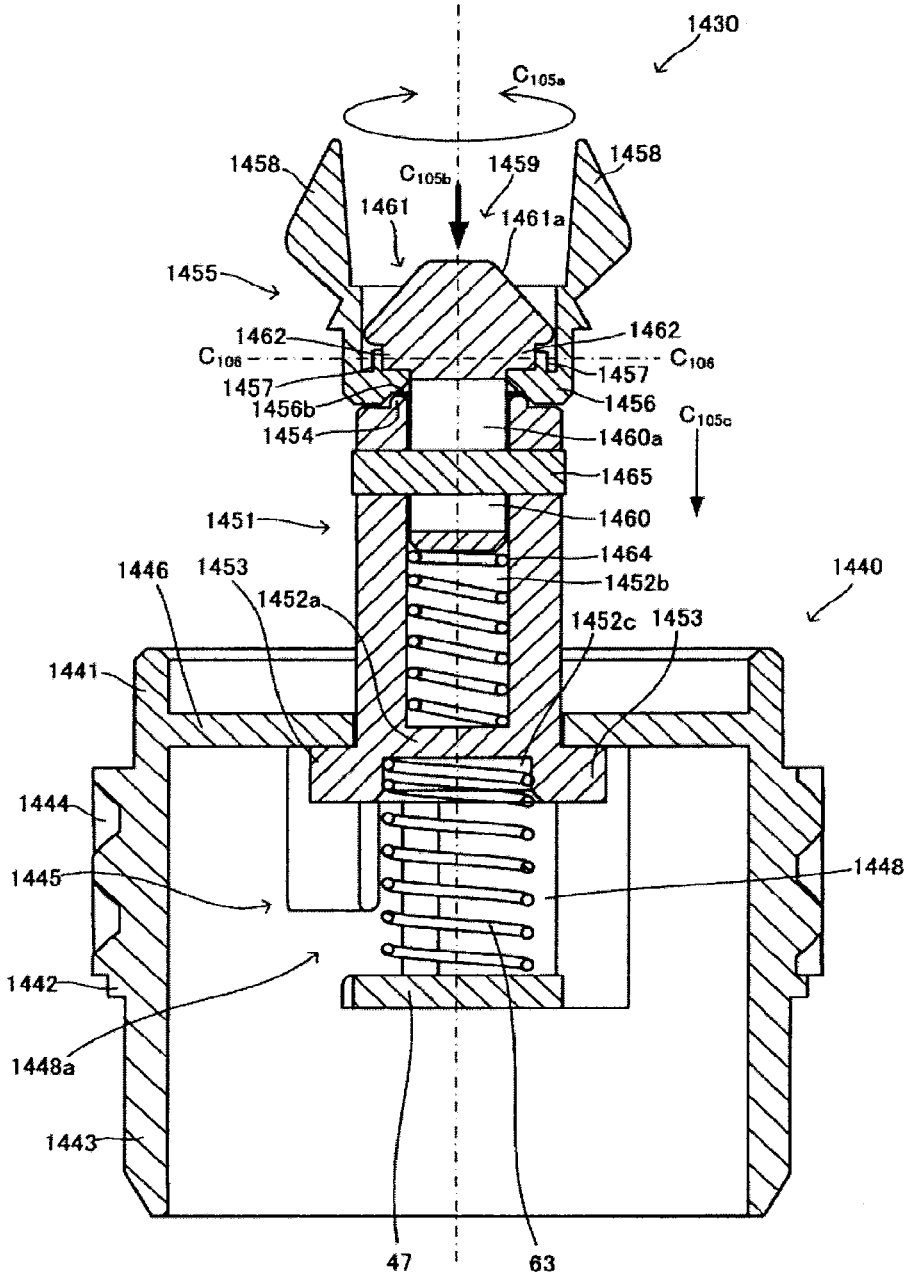

FIG. 105 is a sectional view of the end member 1430.

Figure 106:
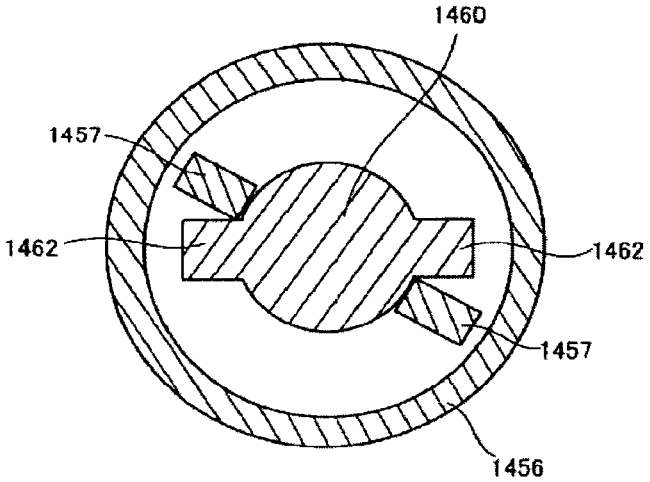

FIG. 106 is a sectional view of the end member 1430.

Figure 107:
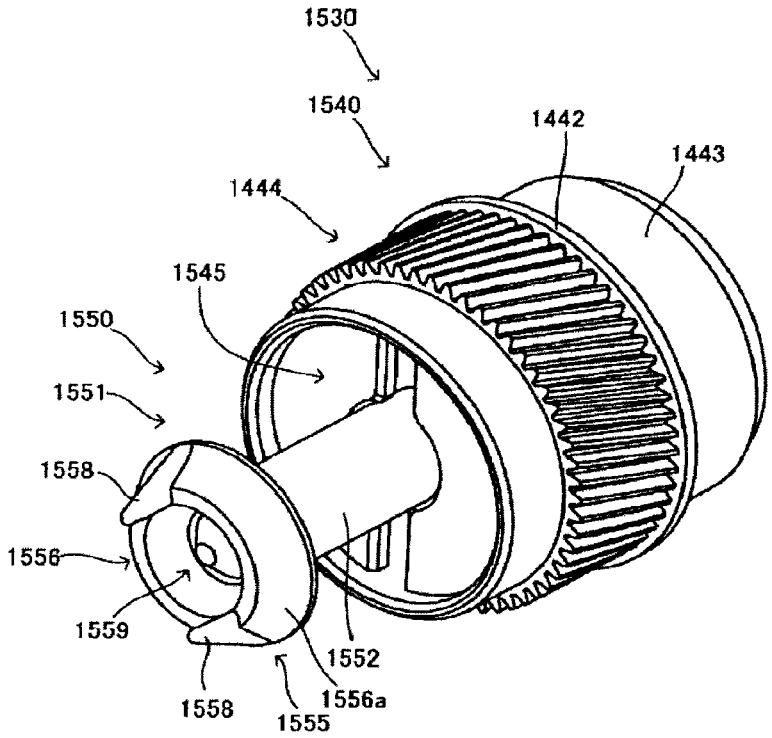

FIG. 107 is a perspective view of an end member 1530.

Figure 108:
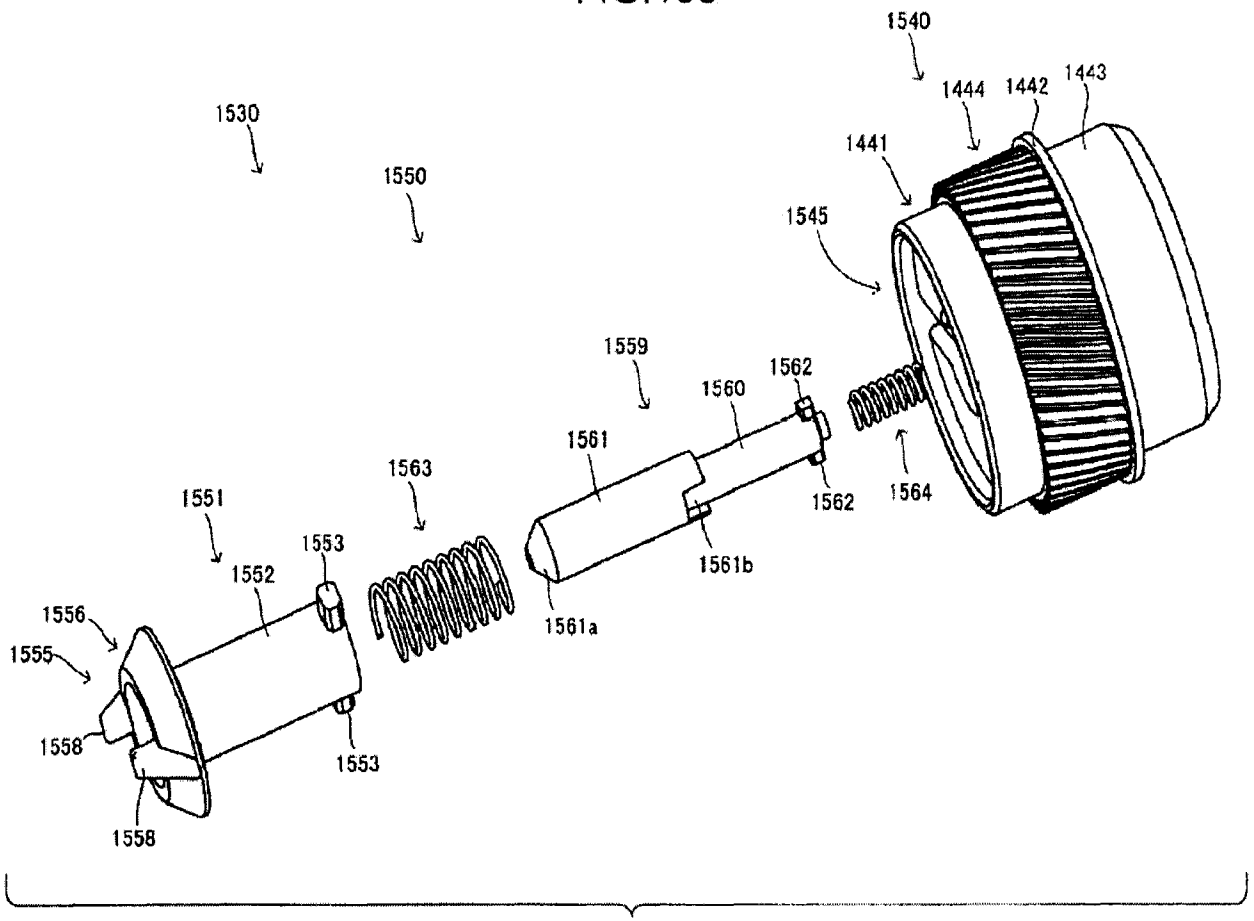

FIG. 108 is an exploded perspective view of the end member 1530.

Figure 109A:
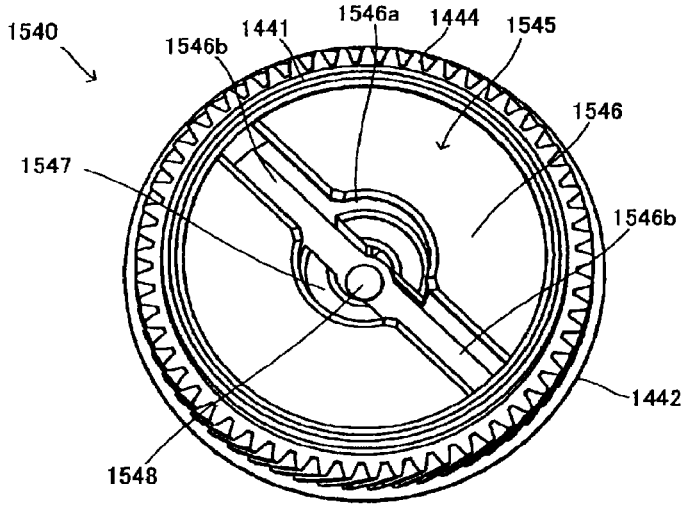

FIG. 109A is a perspective view of a bearing member 1540.

Figure 109B:
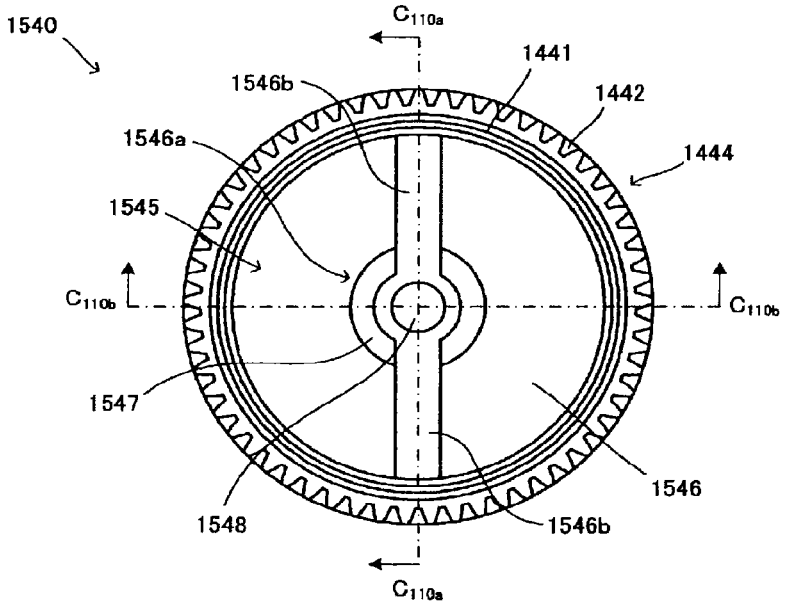

FIG. 109B is a plan view of the bearing member 1540.

Figure 110A:
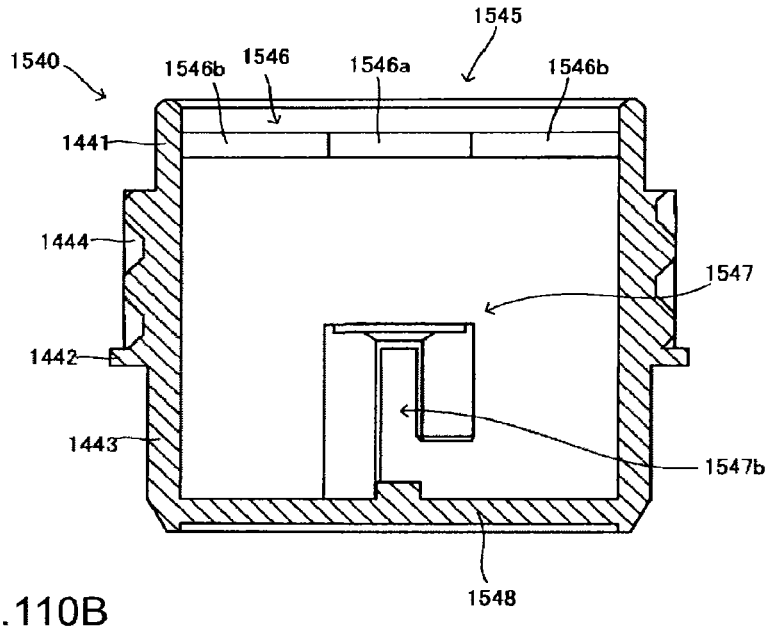

FIG. 110A is a sectional view of the bearing member 1540.

Figure 110B:
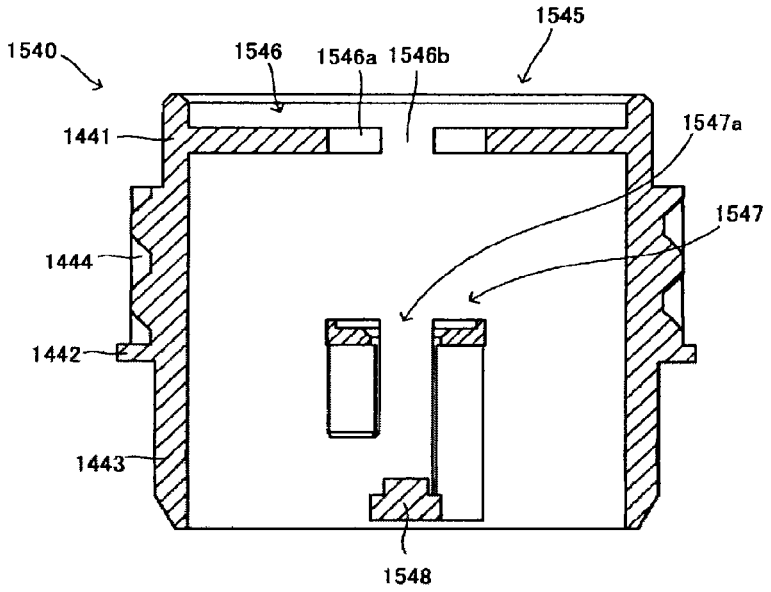

FIG. 110B is another sectional view of the bearing member 1540.

Figure 111A:
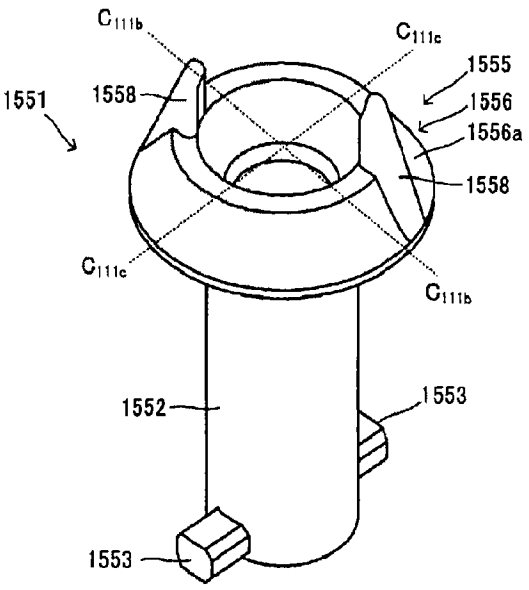

FIG. 111A is a perspective view of a rotating shaft 1551 and a rotating force receiving member 1555.

Figure 111B:
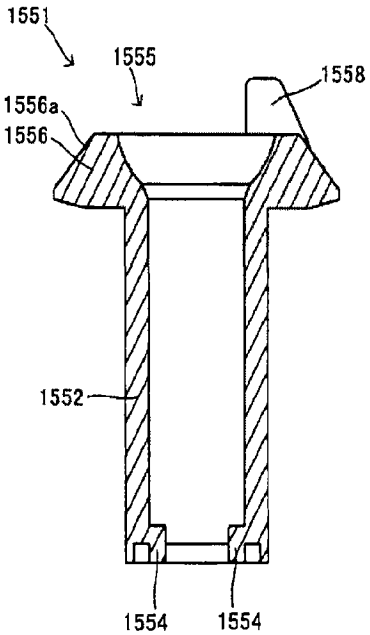

FIG. 111B is a sectional view of the rotating shaft 1551 and the rotating force receiving member 1555.

Figure 111C:
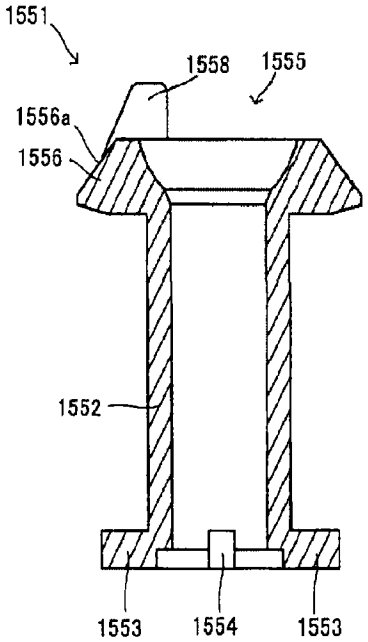

FIG. 111C is another sectional view of the rotating shaft 1551 and the rotating force receiving member 1555.

Figure 112A:
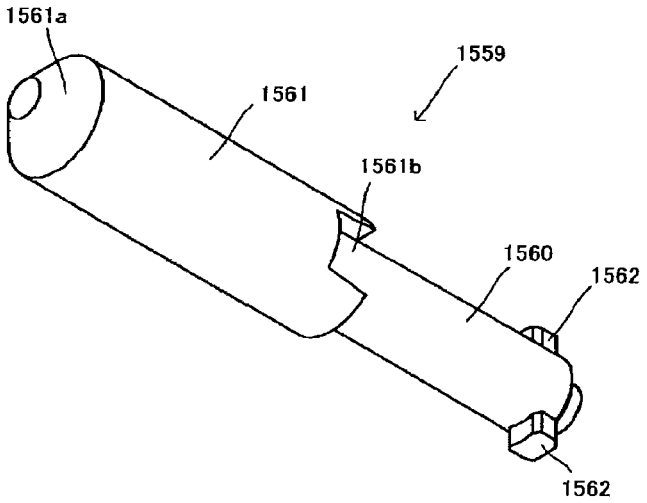

FIG. 112A is a perspective view of a regulating member 1559.

Figure 112B:
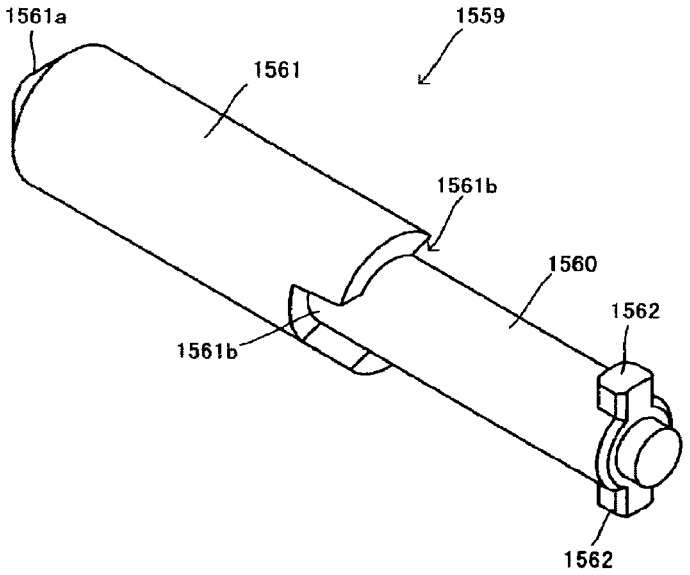

FIG. 112B is another perspective view of the regulating member 1559.

Figure 113:
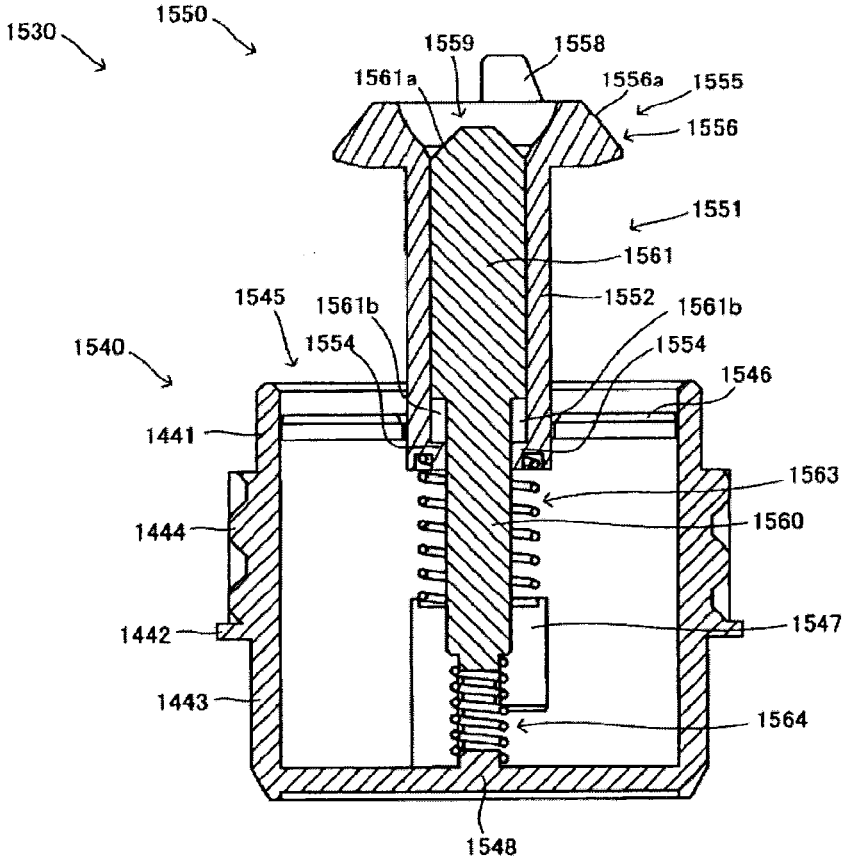

FIG. 113 is a sectional view of the end member 1530.

Figure 114:
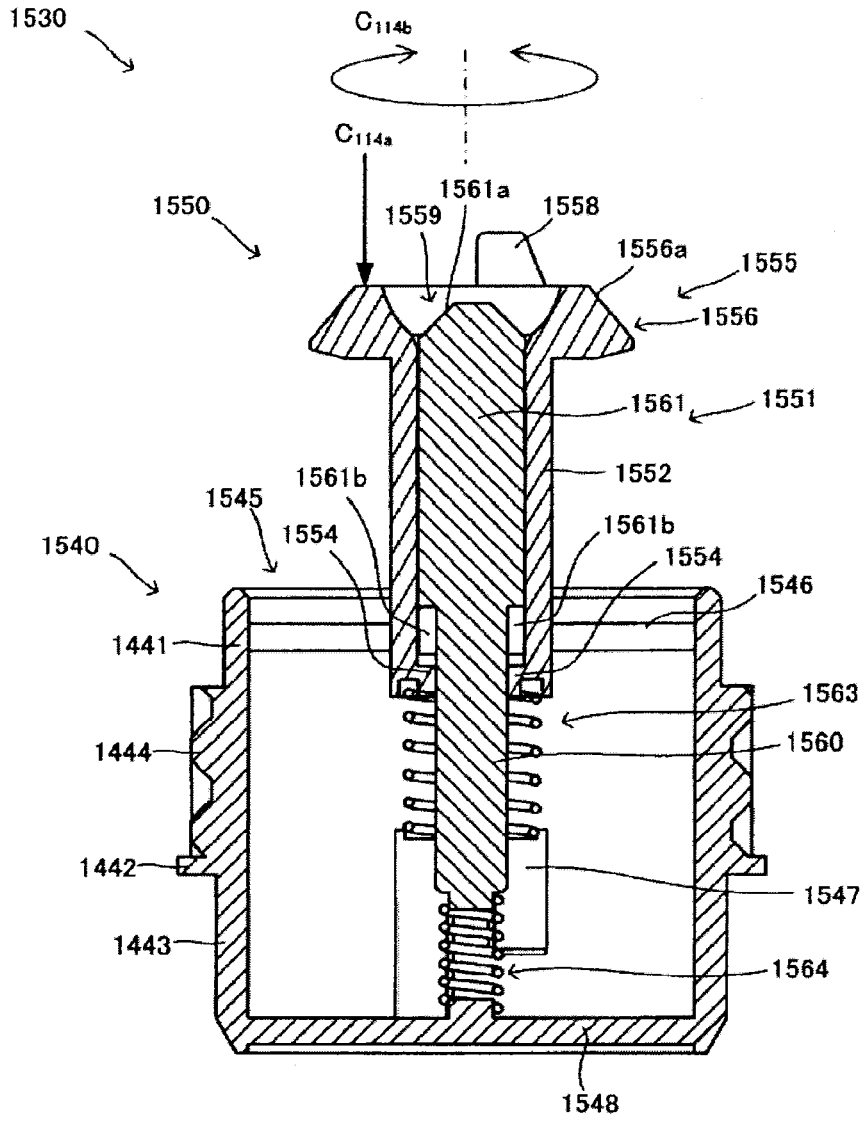

FIG. 114 is a sectional view of the end member 1530.

Figure 115:
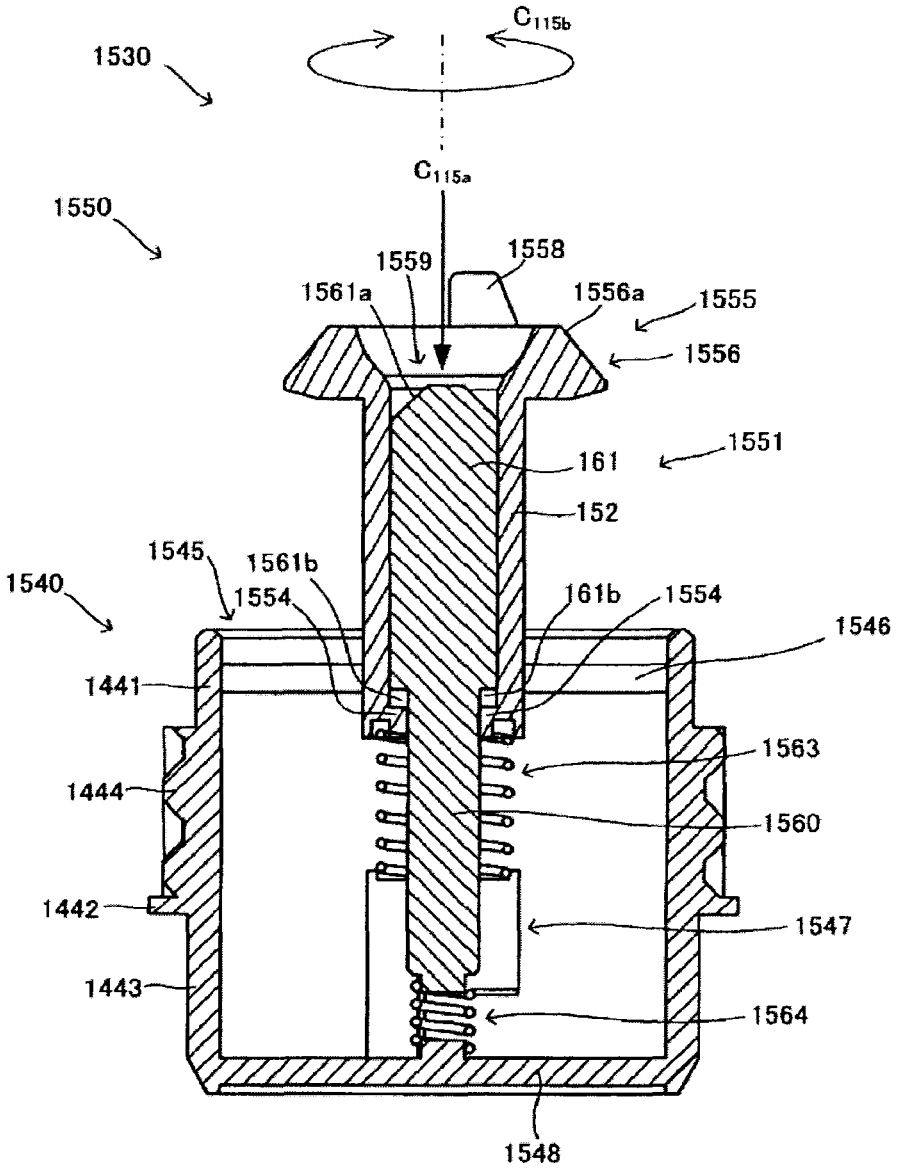

FIG. 115 is a sectional view of the end member 1530.

Figure 116A:
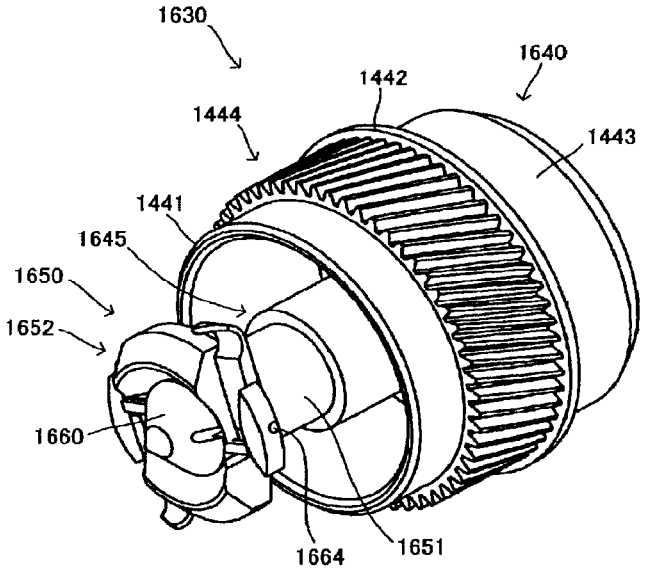

FIG. 116A is a perspective view of an end member 1630.

Figure 116B:
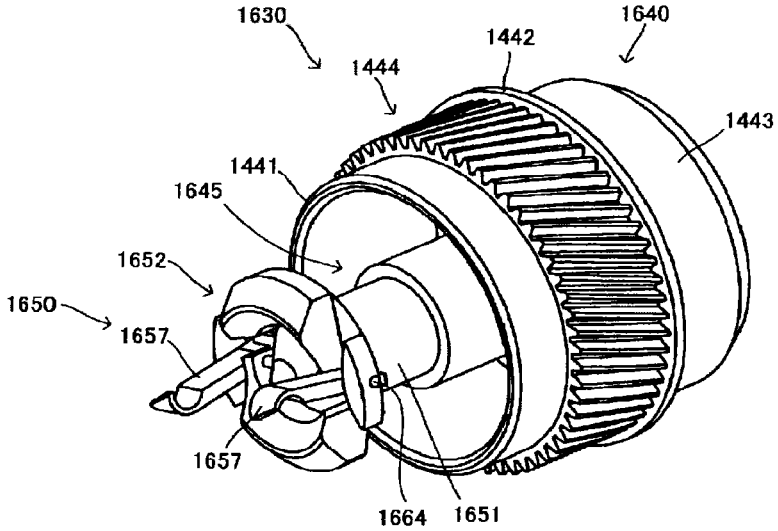

FIG. 116B is another perspective view of the end member 1630.

Figure 117:
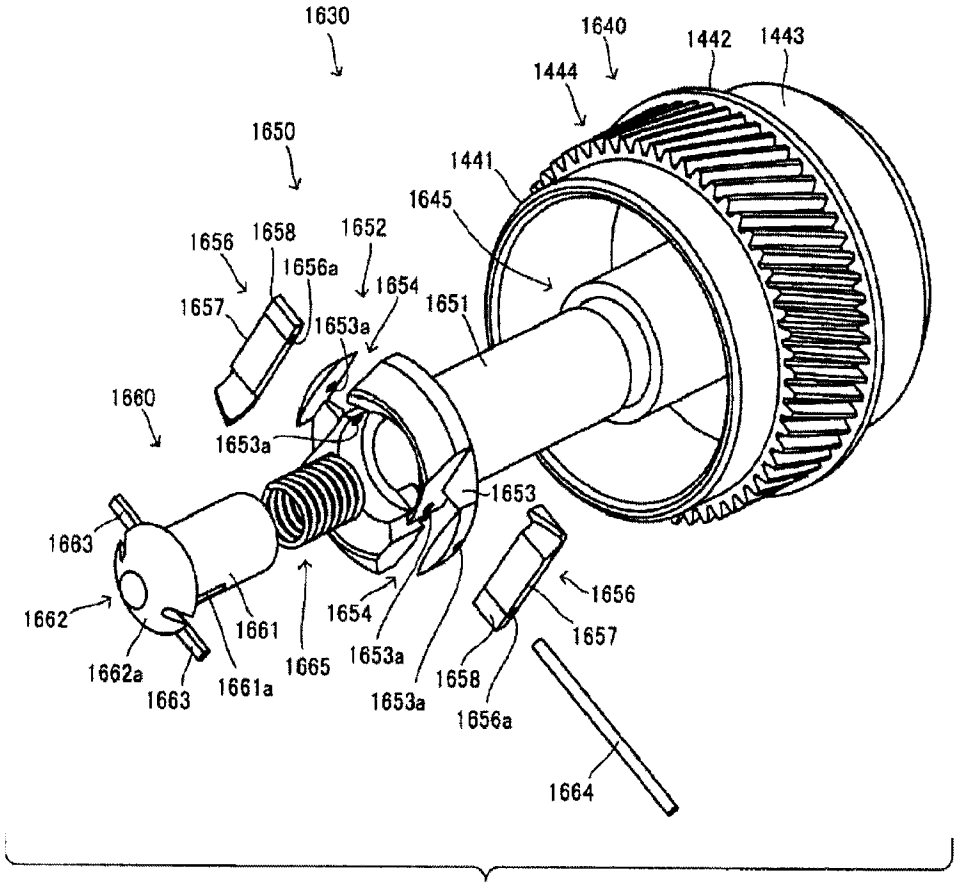

FIG. 117 is an exploded perspective view of the end member 1630.

Figure 118A:
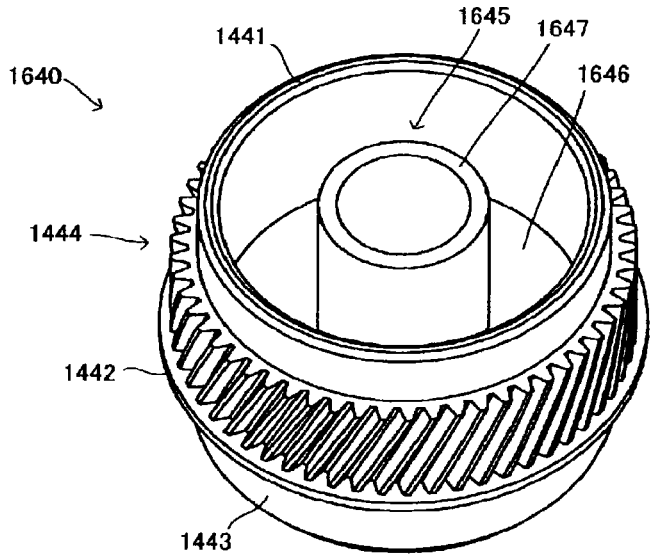

FIG. 118A is a perspective view of a bearing member 1640.

Figure 118B:
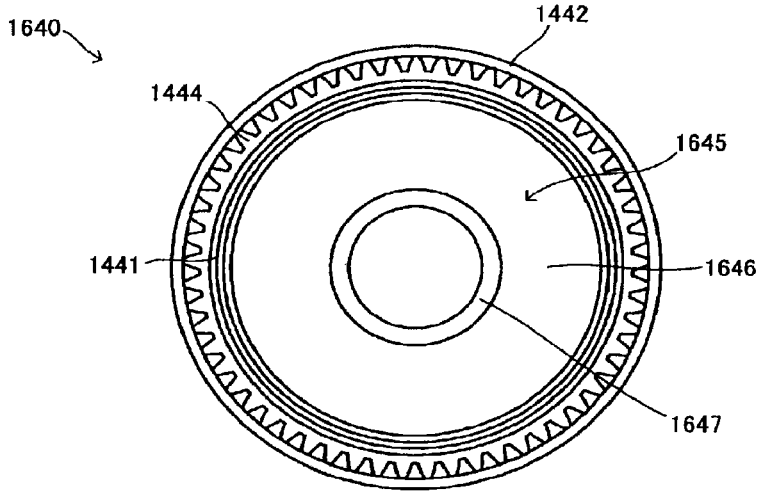

FIG. 118B is a plan view of the bearing member 1640.

Figure 119:
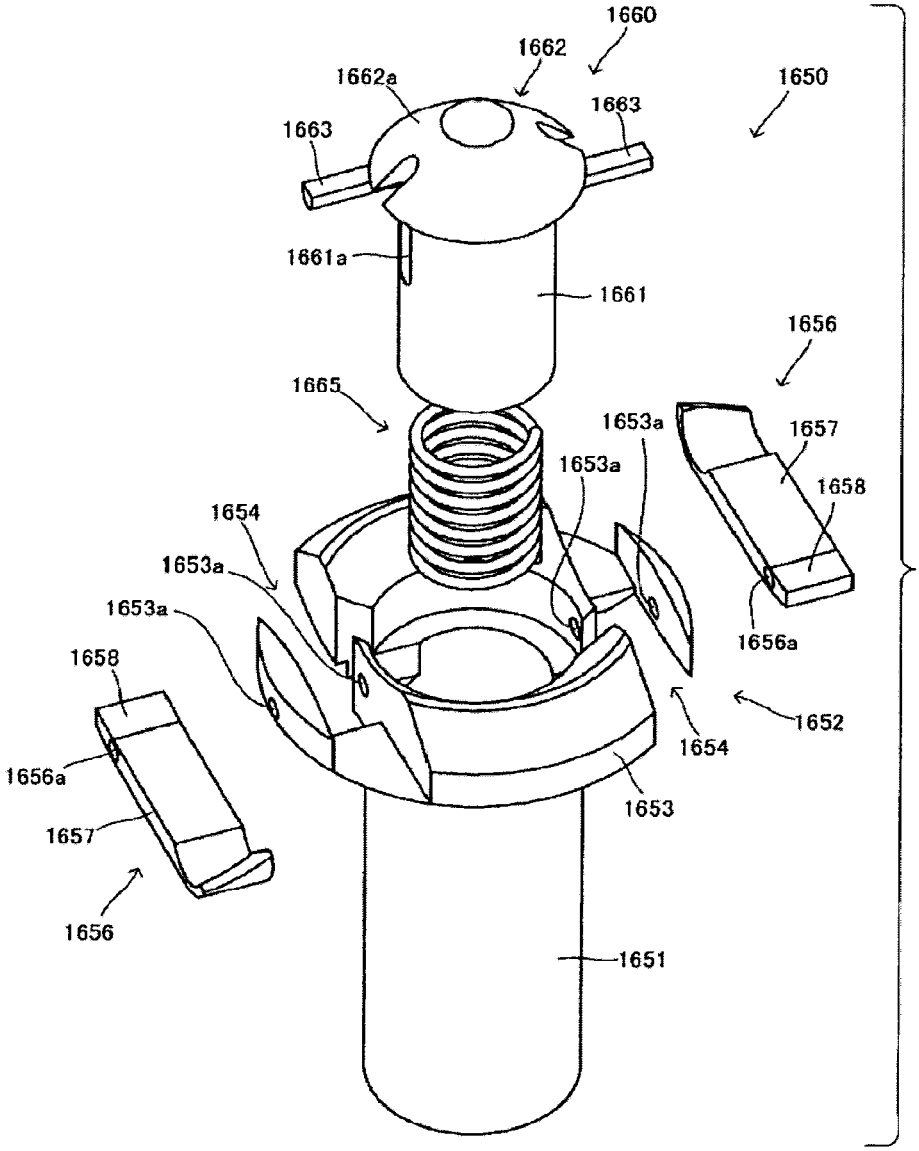

FIG. 119 is an exploded perspective view of a shaft member 1650.

Figure 120:
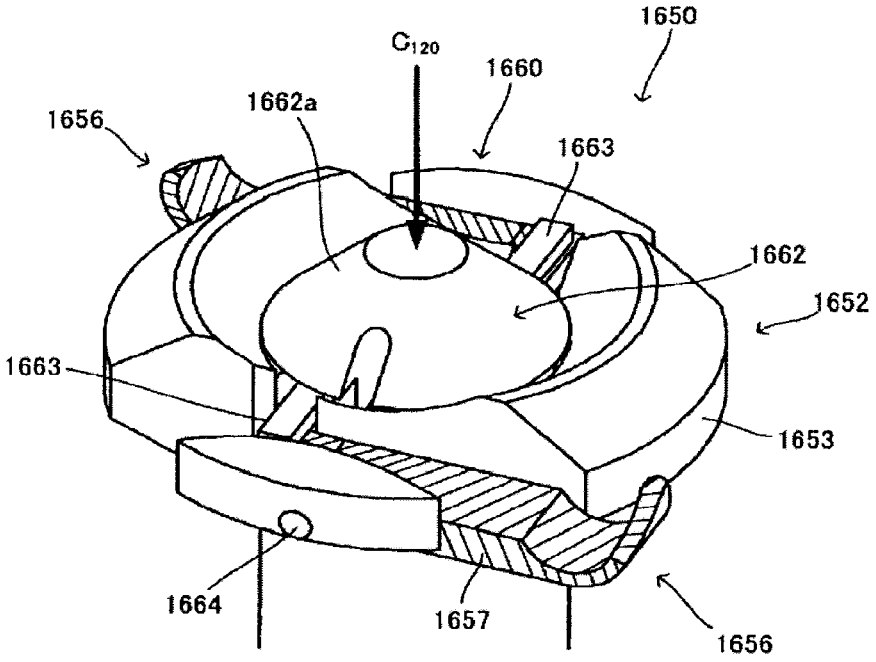

FIG. 120 is an enlarged perspective view illustrating a part of the shaft member 1650.

Figure 121:
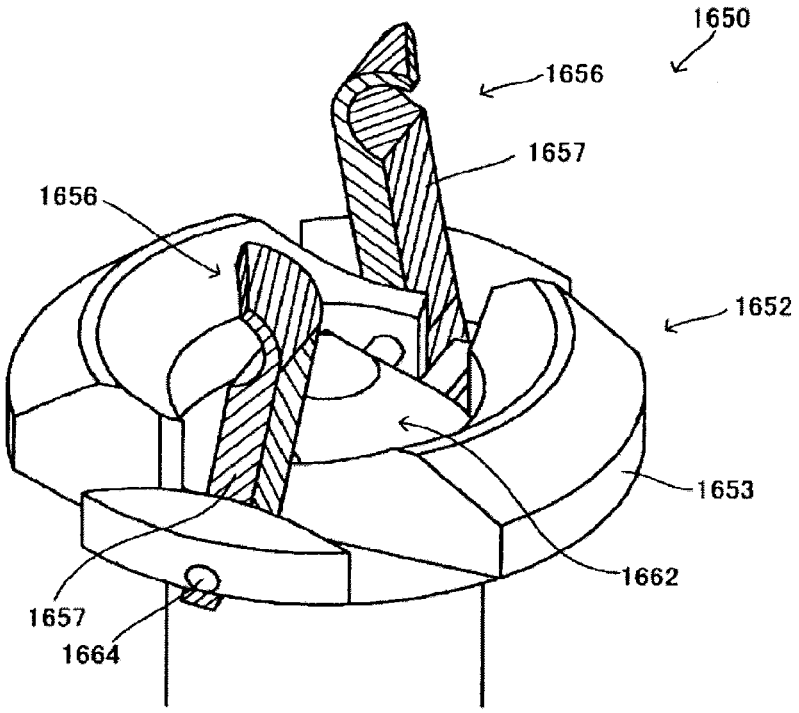

FIG. 121 is an enlarged perspective view illustrating a part of the shaft member 1650.

Figure 122:
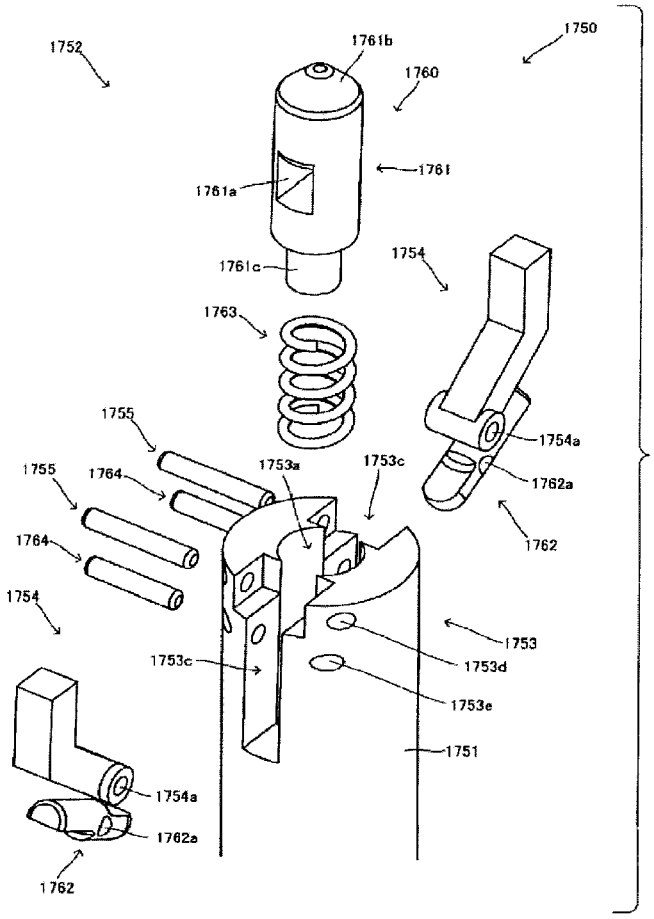

FIG. 122 is an exploded perspective view of a shaft member 1750.

Figure 123:
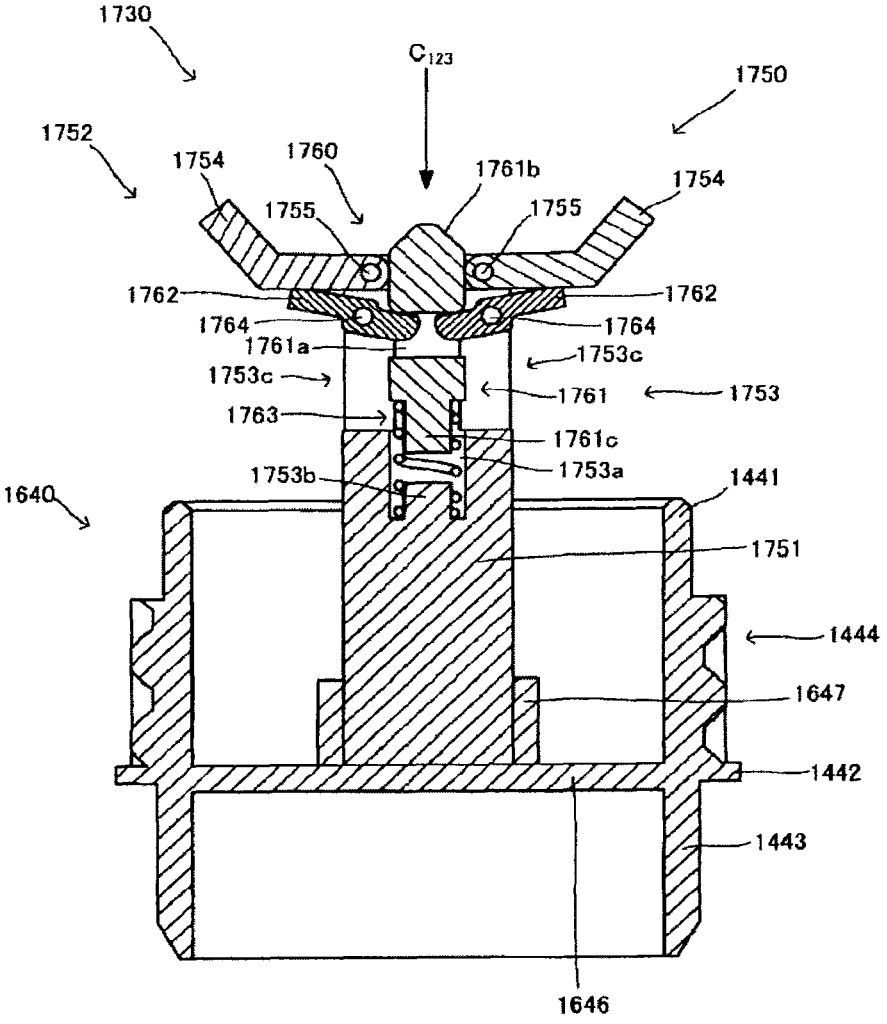

FIG. 123 is a sectional view of an end member 1730.

Figure 124:
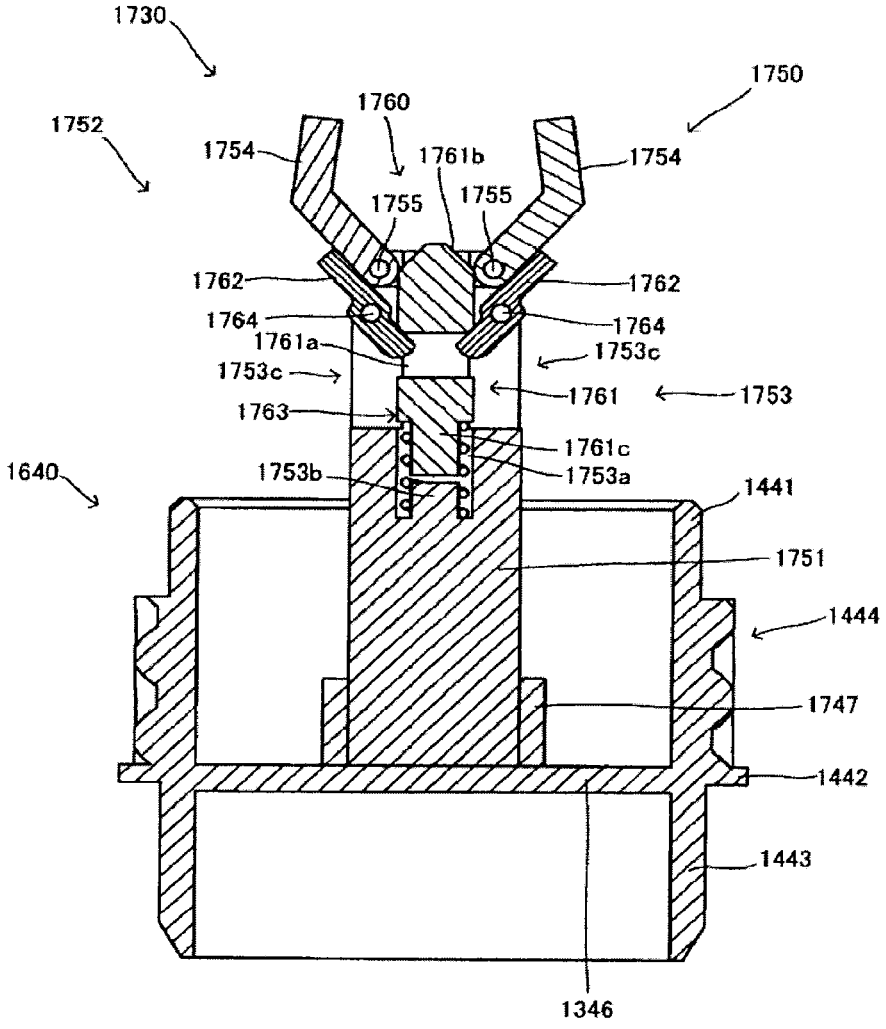

FIG. 124 is a sectional view of a posture in which the end member 1730 is deformed.

Figure 125A:
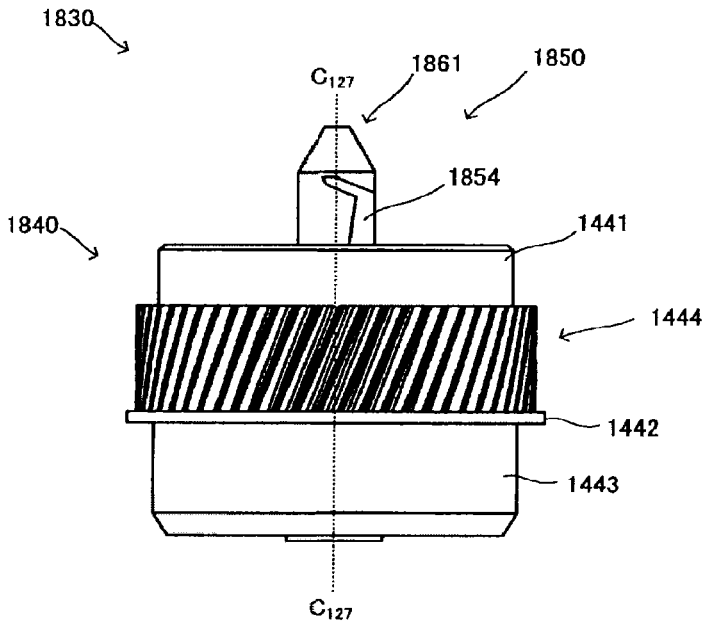

FIG. 125A is a front view of an end member 1830.

Figure 125B:
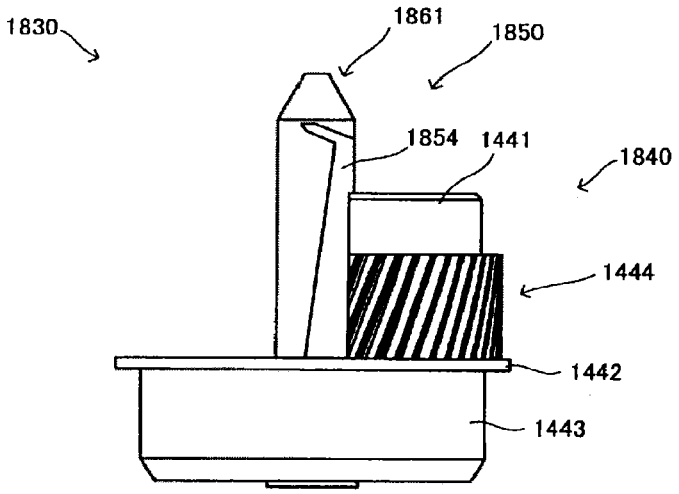

FIG. 125B is a front view illustrating a cut-out part of the end member 1830.

Figure 126:
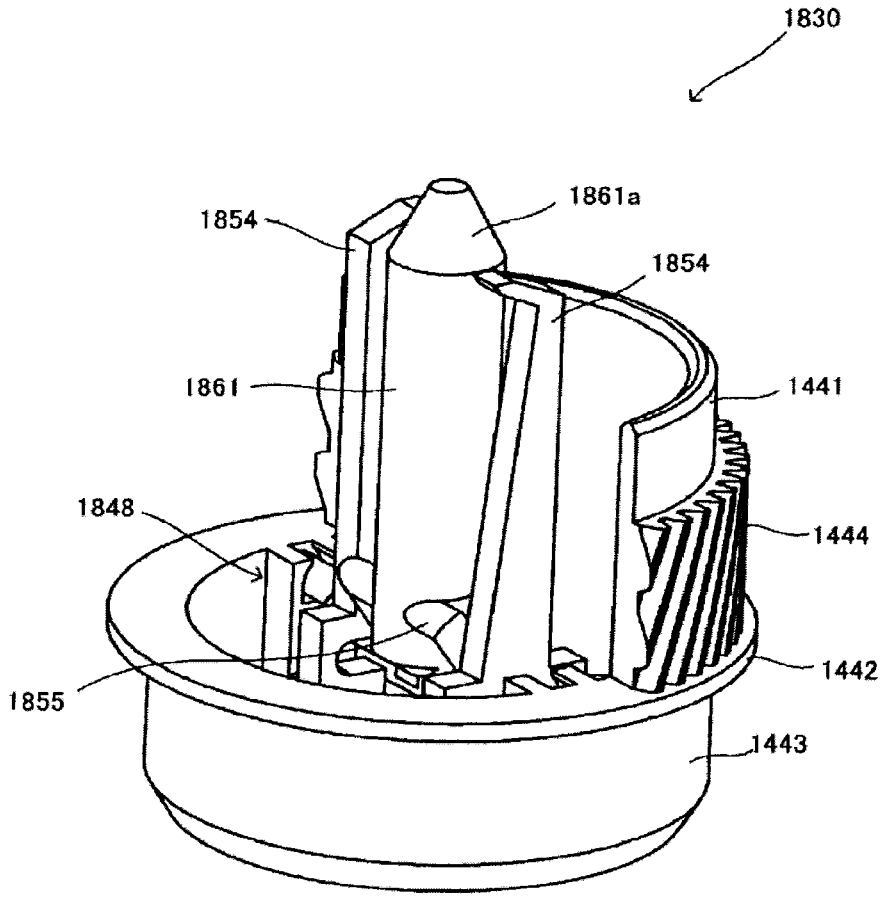

FIG. 126 is a perspective view illustrating a cut-out part of the end member 1830.

Figure 127:
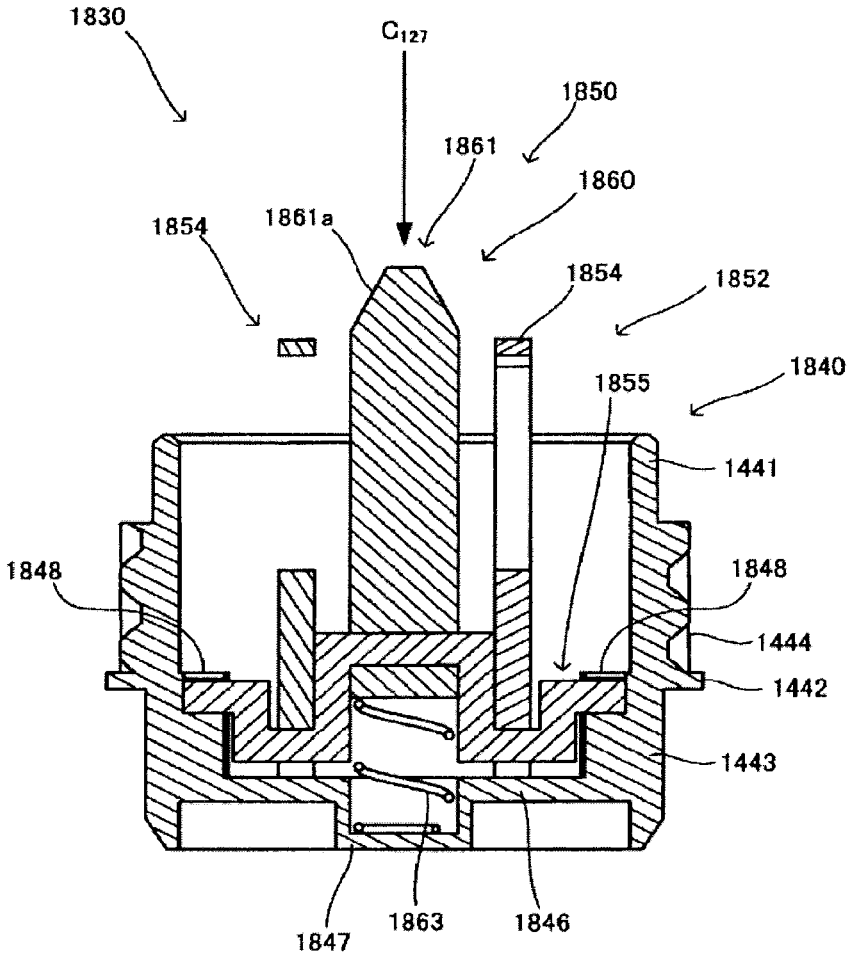

FIG. 127 is a sectional view of the end member 1830.

Figure 128:
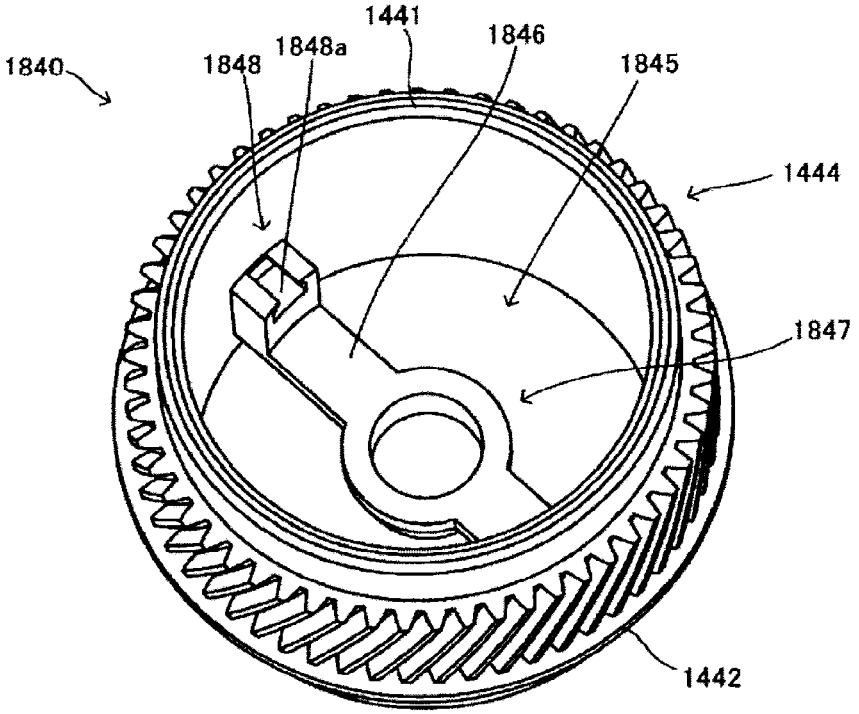

FIG. 128 is a perspective view of a bearing member 1840.

Figure 129:
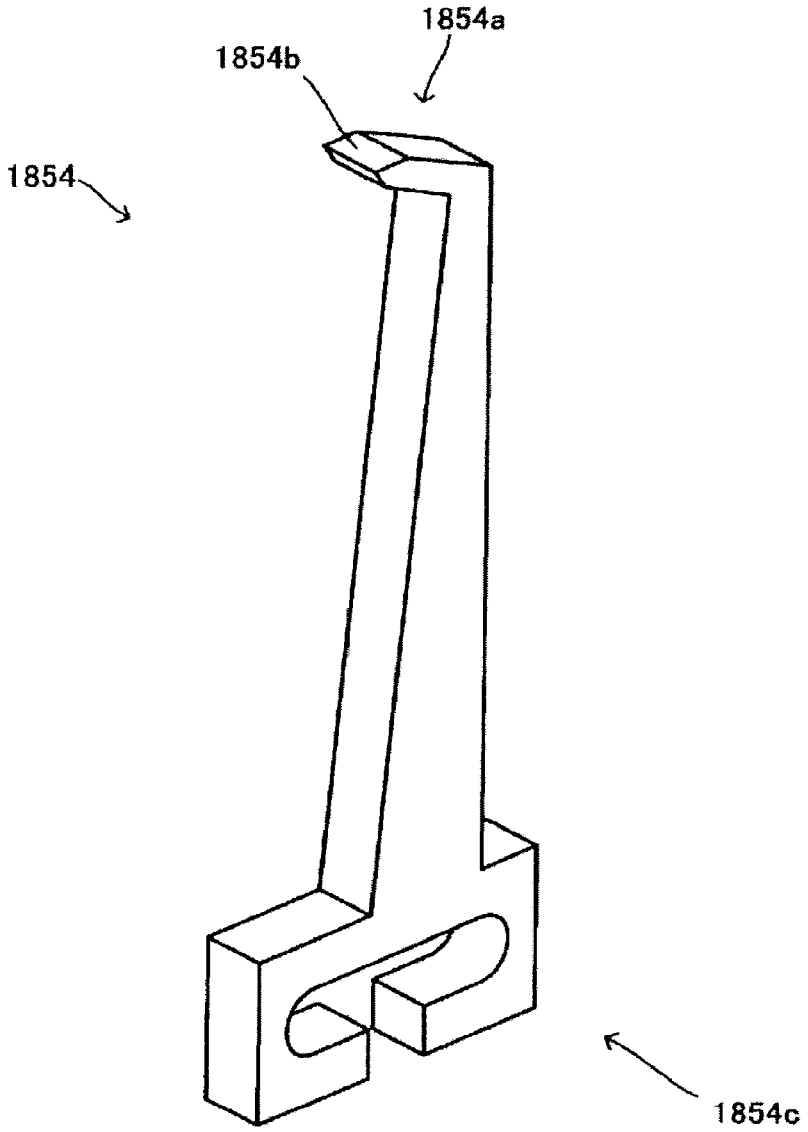

FIG. 129 is a perspective view of an engaging member 1854.

Figure 130:
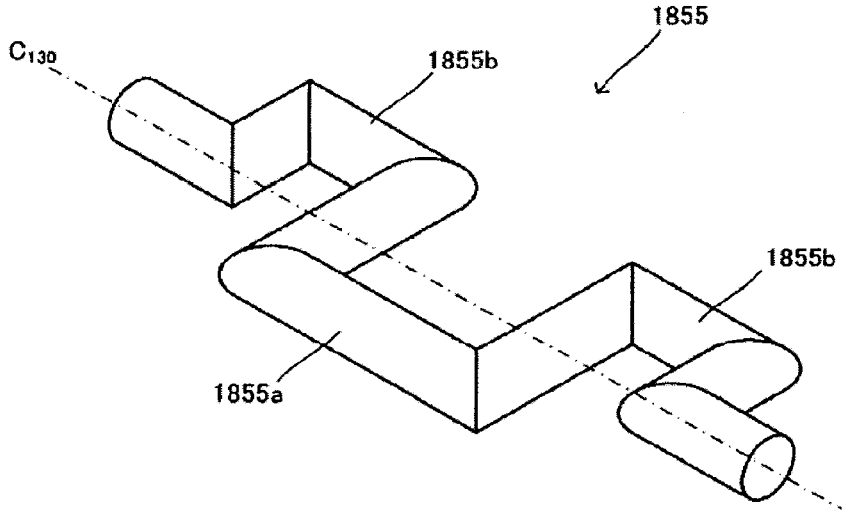

FIG. 130 is a perspective view of a crank shaft 1855.

Figure 131:
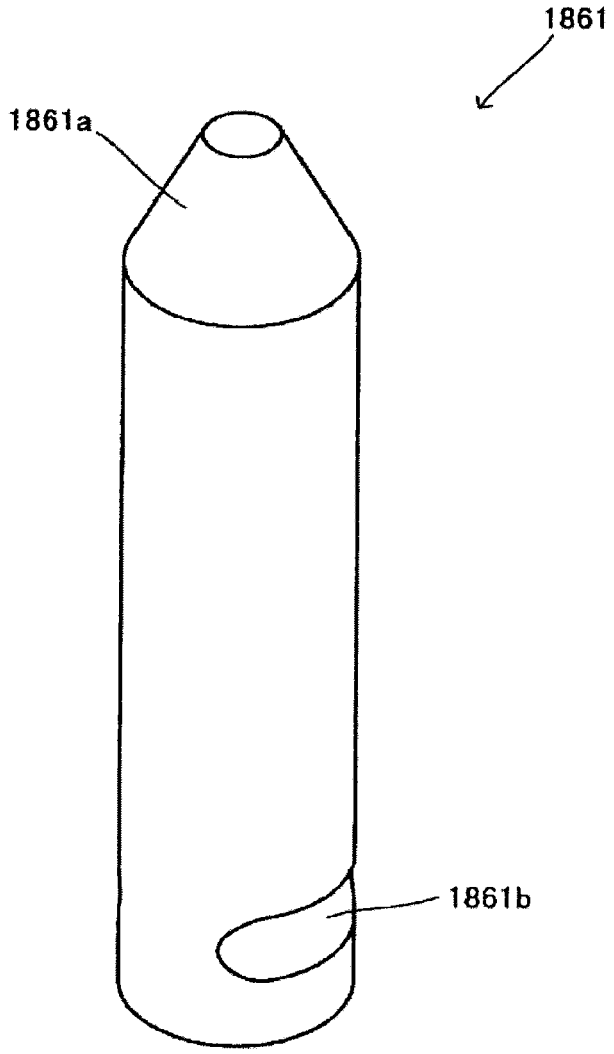

FIG. 131 is a perspective view of a regulation shaft 1861.

Figure 132:
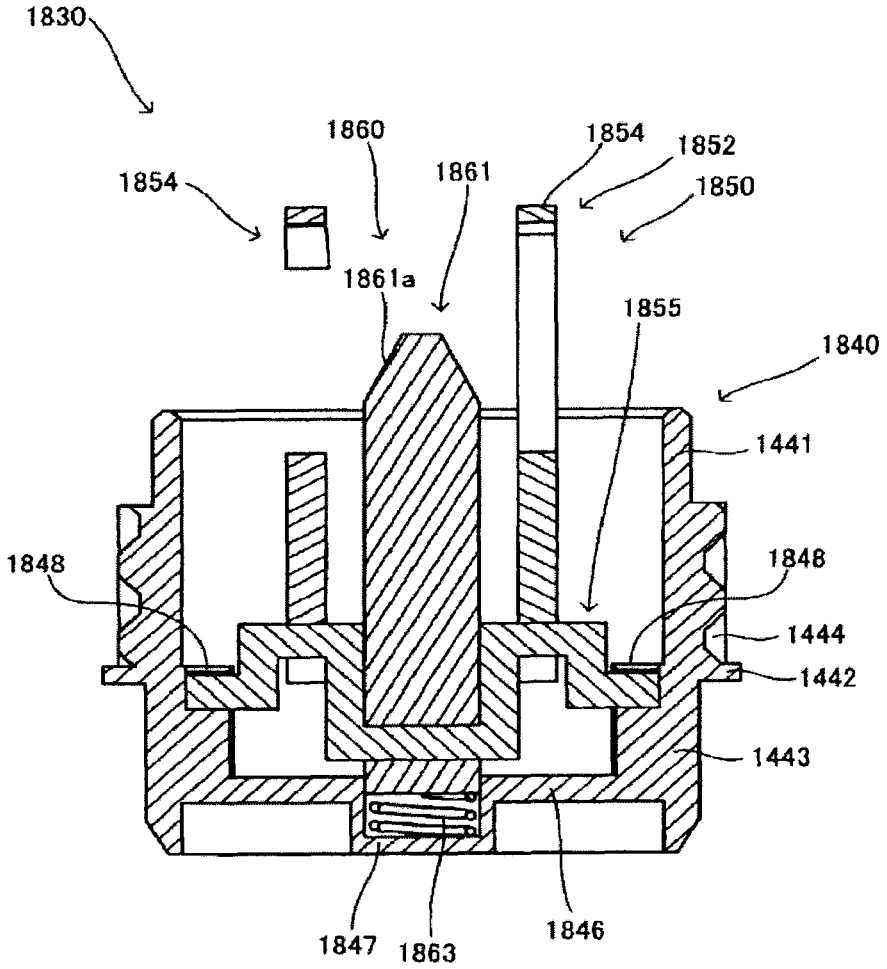

FIG. 132 is a sectional view in a posture in which the end member 1830 is deformed.

Figure 133:
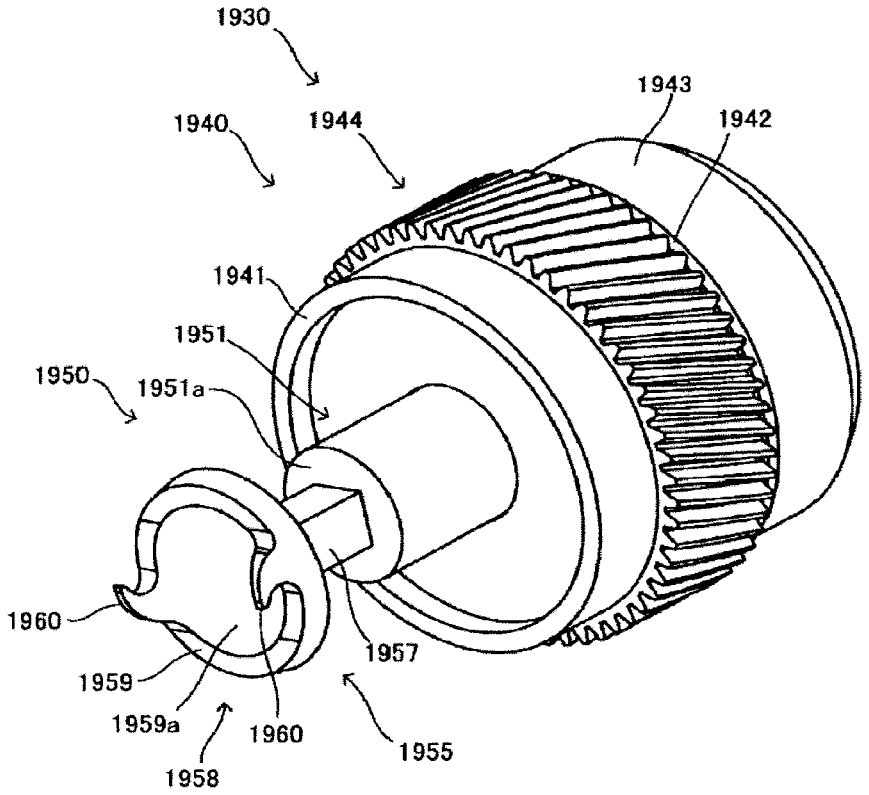

FIG. 133 is a perspective view of an end member 1930.

Figure 134:
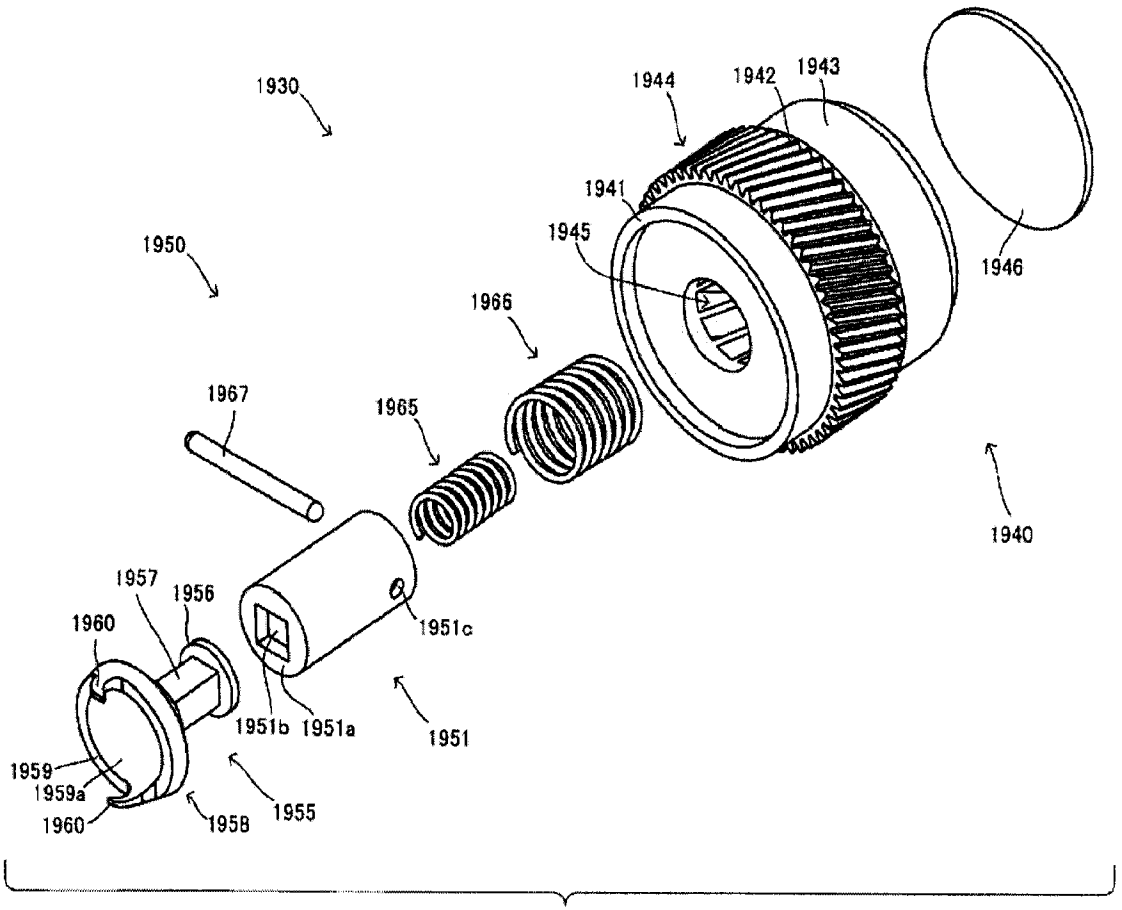

FIG. 134 is an exploded perspective view of the end member 1930.

Figure 135A:
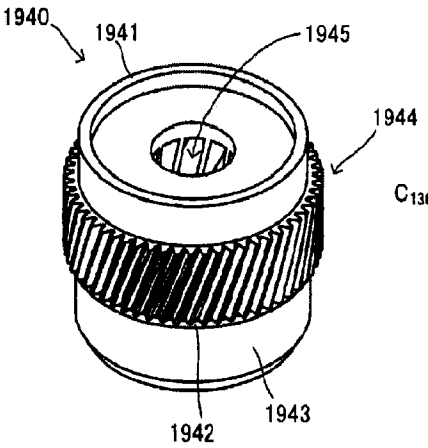

FIG. 135A is a perspective view of a bearing member 1940.

Figure 135B:
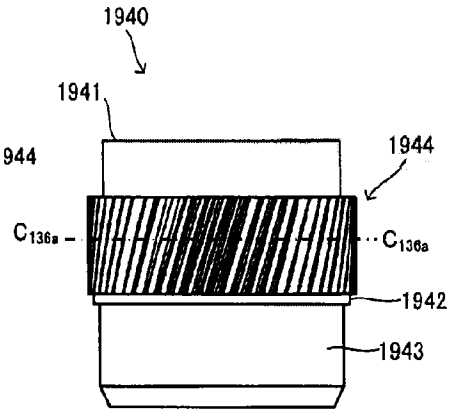

FIG. 135B is a front view of the bearing member 1940.

Figure 135C:
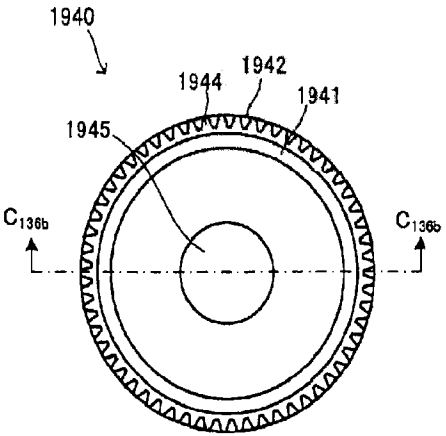

FIG. 135C is a plan view of the bearing member 1940.

Figure 136A:
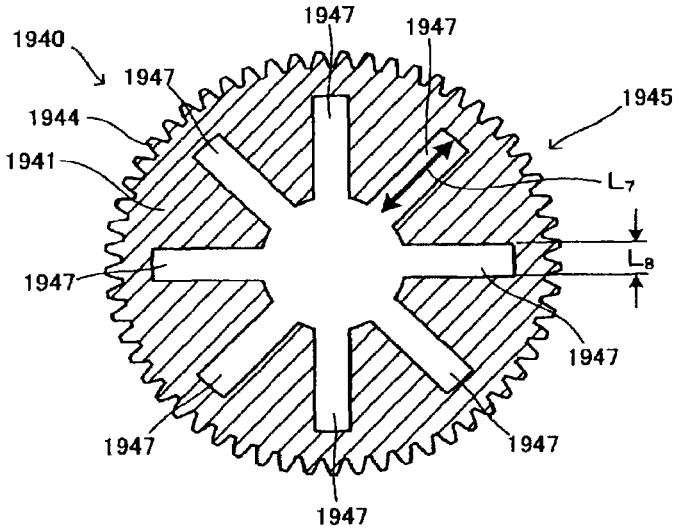

FIG. 136A is an end surface view which is orthogonal to the axial direction of the bearing member 1940.

Figure 136B:
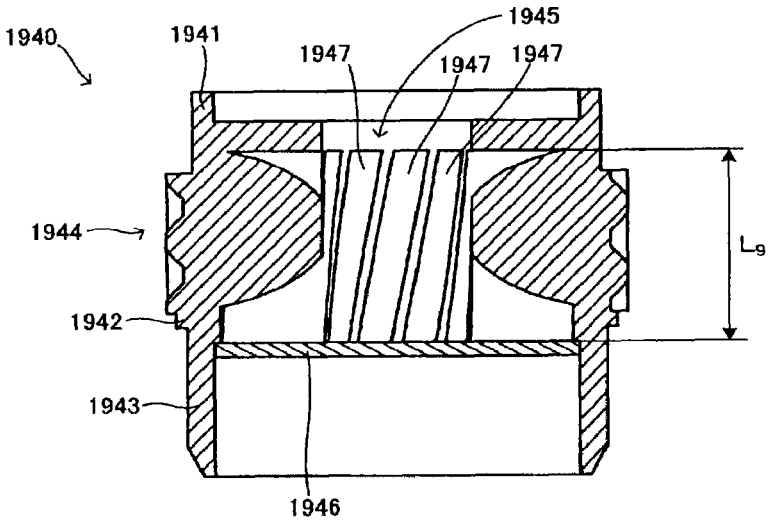

FIG. 136B is a sectional view along the axial direction of the bearing member 1940.

Figure 137A:
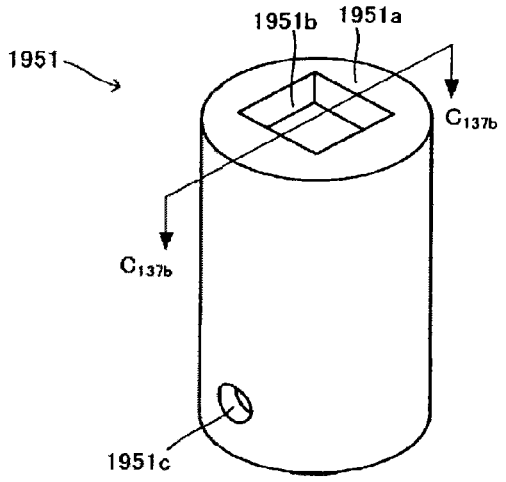

FIG. 137A is a perspective view of a rotating shaft 1951.

Figure 137B:
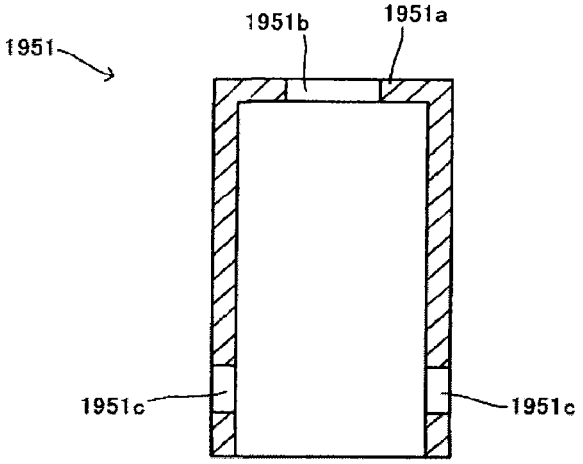

FIG. 137B is a sectional view of the rotating shaft 1951.

Figure 138A:
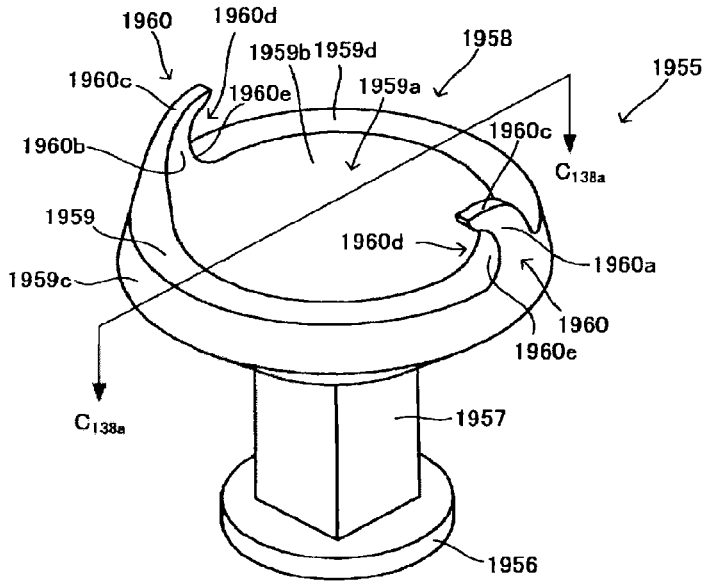

FIG. 138A is a perspective view of a tip end member 1955.

Figure 138B:
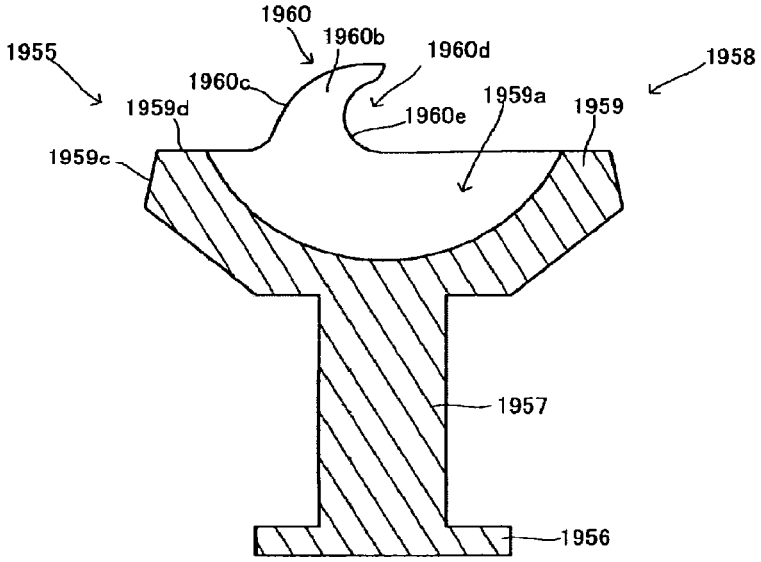

FIG. 138B is a sectional view of the tip end member 1955.

Figure 139A:
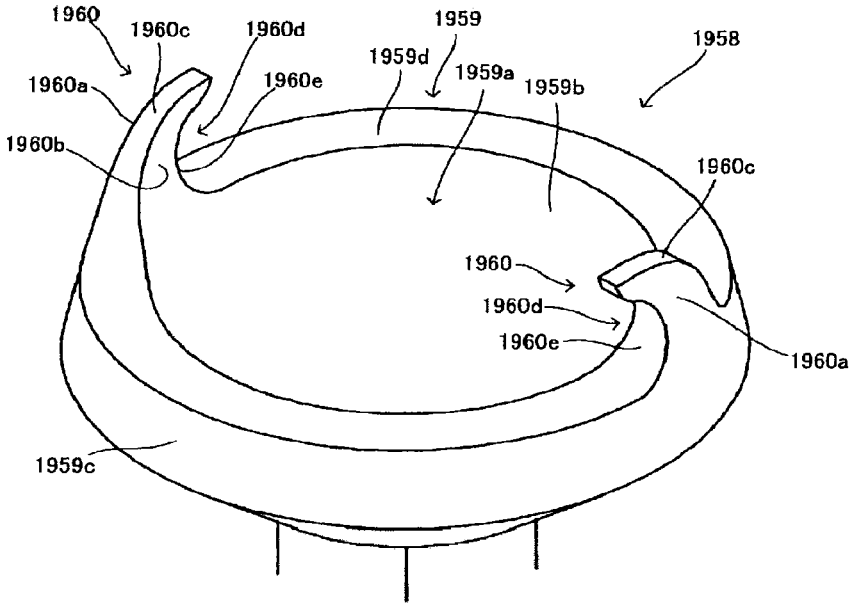

FIG. 139A is a perspective view of a rotating force receiving member 1958.

Figure 139B:
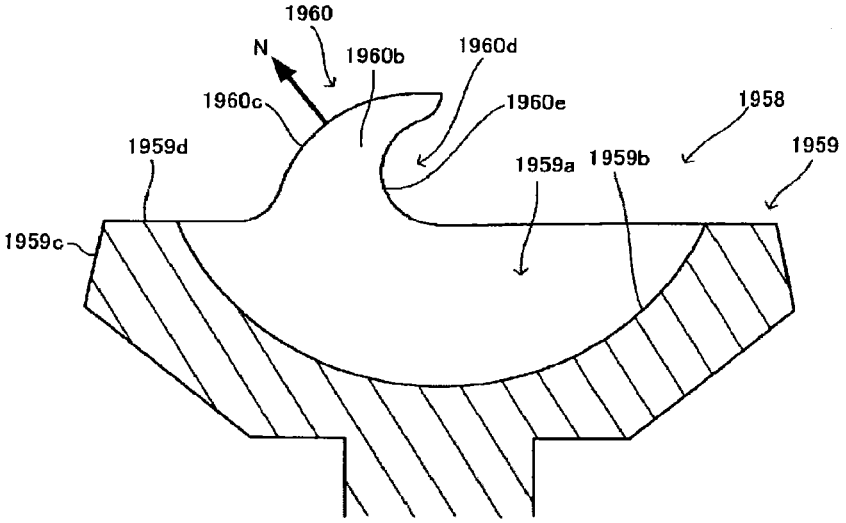

FIG. 139B is a sectional view of the rotating force receiving member 1958.

Figure 140:
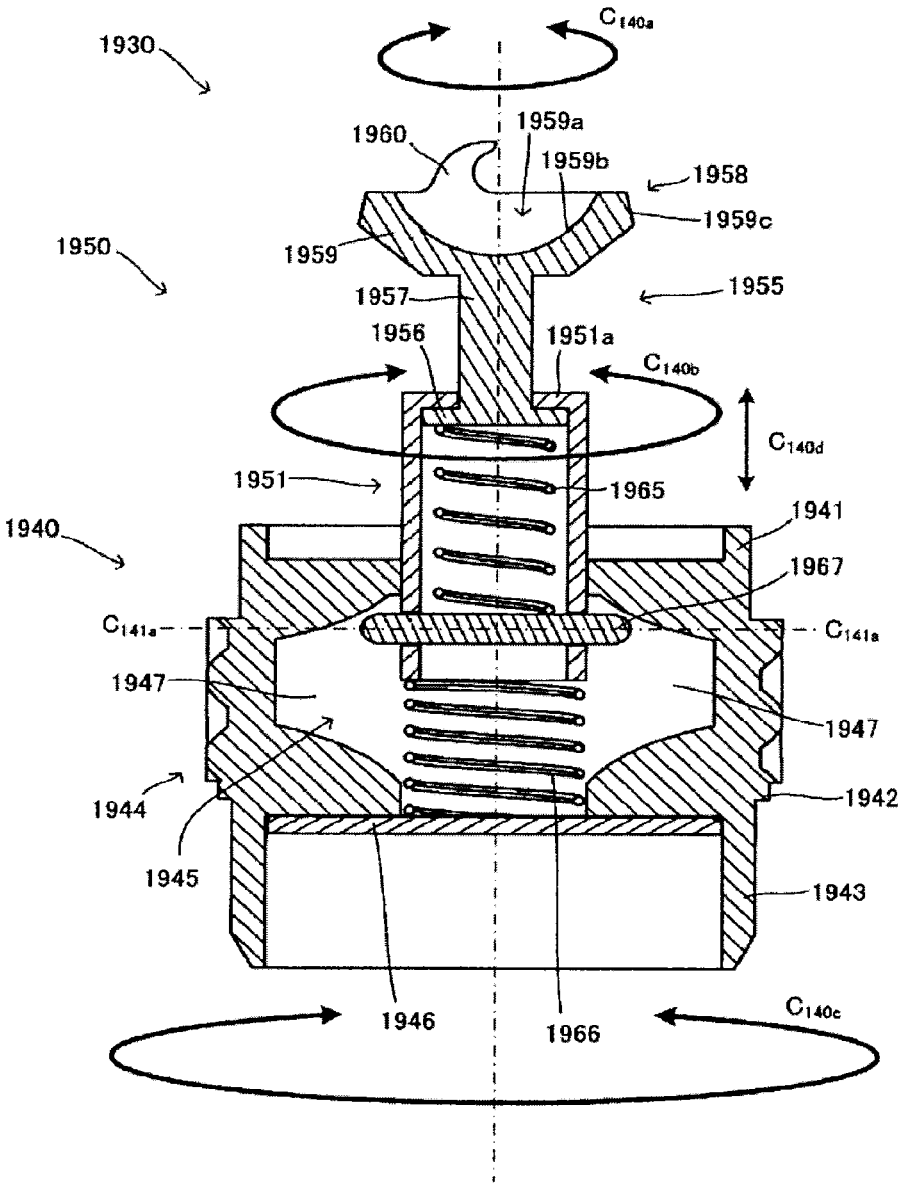

FIG. 140 is a sectional view of the end member 1930.

Figure 141A:
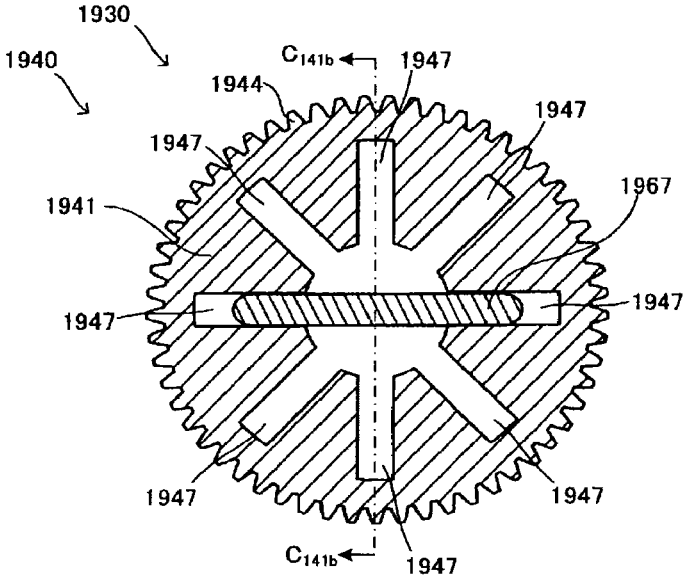

FIG. 141A is an end surface view which is orthogonal to the axial direction of the end member 1930.

Figure 141B:
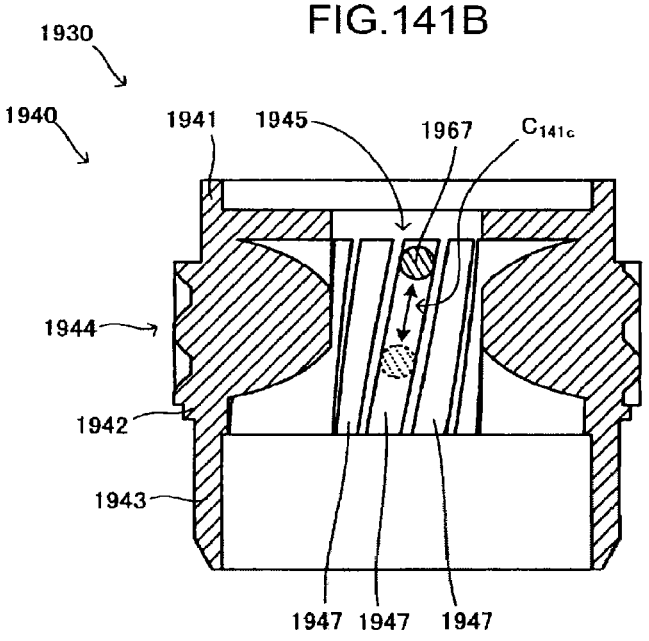

FIG. 141B is a sectional view along the axial direction of the end member 1930.

Figure 142:
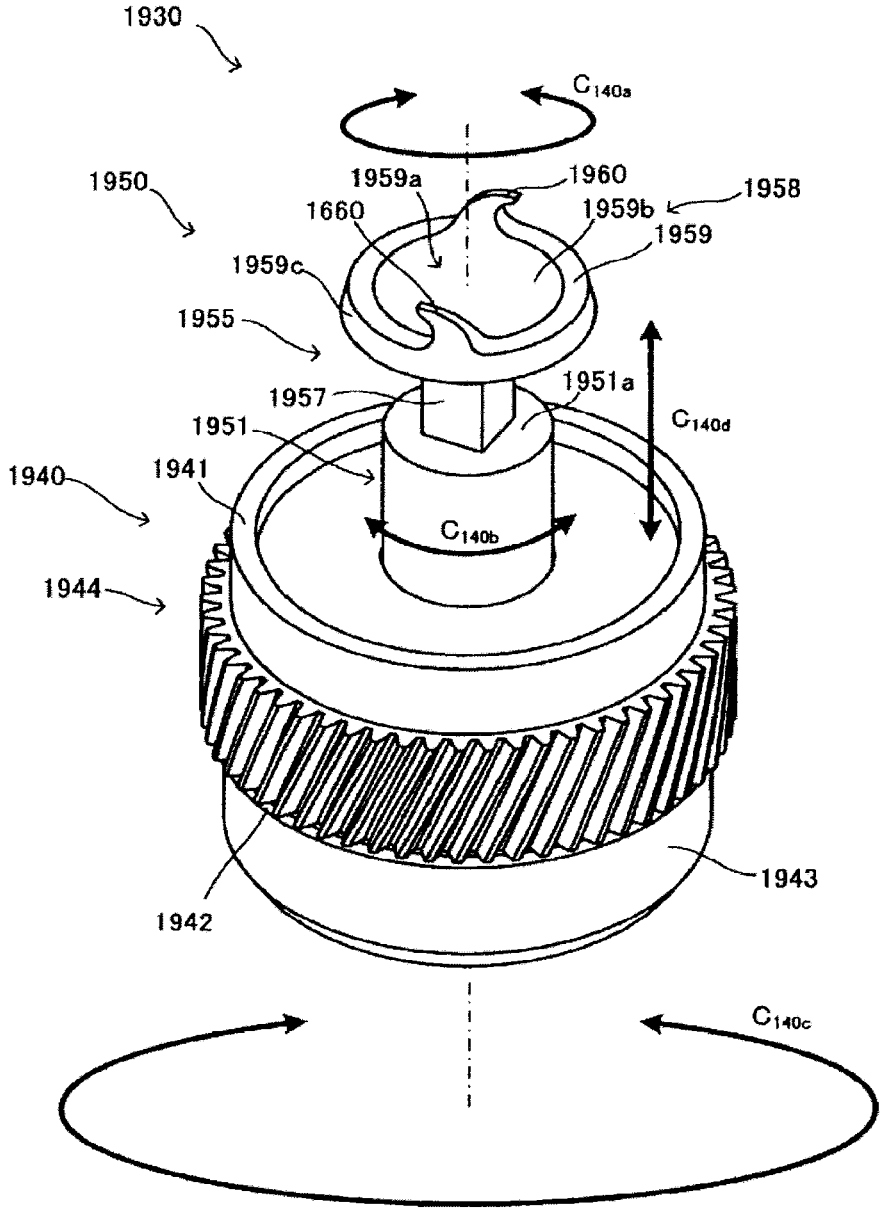

FIG. 142 is a perspective view of the end member 1930.

Figure 143:
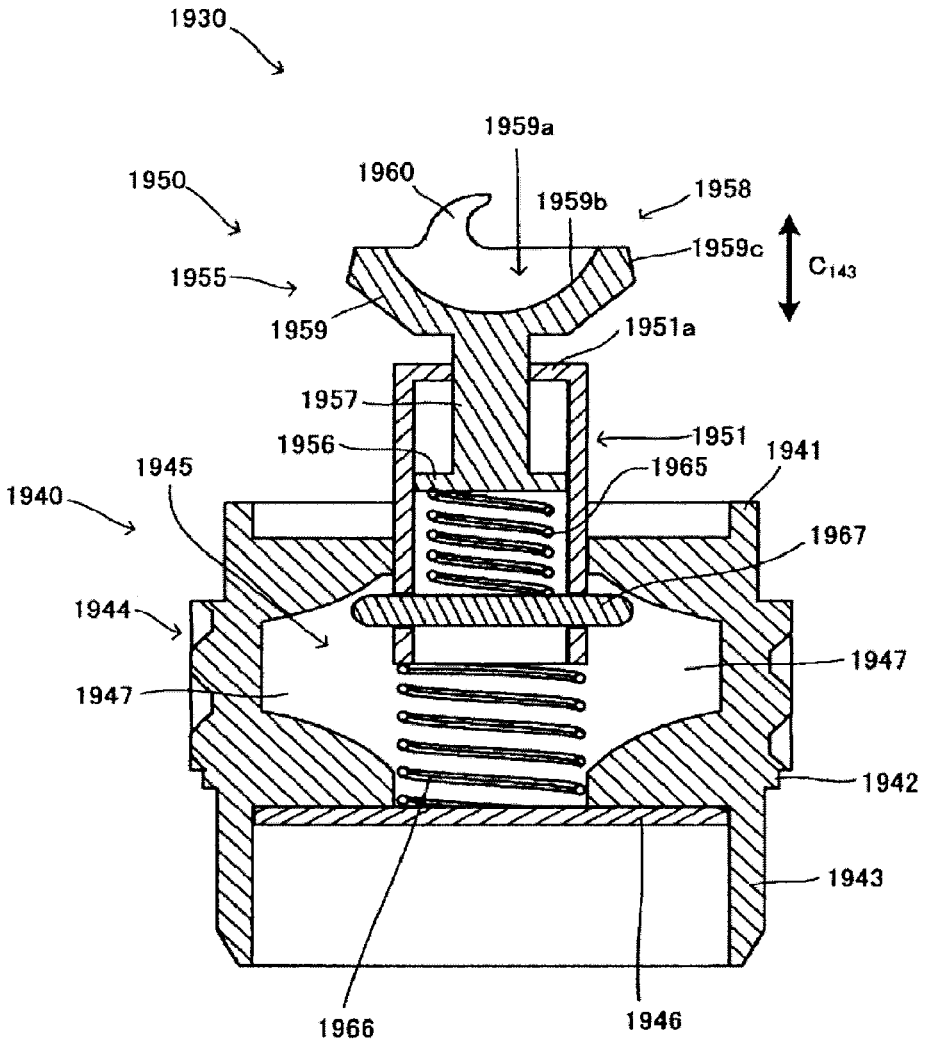

FIG. 143 is a sectional view of the end member 1930.

Figure 144A:
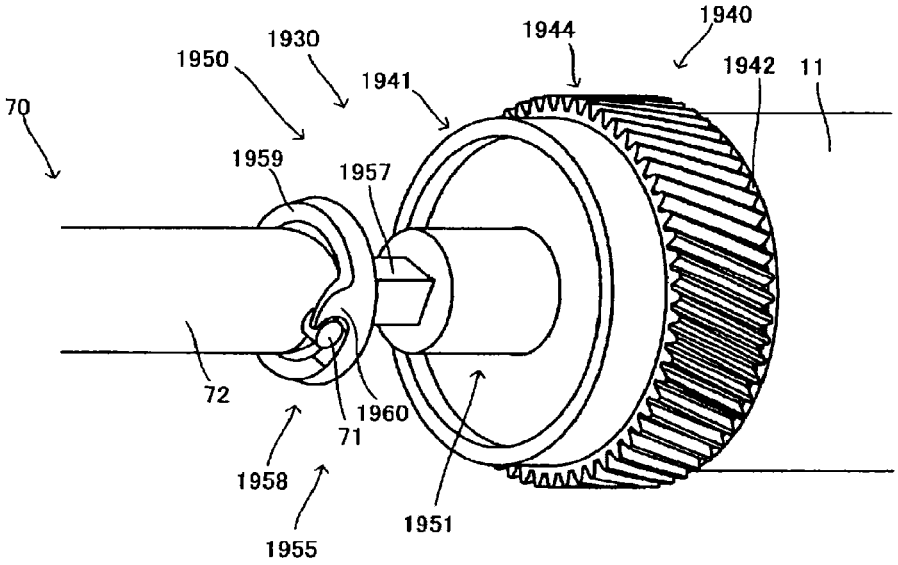

FIG. 144A is a perspective view of a scene where the driving shaft 70 and the end member 1930 are engaged.

Figure 144B:
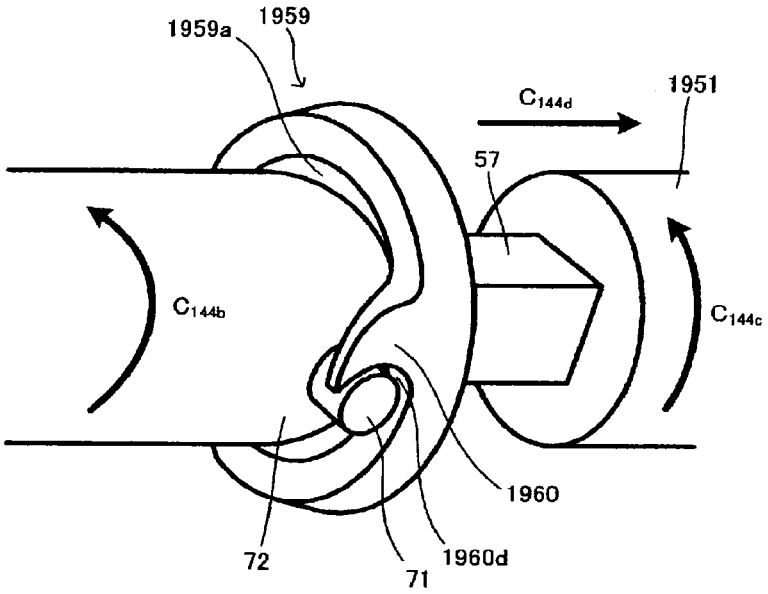

FIG. 144B is an enlarged perspective view illustrating the engaged part.

Figure 145:
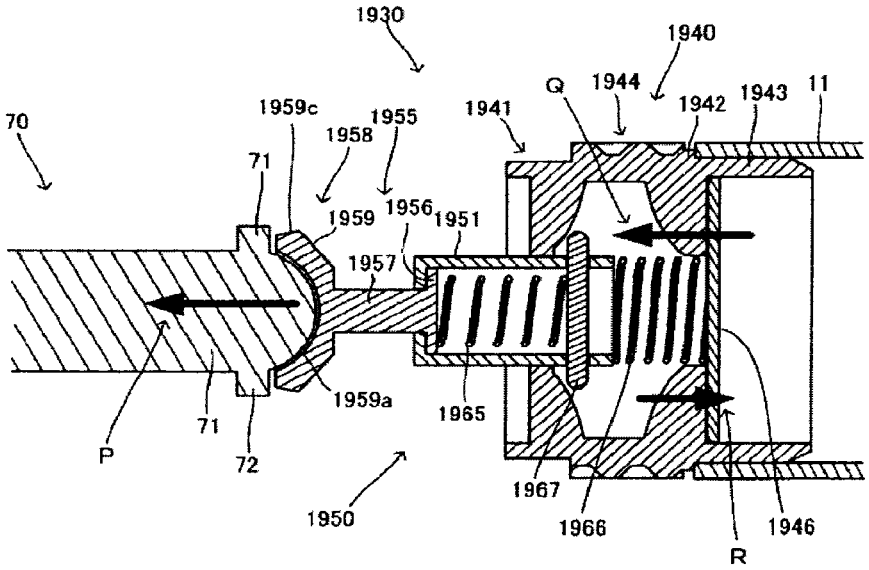

FIG. 145 is a sectional view along the axial direction of a scene where the driving shaft 70 and the end member 1930 are engaged.

Figure 146A:
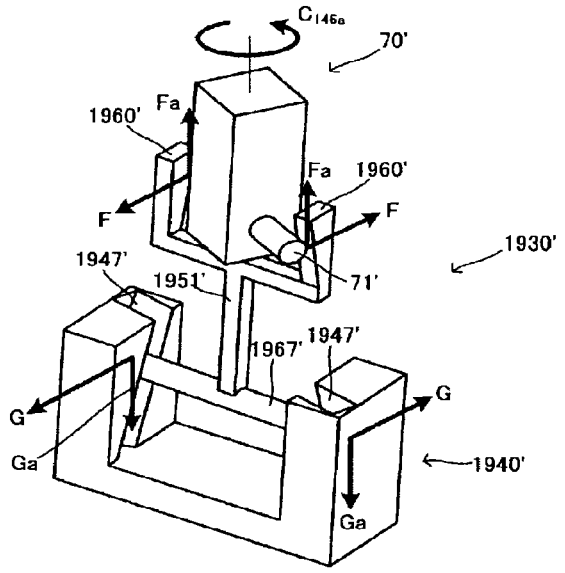

FIG. 146A is a schematic view illustrating a force generated in a posture in which a rotating force is transmitted.

Figure 146B:
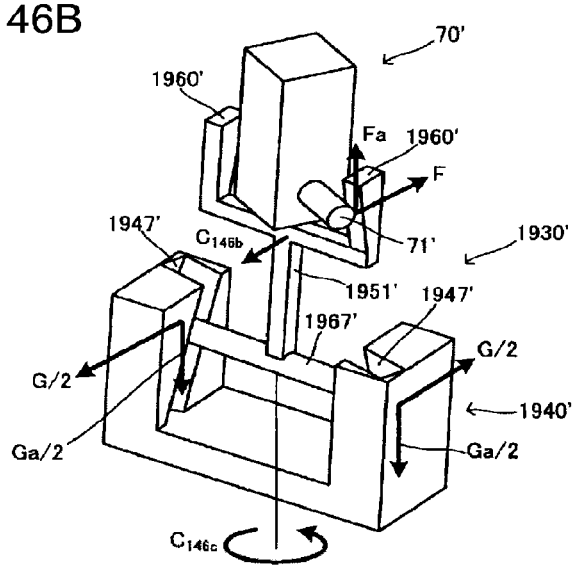

FIG. 146B is a schematic view illustrating a force generated in a scene where the processing cartridge is disengaged.

Figure 147:
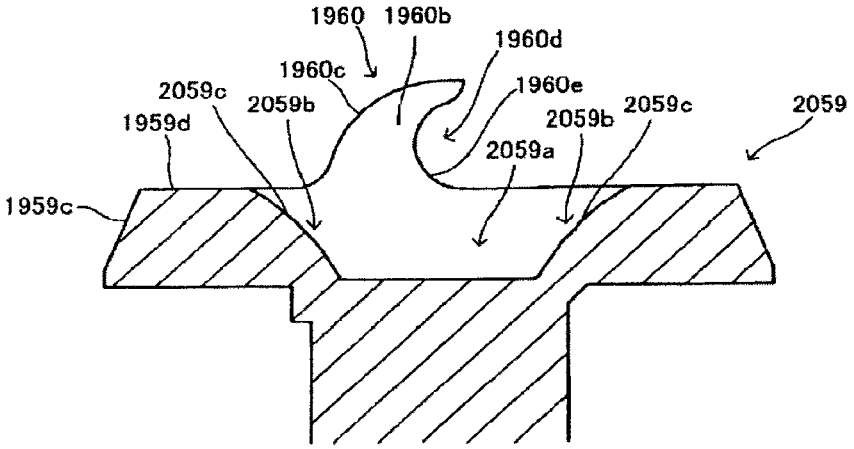

FIG. 147 is a view illustrating a receiving member 2059.

Figure 148A:
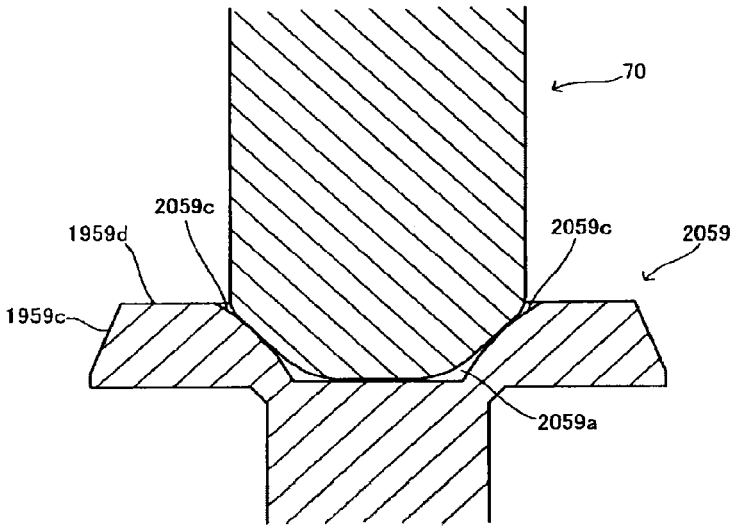

FIG. 148A is a view illustrating a posture in which the receiving member 2059 is engaged with the driving shaft 70 and the rotating force is transmitted.

Figure 148B:
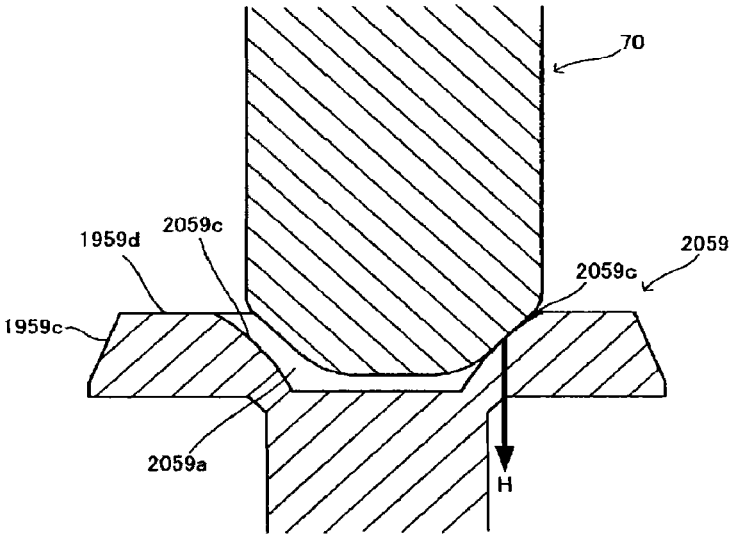

FIG. 148B is a view illustrating a scene where the driving shaft 70 is disengaged from the receiving member 2059.

Figure 149:
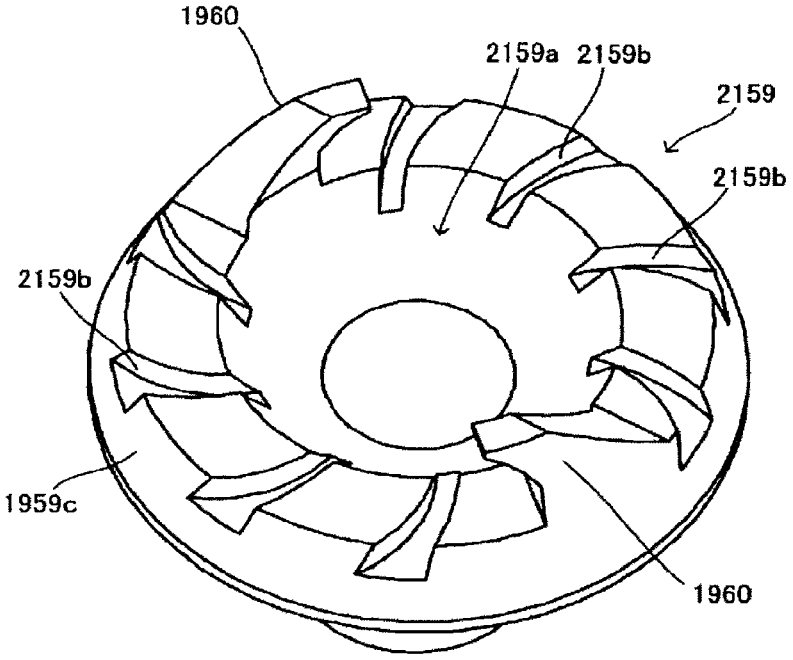

FIG. 149 is a perspective view illustrating a receiving member 2159.

Figure 150A:
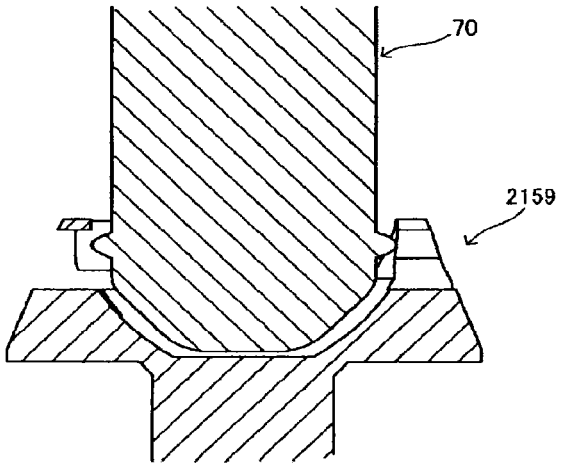

FIG. 150A is a view illustrating a posture in which the receiving member 2159 is engaged with the driving shaft 70 and the rotating force is transmitted.

Figure 150B:
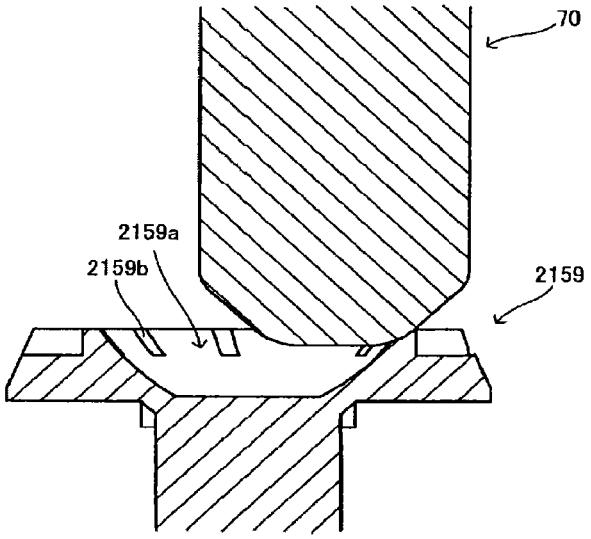

FIG. 150B is a view illustrating a scene where the driving shaft 70 is disengaged from the receiving member 2159.

Figure 151:
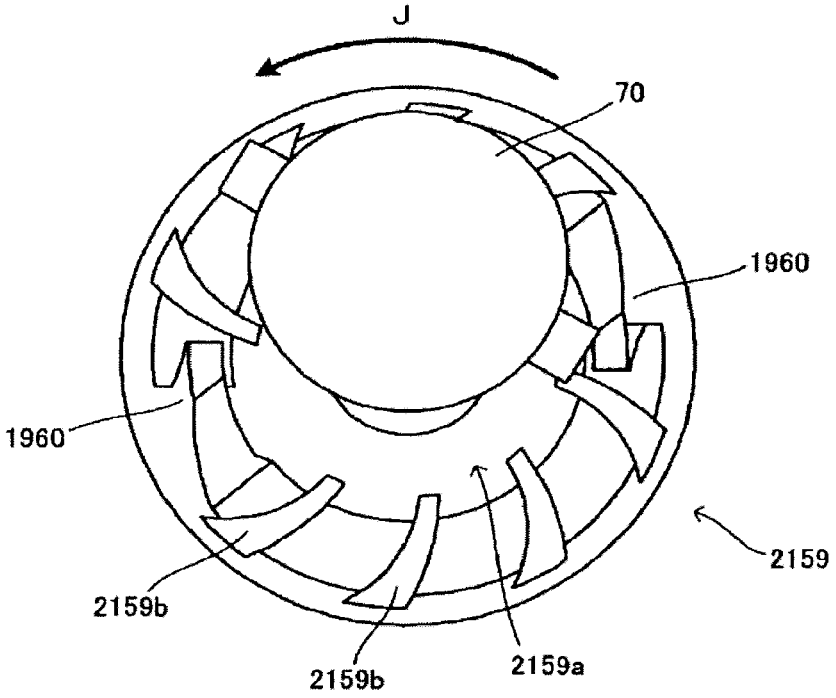

FIG. 151 is another view illustrating a scene where the driving shaft 70 is disengaged from the receiving member 2159.

Figure 152:
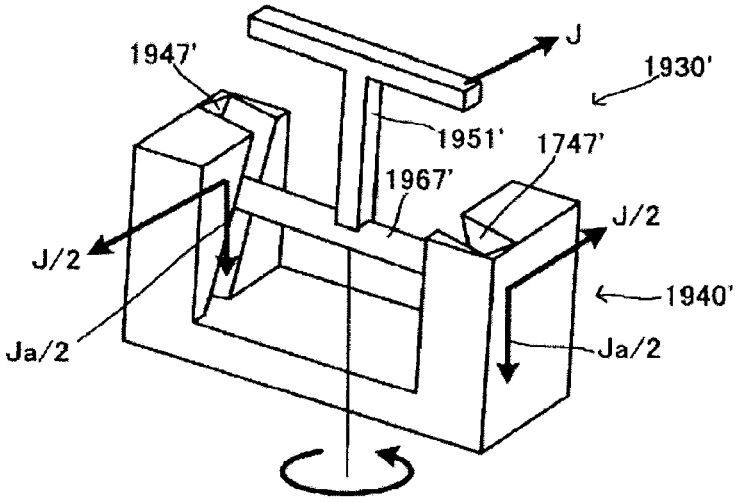

FIG. 152 is a view illustrating a force generated when the driving shaft 70 is disengaged from the receiving member 2159.

Figure 153A:
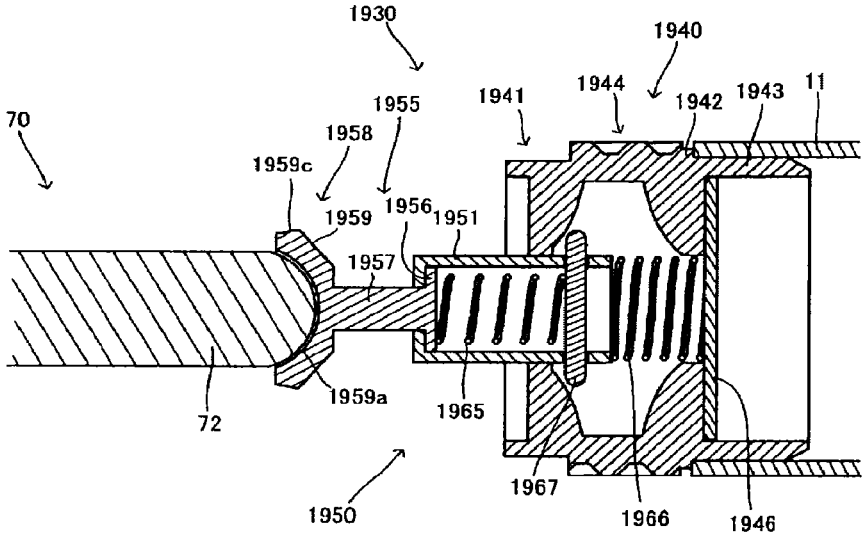

FIG. 153A is a sectional view illustrating a posture in which the end member 1930 is engaged with the driving shaft 70.

Figure 153B:
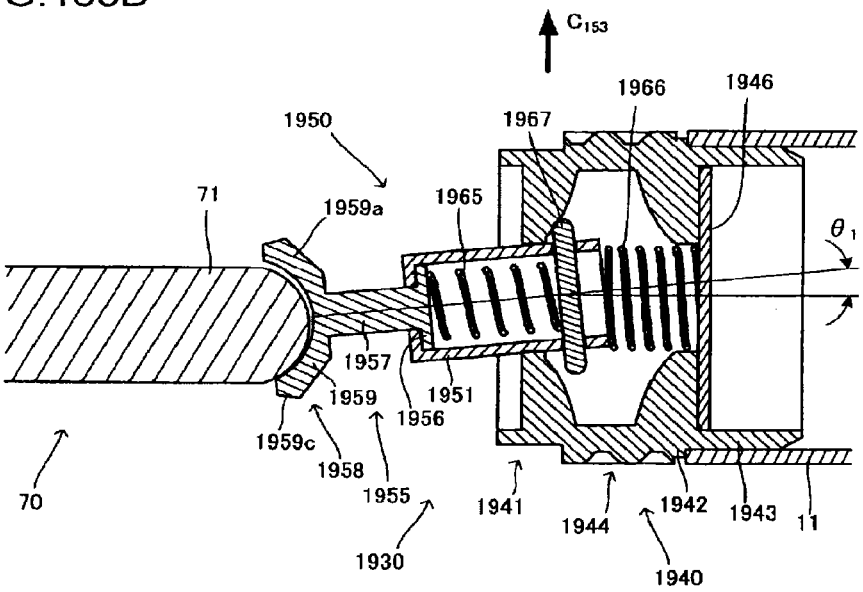

FIG. 153B is a sectional view illustrating one example of a scene where the end member 1930 is disengaged from the driving shaft 70.

Figure 154A:
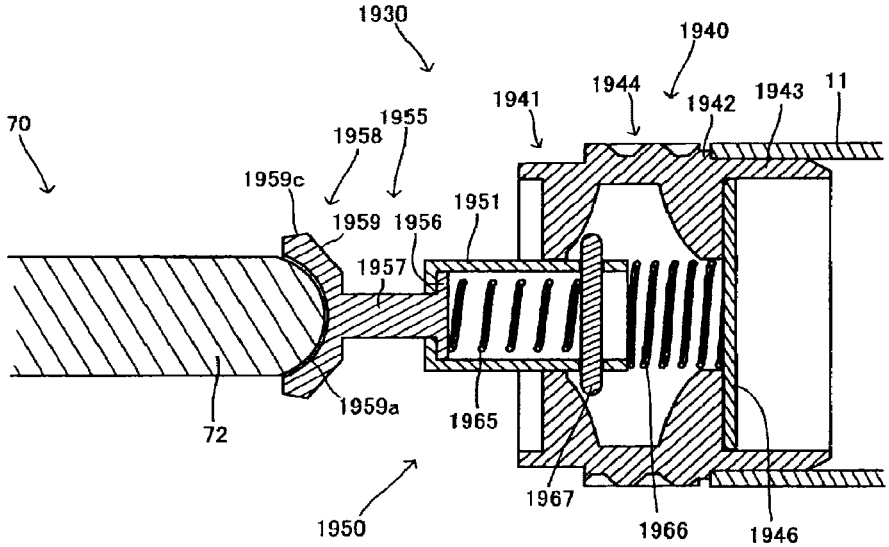

FIG. 154A is a sectional view illustrating a posture in which the end member 1930 is engaged with the driving shaft 70.

Figure 154B:
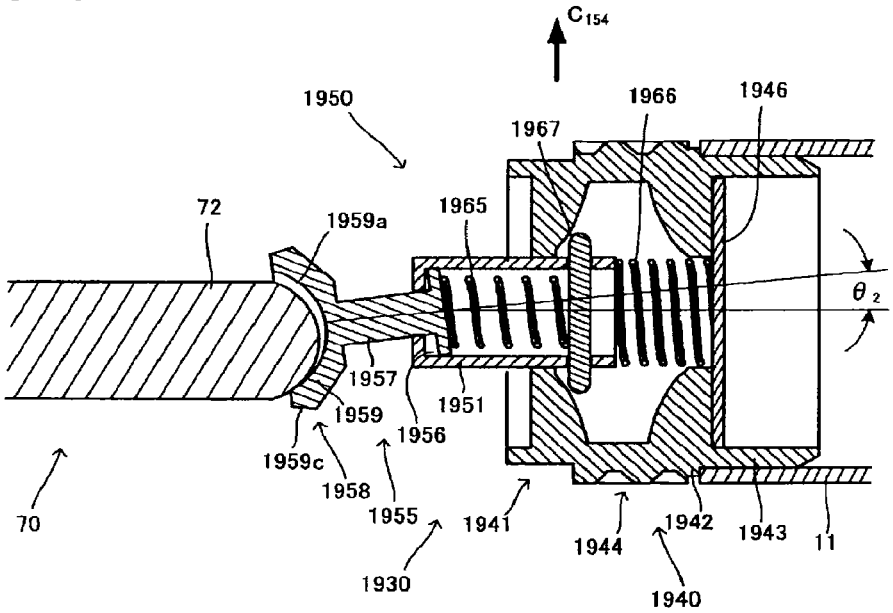

FIG. 154B is a sectional view illustrating another example of a scene where the end member 1930 is disengaged from the driving shaft 70.

Figure 155:
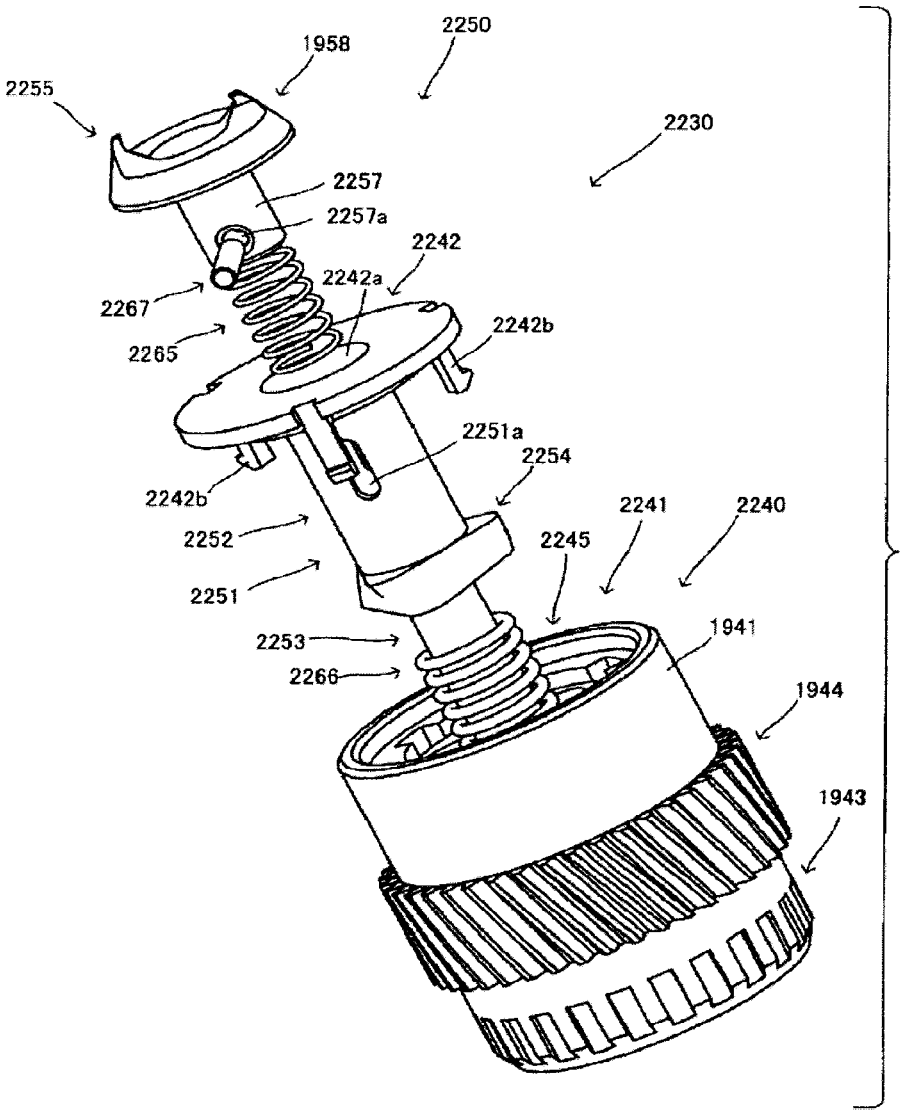

FIG. 155 is an exploded perspective view of an end member 2230.

Figure 156:
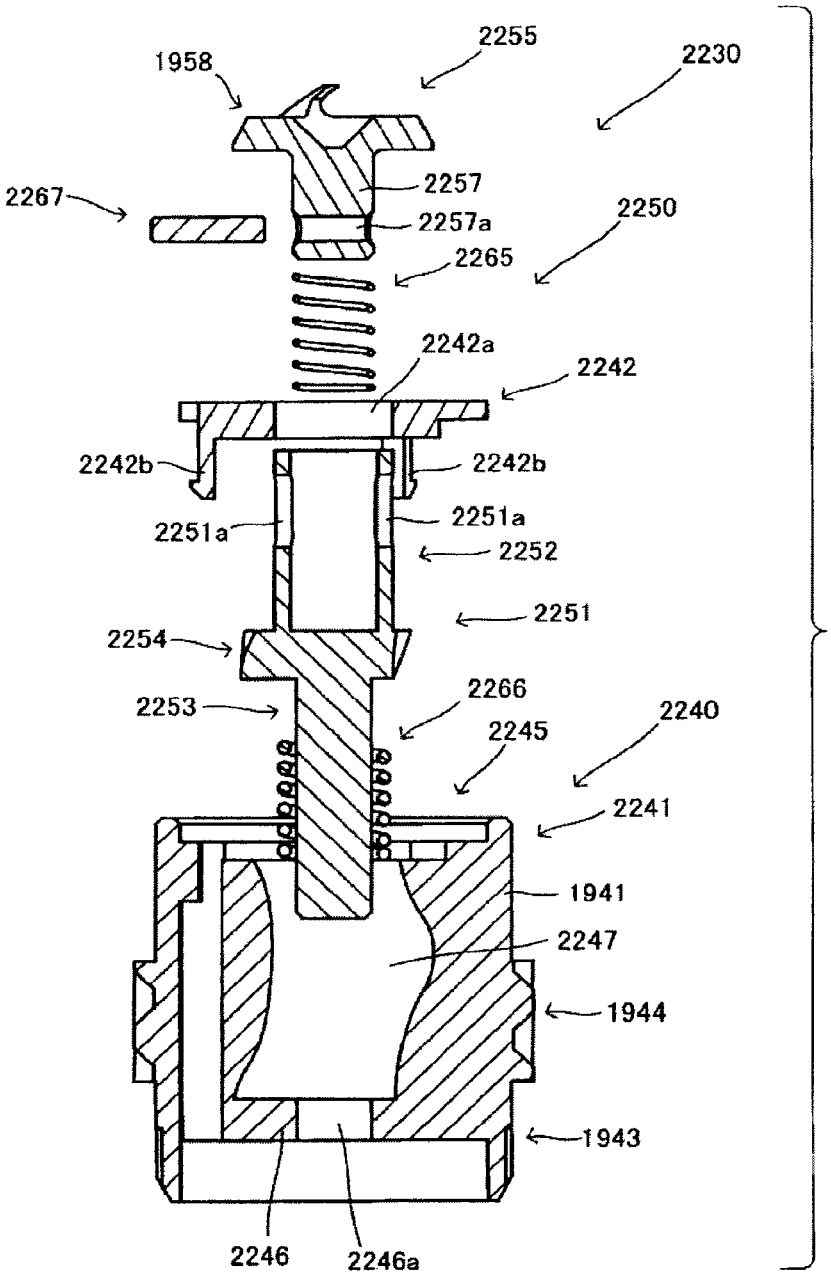

FIG. 156 is an exploded sectional view along the axial direction of the end member 2230.

Figure 157A:
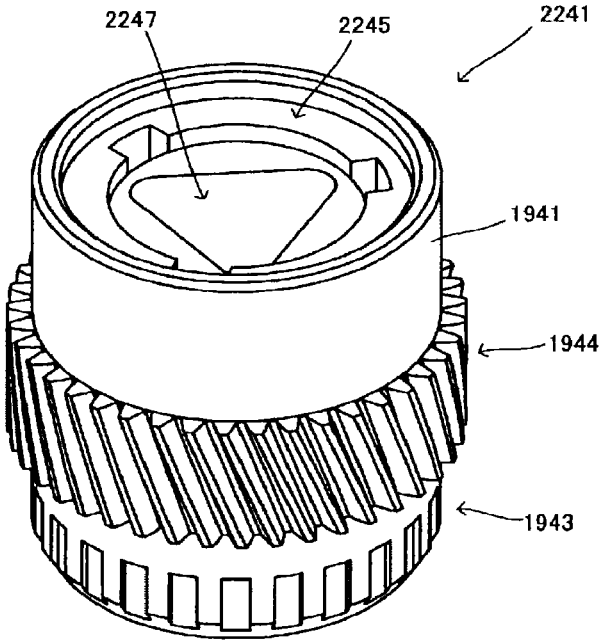

FIG. 157A is a perspective view of a main body 2241 of a bearing member 2240.

Figure 157B:
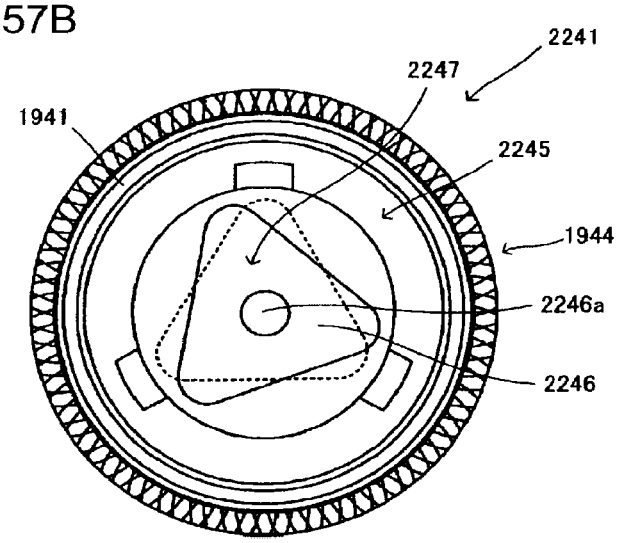

FIG. 157B is a plan view of the main body 2241 of the bearing member 2240.

Figure 158:
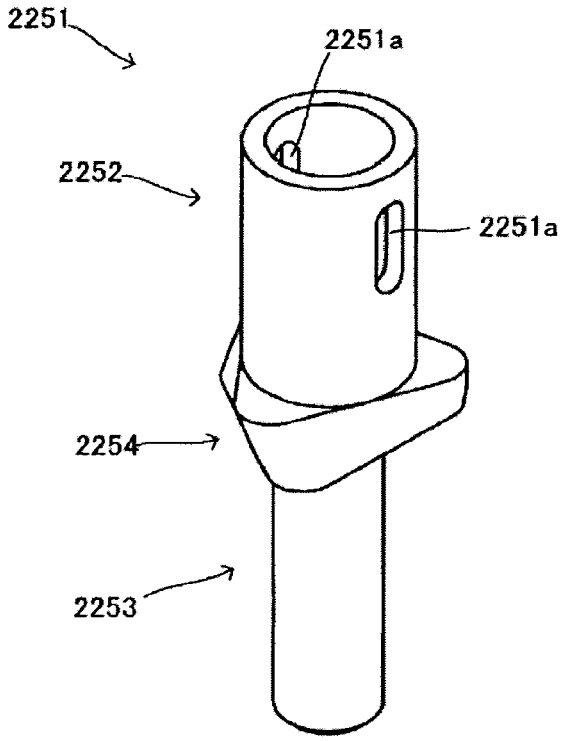

FIG. 158 is a perspective view of a rotating shaft 2251.

Figure 159:
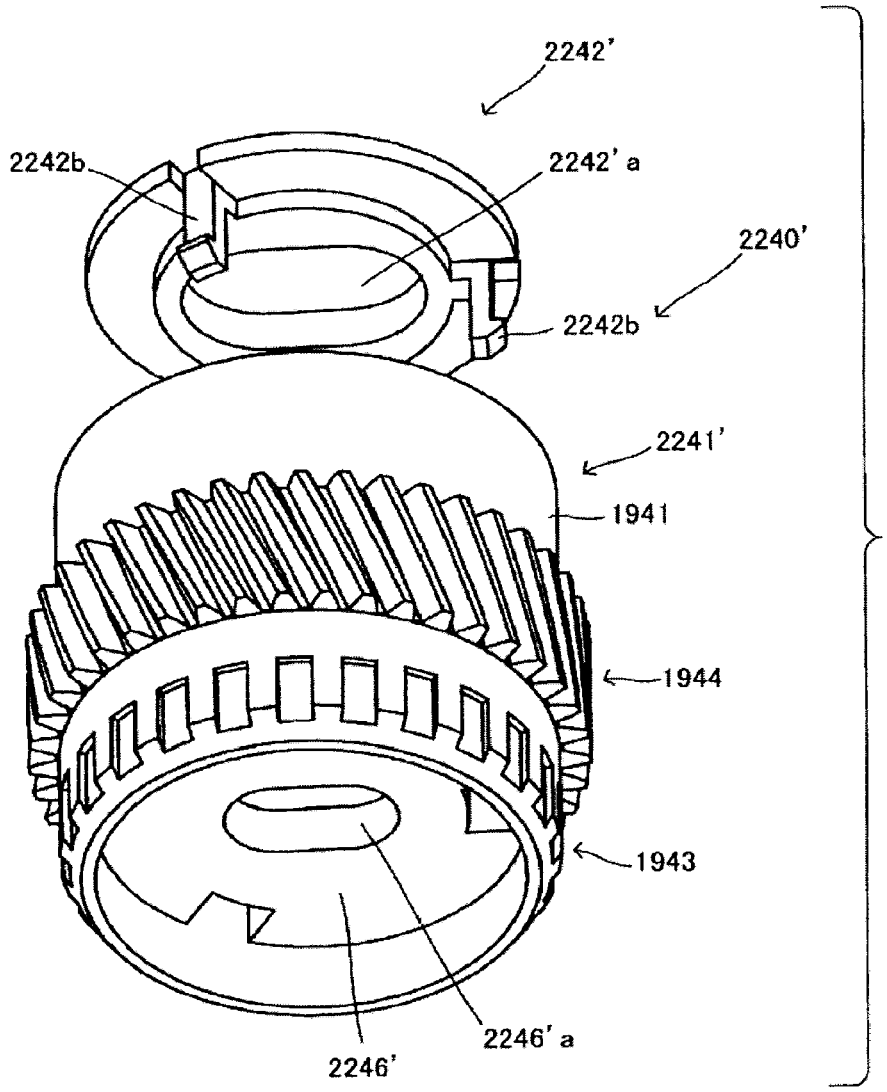

FIG. 159 is an exploded perspective view illustrating a bearing member 2240' which is a modification example.

Figure 160A:
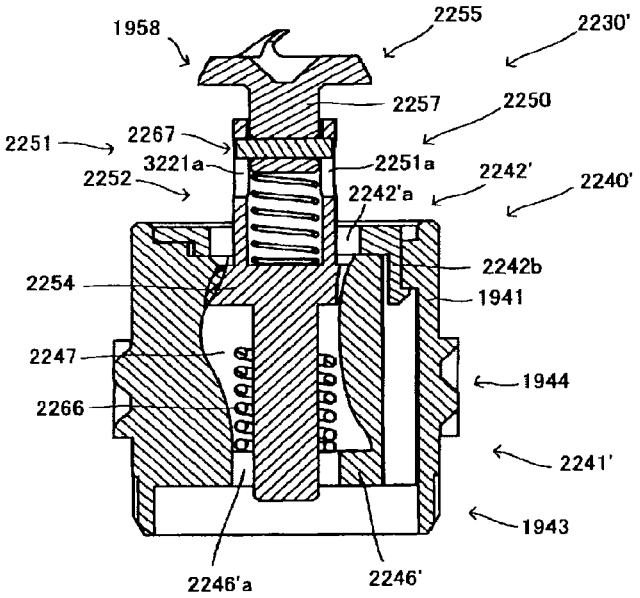

FIG. 160A is a sectional view in the axial direction of an end member 2230'.

Figure 160B:
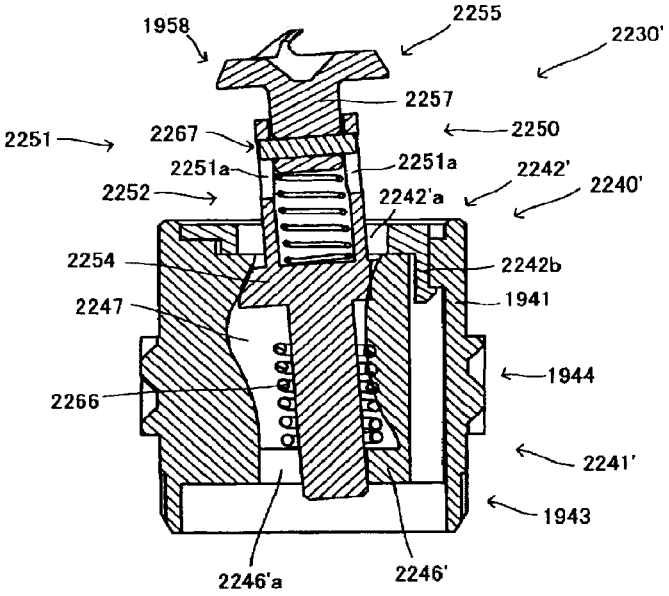

FIG. 160B is a sectional view in the shaft direction in another posture of the end member 2230'.

Figure 161:
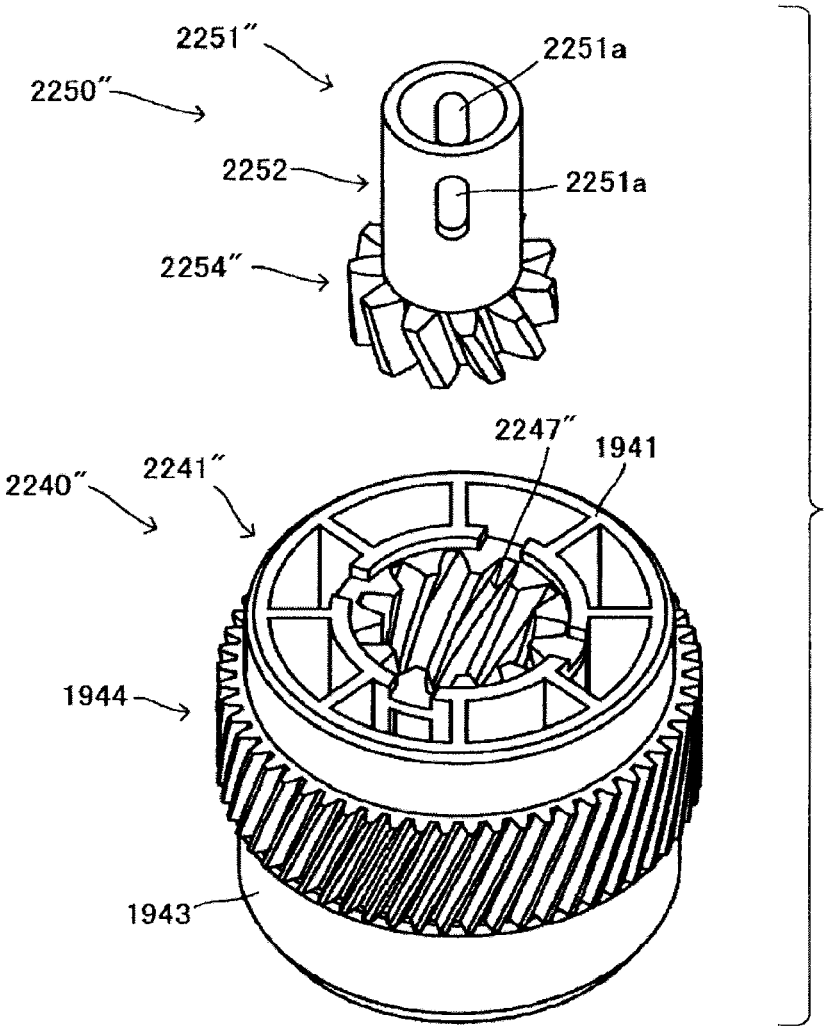

FIG. 161 is an exploded perspective view illustrating a modification example.

Figure 162:
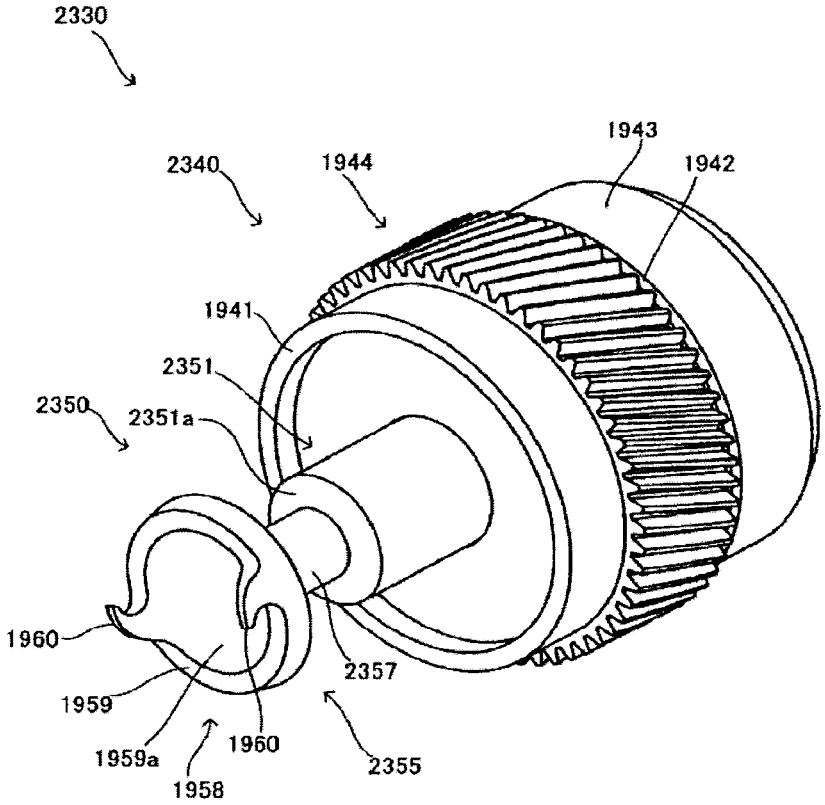

FIG. 162 is a perspective view of an end member 2330.

Figure 163:
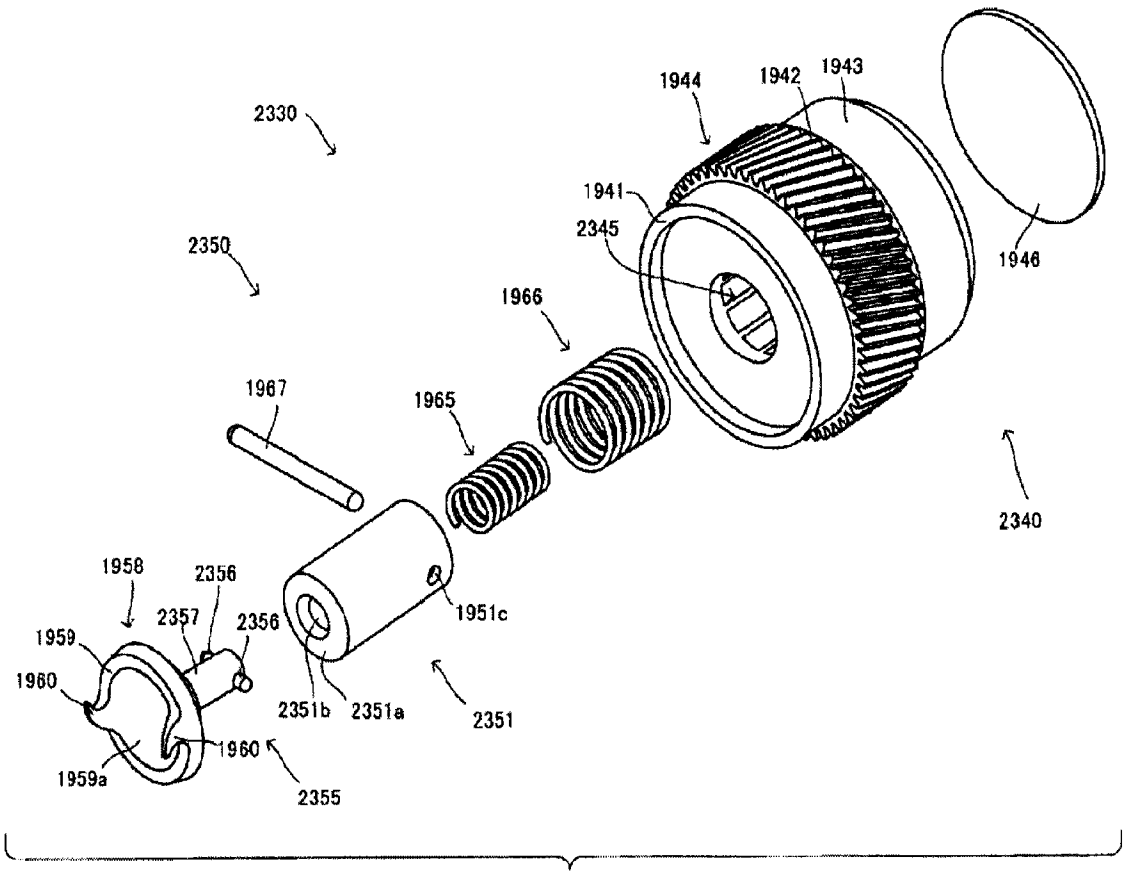

FIG. 163 is an exploded perspective view of the end member 2330.

Figure 164:
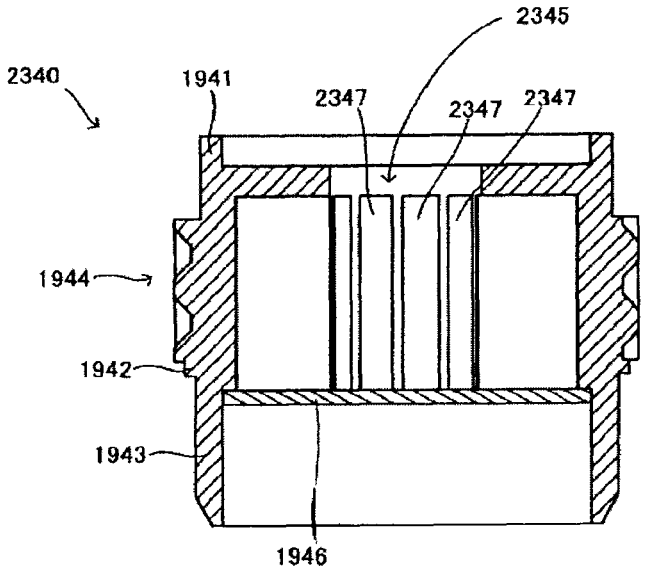

FIG. 164 is a sectional view in the axial direction of a bearing member 2340.

Figure 165A:
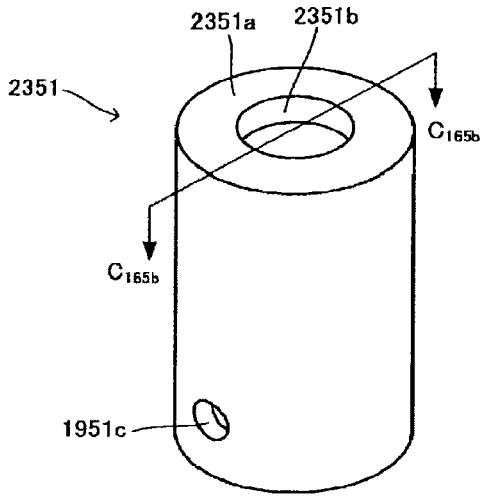

FIG. 165A is a perspective view of a rotating shaft 2351.

Figure 165B:
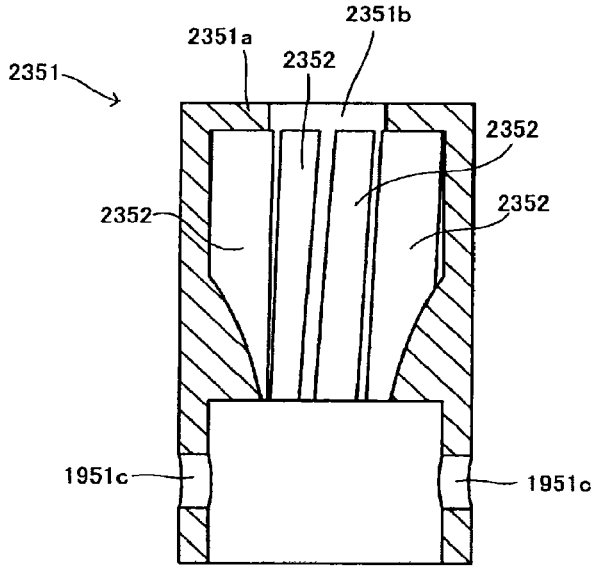

FIG. 165B is a sectional view in the axial direction of the rotating shaft 2351.

Figure 166:
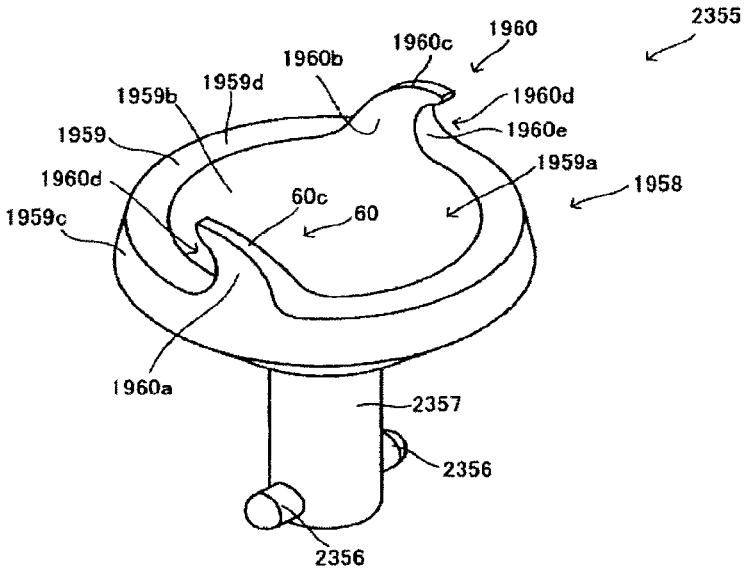

FIG. 166 is a perspective view of a tip end member 2355.

Figure 167:
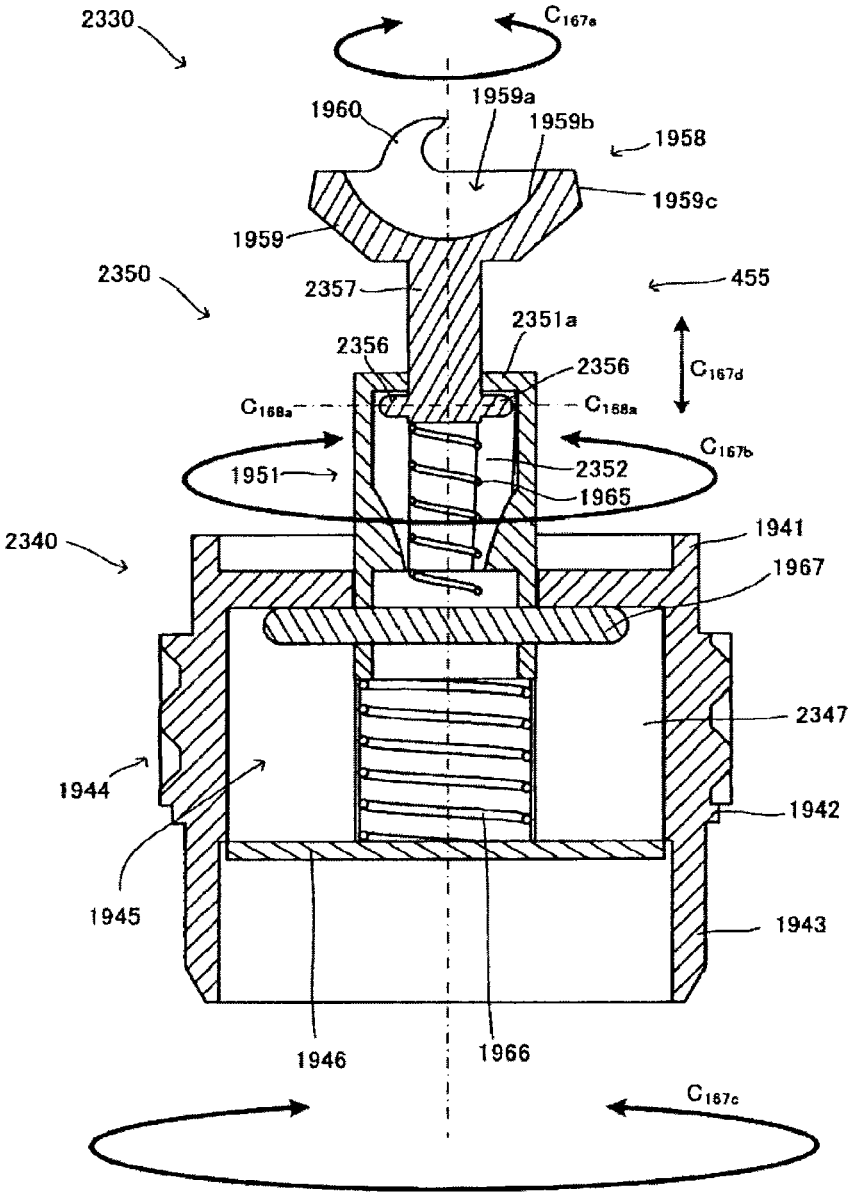

FIG. 167 is a sectional view in the axial direction of the end member 2330.

Figure 168A:
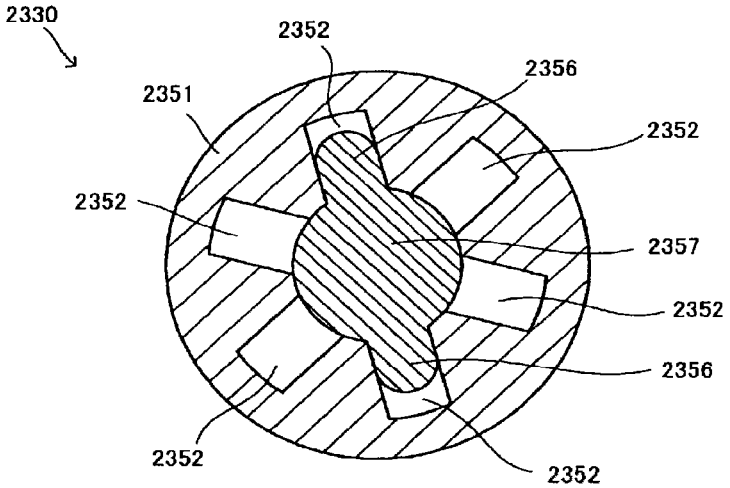

FIG. 168A is an end surface view which is orthogonal to the axial direction of the end member 2330.

Figure 168B:
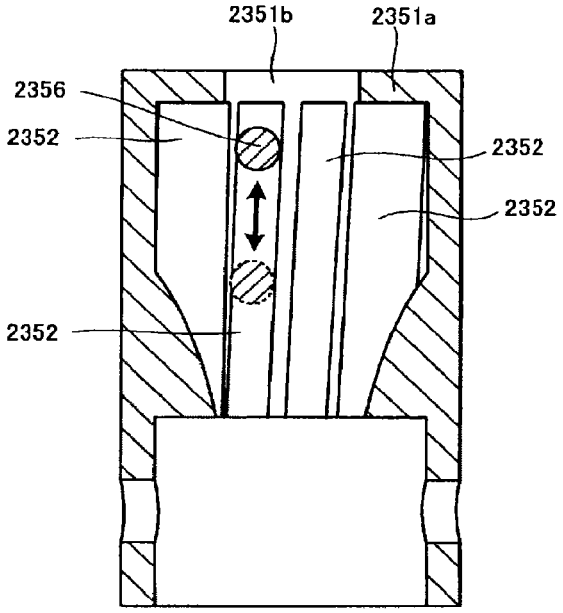

FIG. 168B is a view illustrating a relationship between the rotating shaft 2351 and a projection 2356.

Figure 169:
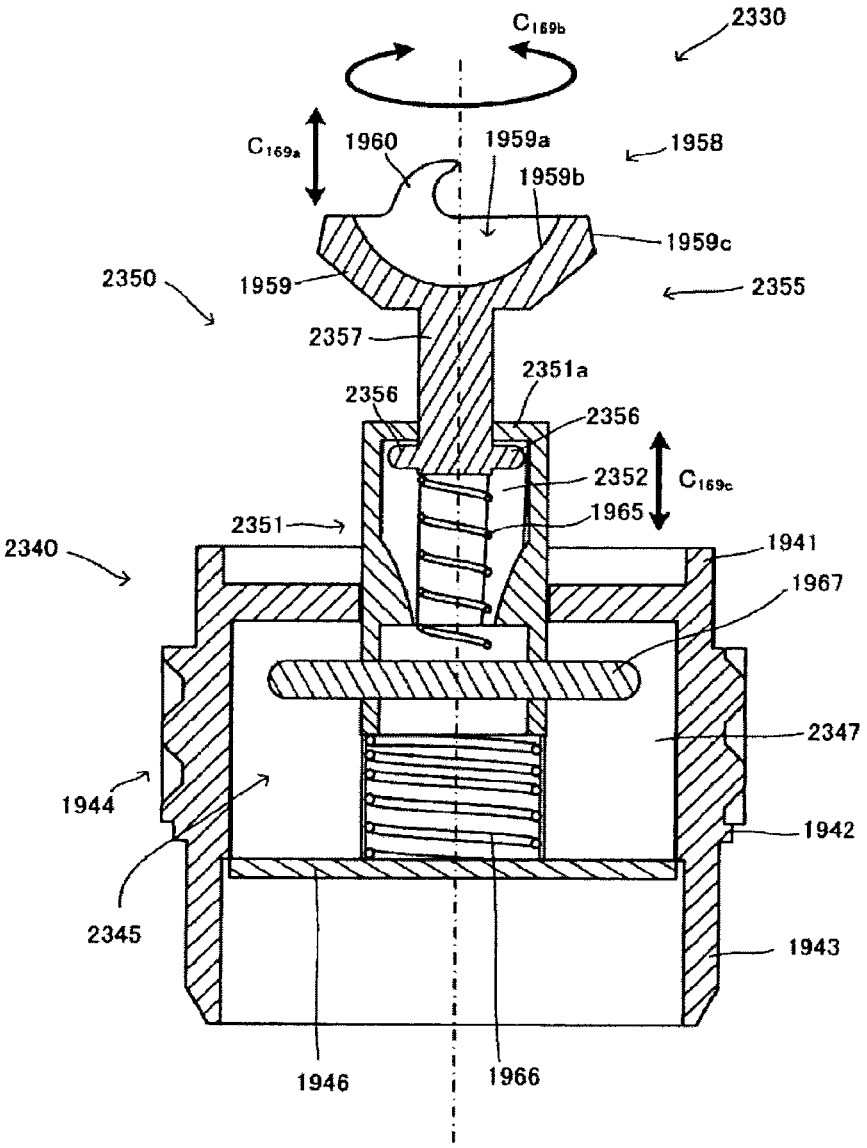

FIG. 169 is a sectional view in the axial direction of the end member 2330.

Figure 170:
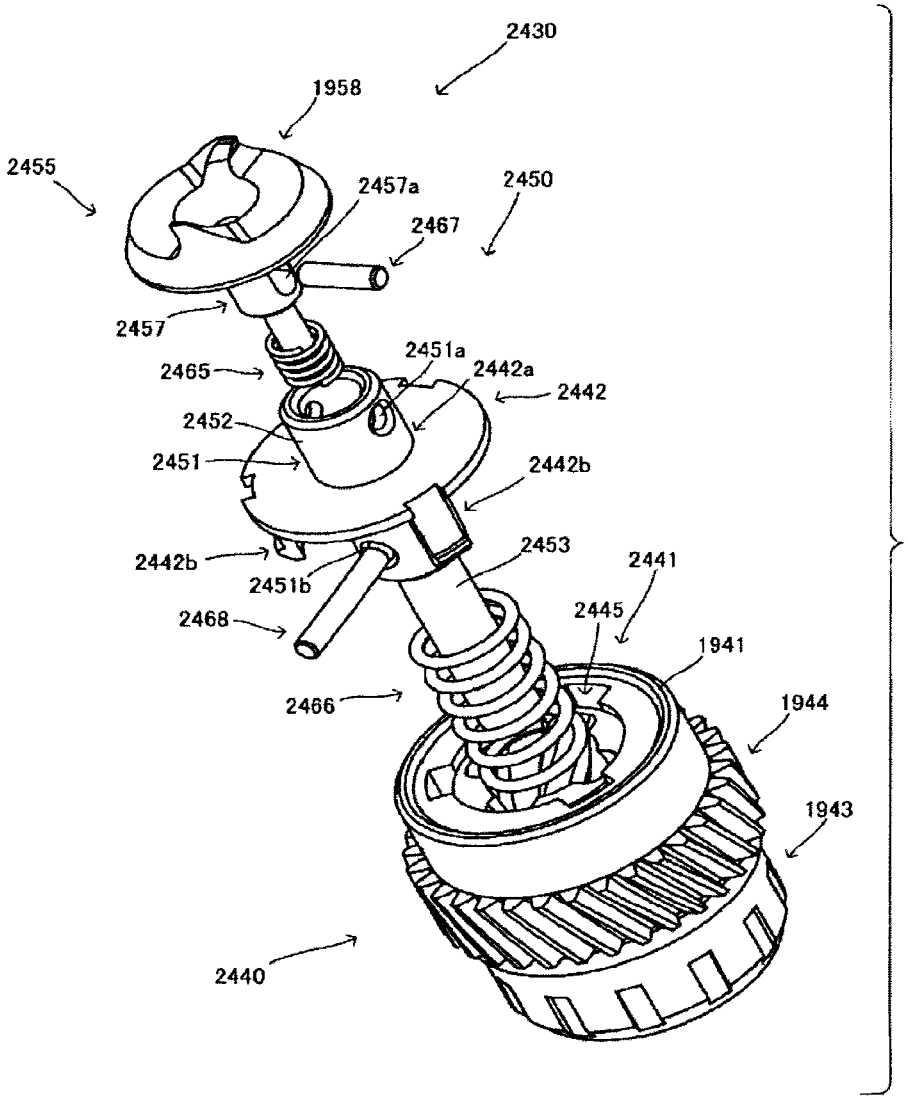

FIG. 170 is an exploded perspective view of an end member 2430.

Figure 171:
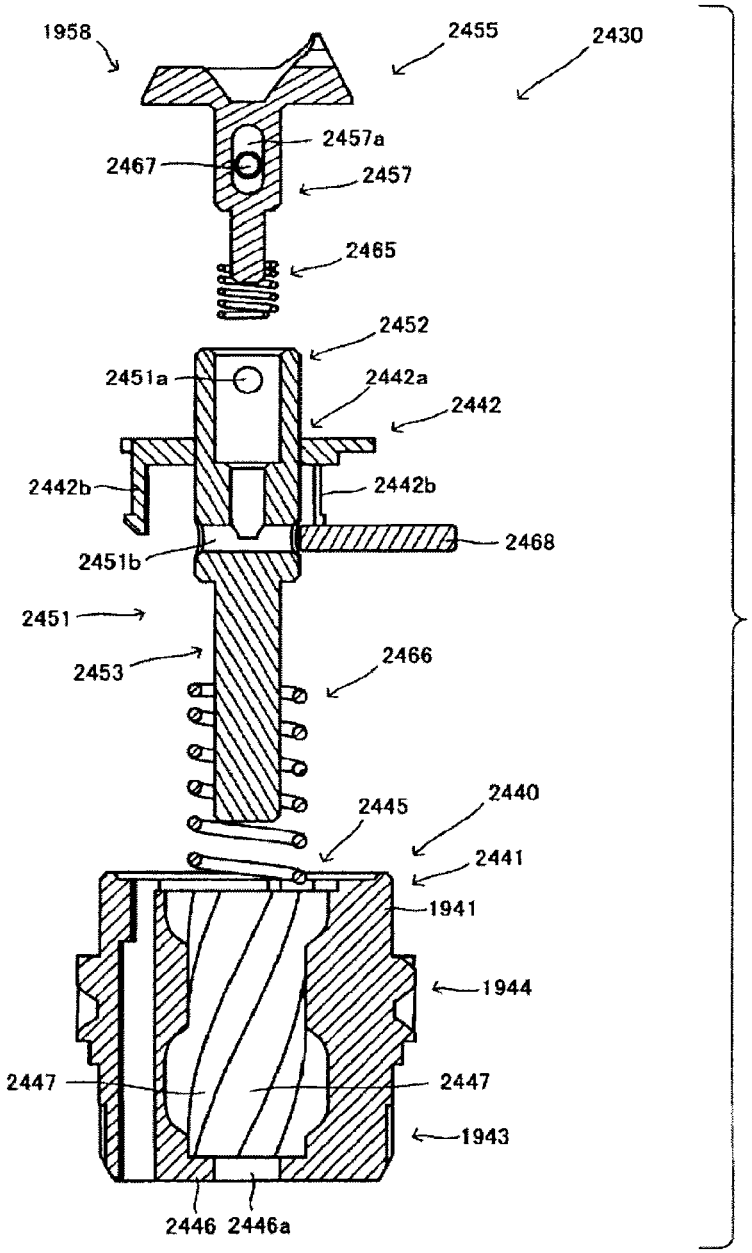

FIG. 171 is an exploded sectional view of the end member 2430.

Figure 172:
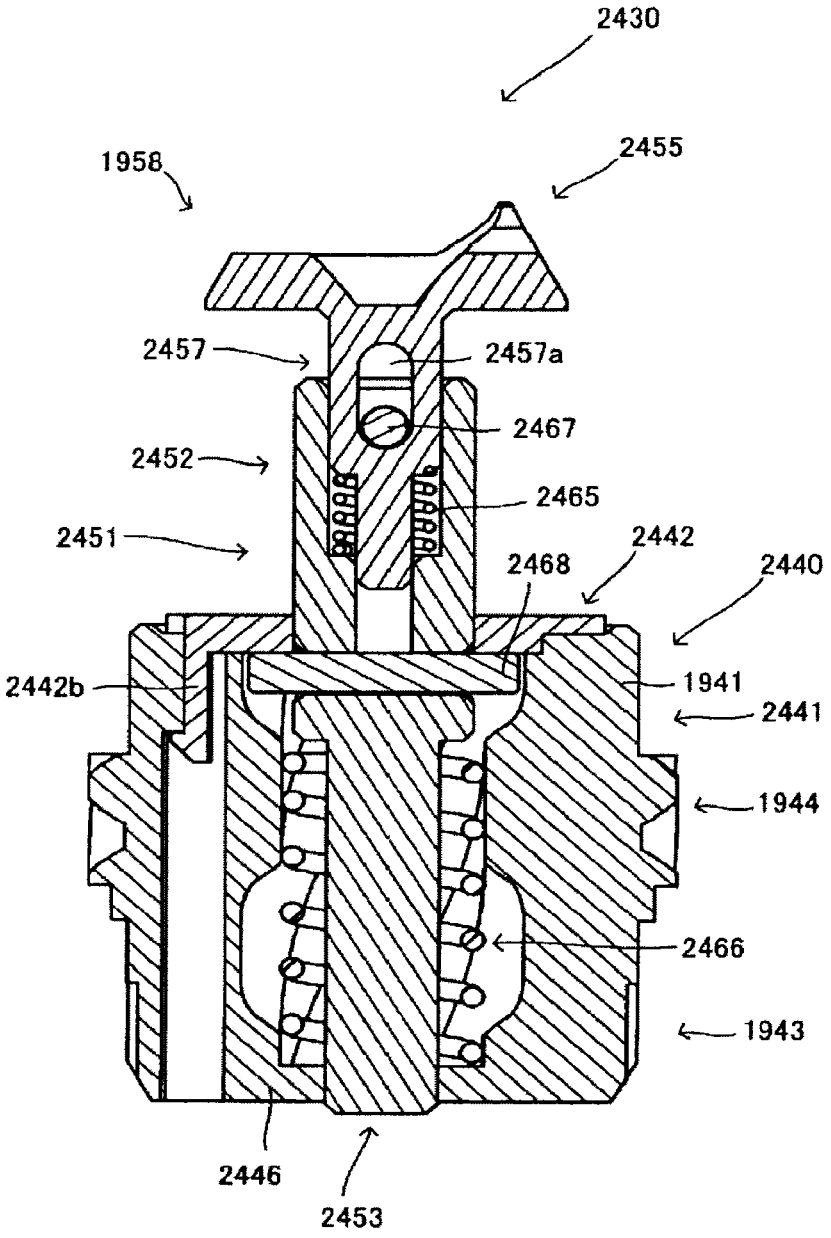

FIG. 172 is a sectional view of the end member 2430.

Figure 173:
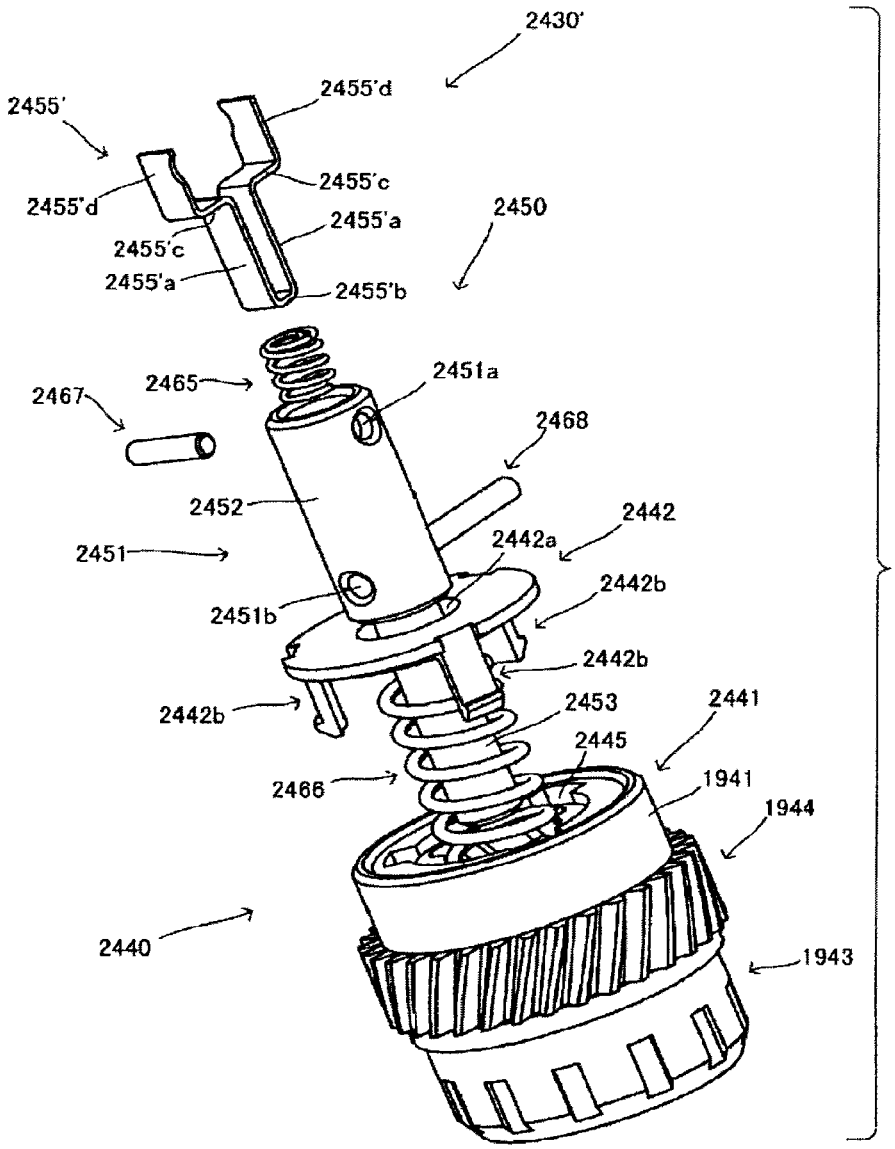

FIG. 173 is an exploded perspective view of an end member 2430'.

Figure 174:
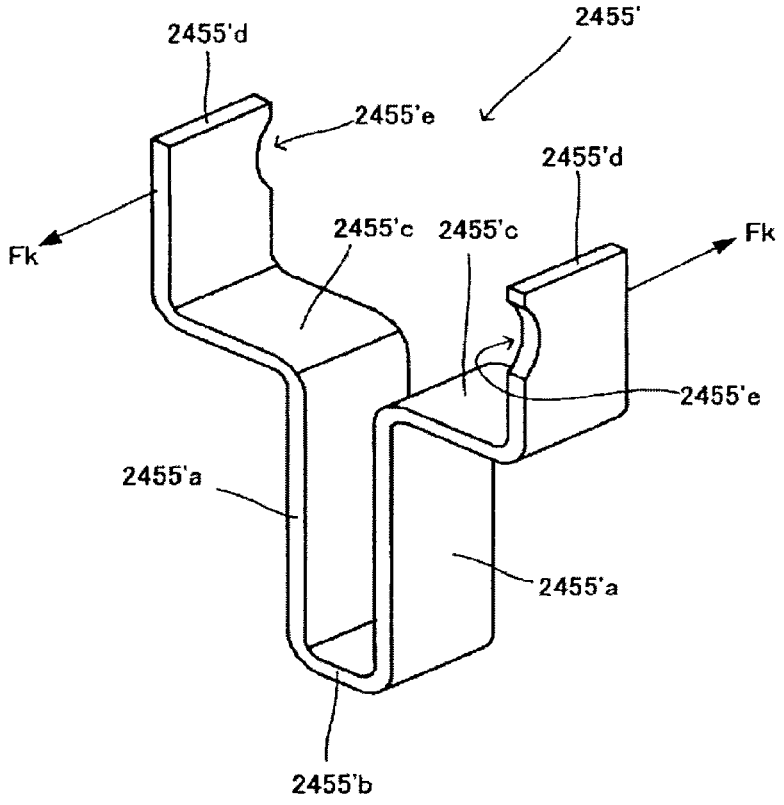

FIG. 174 is a perspective view of a tip end member 2455'.

Figure 175:
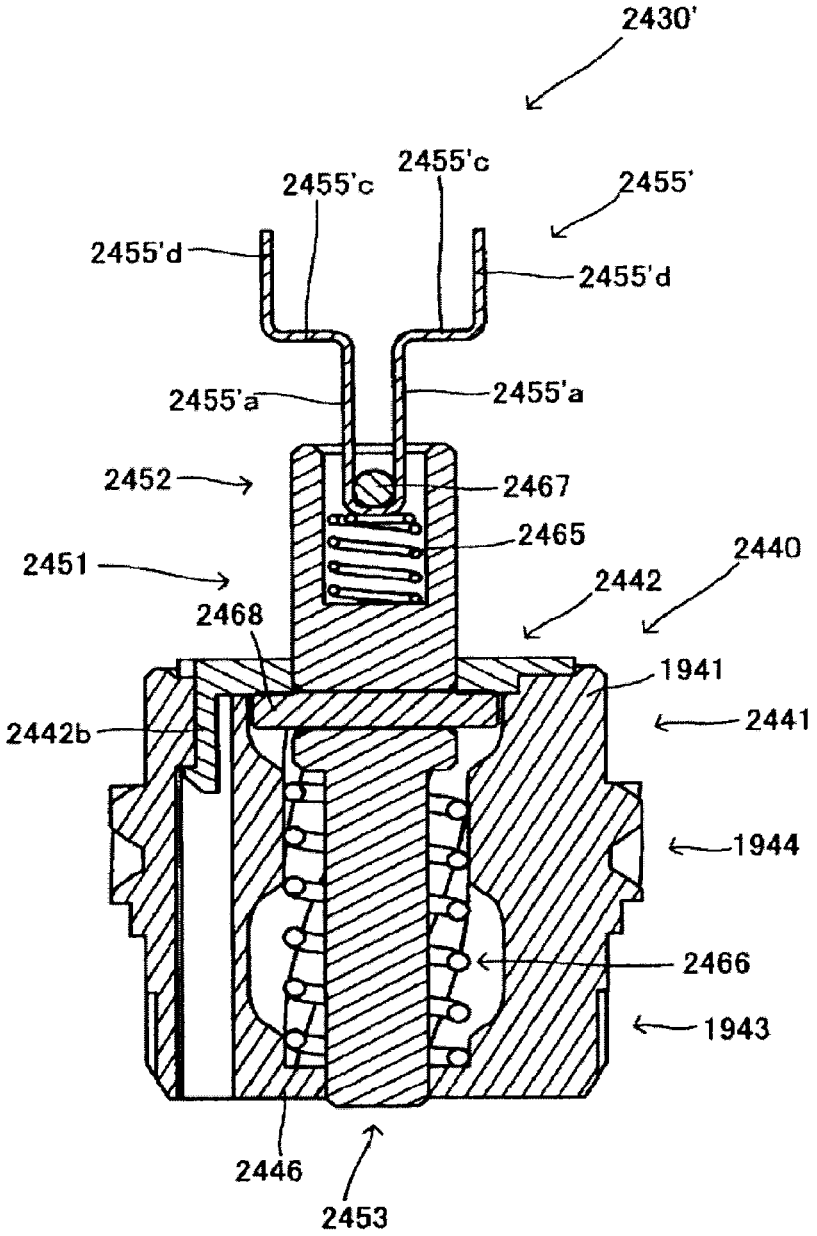

FIG. 175 is a sectional view along the axis of the end member 2430'.

Figure 176:
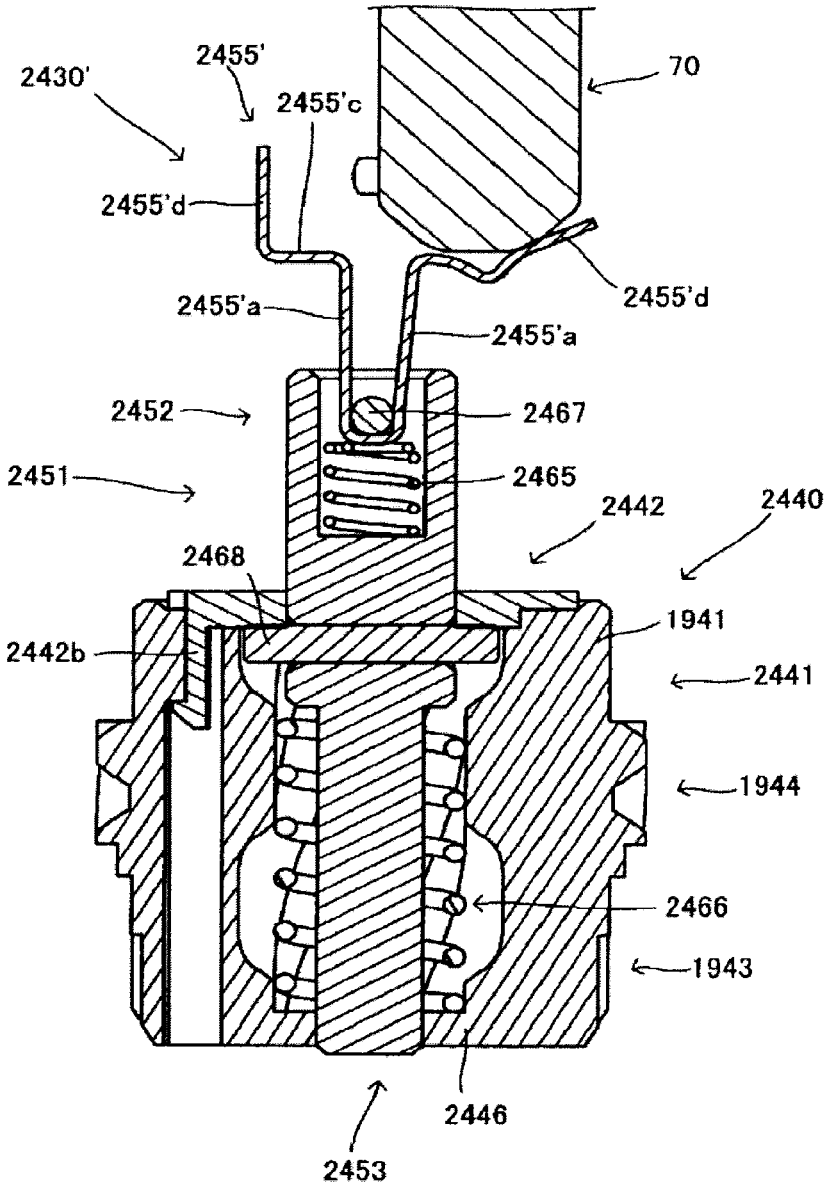

FIG. 176 is another sectional view along the axis of the end member 2430'.

Figure 177:
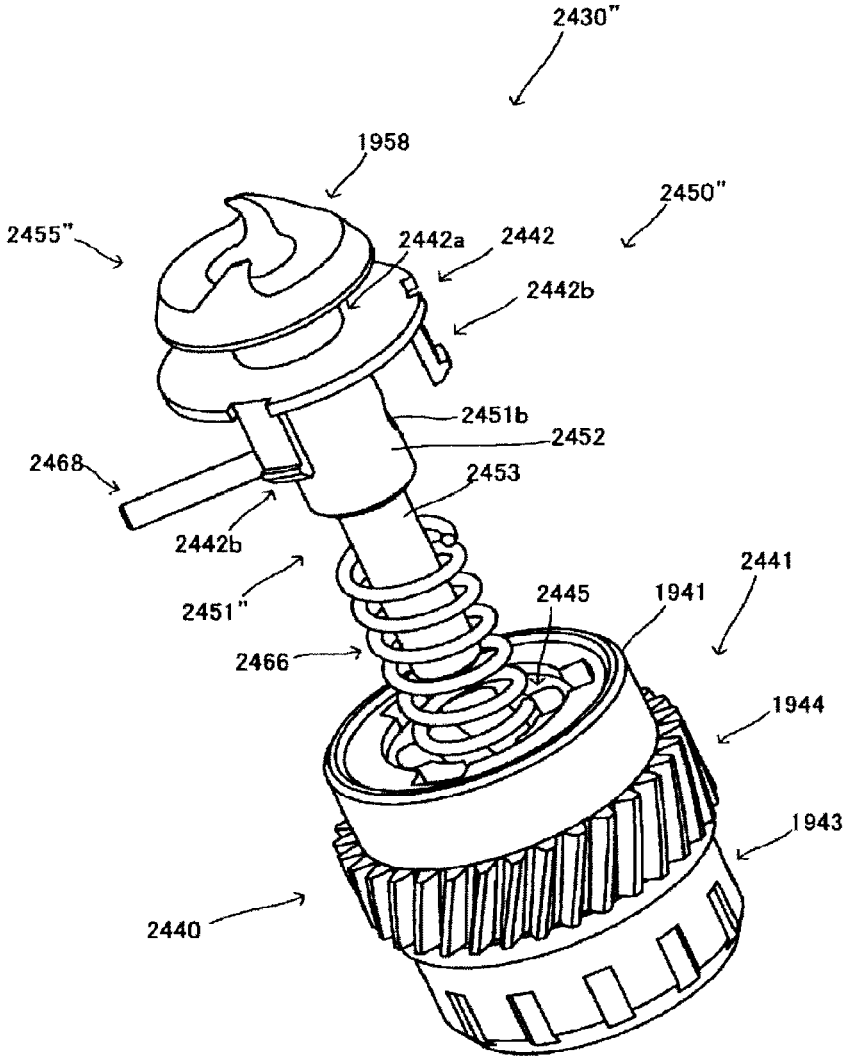

FIG. 177 is an exploded perspective view of an end member 2430".

Figure 178:
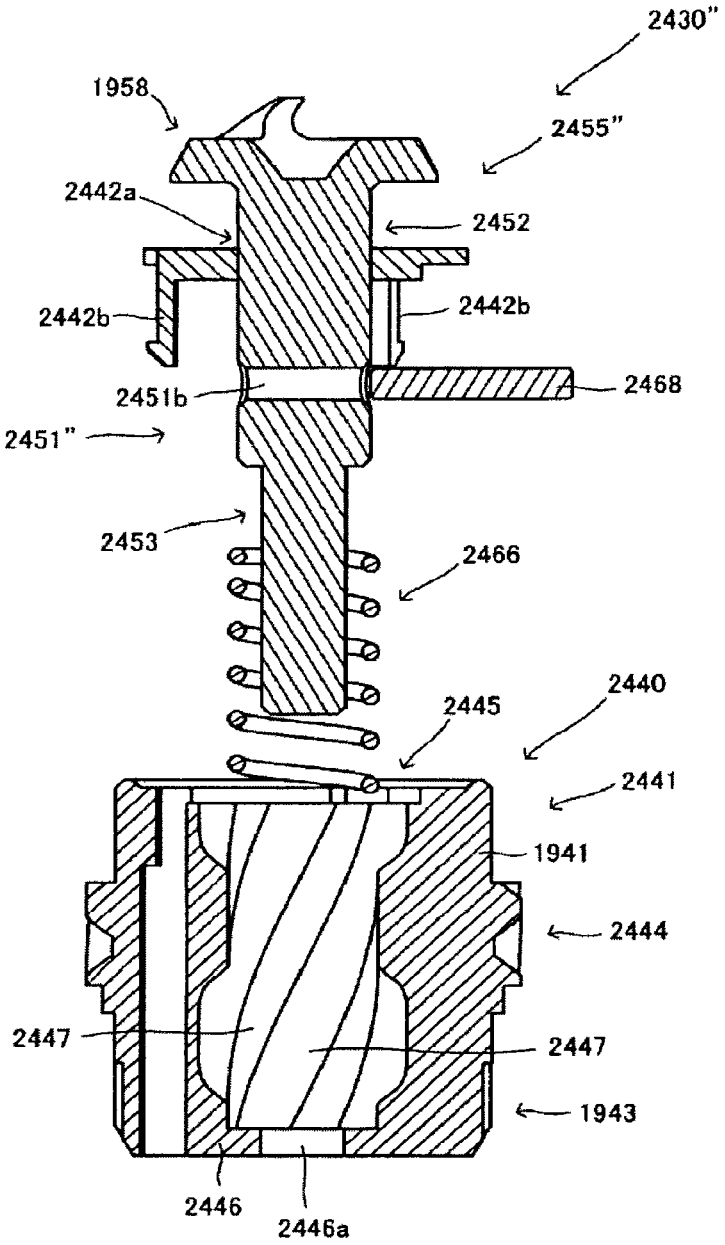

FIG. 178 is an exploded perspective view of the end member 2430".

Figure 179:
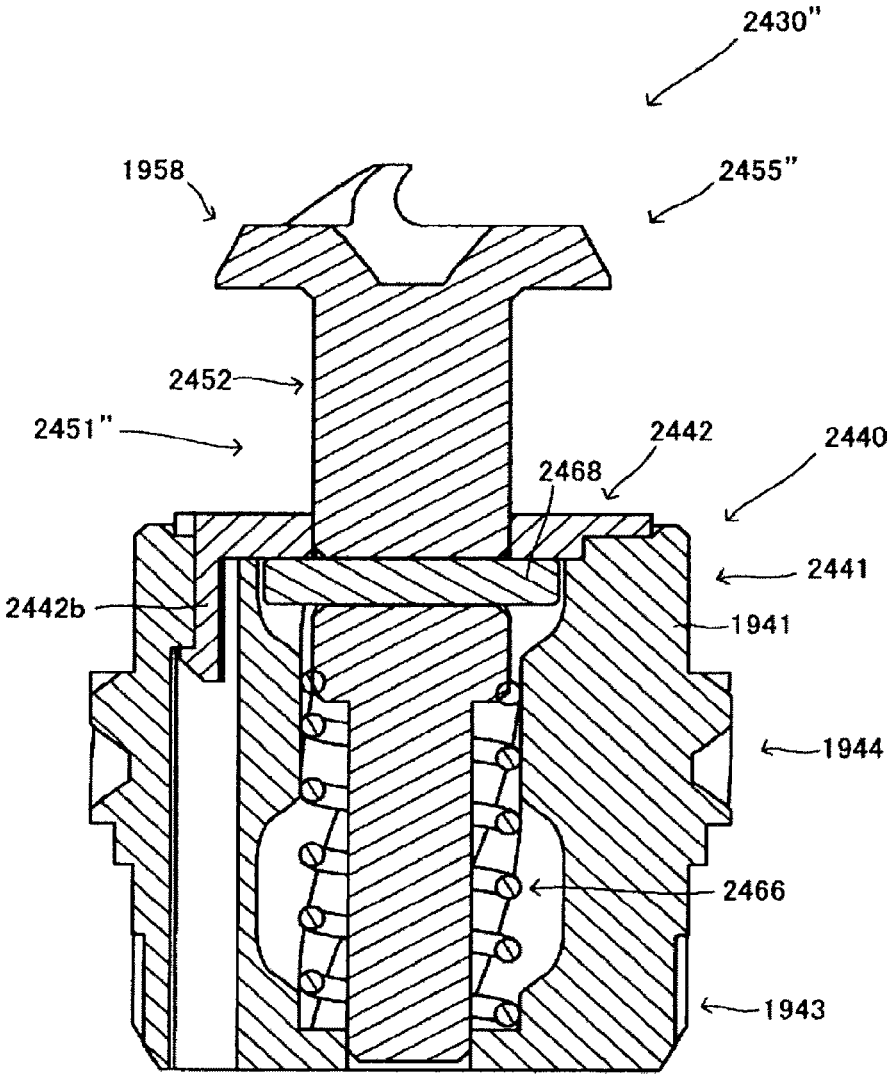

FIG. 179 is a sectional view of the end member 2430".

Figure 180A:
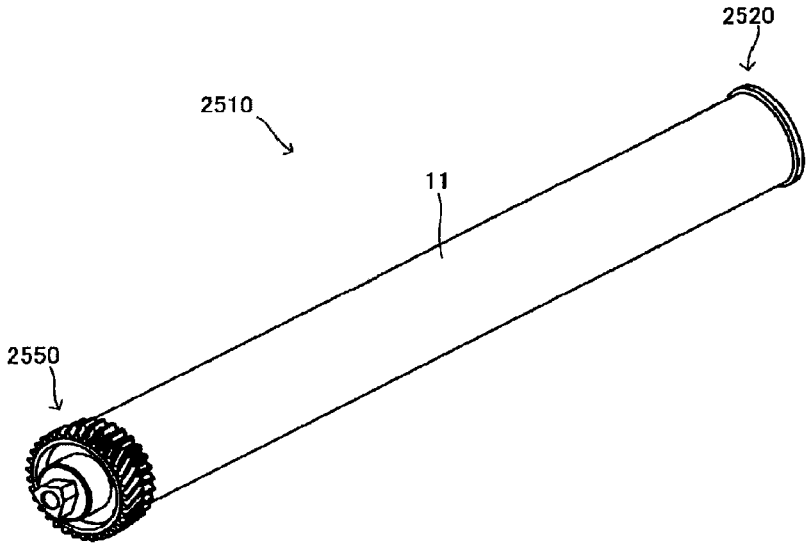

FIG. 180A is an outer appearance perspective view of a photoreceptor drum unit in which a driving side end member 2550 is illustrated in front.

Figure 180B:
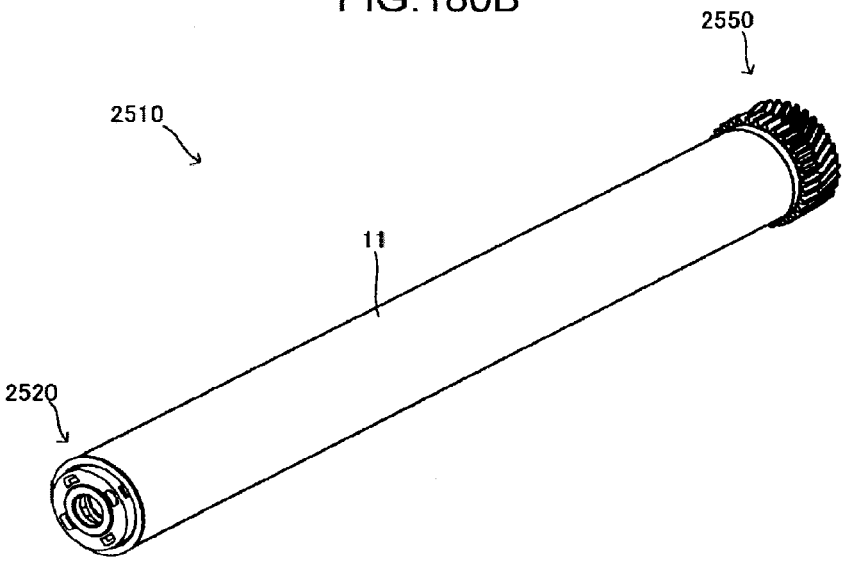

FIG. 180B is an outer appearance perspective view of a photoreceptor drum unit 2510 in which a non-driving side end member 2520 is in front.

Figure 181A:
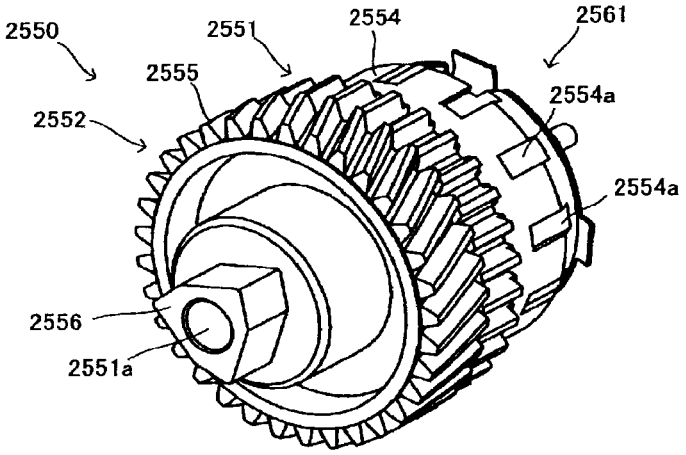

FIG. 181A is an outer appearance perspective view of the driving side end member 2550 in which a bearing portion 2556 is illustrated in front.

Figure 181B:
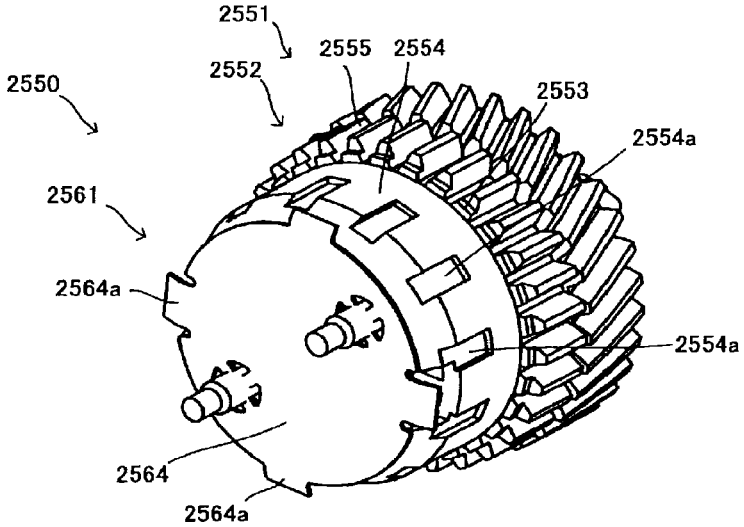

FIG. 181B is an outer appearance perspective view of the driving side end member 2550 in which a fitting portion is illustrated in front.

Figure 182A:
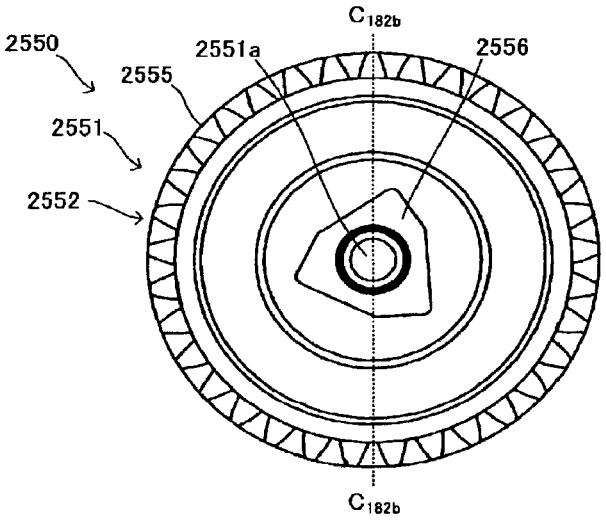

FIG. 182A is a front view of the driving side end member 2550 when viewed from the bearing portion 2556 side.

Figure 182B:
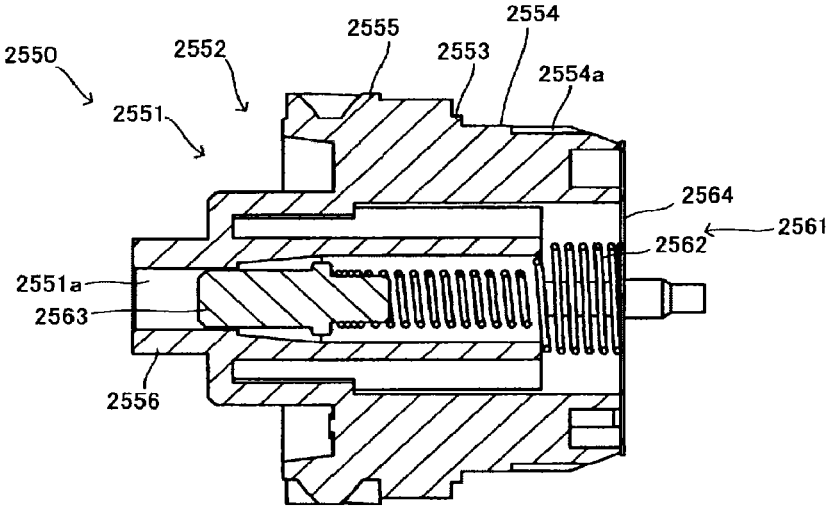

FIG. 182B is a sectional view along a line illustrated by $C_{182b}$-$C_{182b}$ in FIG. 182A.

Figure 183A:
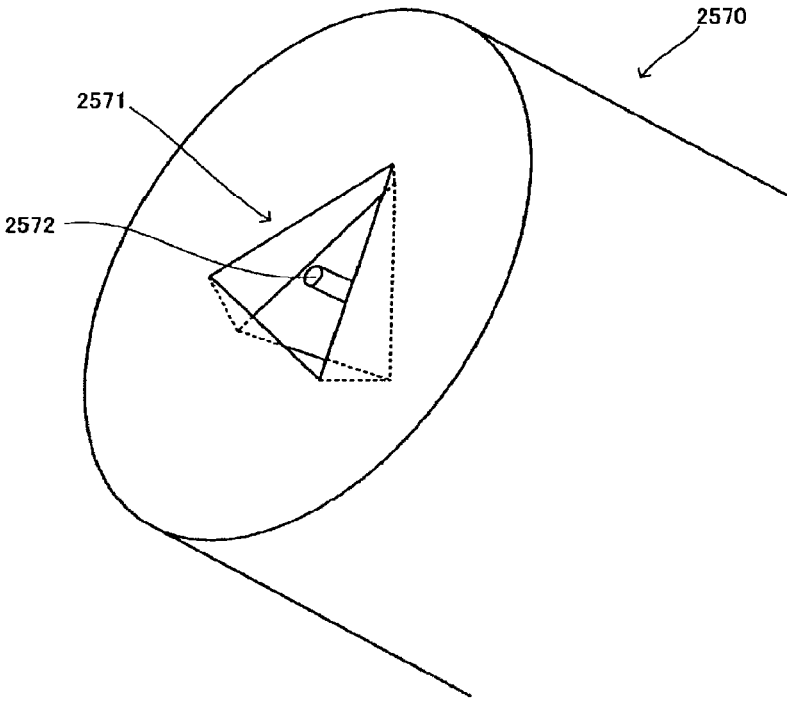

FIG. 183A is a perspective view of a driving shaft 2570.

Figure 183B:
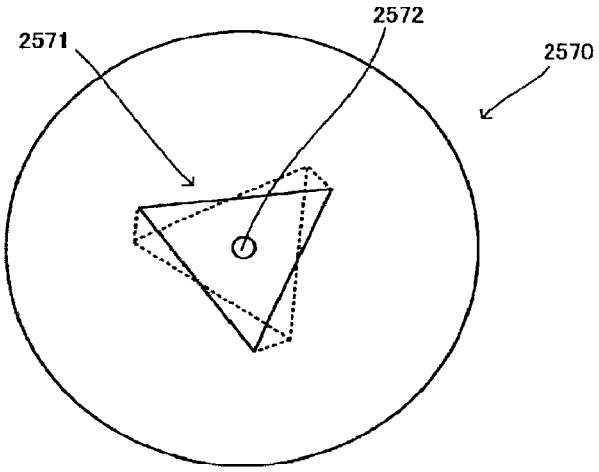

FIG. 183B is a front view of the driving shaft 2570.

Figure 184:
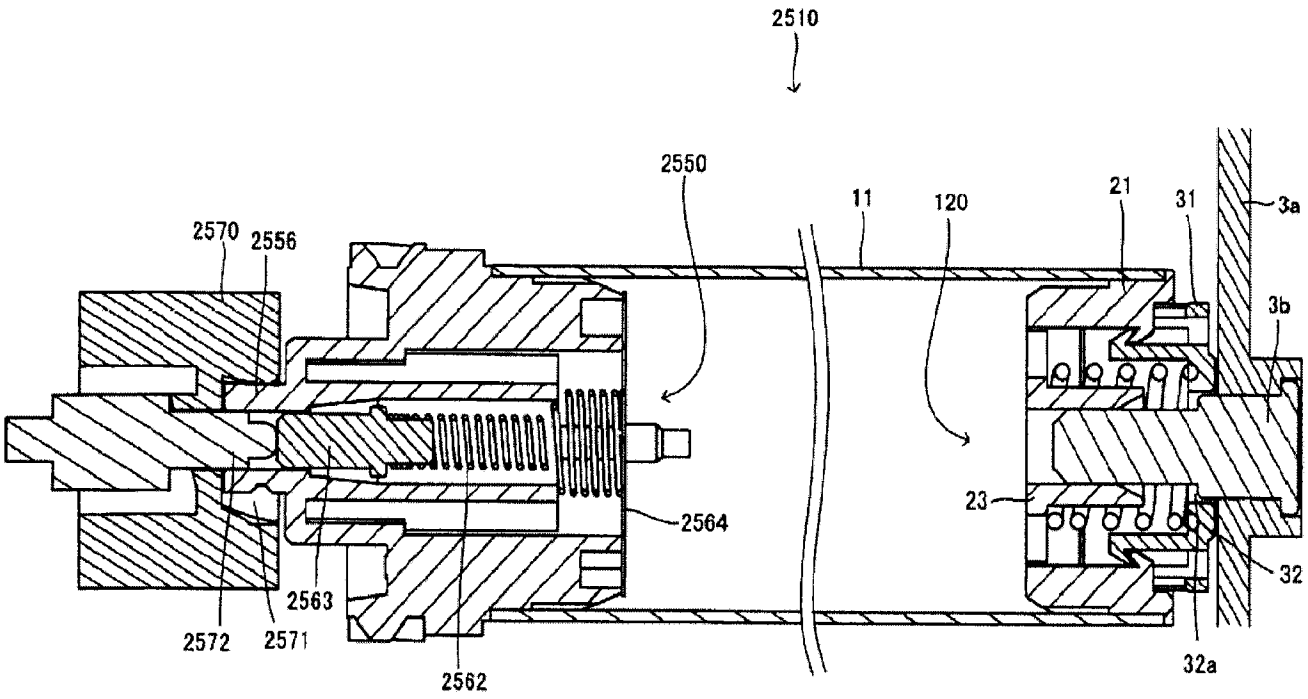

FIG. 184 is a view focusing on the photoreceptor drum unit 2510 and the periphery thereof on a section of the processing cartridge in a scene where the processing cartridge 3 including the photoreceptor drum unit 2510 is mounted on the apparatus main body 2.

Figure 185:
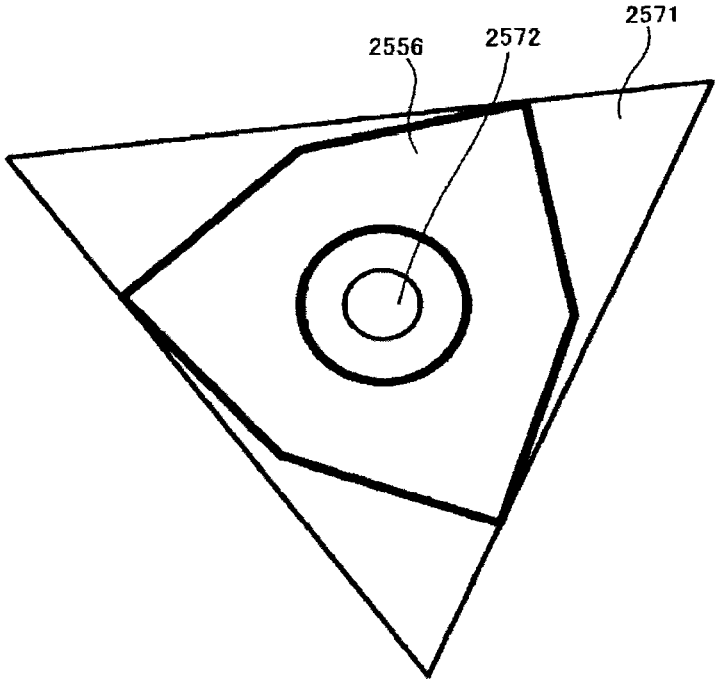

FIG. 185 is a view illustrating a scene where the bearing portion 2556 is inserted into a recessed portion 2571 of the driving shaft 2570.

DETAILED DESCRIPTION OF EXEMPLARY EMBODIMENTS

Figure 1:
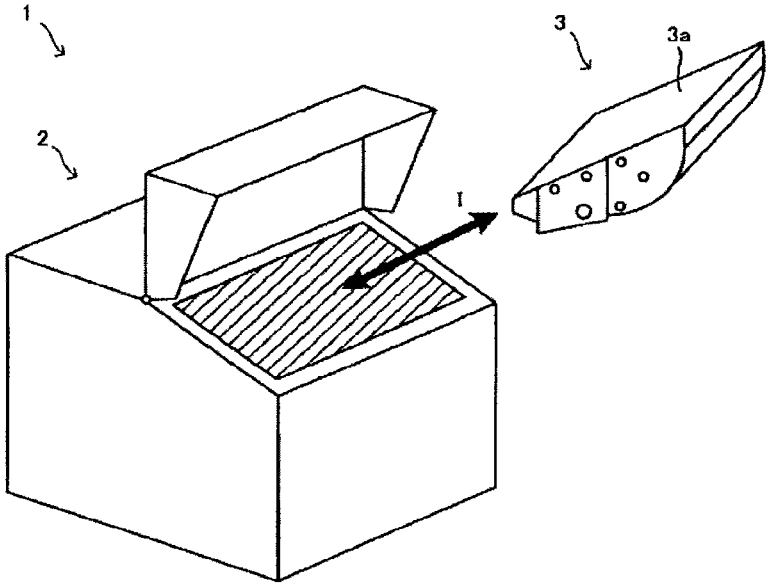
FIG. 1 is a schematic view of an image forming apparatus in a view illustrating a first aspect.

First, a first aspect will be described. FIG. 1 is a view illustrating the first aspect, and is a perspective view schematically illustrating an image forming apparatus 1 including a processing cartridge 3 and an image forming apparatus main body 2 (hereinafter, there is a case of being described as "apparatus main body 2") in which the processing cartridge 3 is mounted and used. The processing cartridge 3 can be mounted on and disengaged from the apparatus main body 2 by being moved in the direction illustrated by I in FIG. 1.

Figure 2:
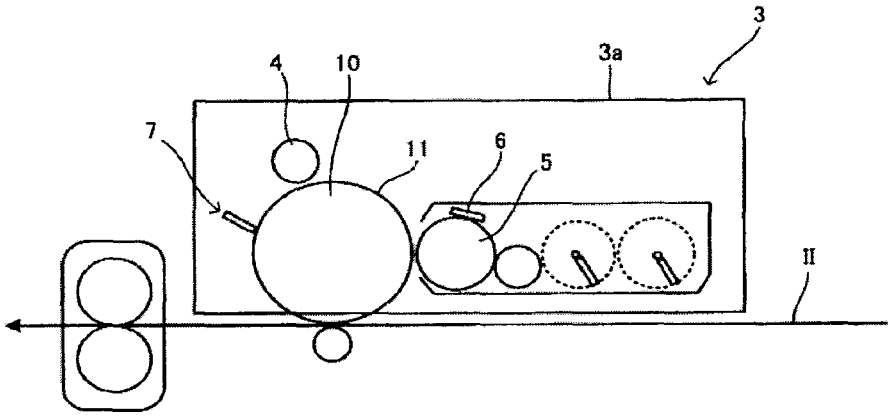
FIG. 2 is a view schematically illustrating a structure of a processing cartridge.

FIG. 2 schematically illustrates a structure of the processing cartridge 3. As can be ascertained from FIG. 2, the processing cartridge 3 includes a photoreceptor drum unit 10 (refer to FIG. 3), a charging roller 4, a developing roller 5, a regulating member 6, and a cleaning blade 7, inside a housing 3*a*. In a posture in which the processing cartridge 3 is mounted on the apparatus main body 2, as a recording medium, such as a paper sheet, moves along a line illustrated by II in FIG. 2, an image is transferred to the recording medium.

In addition, attachment and detachment of the processing cartridge 3 to and from the apparatus main body 2 are generally performed as follows. Since the photoreceptor drum unit 10 provided in the processing cartridge 3 receives a rotation driving force from the apparatus main body 2 and rotates, a driving shaft 70 (refer to FIG. 10) of the apparatus main body 2 and a shaft member 61 (refer to FIG. 10) of the photoreceptor drum unit 10 are engaged at least when an operation is performed. Meanwhile, when attaching and detaching the processing cartridge 3 to and from the apparatus main body 2, the engagement of the driving shaft 70 of the apparatus main body 2 and the shaft member 61 of the photoreceptor drum unit 10 is released.

In other words, it is necessary to appropriately engage the shaft member 61 of the photoreceptor drum unit 10 with the driving shaft 70 of the apparatus main body 2, and to transmit the rotation driving force.

Hereinafter, each configuration member will be described.

As described above, in the processing cartridge 3, the charging roller 4, the developing roller 5, the regulating member 6, the cleaning blade 7, and the photoreceptor drum unit 10 are provided. The members are included inside the housing 3*a*. Each member is as follows.

The charging roller 4 charges a photoreceptor drum 11 of the photoreceptor drum unit 10 by applying a voltage from the image forming apparatus main body 2. The charging is performed as the charging roller 4 rotates following the photoreceptor drum 11 and comes into contact with an outer circumferential surface of the photoreceptor drum 11.

The developing roller 5 is a roller which supplies a developer to the photoreceptor drum 11. In addition, an electrostatic latent image formed in the photoreceptor drum 11 is developed by the developing roller 5. In addition, a fixing magnet is embedded in the developing roller 5.

The regulating member 6 is a member which adjusts an amount of a developer which is adhered to the outer circumferential surface of the developing roller 5, and gives a frictional electrification charge to the developer itself.

The cleaning blade 7 is a blade which comes into contact with the outer circumferential surface of the photoreceptor drum 11, and removes the developer remaining after transferring by a tip end thereof.

Figure 3A:
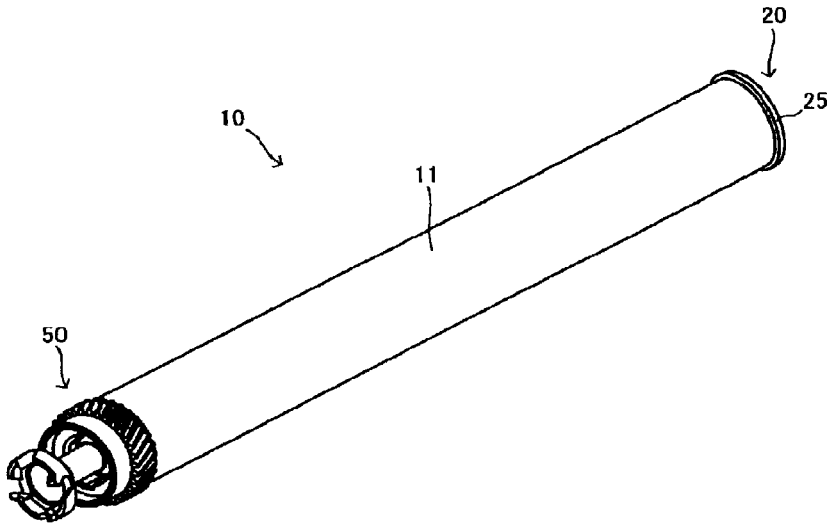
FIG. 3A is an outer appearance perspective view of a photoreceptor drum unit 10 in which a driving side end member 50 is illustrated in front.
Figure 3B:
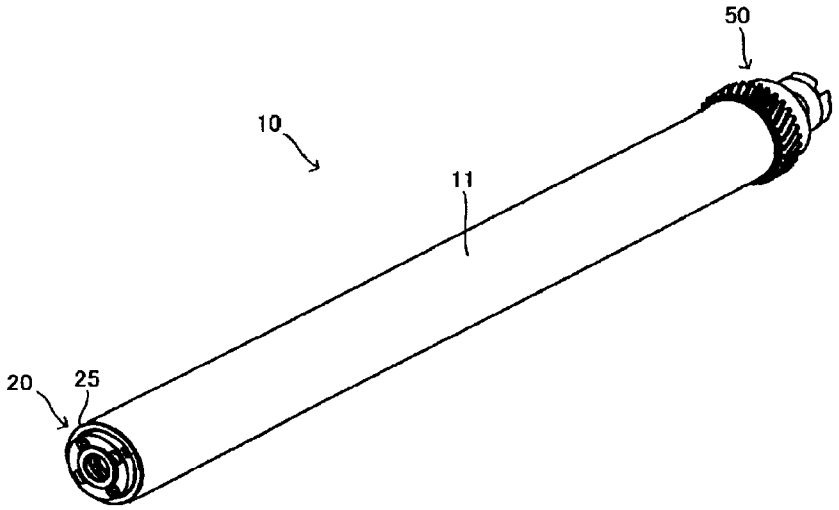
FIG. 3B is an outer appearance perspective view of the photoreceptor drum unit 10 in which a non-driving side end member 20 is illustrated in front.

FIG. 3 is an outer appearance perspective view of the photoreceptor drum unit 10. FIG. 3A is an outer appearance perspective view of the photoreceptor drum unit 10 in which a driving side end member 50 is illustrated in front. FIG. 3B is an outer appearance perspective view of the photoreceptor drum unit 10 in which a non-driving side end member 20 is illustrated in front. As can be ascertained from FIGS. 3A and 3B, the photoreceptor drum unit 10 is provided with the photoreceptor drum 11, the non-driving side end member 20 which is one end member in an end member pair, and the driving side end member 50 which is the other end member in the end member pair.

The photoreceptor drum 11 is a member which covers a photoreceptor layer on the outer circumferential surface of a drum cylinder (there is a case of being called "base body") which is a cylindrical rotating body. In other words, the drum cylinder is a conductive cylinder made of aluminum or the like, and here, the cylinder is covered with the photoreceptor layer. In the photoreceptor layer, characters or figures to be transferred to the recording medium, such as a paper sheet, are formed.

The base body is a member in which a conductive material made of aluminum or aluminum alloy is formed in a cylindrical shape. A type of the aluminum alloy used in the base body is not particularly limited, but 6000 series, 5000 series, and 3000 series aluminum alloys which are defined by JIS standard (JIS H 4140) which are used as the base body of the photoreceptor drum in many cases, are preferable.

In addition, the photoreceptor layer formed on the outer circumferential surface of the base body is not particularly limited, and a known material can be employed according to the purpose.

It is possible to manufacture the base body by forming the cylindrical shape by a cutting process, an extrusion processing, or a drawing processing. In addition, it is possible to manufacture the photoreceptor drum 11 by laminating by coating the outer circumferential surface of the base body with the photoreceptor layer.

In order to rotate the photoreceptor drum 11 around the axis as will be described later, the end member pair is attached to one end of the photoreceptor drum 11. One end member is the non-driving side end member 20, and the other end member is the driving side end member 50. Here, the base body has a hollow cylindrical shape, but may be a shape of a solid rod.

Figure 4A:
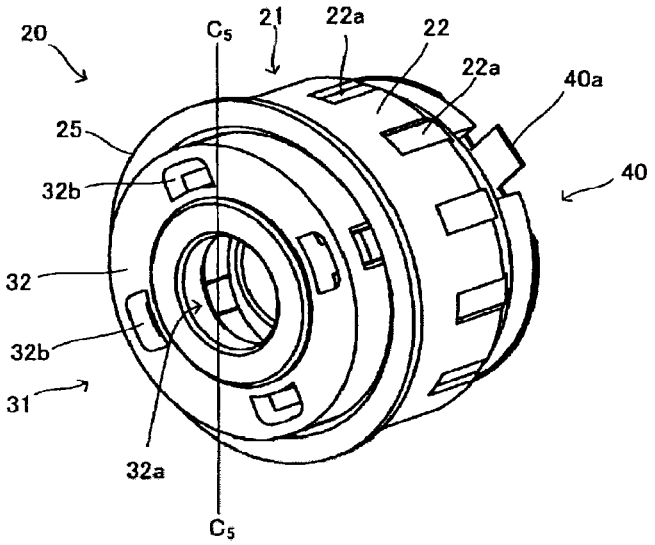
FIG. 4A is an outer appearance perspective view of the non-driving side end member 20 in which a cap member 31 side is illustrated in front.
Figure 4B:
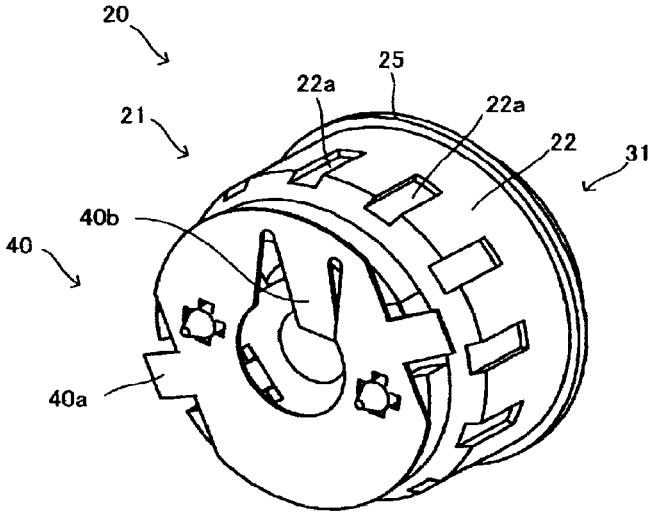
FIG. 4B is an outer appearance perspective view of the non-driving side end member 20 in which a flange member 21 is illustrated in front.
Figure 5:
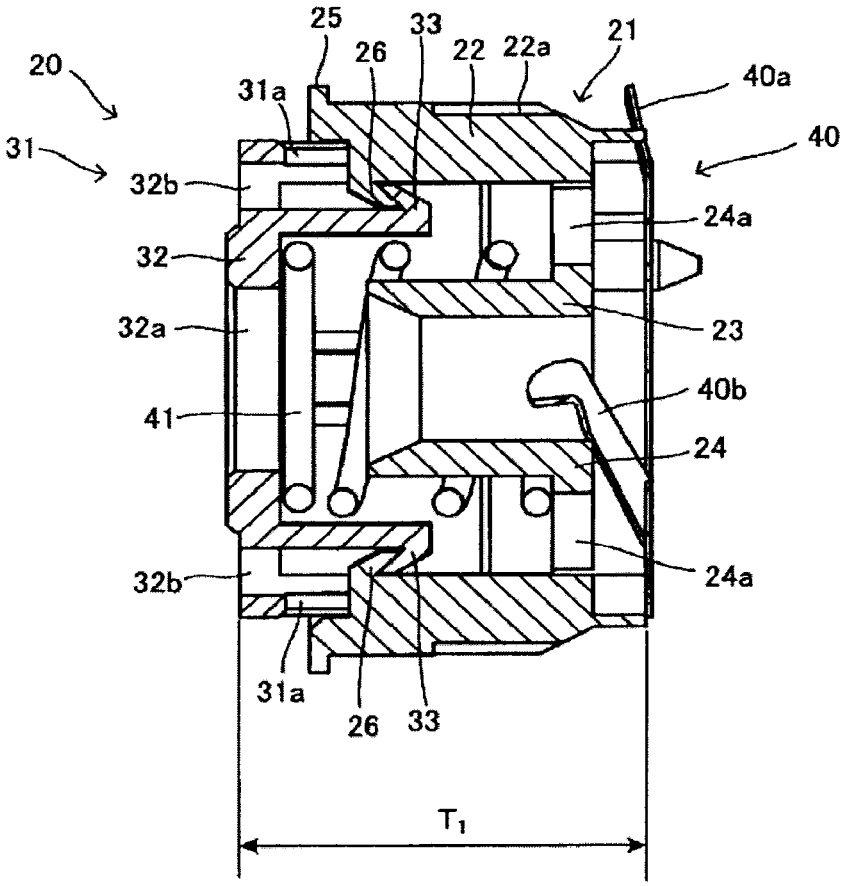
FIG. 5 is a sectional view along a line illustrated by $C_5$-$C_5$ in FIG. 4A.

The non-driving side end member 20 is an end member which is disposed in an end portion on a side on which the driving shaft 70 (refer to FIG. 10) of the apparatus main body 2 is not engaged, among the end portions in the axial direction of the photoreceptor drum 11. FIG. 4 is an outer appearance perspective view of the non-driving side end member 20. FIG. 4A is an outer appearance perspective view in which a cap member 31 side is illustrated in front. FIG. 4B is an outer appearance perspective view in which an earth plate 40 which is opposite to the cap member 31 is illustrated in front. In addition, FIG. 5 is a sectional view in the axial direction along a line illustrated by $C_5$-$C_5$V in FIG. 4A.

As can be ascertained from the drawings, the non-driving side end member 20 is configured to include a flange member 21, the cap member 31, an elastic member 41, and the earth plate 40.

In the aspect, the earth plate 40 is provided in the non-driving side end member 20.

Figure 6A:
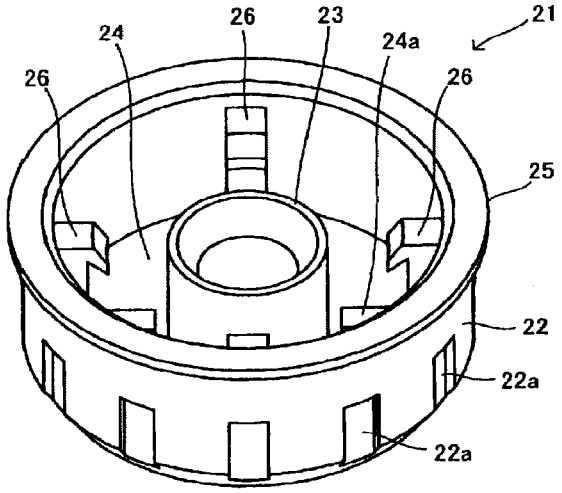
FIG. 6A is an outer appearance perspective view of the flange member 21.

FIG. 6A is an outer appearance perspective view of the flange member 21. As can be ascertained from FIGS. 4 to 6A, the flange member 21 is provided with a cylindrical outer tube portion 22, and a cylindrical inner tube portion 23 which is coaxial to the outer tube portion 22 is disposed inside the outer tube portion 22. Therefore, the flange member 21 has a double tube structure. However, a bottom portion 24 is provided between one end of the outer tube portion 22 and one end of the inner tube portion 23, and at least a part thereof is blocked. The inner tube portion 23 is held inside the outer tube portion 22 by the bottom portion 24.

Among the end portions of the outer tube portion 22, a ring-shaped contact wall 25 provided to stand from the outer circumferential surface of the outer tube portion 22 is provided in the end portion opposite to the bottom portion 24. As can be ascertained from FIGS. 3A and 3B, in a posture in which the non-driving side end member 20 is mounted on the photoreceptor drum 11, an end surface of the photoreceptor drum 11 comes into contact with the contact wall 25 to abut against the contact wall 25. Accordingly, the depth of insertion of the non-driving side end member 20 into the photoreceptor drum 11 is regulated.

Among the end portions of the outer tube portion 22, the end portion on the bottom portion 24 side, that is, the side opposite to the side on which the contact wall 25 is provided, is inserted into the photoreceptor drum 11, and functions as a fitting portion which is fixed to an inner surface of the photoreceptor drum 11 by an adhesive. Accordingly, the non-driving side end member 20 is fixed to the end portion of the photoreceptor drum 11. Therefore, the outer diameter of the outer tube portion 22 is substantially the same as the inner diameter of the photoreceptor drum 11 within a range in which insertion into the cylindrical inner side of the photoreceptor drum 11 is possible.

At a part which functions as the fitting portion, a groove 22*a* may be formed on the outer circumferential surface. Accordingly, the groove 22*a* is filled with the adhesive, and adhesiveness between the non-driving side end member 20 and the photoreceptor drum 11 is improved by an anchor effect or the like.

In addition, cap member engaging means 26 are provided at a predetermined interval to protrude from the inner surface, on the inner surface of the outer tube portion 22. The cap member engaging means 26 is means for holding the cap member 31 which will be described later by the flange member 21. However, the cap member engaging means 26 is configured not to regulate the movement of the cap member 31 in the axial direction with respect to the flange member 21 while regulating the cap member 31 not to fall out of the flange member 21.

If the regulation in this manner is possible, an aspect of the cap member engaging means 26 is not particularly limited. As one example thereof, a hook-like projection provided with a hook toward the bottom portion 24 side as described in the aspect illustrated in FIGS. 5 and 6A, can be employed. in addition, in the aspect, a hole 24*a* is provided in the bottom portion 24, and a position thereof corresponds to the cap member engaging means 26. Accordingly, it is possible to integrally manufacture the flange member 21 including the cap member engaging means 26 by injection molding.

In addition, a support shaft member 3*b* provided on the inner surface of the housing 3*a* of the processing cartridge 3 which will be described later, is inserted into the cylindrical inner side of the inner tube portion 23 (refer to FIG. 11). Therefore, a hole of the inner tube portion 23 is formed to have the size by which the hole can function as a bearing.

Figure 6B:
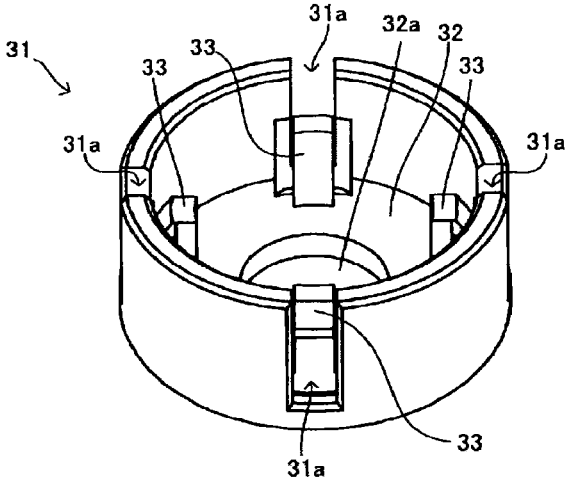
FIG. 6B is an outer appearance perspective view of the cap member 31.

FIG. 6B is an outer appearance perspective view of the cap member 31. As can be ascertained from FIGS. 4, 5, and 6B, the cap member 31 is a cylindrical member which has a bottom portion 32 in one end portion. In the bottom portion 32, a circular hole 32*a* around a cylindrical shaft of the cap member 31 is provided. The support shaft member 3*b* provided on the inner surface of the housing 3*a* of the processing cartridge 3 is inserted into the hole 32*a* as will be described later (refer to FIG. 11). Therefore, the hole 32*a* is formed to have the size by which at least the support shaft member 3*b* can pass through.

The size of the outer circumferential portion of the cap member 31 is formed to be capable of being accommodated in the outer tube portion 22 of the flange member 21. In other words, the outer diameter of the cap member 31 becomes smaller than the inner diameter of the outer tube portion 22 of the flange member 21. In addition, as can be ascertained from FIG. 6B, in the outer circumferential portion of the cap member 31, a slit 31*a* is provided in the axial direction from the end portion opposite to the bottom portion 32.

The slit 31*a* is provided at a position which corresponds to the cap member engaging means 26 of the flange member 21, and has the size by which the cap member engaging means 26 can be disposed inside the slit 31*a*. Accordingly, the cap member engaging means 26 can link the flange member 21 and the cap member 31 without interfering with the cap member 31.

In addition, on the inner side of the cap member 31, flange member engaging means 33 is provided to stand in the direction parallel to the axial direction from the bottom portion 32. The flange member engaging means 33 is means for being engaged with the cap member engaging means 26, and holding the cap member 31 to the flange member 21. As described above, while the flange member engaging means 33 is coupled with the cap member engaging means 26, and the cap member 31 is regulated not to fall out of the flange member 21, the movement of the cap member 31 along the axial direction with respect to the flange member 21 is not regulated.

Therefore, the flange member engaging means 33 is disposed at a position which corresponds to the cap member engaging means 26, and is positioned to be aligned with the slit 31*a* on the cylindrical inner side of the cap member 31. The flange member engaging means 33 is not particularly limited if the means acts as described above. As one example, a hook-like projection which corresponds to the cap member engaging means 26 and is provided with a hook toward the bottom portion 32 side on the slit 31*a* side, can be employed. In addition, in the aspect, a hole 32*b* is provided in the bottom portion 32, and a position thereof corresponds to the flange member engaging means 33. Accordingly, it is possible to integrally manufacture the cap member 31 including the flange member engaging means 33 by injection molding.

The elastic member 41 is means for biasing both the flange member 21 and the cap member 31 in the separating direction when the flange member 21 and the cap member 31 are combined with each other. A specific aspect of the elastic member 41 is not particularly limited, but it is possible to use a so-called coiled spring. At this time, as illustrated in FIG. 5, it is possible to use the coiled spring which has the inner diameter by which insertion of the inner tube portion 23 on the inner side thereof is possible, and the outer diameter by which falling out of the hole 32*a* is not possible.

Figure 7:
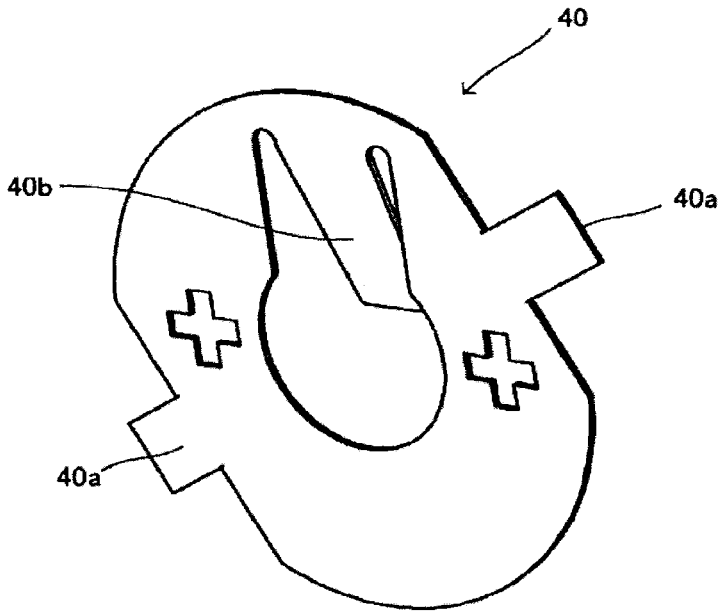
FIG. 7 is an outer appearance perspective view of an earth plate 40.

FIG. 7 is a perspective view of the earth plate 40. The earth plate 40 is a conductive member which has a shape of a circular plate, and a protrusion portion 40*a* is formed to be in contact with the inner surface of the photoreceptor drum 11 from the outer circumferential portion thereof. In addition, a contact piece 40*b* which comes into contact with the support shaft member 3*b* of the processing cartridge 3 is provided at the center of the earth plate 40 as will be described later. In other words, the earth plate 40 is similar to a known earth plate, a structure for the earth plate 40 is not particularly limited, and a known shape can be employed.

The flange member 21, the cap member 31, the elastic member 41, and the earth plate 40, are, for example, combined with each other as follows, and become the non-driving side end member 20. This will be described by postures illustrated in FIGS. 4 and 5.

The bottom portion 24 in the flange member 21 and an end portion (that is, an opening end) on the opposite side, and the bottom portion 32 of the cap member 31 and the end portion (that is, an opening end) on the opposite side, face each other, and the cap member 31 is inserted into the flange member 21. Therefore, in the non-driving side end member 20, the bottom portion 24 appears, and the bottom portion 32 appears on the opposite side.

In addition, at this time, as illustrated in FIG. 5, the elastic member 41 is nipped between the flange member 21 and the cap member 31. Specifically, one end of the elastic member 41 in the biasing direction is disposed in the bottom portion 24, and the other end is disposed being in contact with the bottom portion 32. In a case where the elastic member 41 is the coiled spring, the inner tube portion 23 is inserted into the elastic member 41.

Accordingly, the elastic member 41 is biased in the direction of separating the flange member 21 and the cap member 31, and a part of the cap member 31 is projected out of the flange member 21.

Meanwhile, as can be ascertained from FIG. 5, at a position where the cap member 31 is projected out of the flange member 21 by a predetermined size, the cap member engaging means 26 and the flange member engaging means 33 are engaged with each other, and the movement in the direction in which the flange member 21 and the cap member 31 are separated from each other is regulated. Accordingly, it is possible to prevent the cap member 31 from falling out of the flange member 21.

Above, as illustrated in FIGS. 4A and 5, a part of the cap member 31 can maintain a posture of being protruded from the flange member 21 in a biased state.

In addition, the earth plate 40 is a non-driving side end member which is disposed to overlap an outer side of the bottom portion 24 of the flange member 21. At this time, as illustrated in FIG. 5, a tip end of the contact piece 40*b* of the earth plate 40 is disposed on the inner side of the inner tube portion 23 of the flange member 21.

Figure 8A:
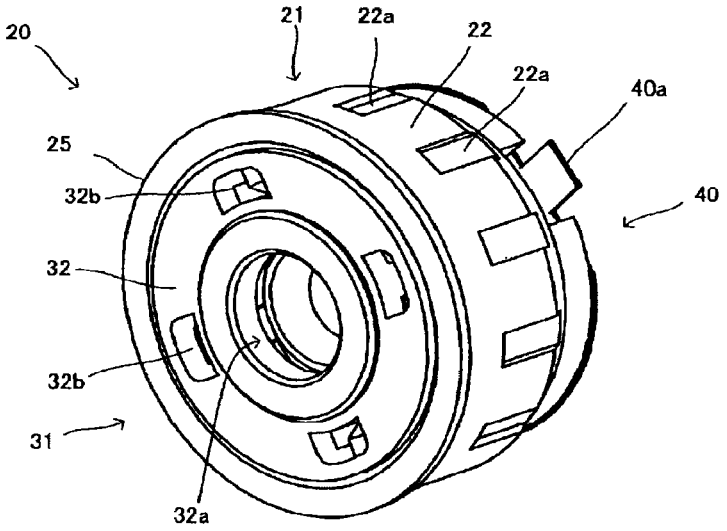
FIG. 8A is a perspective view from the same viewpoint of FIG. 4A in another posture of the non-driving side end member 20.
Figure 8B:
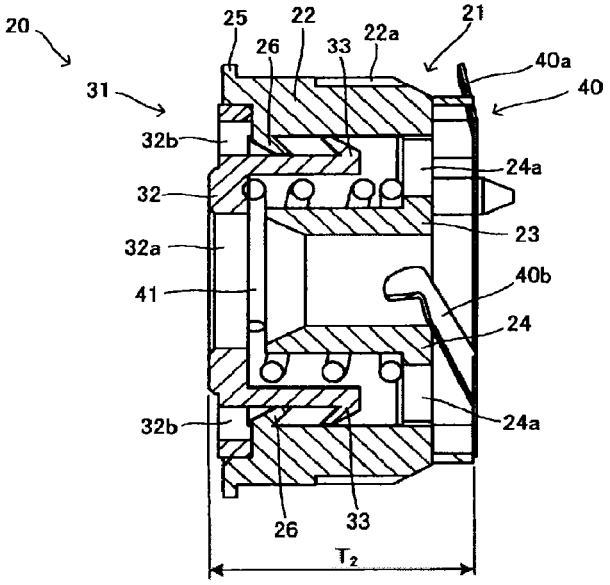
FIG. 8B is a sectional view from the same viewpoint of FIG. 5 in another posture of the non-driving side end member 20.

Here, the movement of the cap member engaging means 26 and the flange member engaging means 33 in the direction parallel to the axial direction, other than the direction in which the cap member 31 is separated from the flange member 21 more than the postures illustrated in FIGS. 4A and 5, is not regulated. Therefore, when pressing the bottom portion 24 and/or the bottom portion 32 to approach each other against the biasing force of the elastic member 41 from the posture illustrated in FIG. 5, the flange member 21 and the cap member 31 can relatively move in the direction parallel to the axial direction to approach each other. FIG. 8 is a view illustrating this. FIG. 8A is a perspective view from the same viewpoint as that of FIG. 4A. FIG. 8B is a sectional view form the same viewpoint as that of FIG. 5. In this manner, in a state where the cap member 31 more deeply gets into the flange member 21, both the cap member 31 and the flange member 21 can relatively move in the direction parallel to the axial direction. Accordingly, the length of the non-driving side end member 20 in the axial direction changes, and for example, the length which is $T_1$ in the posture of FIG. 5 becomes $T_2$ which is shorter than $T_1$ in the posture of FIG. 8B.

It is preferable that the flange member 21 and the cap member 31 are formed of a crystalline resin. In case of the crystalline resin, when performing injection molding by using a mold, molding processing properties are excellent since a flow is excellent, and even when cooling is not performed until reaching a glass transition point, releasing is possible by crystallizing and fixing. Therefore, it is possible to remarkably improve productivity. In addition, the crystalline resin has excellent heat resistance, solvent resistance, oil resistance, grease resistance, friction and wear resistance, and sliding properties, and is preferable as a material which is employed in the end member from the viewpoint of the rigidity and hardness.

Examples of the crystalline resin include polyethylene, polypropylene, polyamide, polyacetal, polyethylene telephthalate, polybutylene terephthalate, methyl pentene, polyphenylene sulfide, polyetherether ketone, polytetrafluoroethylene, and nylon.

Among these, a polyacetal-based resin is preferable from the viewpoint of molding processing properties.

In addition, from the viewpoint of improving the strength, a glass fiber or a carbon fiber may be filled.

In addition, the flange member 21 and the cap member 31 may be formed of different materials. The flange member 21 and the cap member 31 mutually slide at the time of expansion and contraction, but there is a case where abnormal noise is generated at the time of expansion and contraction when both the flange member 21 and the cap member 31 are formed of the same material. Meanwhile, it is possible to prevent the abnormal noise by configuring both the flange member 21 and the cap member 31 by different materials.

Figure 9A:
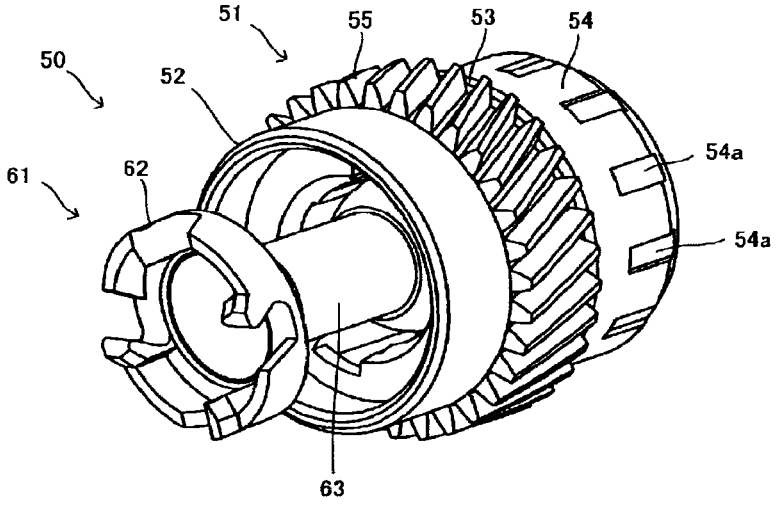
FIG. 9A is an outer appearance perspective view of the driving side end member 50.
Figure 9B:
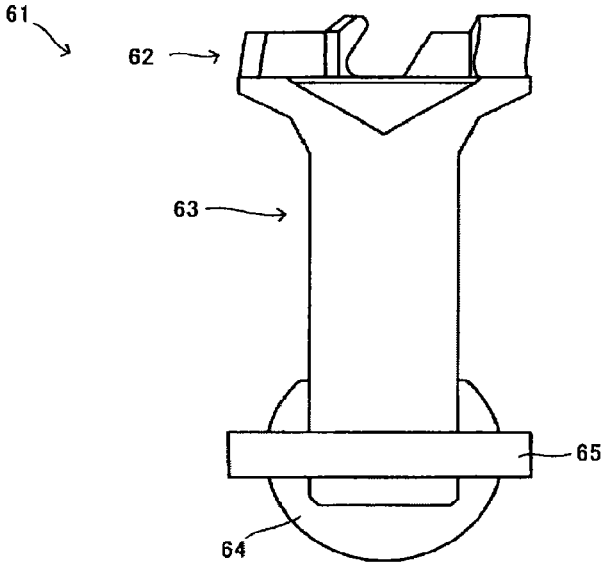
FIG. 9B is a sectional view of a shaft member 61.

Returning to FIG. 3, the driving side end member 50 will be described. The driving side end member 50 is an end member which is disposed in the end portion on a side on which the driving shaft 70 of the apparatus main body 2 is engaged, on a side opposite to the non-driving side end member 20, among the end portions in the direction along the axis of the photoreceptor drum 11. FIG. 9A is an outer appearance perspective view of the driving side end member 50. FIG. 9B is a sectional view along the axial direction of the shaft member 61 which configures the driving side end member 50.

The driving side end member 50 is provided with a bearing member 51 and a shaft member 61.

As can be ascertained from FIG. 9, the bearing member 51 includes a tubular body 52, a contact wall 53, a fitting portion 54, a gear portion 55, and a holding portion.

The tubular body 52 is an overall tubular member, and the contact wall 53 which comes into contact with and is locked to the end surface of the photoreceptor drum 11 from a part of the outer circumferential surface, stands. Accordingly, the depth of insertion of the driving side end member 50 into the photoreceptor drum 11 is regulated in a posture in which the driving side end member 50 is mounted on the photoreceptor drum 11.

By nipping the contact wall 53 of the tubular body 52, the fitting portion 54 of which one side is inserted into the photoreceptor drum 11 is made. The fitting portion 54 is inserted into the photoreceptor drum 11, and is fixed to the inner surface of the photoreceptor drum 11 by the adhesive. Accordingly, the driving side end member 50 is fixed to the end portion of the photoreceptor drum 11. Therefore, the outer diameter of the fitting portion 54 is substantially the same as the inner diameter of the photoreceptor drum 11 within a range in which insertion into the cylindrical inner side of the photoreceptor drum 11 is possible.

A groove 54*a* may be formed on the outer circumferential surface in the fitting portion 54. Accordingly, the groove 54*a* is filled with the adhesive, and adhesiveness between the bearing member 51 (driving side end member 50) and the photoreceptor drum 11 is improved by an anchor effect or the like.

By nipping the contact wall 53, the gear portion 55 is formed on the outer circumferential surface of the tubular body 52 opposite to the fitting portion 54. The gear portion 55 is a gear which transmits the rotating force to another member, such as the developing roller, and in the aspect, a helical gear is disposed. However, the type of the gear is not particularly limited, and may be a spur gear. In addition, it is not necessary to provide the gear.

Furthermore, the holding portion which holds the shaft member 61 is provided on the tubular inner side of the tubular body 52. The holding portion is a part which holds a spherical body portion 64 of the shaft member 61 and a rotating force transmission pin 1465 as will be described later, and can allow the shaft member 61 swing. An aspect of the holding portion is not particularly limited if the function thereof is achieved, and a known aspect can be employed. For example, an aspect illustrated in PTL 1 can also be employed.

It is preferable that the bearing member 51 is formed of the crystalline resin. In case of the crystalline resin, when performing injection molding by using a mold, molding processing properties are excellent since the flow is excellent, and even when cooling is not performed until reaching the glass transition point, releasing is possible by crystallizing and fixing. Therefore, it is possible to remarkably improve productivity. In addition, the crystalline resin has excellent heat resistance, solvent resistance, oil resistance, grease resistance, friction and wear resistance, and sliding properties, and is preferable as a material which is employed in the end member from the viewpoint of the rigidity and hardness.

Examples of the crystalline resin include polyethylene, polypropylene, polyamide, polyacetal, polyethylene telephthalate, polybutylene terephthalate, methyl pentene, polyphenylene sulfide, polyetherether ketone, polytetrafluoroethylene, and nylon.

Among these, a polyacetal-based resin is preferable from the viewpoint of molding processing properties.

In addition, from the viewpoint of improving the strength, the glass fiber or the carbon fiber may be filled.

Meanwhile, as can be ascertained from FIGS. 9A and 9B, the shaft member 61 includes a coupling portion 62, a rotating shaft 63, the spherical body portion 64, and the rotating force transmission pin 1465.

The coupling portion 62 is a part which functions as a rotating force receiving portion that receives the rotation driving force from the apparatus main body 2. Therefore, a shape which can be engaged with the driving shaft 70 of the apparatus main body 2 is provided as will be described later.

The rotating shaft 63 is a columnar shaft-shape member which functions as a rotating force transmission portion that transmits the rotating force received by the coupling portion 62. Therefore, the coupling portion 62 is provided at one end of the rotating shaft 63. In addition, the spherical body portion 64 which will be described in the following is provided at the other end.

The spherical body portion 64 is a spherical part which functions as a base end portion as can be ascertained from FIG. 9B in the aspect, and is provided in the end portion opposite to the side on which the coupling portion 62 is disposed among the end portions of the rotating shaft 63. At this time, it is preferable that the center of the spherical body portion 64 is disposed on the axis of the rotating shaft 63. Accordingly, it is possible to achieve more stabilized rotation of the photoreceptor drum 11.

The rotating force transmission pin 1465 is a columnar shaft-shape member which passes through the center of the spherical body portion 64, and forms a rotating force transmission projection (there is a case of being described as a rotating force transmission projection 65 or a rotating force transmission pin 65) as both ends protrude from the spherical body portion 64 through the spherical body portion 64. The axis of the rotating force transmission pin 1465 is provided to be orthogonal to the axis of the rotating shaft 63.

A material of the shaft member 61 is not particularly limited, but it is possible to use a resin, such as polyacetal, polycarbonate, or PPS. However, in order to improve the rigidity of the member, the glass fiber or the carbon fiber may be mixed into the resin in accordance with load torque. In addition, the rigidity may be further improved by inserting metal into the resin, or the entire member may be made of metal.

The spherical body portion 64 of the shaft member 61 and the rotating force transmission pin 1465 are held to be swingable by the holding portion of the bearing member 51. Accordingly, the photoreceptor drum unit 10 is attachable to and detachable from the apparatus main body.

Here, the driving side end member 50 is described as an example of one aspect, but the member is not particularly limited if the engaging portion (coupling member) is swingable to be inclined with respect to the axis of the driving shaft of the apparatus main body, and a known member can be employed.

Above, the outer tube portion 22 of the non-driving side end member 20 is inserted into one end portion of the photoreceptor drum 11 until coming into contact with the contact wall 25. At this time, the protrusion portion 40*a* of the earth plate 40 comes into contact with the inner surface of the photoreceptor drum 11. In addition, as illustrated in FIGS. 3A and 3B, by inserting the fitting portion 54 of the driving side end member 50 into the other end portion of the photoreceptor drum 11 until coming into contact with the contact wall 53, the photoreceptor drum unit 10 is made.

Next, a posture of the photoreceptor drum unit 10 in a posture in which the processing cartridge including the photoreceptor drum unit 10 is mounted on the image forming apparatus, will be described.

Figure 10:
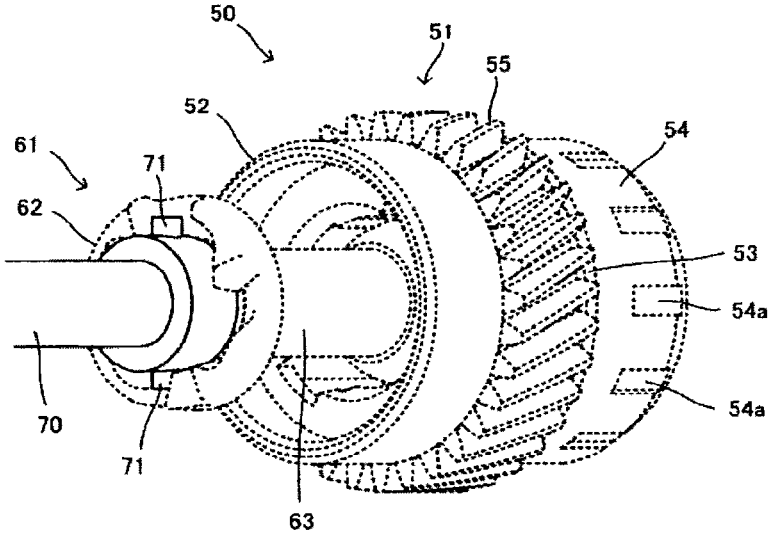
FIG. 10 is a perspective view illustrating a posture in which a driving shaft 70 is engaged with the driving side end member 50.

Here, the driving shaft 70 of the apparatus main body in the aspect will be described. It is possible to use a known configuration in other parts. FIG. 10 is a scene where the driving shaft 70 which is provided in the apparatus main body and gives the rotation driving force to the photoreceptor drum unit 10 is engaged with the coupling portion 62 of the driving side end member 50.

The driving shaft 70 is a columnar shaft member of which a tip end is a hemispherical surface, and a columnar driving projection 71 which serves as a rotating force giving portion that protrudes in the direction orthogonal to the rotating axis, is provided. On the side opposite to the tip end side illustrated in FIG. 10 in the driving shaft 70, it is possible to rotate the driving shaft 70 around the axis.

Figure 11:
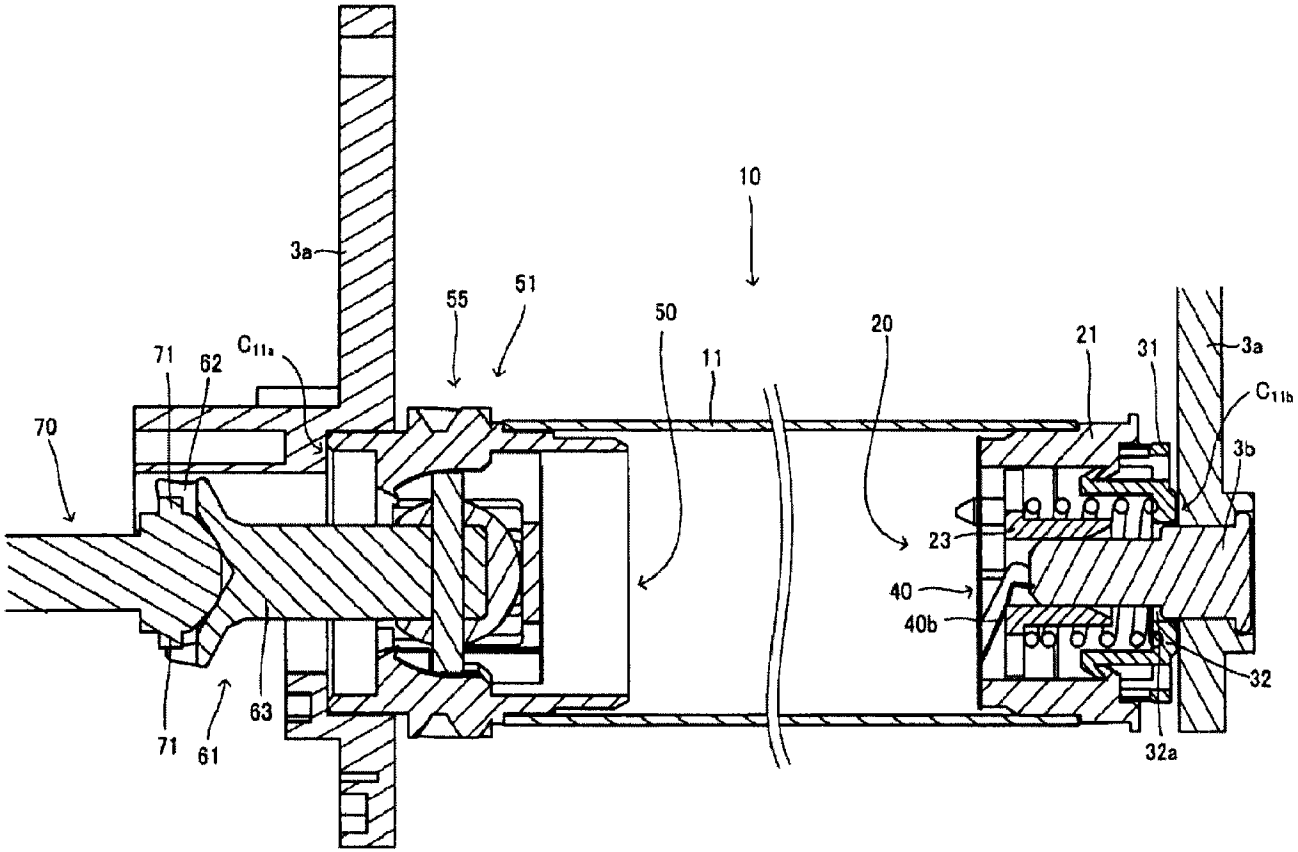
FIG. 11 is a view focusing on the photoreceptor drum unit 10 and the periphery thereof in a sectional view of the processing cartridge in a scene where a processing cartridge 3 including the photoreceptor drum unit 10 is mounted on an apparatus main body 2.

FIG. 11 is a sectional view along the axial direction of the photoreceptor drum unit 10 focusing on the periphery of the photoreceptor drum unit 10 in the processing cartridge 3 mounted on the apparatus main body 2. Therefore, the driving shaft 70, the photoreceptor drum unit 10, and the housing 3*a* which is at a part for holding the photoreceptor drum unit 10, are illustrated in FIG. 11.

As can be ascertained from FIGS. 10 and 11, in the driving side end member 50, the tip end of the driving shaft 70 abuts against the coupling portion 62. In addition, the driving projection 71 of the driving shaft 70 is connected to be engaged with the coupling portion 62, and can transmit the rotating force. In addition, the rotating force is transmitted to the driving side end member 50, and the photoreceptor drum 11 is rotated. In accordance with this, the non-driving side end member 20 also rotates.

Meanwhile, as can be ascertained from FIG. 11, the support shaft member 3*b* which extends from the inner surface of the housing 3*a* of the processing cartridge 3 passes through the hole 32*a* provided in the bottom portion 32 of the cap member 31 in the non-driving side end member 20, and is inserted into the inner tube portion 23 of the flange member 21. Accordingly, the hole 32*a* and the inner tube portion 23 function as bearings, and support the photoreceptor drum unit 10 to be rotatable.

Here, in the driving side end member 50, a part of the end surface of the driving shaft 70 side comes into contact with the housing 3*a* as illustrated by Cite in FIG. 11, and the movement in the direction in which the photoreceptor drum unit 10 approaches the driving shaft 70 is regulated. Meanwhile, in the non-driving side end member 20, the surface opposite to the driving shaft 70 comes into contact with the housing 3*a* to overlap the inner surface of the housing 3*a* as illustrated by Cub in FIG. 11. Accordingly, the movement in the direction in which the photoreceptor drum unit 10 is separated from the driving shaft 70 is regulated. In other words, the non-driving side end member 20 and the driving side end member 50 come into contact with the housing 3*a* on the surface opposite to the photoreceptor drum 11 side, and the movement in the axial direction is regulated. A surface which faces the photoreceptor drum side does not come into contact with the housing 3*a*, and is not regulated.

In other words, the movement of the photoreceptor drum unit 10 only in one direction among the directions along the axis of the photoreceptor drum 11 by the housing 3*a* (here, the direction of being separated from the driving shaft 70), is regulated by the non-driving side end member 20, and the movement of the driving side end member 50 only in the other direction among the directions along the axis of the photoreceptor drum 11 by the housing (3*a*) (in the direction of approaching the driving shaft 70), is not regulated.

At this time, in order to reduce friction between the outer surface of the bottom portion 32 and the housing 3*a*, here, lubricating oil may be coated, or friction prevention sheet (for example, a Teflon sheet (registered trademark), a nylon sheet, a felt sheet, or a PET sheet) may be nipped. Instead of this, the cap member 31 may be formed of a material having high sliding properties (for example, Teflon sheet (registered trademark)).

According to this, since the non-driving side end member 20 has the biasing force which presses the photoreceptor drum unit 10 to the driving shaft 70 side, and is extendable and contractable, it is possible to press the driving side end member 50 to the driving shaft 70 side, and to reliably engage the coupling portion 62 with the driving shaft 70. In addition, since a range in which the cap member 31 of the non-driving side end member 20 is extendable and contractable may be employed, conditions for dimension accuracy is relieved.

At this time, since it is not necessary to regulate the movement in the direction in which the photoreceptor drum unit 10 is separated from the driving shaft 70 as described in PTL 1, the driving side end member 50 does not require a member provided in the housing 3*a* for the regulation. Therefore, since it is not necessary to make the photoreceptor drum fitted into a part which does not have enough dimension, it is not necessary to improve precision of the member, and thus, management becomes easy, and the productivity is also improved.

In addition, since it is not necessary to regulate the driving side end member 50 in this manner, as can be ascertained from FIG. 11, it is not necessary to form a part which is largely expanded in the radial direction of the driving side end member 50. Therefore, it is possible to make the largest diameter of the gear portion 55 with respect to other parts in the driving side end member 50. In addition, a shape at a part other than the gear portion 55, can be formed to be equal to or less than the outer diameter (diameter) of the photoreceptor drum 11. Accordingly, it is possible to simplify the shape, and to improve productivity.

In addition, in the non-driving side end member 20, the contact piece 40*b* of the earth plate 40 comes into contact with the support shaft member 3*b*, and accordingly, the photoreceptor drum 11, the earth plate 40, the support shaft member 3*b*, and the apparatus main body 2 are electrically connected, and the apparatus main body 2 is conducted from the photoreceptor drum 11.

Figure 12:
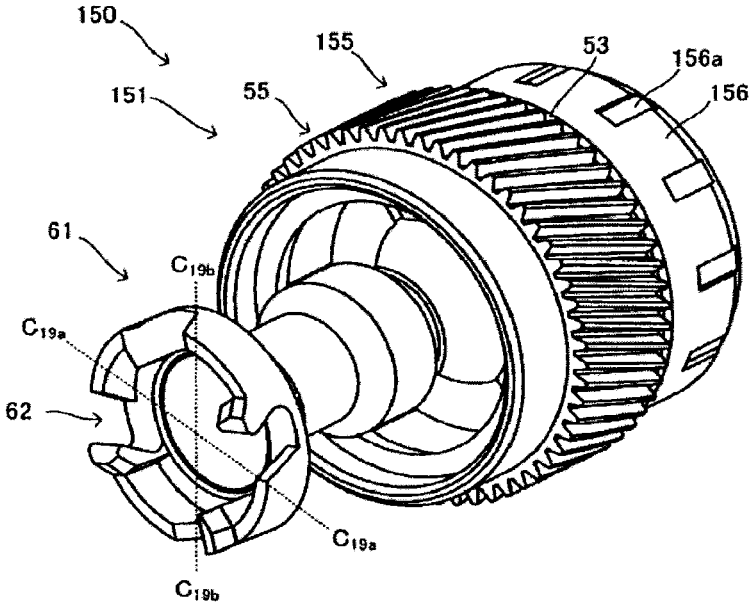
FIG. 12 is an outer appearance perspective view of an end member 150.
Figure 13:
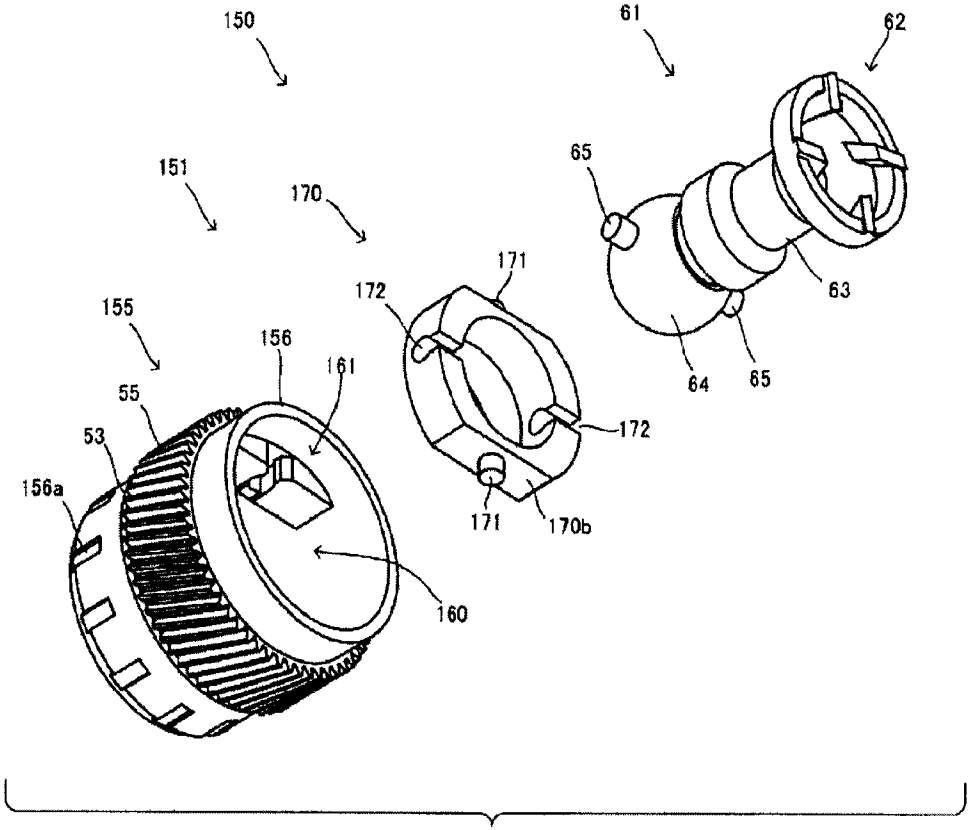
FIG. 13 is an exploded perspective view of the end member 150.

Next, a second aspect will be described. FIG. 12 is a perspective view of a driving side end member 150. FIG. 13 is an exploded perspective view of the driving side end member 150. In the aspect, instead of the driving side end member 50 in the above-described first aspect, the driving side end member 150 is employed. Here, the driving side end member 150 will be described. As can be ascertained from FIG. 12, the driving side end member 150 is provided with a bearing member 151 and a shaft member 61. Here, since the shaft member 61 can be considered the same as that in the first aspect, the same reference numeral will be given, and the description thereof will be omitted.

Figure 14:
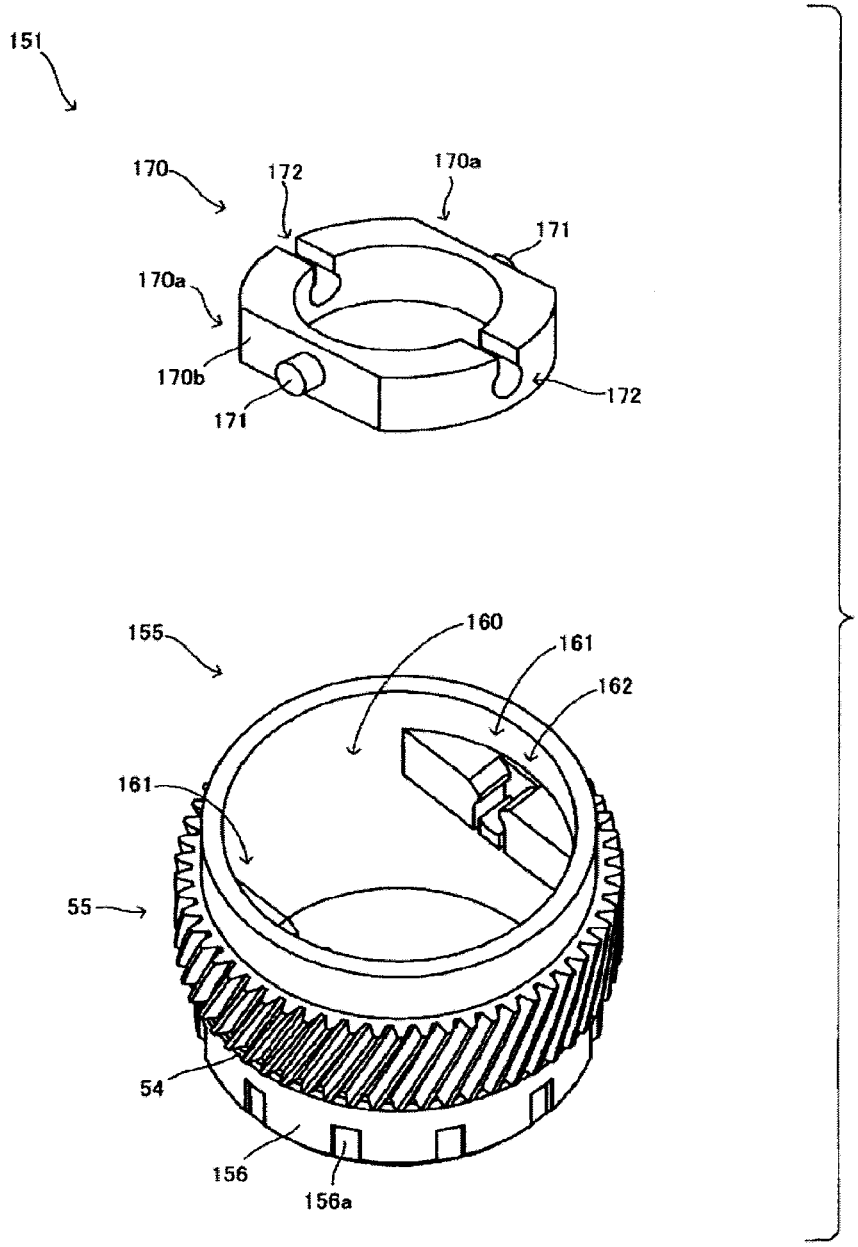
FIG. 14 is an exploded perspective view of a bearing member 151.

The bearing member 151 is a member which is fixed to the end portion of the photoreceptor drum 11. FIG. 14 is an exploded perspective view of the bearing member 151. As can be ascertained from FIG. 14, the bearing member 151 is provided with a main body 155 and an intermediate member 170. Each of the members will be described.

Figure 15A:
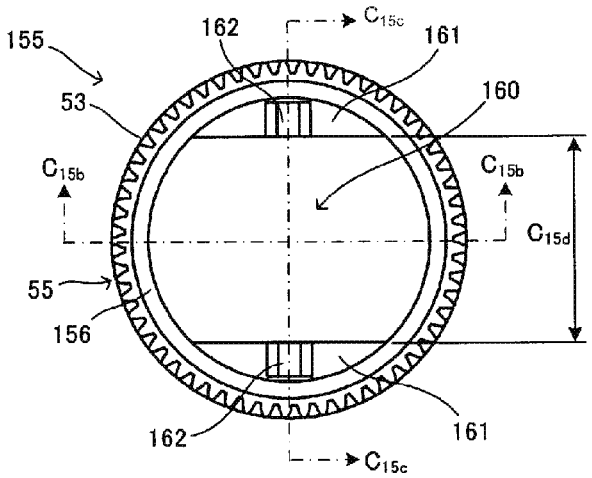
FIG. 15A is a plan view of a main body 155.
Figure 15B:
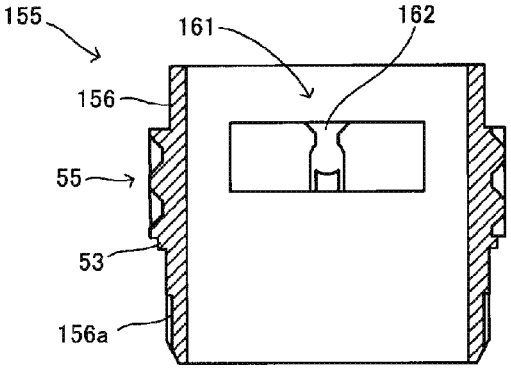
FIG. 15B is one sectional view of the main body 155.
Figure 15C:
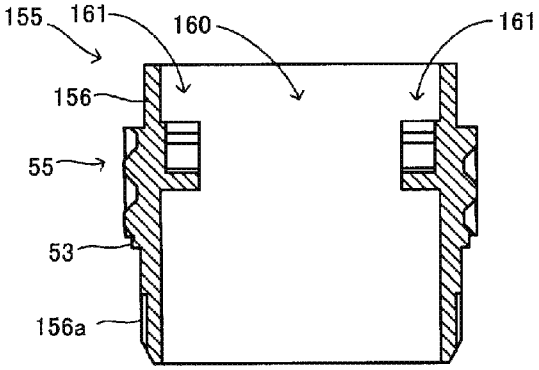
FIG. 15C is another sectional view of the main body 155.

FIG. 15A is a plan view when the main body 155 is viewed from a side on which the intermediate member 170 is inserted. FIG. 15B is a sectional view by a line illustrated by $C_{15b}$-$C_{15b}$ in FIG. 15A. FIG. 15C is a sectional view by a line illustrated by $C_{15c}$-$C_{15c}$ in FIG. 15A. FIGS. 15B and 15C are sections deviated by 90° around the axis of the main body 155.

In the aspect, as can be ascertained from FIGS. 13 to 15, the main body 155 is provided with a cylindrical tubular body 156. In addition, on an outer circumferential surface of the tubular body 156, the ring-shaped contact wall 53 which stands along the outer circumferential surface, and the gear portion 55, are formed. The outer diameter of the tubular body 156 is substantially the same as the inner diameter of the photoreceptor drum 11, and the main body 155 is fixed to the photoreceptor drum 11 by inserting one end side of the tubular body 156 into the photoreceptor drum 11 and making one end side fitted to the photoreceptor drum 11. At this time, the end surface of the photoreceptor drum 11 is deeply inserted to bump into the contact wall 53. At this time, in order to more firmly fix the main body 155, the adhesive may be used. In addition, a groove 156*a* or unevenness may be provided in the tubular body 156 at a part in which the adhesive is disposed. Accordingly, the adhesive is held by the groove 156*a* or a recessed portion, and the photoreceptor drum 11 and the main body 155 are more firmly adhered to each other.

The gear portion 55 is a gear which transmits the rotating force to a developing roller unit, and is a helical gear in the aspect. The type of the gear is not particularly limited, and may be a spur gear or the like. However, it is not necessary to provide the gear.

On the tubular inner side of the tubular body 156, a holding portion 160 which holds the shaft member 61 to the main body 155 via the intermediate member 170 is provided.

The holding portion 160 is provided with two holding projections 161 which protrude from a part of the inner wall surface of the tubular body 156, and two holding projections 161 are disposed to face each other nipping the axis of the tubular body 156. A void is formed between the two holding projections 161, and here, the intermediate member 170 is disposed.

In a case of the holding projection 161, two holding projections 161 which oppose each other nipping the axis of the tubular body 156 function as one pair. In addition, the holding projections 161 which are practically used may be one pair. However, regarding the disposed holding projections 161, four holding projections 161 may be provided as two pairs, six holding projections 161 may be provided as three pairs, and more holding projections may be provided. Accordingly, it is possible to improve balance of behavior (a sink or the like) of a material when performing injection molding with respect to the main body 155, and to form a main body having higher precision. Therefore, the number of holding projections may be determined from the viewpoint of the behavior of the material when performing the molding.

Figure 16:
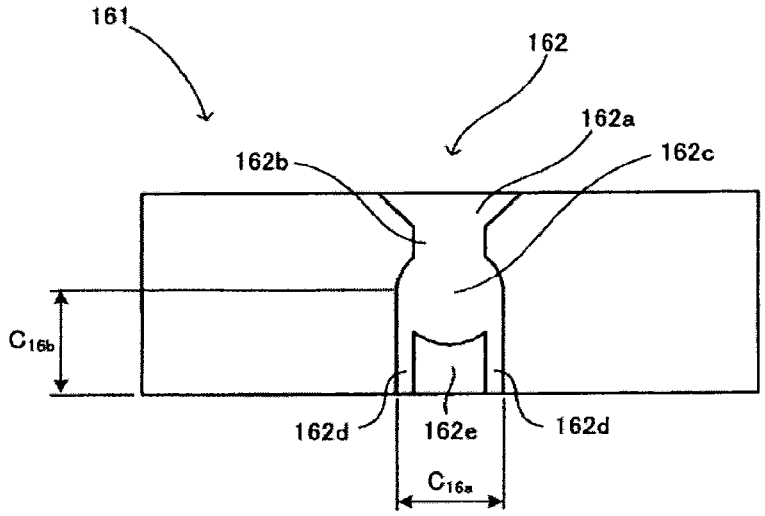
FIG. 16 is a view illustrating a holding projection 161 of a holding portion 160.

Each holding projection 161 of the aspect is opened to the other holding projection 161 which makes a pair, and includes a holding groove 162 which extends in the direction along the axial direction of the tubular body 156. FIG. 16 is an enlarged view illustrating a part of the holding projection 161 in FIG. 15B. As can be ascertained from FIG. 16, the holding groove 162 has a predetermined shape along the extending direction, and specifically, an inlet portion 162*a*, a communicating portion 162*b*, a holding portion 162*c*, and a forming portion 162*d* are continuously aligned in the direction along the axis of the tubular body 156.

The inlet portion 162*a* is a part which is disposed on the side on which the intermediate member 170 is inserted in the holding groove 162, and the groove width (the size in the leftward-and-rightward direction of the paper surface of FIG. 16, the size in the inner circumferential direction of the tubular body 156) becomes narrow when approaching the side opposite to the side on which the intermediate member 170 is disposed. The end portion on the side on which the intermediate member 170 is inserted in the inlet portion 162*a* is opened, and as will be described later, from here, it is possible to introduce a main body linking projection 171 (refer to FIG. 14) of the intermediate member 170. In the aspect, the inlet portion 162*a* is provided from the viewpoint of ease of inserting the main body linking projection 171, but this is not necessary, and the communicating portion 162*b* which will be described later may be disposed in the end portion of the holding groove 162 without providing the inlet portion 162*a*.

The communicating portion 162*b* is a groove which is continuously provided from the end portion opposite to the side on which the intermediate member 170 is inserted in the inlet portion 162*a*, and is a groove which extends by the groove width maintaining the narrowed groove width in the inlet portion 162*a*. Accordingly, the communicating portion 162*b* functions as a snap-fit bonding projection portion.

The holding portion 162*c* is a groove which is continuously provided from the end portion of the communicating portion 162*b*, and is a groove of which the groove width becomes wider than the communicating portion 162*b*. As will be described later, here, the main body linking projection 171 of the intermediate member 170 is held.

The forming portions 162*d* are two narrow grooves which are continuously provided from the end portion of the holding portion 162*c*, and respectively extend along the axial direction of the tubular bodies 156 of both end portions at the widest part of the holding portion 162*c* in the groove width direction. Therefore, the groove is not formed between two forming portions 162*d*, and the material remains as a main body linking projection receiving portion 162*e*. Here, the size (width illustrated by $C_{16a}$ in FIG. 16) between outer sides of the two forming portions 162*d* is formed to be the same size as the widest width part of the holding portion 162*c*. Therefore, here, a reverse tapered shape is not formed when viewed from the side of the forming portion 162*d*. In other words, in a section from the forming portion 162*d* to a part where the groove width of the holding portion 162*c* is the widest (section illustrated by $C_{16b}$ in FIG. 16), there is not a part of which the width becomes narrower. Therefore, a shape which does not have an undercut in injection molding is formed. Accordingly, releasing is easy in the integrated molding, the mold can also have a simple structure, and productivity can be improved. An example of a specific manufacturing process will be described later.

According to the holding groove 162, the communicating portion 162*b* of which the groove width between the inlet portion 162*a* and the holding portion 162*c* is narrow is formed, and this functions as a so-called snap-fit bonding projection portion. Therefore, when the main body linking projection 171 is disposed in the holding portion 162*c*, the snap-fit bonding is performed, and the main body linking projection 171 is unlikely to fall out of the holding groove 162.

In addition, since a shape which makes the integrated molding easy is formed as described above, a structure in which the productivity can be improved is also employed.

In addition, since the main body linking projection 171 which is formed in a columnar shape in the holding portion 162*c* is held (refer to FIG. 5), it is preferable that at least a part of the surface which faces the holding portion 162*c* has a shape of an arc. Accordingly, smooth swing is prompted. However, the aspect is not limited thereto.

A material which configures the main body 155 is not particularly limited, but a resin, such as polyacetal, polycarbonate, or PPS, or metal can be used. Here, in order to improve the rigidity of the member in a case where the resin is used, the glass fiber or the carbon fiber may be mixed into the resin in accordance with the load torque. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

In a case of making the main body 155 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

Figure 17A:
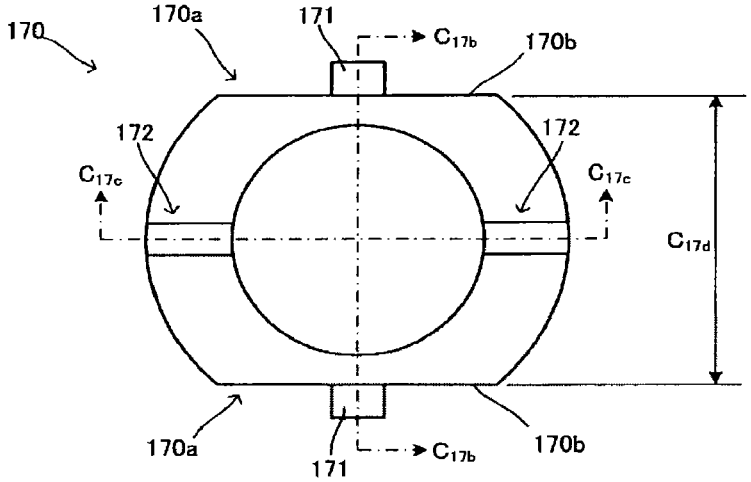
FIG. 17A is a plan view of an intermediate member 170.
Figure 17B:
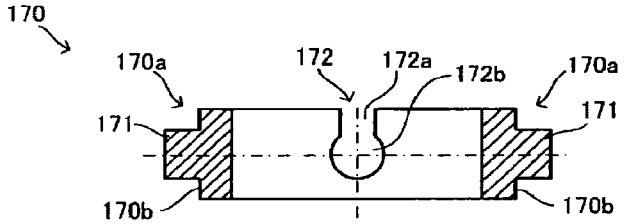
FIG. 17B is one sectional view of the intermediate member 170.
Figure 17C:
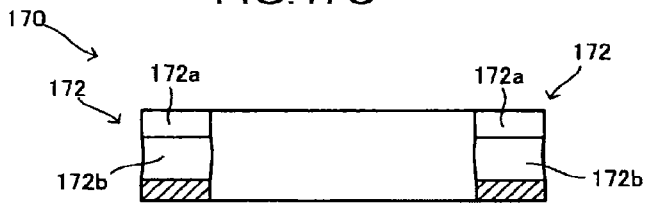
FIG. 17C is another sectional view of the intermediate member 170.

Returning to FIG. 14, the intermediate member 170 will be described. As can be ascertained from FIG. 14, the intermediate member 170 is an overall annular member. FIG. 17 illustrates the intermediate member 170. FIG. 17A is a plan view when the axis of the circle is viewed in the forward-and-rearward direction of a paper surface. FIG. 17B is a sectional view from the arrow direction illustrated by $C_{17b}$-$C_{17b}$ in FIG. 17A. FIG. 17C is a sectional view from the arrow direction illustrated by $C_{17c}$-$C_{17c}$ in FIG. 17A.

The annular inner diameter is greater than the diameter of the spherical body portion 64 of the shaft member 61 in the intermediate member 170. Accordingly, the swing of the shaft member 61 is not interrupted by the intermediate member 170, and is appropriately performed. In addition, the annular outer diameter of the intermediate member 170 has the size by which the intermediate member 170 does not come into contact with the inner side of the tubular body 156 even when the intermediate member 170 swings inside the tubular body 156.

In the outer circumferential portion and the inner circumferential portion which form the annular shape, the intermediate member 170 has one pair of cutout portions 170*a* which are cut out parallel to a part of the outer circumferential portion, and two parallel planes 170*b* are formed. The distance (distance illustrated by $C_{17d}$ in FIG. 17A) between the two surfaces is formed to be smaller than the distance (distance illustrated by $C_{15d}$ in FIG. 15A) between two holding projections 161.

In addition, the columnar main body linking projections 171 stands from each of the planes 170*b*. Here, as can be ascertained from FIG. 17A, in two main body linking projections 171, the axes of the column nip the axis of the intermediate member 170, and are disposed on one diameter of the circle. Here, the columnar diameter of the main body linking projection 171 is slightly greater than the groove width of the communicating portion 162*b* of the holding groove 162, and is formed to be substantially the same as the groove width of the holding portion 162*c*. However, from the viewpoint of adjusting the ease of the swing, for example, the diameter of the main body linking projection 171 can be set to be smaller than the groove width of the holding portion 162*c* for the smooth swing, and on the contrary, from the viewpoint of slightly regulating the extent of the swing and stiffening the movement, the diameter of the main body linking projection 171 can be slightly greater than the groove width of the holding portion 162*c*.

In addition, the intermediate member 170 extends in the direction in which the outer side and the inner side are linked to each other along the annular diameter, and two shaft member linking grooves 172 which consider the direction along the axis of the circle as the depth direction are provided. As can be ascertained from FIG. 17A, in the two shaft member linking grooves 172, the extending direction is the annular diameter direction of the intermediate member 170, and the two shaft member linking grooves 172 nip the axis of the intermediate member 170, and are disposed on one diameter. In addition, the shaft member linking groove 172 and the main body linking projection 171 are disposed at a position deviated by 90° around the axis of the intermediate member 170.

A shape of the shaft member linking groove 172 in the direction orthogonal to the direction in which the shaft member linking groove 172 extends is illustrated in FIG. 17B. As can be ascertained from the drawing, in the shaft member linking groove 172, a communicating portion 172*a* is disposed on the opening side (upper side of FIG. 17B), and a holding portion 172*b* is formed on the deep side being continuous from the communicating portion 172*a*. Since the rotating force transmission projection 65 of the shaft member 61 is held by the holding portion 172*b*, the holding portion 172*b* is formed to match the sectional shape of the rotating force transmission projection 65 and have a circular section. Here, as can be ascertained from FIG. 17B, in the thickness direction of the intermediate member 170, the center position of the holding portion 172*b* is disposed to match the axis position of the main body linking projection 171. Accordingly, the shaft member 61 can equivalently swing in all directions. In addition, regardless of the phase of the photoreceptor drum due to the equivalent swing, attachment and detachment of the processing cartridge are smoothly performed.

In addition, in the aspect, an example in which the shaft member linking groove 172 is formed of the communicating portion 172*a* and the holding portion 172*b*, is described. Not being limited thereto, on a side opposite to the end portion which communicates with the holding portion 172*b* in the communicating portion 172*a*, an inlet portion which is formed so that the groove width gradually widens in accordance with the inlet portion 162*a* of the holding groove 162, may be provided.

In addition, the widest part in the groove width (in the leftward-and-rightward direction of the paper surface of FIG. 17B) of the holding portion 172*b* is formed to be wider than the groove width of the communicating portion 172*a*. This functions as a so-called snap-fit bonding projection. Therefore, when the rotating force transmission projection 65 of the driving shaft 70 is disposed in the holding portion 172*b*, the snap-fit bonding is performed, and the rotating force transmission projection 65 is unlikely to fall out of the shaft member linking groove 172.

A material which configures the intermediate member 170 is not particularly limited, but it is possible to use a material similar to that of the main body 155.

Figure 18A:
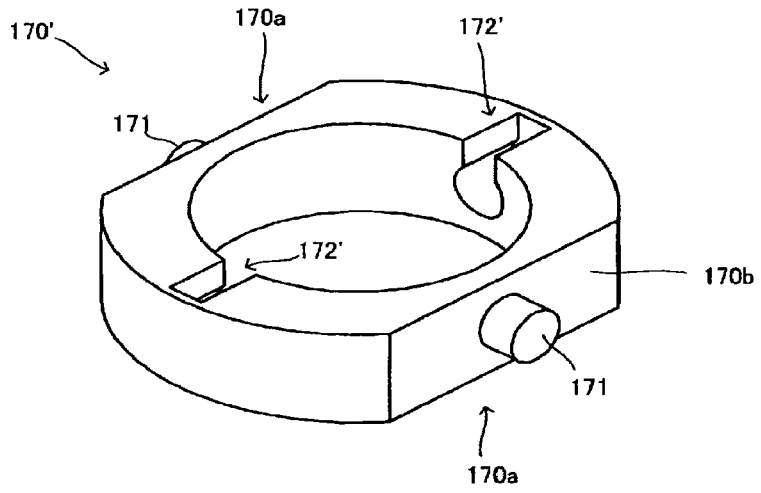
FIG. 18A is a perspective view of an intermediate member 170'.
Figure 18B:
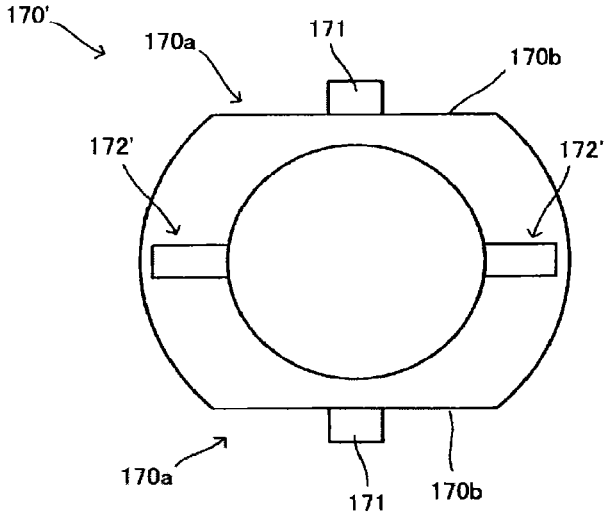
FIG. 18B is a plan view of the intermediate member 170'.

FIG. 18 illustrates an aspect of an intermediate member 170' according to a modification example. FIG. 18A is a perspective view of the intermediate member 170'. FIG. 18B is a plan view of the intermediate member 170'. In the intermediate member 170', an annular outer side of the intermediate member 170' is blocked by a wall in the direction in which a shaft member linking groove 172' extends, and does not communicate with the outer side. According to this, in the rotating force transmission projection 65 (refer to FIG. 9B) of the shaft member 61 which is inserted into the shaft member linking groove 172', the movement of the shaft member linking groove 172' in the extending direction is regulated, and more stabilized swing is possible.

Figure 19B:
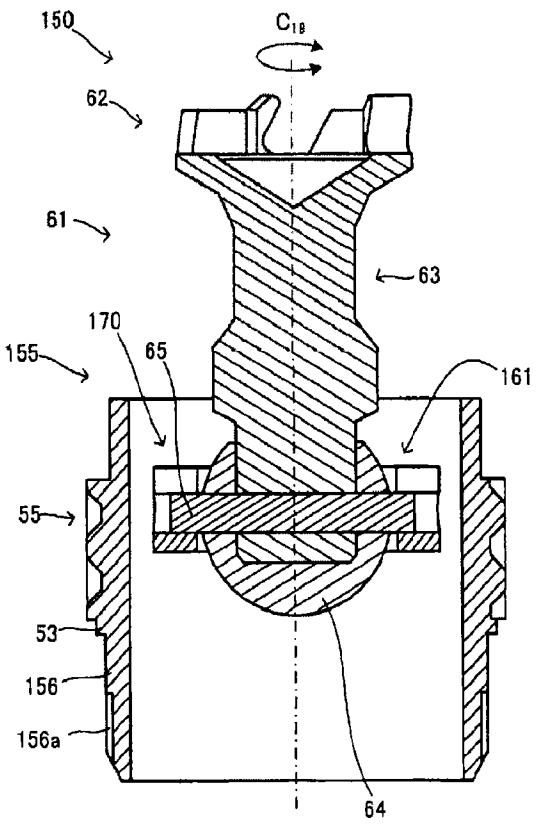
FIG. 19B is another sectional view of the end member 150.
Figure 19A:
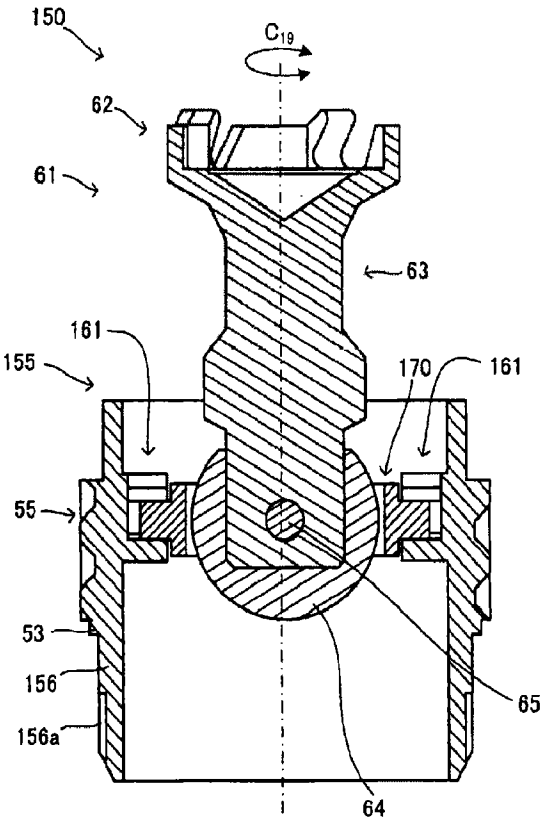
FIG. 19A is one sectional view of the end member 150.

The bearing member 151 and the shaft member 61 are combined with each other as follows, and make the driving side end member 150. By describing the combination, an aspect in which the bearing member 151 and the shaft member 61 are provided, a relationship of the size of the members, and a positional relationship of the members, are further understood. FIG. 19A is a sectional view of the end member 150 along a line $C_{19a}$-$C_{19a}$ illustrated in FIG. 12. FIG. 19B is a sectional view of the end member 150 along a line $C_{19b}$-$C_{19b}$ illustrated in FIG. 12. In addition, FIG. 20A is an example of a posture in which the shaft member 61 is inclined from the viewpoint illustrated in FIG. 19A. FIG.

20B is an example of a posture in which the shaft member 61 is inclined from the viewpoint illustrated in FIG. 19B.

As can be particularly well ascertained from FIGS. 19A and 19B, the spherical body portion 64 is disposed on the annular inner side of the intermediate member 170, and the rotating force transmission pin 65 is inserted into the shaft member linking groove 172 of the intermediate member 170. Accordingly, the intermediate member 170 and the shaft member 61 are combined with each other. When combining is performed, each of the protruded end portions (that is, the rotating force transmission projection 65) of the rotating force transmission pin 65 passes through the communicating portion 172*a* to be pushed from an opening portion of the shaft member linking groove 172, is disposed in the holding portion 172*b*, and is combined by the snap-fit bonding. Accordingly, the shaft member 61 can swing with respect to the intermediate member 170 around the axis of the rotating force transmission pin 65 as illustrated by an arrow $C_{20a}$ in FIG. 20A.

Meanwhile, as can be particularly well from FIGS. 19A and 19B, the intermediate member 170 which is combined with the shaft member 61 is disposed between two holding projections 161 disposed on the inner side of the tubular body 156. At this time, the main body linking projection 171 of the intermediate member 170 is inserted into the holding groove 162 formed in the holding projection 161 of the tubular body 156. Accordingly, the intermediate member 170 and the main body 155 are combined with each other, and as a result, the main body 155, the intermediate member 170, and the shaft member 61 are coaxially combined with each other. When combining is performed, each of the main body linking projections 171 of the intermediate member 170 passes through the communicating portion 162*b* to be pushed from the inlet portion 162*a* of the holding groove 162 provided in the holding projection 161 of the tubular body 156, is disposed in the holding portion 162*c*, and is combined by the snap-fit bonding. In addition, as illustrated by an arrow $C_{20b}$ in FIG. 20B, the shaft member 61 can swing in every intermediate member 170 around the axis of the main body linking projection 171 of the intermediate member 170.

In this manner, in the end member 150, the intermediate member 170 is held in the main body 155 not to fall out by the snap-fit bonding, and the shaft member 61 is held in the intermediate member 170 not to fall out by the snap-fit bonding. Therefore, the shaft member 61 is not directly held in the main body 155.

In addition, the assembly of the end member 150 can be performed, first, by disposing the shaft member 61 in the intermediate member 170, and by attaching the shaft member 61 to the main body 155. In addition, in any case, the linking is performed by the snap-fit bonding. Therefore, it is possible to easily assemble the shaft member 61 to the bearing member 151 with high productivity. In addition, since not only the assembly but also the disengagement is similarly easy, reusing is also easily performed. In particular, when the shaft member 61 is inserted and separated, since it is not necessary to deform the shaft member 61 with a large force, a concern about damage or the like is relieved. In addition, since the separation is easy, it is possible to improve workability.

Furthermore, according to the intermediate member 170, a rotating force transmission projection (rotating force transmission pin) is provided, and the rotating force transmission projection can be combined with the bearing member 151 even when a spherical body is provided in the base end portion. Therefore, it is possible to use the type of the shaft member which is often used in reusing.

Figure 20B:
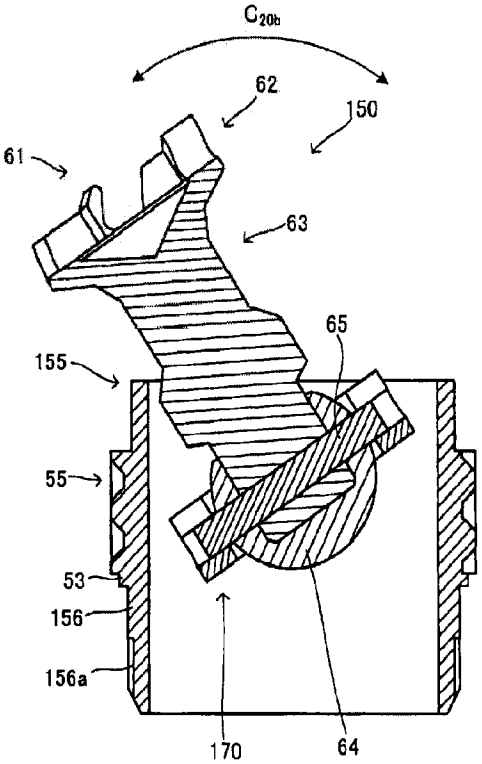
FIG. 20B is a view illustrating an example of a posture in which the driving shaft 70 is inclined in another section of the end member 150.
Figure 20A:
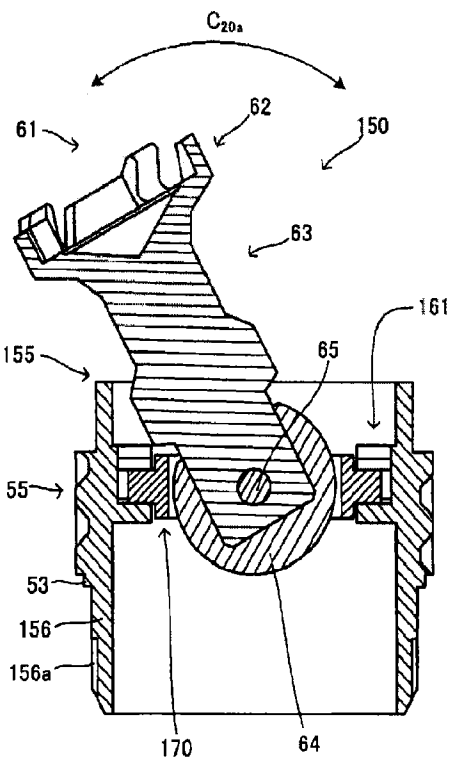
FIG. 20A is view illustrating an example of a posture in which the driving shaft 70 is inclined in one section of the end member 150.

In this manner, as the shaft member 61 is disposed on the inner side of the bearing member 151, the shaft member 61 can swing as illustrated in FIGS. 20A and 20B. In other words, in the viewpoint illustrated in FIG. 20A, as illustrated by an arrow $C_{20a}$, the shaft member 61 can swing around the axis of the rotating force transmission pin 65. Meanwhile, in the viewpoint illustrated in FIG. 20B, as illustrated by an arrow $C_{20b}$, the shaft member 61 can swing following the swing around the main body linking projection 171 of the intermediate member 170 itself. The swing illustrated in FIG. 20A and the swing illustrated in FIG. 20B are swings in the direction orthogonal to each other.

At this time, as can be ascertained from FIG. 17B, in the thickness direction of the intermediate member 170, since the center position of the holding portion 172*b* is disposed to match the axis position of the main body linking projection 171, two swing shafts are on the same plane, and swing which is equivalent in all directions can be performed. In addition, regardless of the phase of the photoreceptor drum, the attachment and detachment of the processing cartridge are smoothly performed by the equivalent swing.

In addition, when receiving the driving force from the apparatus main body 2, as illustrated by an arrow $C_{19}$ in FIGS. 19A and 19B, the shaft member 61 receives the rotating force around the axis. At this time, both end portions of the rotating force transmission pin 65 of the shaft member 61 presses the intermediate member 170, the main body linking projection 171 of the intermediate member 170 is hooked to a side wall of the holding groove 162 of the main body 155, and the rotating force is transmitted to the photoreceptor drum 11.

In this manner, according to the end member 150, since the swing of the shaft member 61 at least in one direction is swing between the intermediate member 170 and the main body 155, the operation is smoothly performed. At this time, since the swing is not related to the aspect of the shaft member, even when slight dimensional irregularity occurs on the shaft member, smooth swing can be sufficiently ensured. In addition, since there is not a concern that the shaft member 61 falls out even when an angle of swing is large, the angle of swing can be large. Accordingly, since a gap between the photoreceptor drum (processing cartridge) and the rotating force transmission shaft on the apparatus main body can be small, it is possible to reduce the size of the apparatus main body.

In addition, according to the end member 150, it is not necessary to provide a groove (inlet groove) for introducing the rotating force transmission pin into the swing groove, it is possible to solve a problem in which a shaft member unexpectedly falls out during the operation.

The shaft member 61 rotates (swings), transmits the rotating force, and is held in the bearing member 151, by the above-described structure.

After the end member 150 is assembled as illustrated in FIGS. 19A and 19B, the attachment of the end member 150 to the photoreceptor drum 11 is performed as the end portion on the side on which the shaft member 61 does not protrude in the end member 150 is inserted into the photoreceptor drum 11. By the end member 150, the rotating force is appropriately given to the photoreceptor drum 11 when mounting the processing cartridge 3 onto the apparatus main body 2, and it is possible to easily attach and detach the processing cartridge 3.

Figure 21:
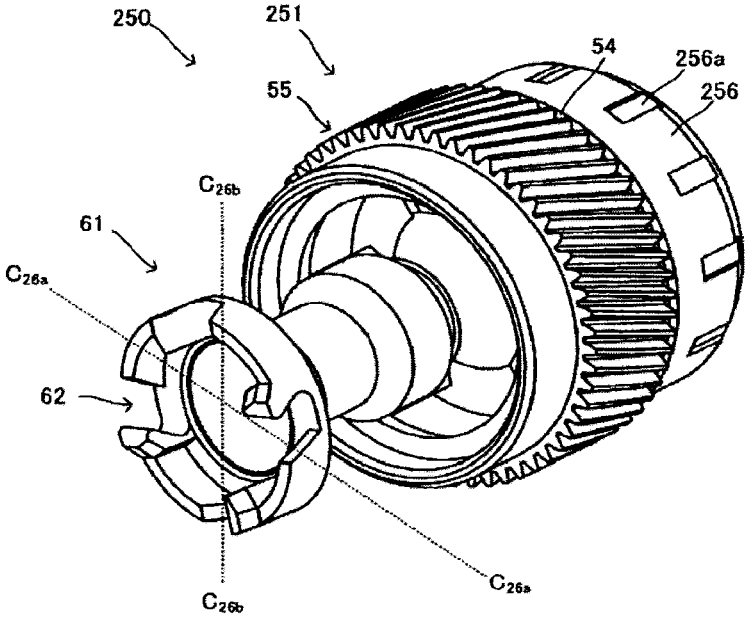
FIG. 21 is an outer appearance perspective view of an end member 250.

Next, a third aspect will be described. FIG. 21 is a perspective view of a driving side end member 250. In the aspect, instead of the driving side end member 50 with respect to the above-described first aspect, the driving side end member 250 is used. Here, the driving side end member 250 will be described. As can be ascertained from FIG. 21, the driving side end member 250 is provided with a bearing member 251 and the shaft member 61. Here, since the shaft member 61 can be considered the same as that in the first aspect, the same reference numeral will be given, and the description thereof will be omitted.

Figure 22:
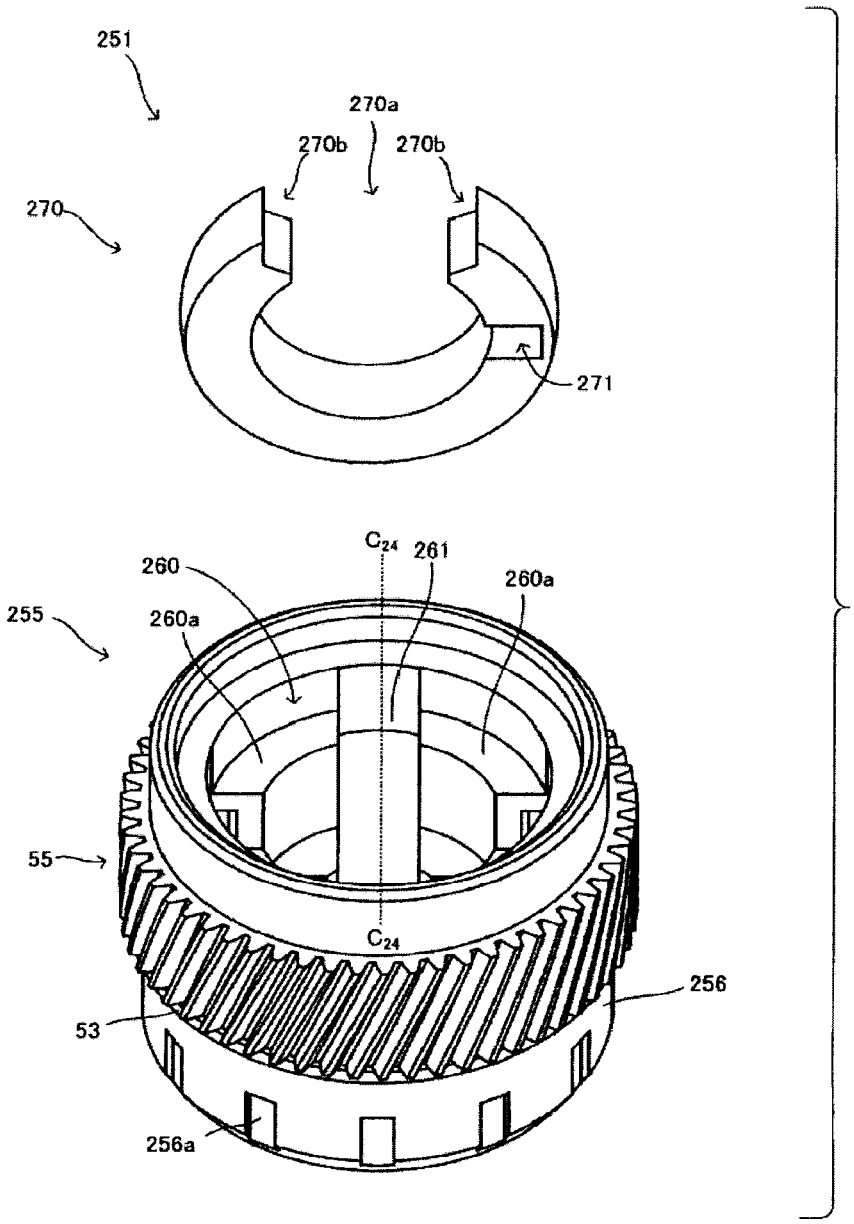
FIG. 22 is an exploded perspective view of a bearing member 251.

The bearing member 251 is a member which is fixed to the end portion of the photoreceptor drum 11. FIG. 22 is an exploded perspective view of the bearing member 251. As can be ascertained from FIG. 22, the bearing member 251 is provided with a main body 255 and an intermediate member 270. Each of the members will be described.

Figure 23A:
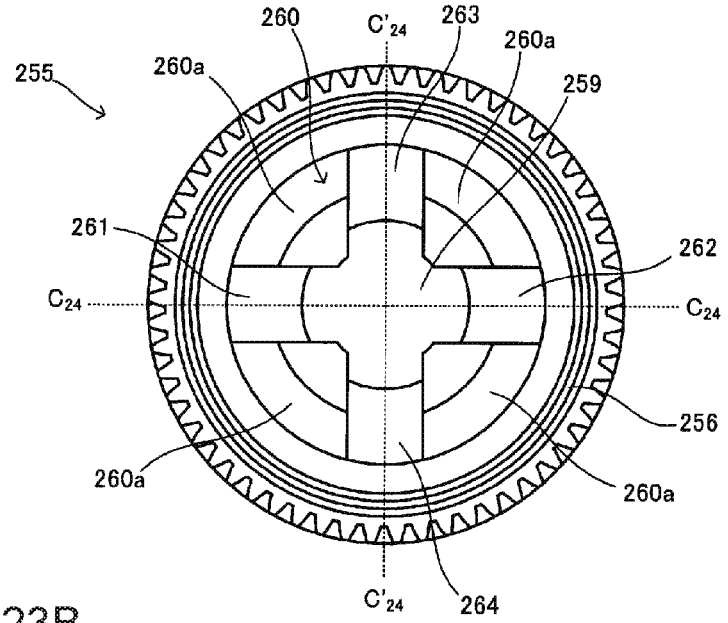
FIG. 23A is a plan view of a main body 255 of the bearing member 251.
Figure 23B:
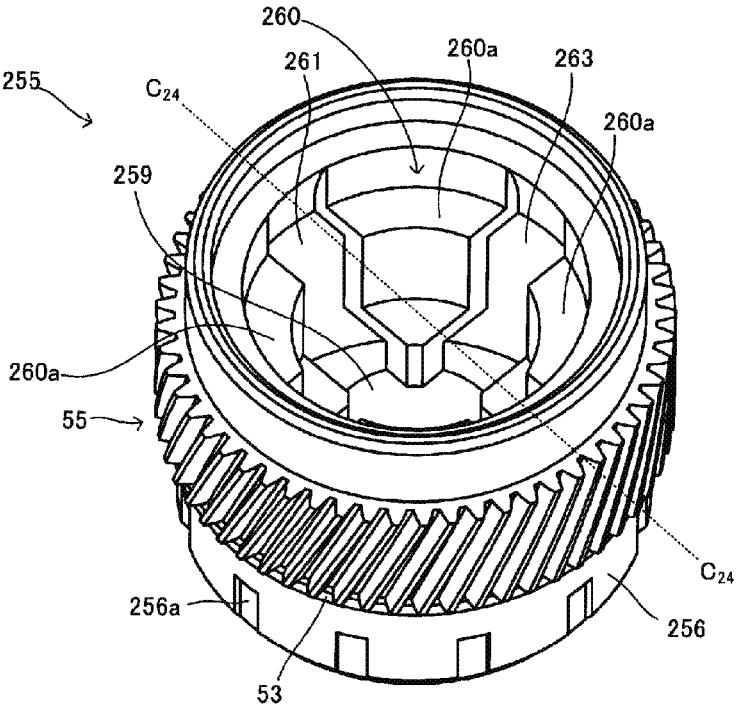
FIG. 23B is a perspective view of the main body 255 of the bearing member 251.
Figure 24:
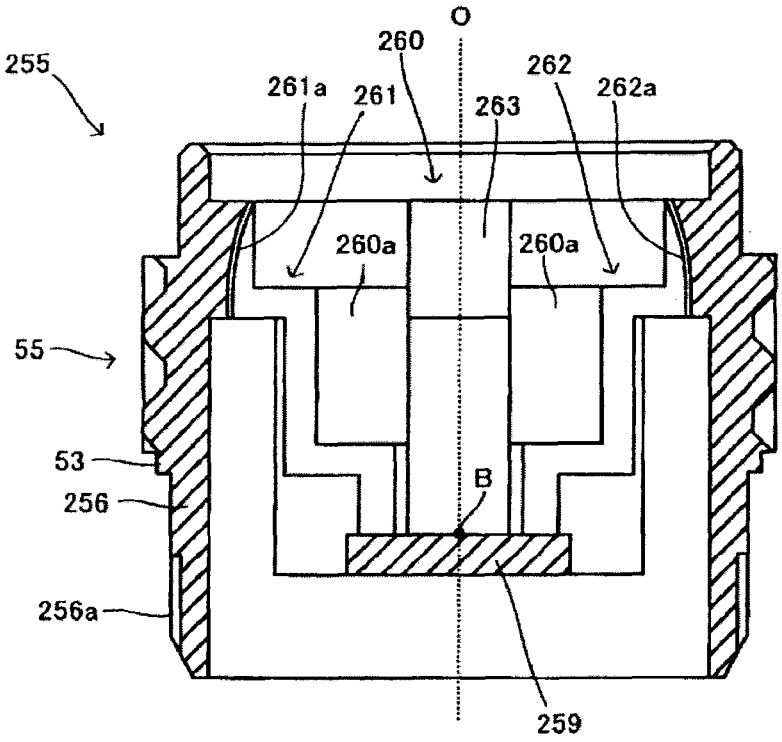
FIG. 24 is a sectional view of the main body 255 of the bearing member 251.

FIG. 23A is a view (plan view) when the main body 255 is viewed from a side on which the intermediate member 270 is inserted. FIG. 23B is a perspective view when the main body 255 is viewed from an angle different from FIG. 22. In addition, FIG. 24 is a sectional view of the axial direction along a line illustrated by $C_{24}$-$C_{24}$ in FIGS. 22, 23A, and 23B. In addition, in the main body 255 of the aspect, the sections of the axial direction along a line (line illustrated by $C'_{24}$-$C'_{24}$ in FIG. 23A) which is made by rotating a line illustrated by $C_{24}$-$C_{24}$ by 90° around the axis of the main body 255, is also similar to FIG. 24.

In the aspect, as can be ascertained from FIGS. 21 to 24, the main body 255 is provided with a cylindrical tubular body 256. In addition, on an outer circumferential surface of the tubular body 256, the ring-shaped contact wall 53 which stands along the outer circumferential surface, and a gear portion 55, are formed. The outer diameter of the tubular body 256 is substantially the same as the inner diameter of the photoreceptor drum 11, and the main body 255 is fixed to the photoreceptor drum 11 by inserting one end side of the tubular body 256 into the photoreceptor drum 11 and making one end side fitted to the photoreceptor drum 11. At this time, the end surface of the photoreceptor drum 11 is deeply inserted to bump into the contact wall 53. At this time, in order to more firmly fix the main body 255, the adhesive may be used. In addition, a groove 256*a* or unevenness may be provided in the tubular body 256 at a part in which the adhesive is disposed. Accordingly, the adhesive is held by the groove 256*a* or a recessed portion, and the photoreceptor drum 11 and the main body 255 are more firmly adhered to each other.

The gear portion 55 is a gear which transmits the rotating force to a developing roller unit, and is a helical gear in the aspect. The type of the gear is not particularly limited, and may be a spur gear or the like. However, it is not necessary to provide the gear.

On the tubular inner side of the tubular body 256, a plate-like bottom portion 259 is provided to block at least a part of the inner side of the tubular body 256. Furthermore, a holding portion 260 is provided on the inner side opposite to the side which is fixed to the photoreceptor drum 11, on the inner side of the tubular body 256 partitioned by the bottom portion 259.

Here, an example in which the bottom portion 259 is provided is described, but it is not necessary to provide the bottom portion 259. Since the shaft member 61 and the intermediate member 270 can be held by the holding portion 260, it is possible to hold the shaft member 61 and the intermediate member 270 on the inner side of the tubular body 256 without providing the bottom portion 259.

The holding portion 260 forms guide grooves 261, 262, 263, and 264 as intermediate member guides on the inner side of the tubular body 256. Therefore, in the holding portion 260, a plurality of protrusion portions 260*a* are disposed along an inner circumferential surface of the tubular body 256 at a predetermined interval to protrude toward the axis of the tubular body 256 from an inner surface of the tubular body 256, and a void of the adjacent protrusion portions 260*a* forms the guide grooves 261, 262, 263, and 264. In addition, a space (recessed portion) is formed at the axis part surrounded by the protrusion portion 260*a*, and here, as will be described later, the base end portion (spherical body portion 64) of the shaft member 61 is disposed.

Here, two guide grooves which oppose each other nipping the axis of the tubular body 256 function as one pair. In addition, the guide grooves which are practically used may be one pair, as will be described later. However, similar to the aspect, four guide grooves 261, 262, 263, and 264, that is, two pairs may be provided, and further, six (three pairs) or more guide grooves may be provided. Accordingly, it is possible to improve balance of behavior (a sink or the like) of a material when performing injection molding with respect to the main body 255, and to make a main body having higher precision. Therefore, the number of guide grooves may be determined from the viewpoint of the behavior of the material.

Here, one pair of guide grooves of which a section is illustrated in FIG. 24, and which is configured of the guide groove 261 and the guide groove 262, will be described. The other pair of guide grooves configured of the guide groove 263 and the guide groove 264 are also similar, and the description thereof will be omitted.

As described above, the guide groove 261 is a groove which extends along the direction of the axis (illustrated by a line O in FIG. 24) of the tubular body 256 formed on the inner circumferential surface of the tubular body 256. In addition, in the guide groove 261, the axis O side of the tubular body 256 is opened, and the guide groove 261 has a bottom surface on the inner circumferential surface side of the tubular body 256. Meanwhile, the guide groove 262 is a groove provided to oppose the opposite side nipping the axis O of the tubular body 256 with respect to the guide groove 261, and similar to the guide groove 261, the guide groove 262 is formed on the inner circumferential surface of the tubular body 256, and extends along the direction of the axis O of the tubular body 256. In addition, in the guide groove 262, the axis O side of the tubular body 256 is also opened, and the guide groove 262 also has a bottom surface on the inner circumferential surface side of the tubular body 256.

In addition, as can be ascertained from FIG. 24, at least at a part of the bottom surfaces of the guide grooves 261 and 262, curved surfaces 261*a* and 262*a* which are curved with respect to the direction along the axis O of the tubular body 256 are formed. It is preferable that the curved surfaces 261*a* and 262*a* are configured as follows in the section illustrated in FIG. 24.

It is preferable that the curved surfaces 261*a* and 262*a* are provided to oppose each other to be line-symmetrical nipping the axis O of the tubular body 256, an interval between the curved surface 261*a* and the curved surface 262*a* becomes narrow as being separated from the bottom portion 259 side (side which is inserted into the photoreceptor drum 11), and the curved surfaces approach each other. Accordingly, as will be described later, the intermediate member 270 can be held not to fall out of the main body 255.

It is preferable that the curved surfaces 261*a* and 262*a* have a shape of an arc, and are included in the same circle, and the center of the circle is on the axis O. Accordingly, it is possible to hold the intermediate member 270 in the main body 255 without rattling in the direction along the axis O, and to swing (inclination) the shaft member 61 by smoothly guiding the rotation of the intermediate member 270.

In addition, in a case where the bottom portion 259 is provided, on the circumference of the circle including the curved surfaces 261*a* and 262*a*, an intersection point (a point illustrated by B in FIG. 24) on the surface on the curved surfaces 261*a* and 262*a* sides, is disposed to be present on the axis O of the tubular body 256 and the bottom portion 259.

Figure 25A:
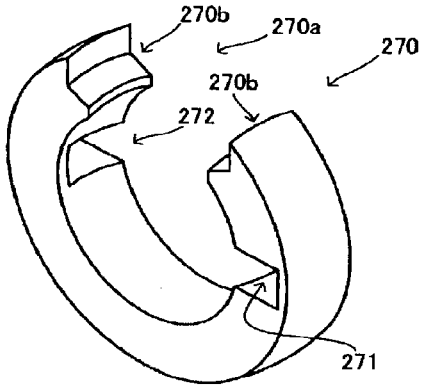
FIG. 25A is a perspective view of an intermediate member 270.
Figure 25B:
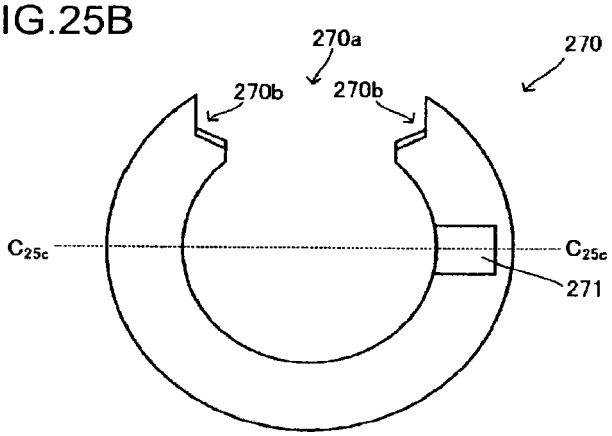
FIG. 25B is a front view of the intermediate member 270.
Figure 25C:
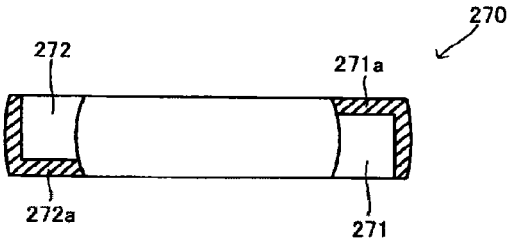
FIG. 25C is a sectional view of the intermediate member 270.

Returning to FIG. 22, the intermediate member 270 will be described. As can be ascertained from FIG. 22, the intermediate member 270 is an annular member of which a part is cut out. FIG. 25 illustrates the intermediate member 270. FIG. 25A is a perspective view, FIG. 25B is a front view, and FIG. 25C is a sectional view along a line illustrated by $C_{25c}$-$C_{25c}$ in FIG. 25B.

The intermediate member 270 has an annular shape in which a cutout 270*a* is provided at a part thereof.

The intermediate member 270 is inserted into any of one pair of guide grooves and functions as a guided member, in the guide grooves 261, 262, 263, and 264 of which a part of the outer circumference is provided in the holding portion 260 of the main body 255. Therefore, the outer diameter of the intermediate member 270 is the size by which the intermediate member 270 can slide being stored in one pair of guide grooves in which the outer circumferential portion of the intermediate member 270 is disposed. In a case where at least a part of the bottom surfaces of the guide grooves 261, 262, 263, and 264 has a shape of an arc as described above, and the arc is included in the same circle in one pair of guide grooves which oppose each other, it is preferable that the diameter of the circle is the same as the outer diameter of the intermediate member 270. Accordingly, the intermediate member 270 can smoothly rotate between the guide grooves, and can also suppress rattling.

Meanwhile, since the base end portion of the shaft member 61 which will be described later is disposed on the ring-shaped inner side of the intermediate member 270, the size and an aspect by which at least a part is accommodated on the inner side of the intermediate member 270, may be employed. In the aspect, since the base end portion of the shaft member 61 is made as a spherical body portion 64, the inner diameter of the intermediate member 270 can be the same as the diameter of the spherical body portion 64. In addition, as can be ascertained from FIG. 25C, in the aspect, the inner circumferential surface of the intermediate member 270 is also curved in a shape of an arc in the direction (vertical direction on the paper surface of FIG. 25C) along the axis of the circle. The curve can match the curve on the outer circumference of the spherical body portion 64. Accordingly, the intermediate member 270 and the spherical body portion 64 can be more appropriately combined.

In addition, the size (that is, the thickness) in the direction along the axis of the circle of the intermediate member 270 is substantially the same as the groove width of the guide grooves 261 and 262 formed in the holding portion 260 of the main body 255.

The cutout 270*a* of the intermediate member 270 has the size and the shape by which at least a part of the rotating shaft 63 of the shaft member 61 which will be described later can be disposed on the inner side thereof. Therefore, an end surface 270*b* of the intermediate member 270 which forms the cutout 270*a* can match the shape of the rotating shaft 63.

In the intermediate member 270, two grooves 271 and 272 which extend to the outside from the annular inner circumferential surface, are provided. The two grooves 271 and 272 are provided at an opposing position along the diameter of the intermediate member 270. Each of both ends of the rotating force transmission pin 65 of the shaft member 61 which will be described later is inserted into the grooves 271 and 272. Therefore, the shape and the disposition of the grooves 271 and 272 are configured so that both end portions of the rotating force transmission pin 65 are respectively inserted into the grooves 271 and 272.

In addition, in the grooves 271 and 272, it is preferable that pieces 271*a* and 272*a* remain in one side of the axial direction of the circle of the intermediate member 270, and the grooves 271 and 272 do not pass through in the direction along the axis. Accordingly, when the shaft member 61 is combined with the intermediate member 270, and the rotating force is given to the shaft member 61 from the apparatus main body 2, the rotating force transmission pin 65 is hooked to the pieces 271*a* and 272*a*, and the rotating force can be appropriately transmitted to the intermediate member 270. Therefore, in consideration of rotation of the rotating force transmission pin 65, as can be ascertained from FIGS. 25A to 25C, the piece 271*a* of the groove 271 and the piece 272*a* of the groove 272 are provided on different sides in the axial direction of the intermediate member 270.

In addition, if the tip end of the rotating force transmission pin 65 extends until reaching the inside of the guide grooves 261 and 262 of the holding portion 260 of the main body 255, since the tip end of the rotating force transmission pin 65 is hooked to the side walls of the guide grooves 261 and 262 during the rotation, the rotating force can be transmitted, and thus, it is not necessary to provide the pieces 271*a* and 272*a*.

In addition, opening portions which oppose the pieces 271*a* and 272*a* in the grooves 271 and 272 may be slightly nipped compared to the grooves. Specifically, the opening portion can be an opening which is slightly smaller than the diameter of the rotating force transmission pin 65. Accordingly, the rotating force transmission pin 65 which is inserted into the grooves 271 and 272 is unlikely to be fall out of the grooves 271 and 272 by the narrowed opening portion.

A material which configures the intermediate member 270 is not particularly limited, but a resin, such as polyacetal, polycarbonate, or PPS, can be used. Here, in order to improve the rigidity of the member, the glass fiber or the carbon fiber may be mixed into the resin in accordance with the load torque. In addition, in order to make the swing of the intermediate member 270 smooth when being attached to the main body 255, sliding properties may be improved by containing at least one type of a fluororesin, polyethylene, and silicon rubber in the resin. In addition, the resin may be coated with fluororesin or lubricant.

Figure 26A:
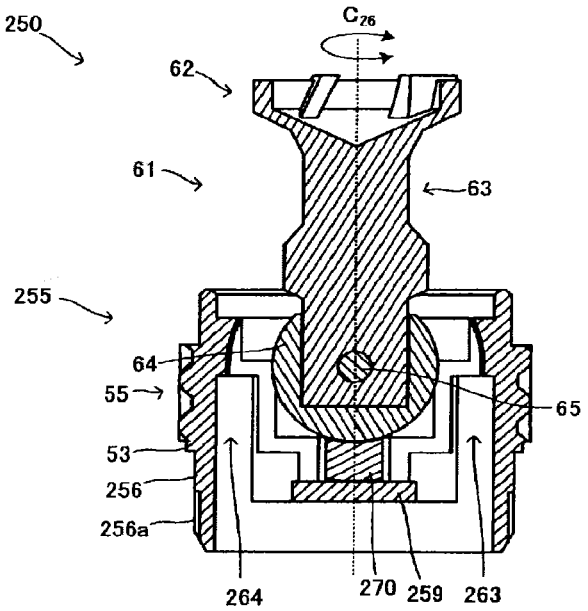
FIG. 26A is one sectional view of the end member 250.
Figure 26B:
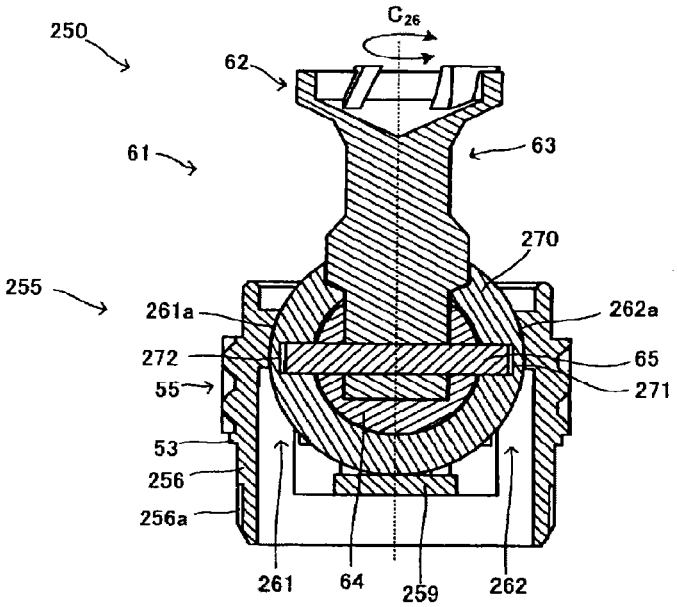
FIG. 26B is another sectional view of the end member 250.
Figure 27A:
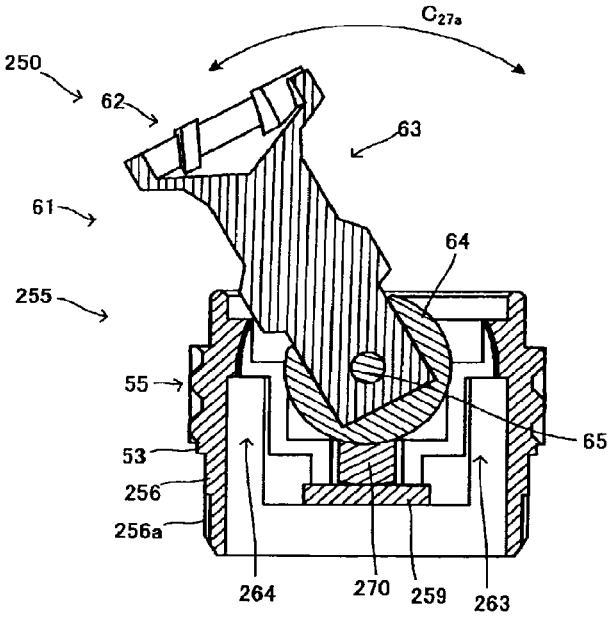
FIG. 27A is a view illustrating an example of a posture in which the shaft member 61 is inclined in one section of the end member 250.
Figure 27B:
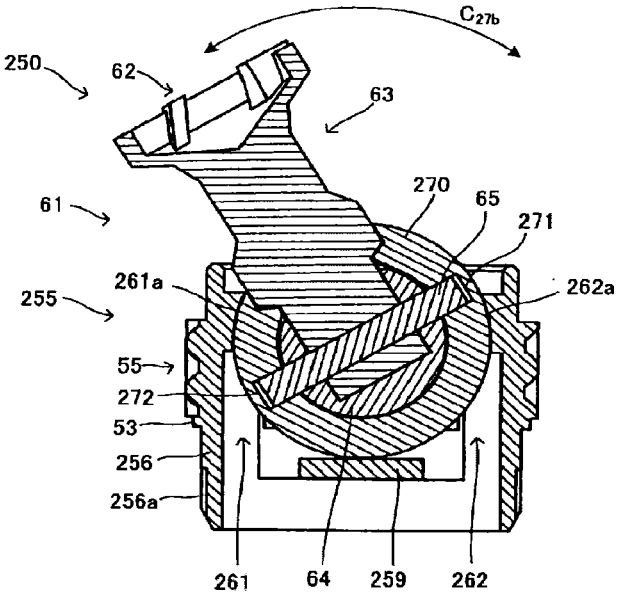
FIG. 27B is a view illustrating an example of the posture in which the shaft member 61 is inclined in another section of the end member 250.

The bearing member 251 and the shaft member 61 are combined with each other as follows, and become the end member 250. By describing the combination, an aspect in which the bearing member 251 and the shaft member 61 are provided, the size, and a positional relationship of the members, are further understood. FIG. 26A is a sectional view of the end member 250 along a line $C_{26a}$-$C_{26a}$ illustrated in FIG. 21. FIG. 26B is a sectional view of the end member 250 along a line $C_{26b}$-$C_{26b}$ illustrated in FIG. 21. In addition, FIG. 27A is an example of a posture in which the shaft member 61 is inclined from the viewpoint illustrated in FIG. 26A. FIG. 27B is an example of a posture in which the shaft member 61 is inclined from the viewpoint illustrated in FIG. 26B.

As can be particularly well ascertained from FIG. 26B, the spherical body portion 64 is disposed on the annular inner side of the intermediate member 270, and the rotating force transmission pin 65 is inserted into the grooves 271 and 272 of the intermediate member 270. Accordingly, the intermediate member 270 and the shaft member 61 are combined with each other. Accordingly, the shaft member 61 can swing with respect to the intermediate member 270 around the axis of the rotating force transmission pin 65 as illustrated by an arrow $C_{27a}$ in FIG. 27A.

Meanwhile, as can be particularly well from FIGS. 26A and 26B, in the intermediate member 270 in which the shaft member 61 is disposed, the outer circumferential portion of the intermediate member 270 is fitted into the guide grooves 261 and 262 so that the thickness direction of the intermediate member 270 becomes the groove width direction of the guide grooves 261 and 262 formed in the holding portion 260 of the main body 255. Therefore, the outer circumferential portion of the intermediate member 270 is disposed in the guide grooves 261 and 262, the intermediate member 270 can move to slide in the guide grooves 261 and 262, and as a result, the intermediate member 270 can rotate on the inner side of the main body 255 as illustrated by an arrow $C_{27b}$ in FIG. 27B.

In addition, as described in the aspect, when the curved surfaces 261*a* and 262*a* are formed on the bottom surfaces of the guide grooves 261 and 262 are on one circle, and the outer circumference of the intermediate member 270 also has substantially the same diameter as that of the circle, as illustrated in FIG. 26B, the intermediate member 270 is accommodated in the main body 255 without rattling, and the end member 250 which has more excellent rotation transmission precision is achieved.

In this manner, in the end member 250 of the aspect, the intermediate member 270 is held not to fall out of the guide grooves 261, 262, 263, and 264 formed in the main body 255, and the shaft member 61 is held not to fall out of the intermediate member 270. Therefore, the shaft member 61 is not directly held in the main body 255.

In addition, the assembly of the end member 250 can be performed, first, by disposing the shaft member 61 in the intermediate member 270, and by attaching the shaft member 61 to the main body 255. In this case, when the intermediate member 270 is disposed in the guide grooves 261 and 262 of the holding portion 260, the assembly is possible by elastically deforming the intermediate member 270 by adding a slight force. Therefore, it is possible to simply assemble the shaft member 61 to the bearing member 251 with high productivity. In addition, since not only the assembly is easy but also the disengagement is also similarly easy, the reusing is also easily performed. In particular, at this time, when the shaft member 61 is inserted and separated, since it is not necessary to deform the shaft member 61, a concern about damage or the like is relieved. In addition, since the separation is easy, it is possible to improve workability.

In this manner, as the shaft member 61 is disposed on the inner side of the bearing member 251, the shaft member 61 can swing as illustrated in FIGS. 27A and 27B. In other words, in the viewpoint illustrated in FIG. 27A, the shaft member 61 can swing around the axis of the rotating force transmission pin 65 as illustrated by an arrow $C_{27a}$. Meanwhile, in the viewpoint illustrated in FIG. 27B, the shaft member 61 can swing in accordance with the rotation of the intermediate member 270 as illustrated by an arrow $C_{27b}$. The swing illustrated in FIG. 27A and the swing illustrated in FIG. 27B are swings in the direction orthogonal to each other.

In addition, when the driving force from the apparatus main body 2 is received, the shaft member 61 receives the rotating force around the axis as illustrated by an arrow $C_{26}$ in FIGS. 26A and 26B. At this time, both end portions of a rotating force transmission pin 95 of the shaft member 61 press the intermediate member 270, the intermediate member 270 is hooked to the side wall of the guide grooves 261 and 262 of the main body 255, and the rotating force can be transmitted to the photoreceptor drum 11. In addition, when the tip end of the rotating force transmission pin 65 is configured to reach the inside of the guide grooves 261 and 262, even in a case where the pieces 271*a* and 272*a* (refer to FIG. 25C) are not provided, the tip end of the rotating force transmission pin 65 is hooked to the side walls of the guide grooves 261 and 262 of the main body 255, and the rotating force can be transmitted to the photoreceptor drum 11.

In this manner, according to the end member 250, in the swing of the shaft member 61 at least in one direction, since the intermediate member 270 and the main body 255 can slide and swing, the operation thereof is smoothly performed. At this time, since the swing is not related to the aspect of the shaft member, even when slight dimensional irregularity occurs on the shaft member, smooth swing can be sufficiently ensured. In addition, since there is not a concern that the shaft member 61 fall out even when an angle of swing is large, the angle of swing can be large. Accordingly, since a gap between the photoreceptor drum (processing cartridge) and the driving shaft of the apparatus main body can be small, it is possible to reduce the size of the apparatus main body.

In addition, according to the end member 250, it is not necessary to provide a groove (inlet groove) for introducing the rotating force transmission pin described in the above-described Patent Document 1 to the swing groove, it is possible to solve a problem in which a shaft member unexpectedly falls out during the operation.

The shaft member 61 rotates (swings), transmits the rotating force, and is held in the bearing member 251, by the above-described structure.

After the end member 250 is assembled as illustrated in FIGS. 26A and 26B, the attachment of the end member 250 to the photoreceptor drum 11 is performed as the end portion on the side on which the shaft member 61 does not protrude in the end member 250 is inserted into the photoreceptor drum 11. By the end member 250, the rotating force is appropriately given to the photoreceptor drum 11 when mounting the processing cartridge 3 onto the apparatus main body 2, and it is possible to easily attach and detach the processing cartridge 3.

Next, a fourth aspect will be described. In the fourth aspect, since many parts are common to those in the third aspect, here, the description will focus on a part different from that in the third aspect, and the part common to those in the third aspect will be given the same reference numerals.

Figure 28:
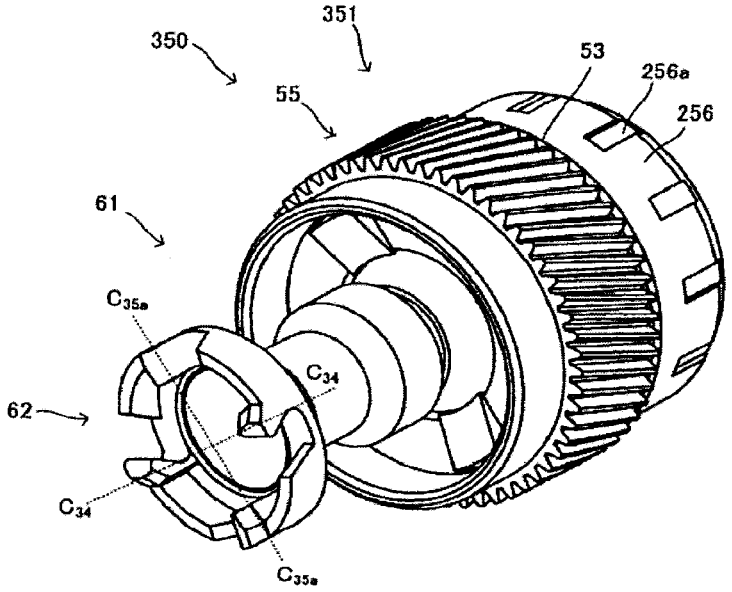
FIG. 28 is a perspective view of an end member 350.

FIG. 28 is a view illustrating the fourth aspect, and is a perspective view of an end member 350. The end member 350 is provided with a bearing member 351 and the shaft member 61. The shaft member 61 is the same as that described above.

Figure 29:
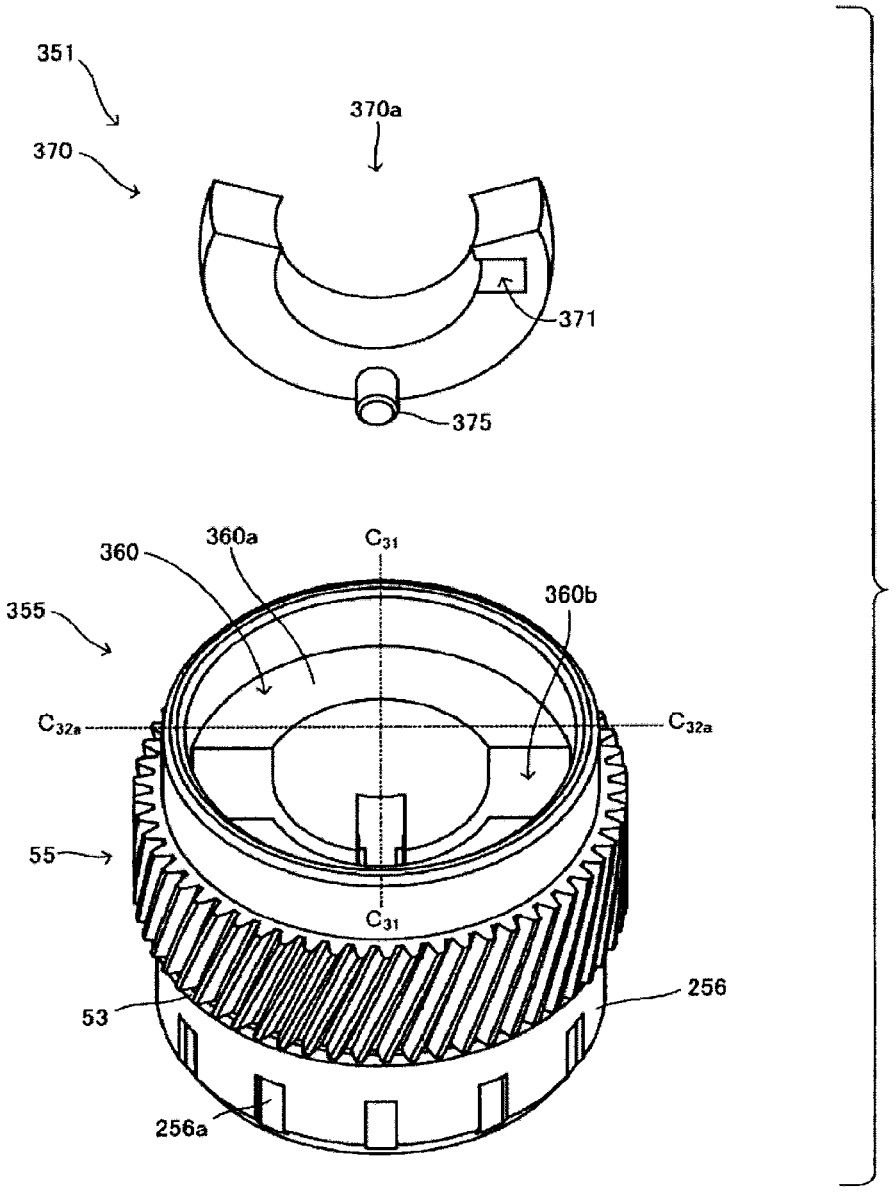
FIG. 29 is an exploded perspective view of a bearing member 351.

The bearing member 351 is a member which is fixed to the end portion of the photoreceptor drum 11. FIG. 29 is an exploded perspective view of the bearing member 351. As can be ascertained from FIG. 15, the bearing member 351 is provided with a main body 355 and an intermediate member 370. Hereinafter, each of the members will be described.

Figure 30A:
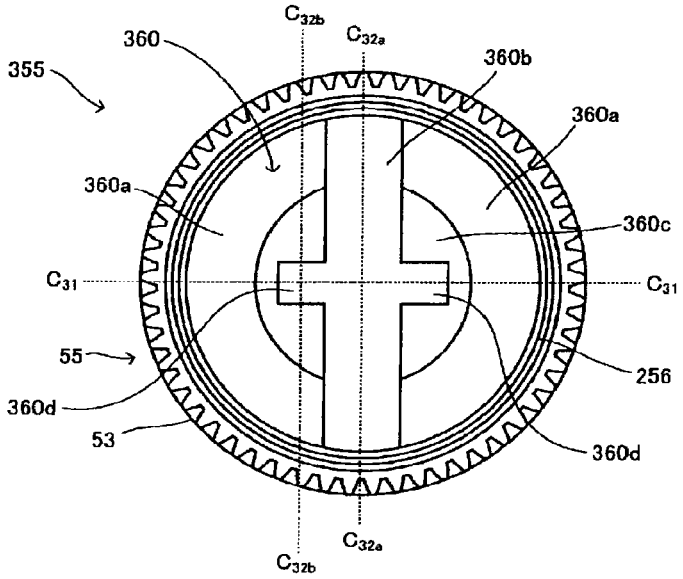
FIG. 30A is a plan view of a main body 355 of the bearing member 351.
Figure 30B:
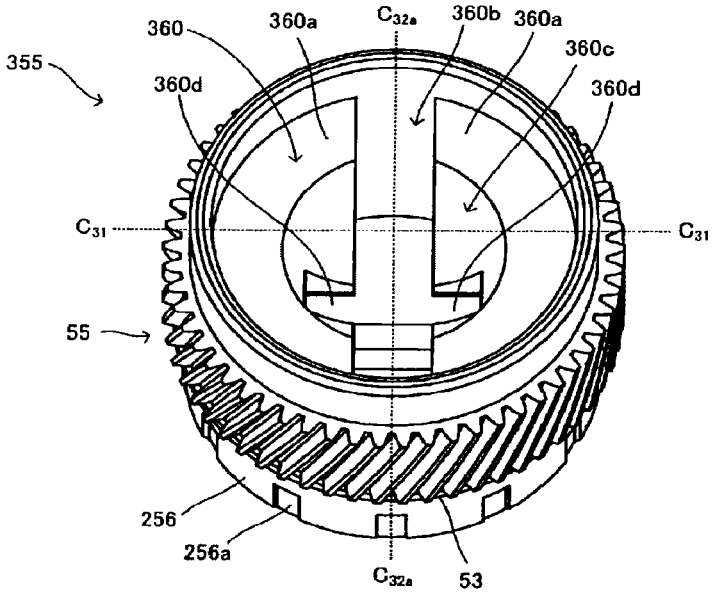
FIG. 30B is a perspective view of the main body 355 of the bearing member 351.
Figure 31:
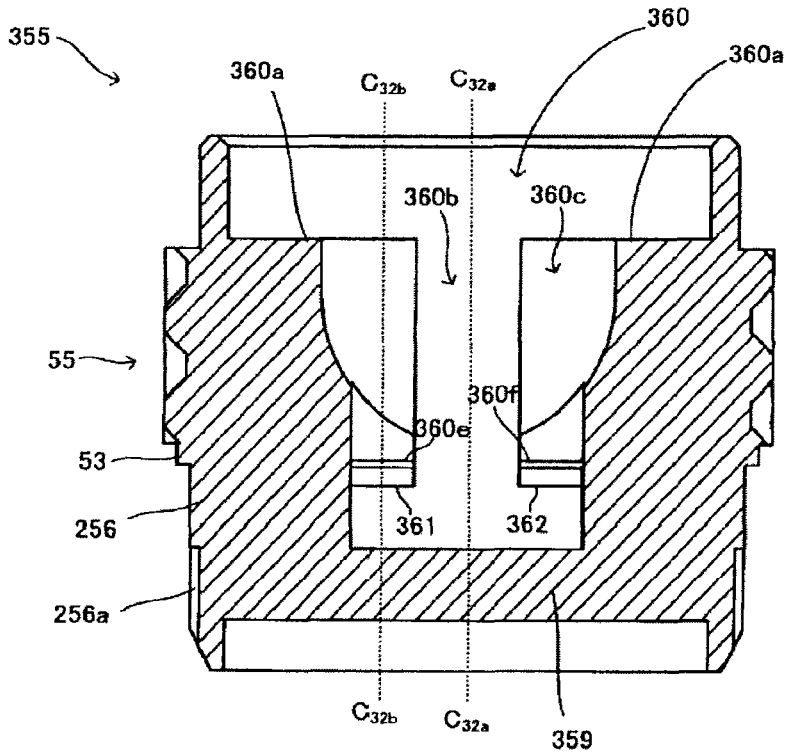
FIG. 31 is a sectional view of the main body 355 of the bearing member 351.
Figure 32A:
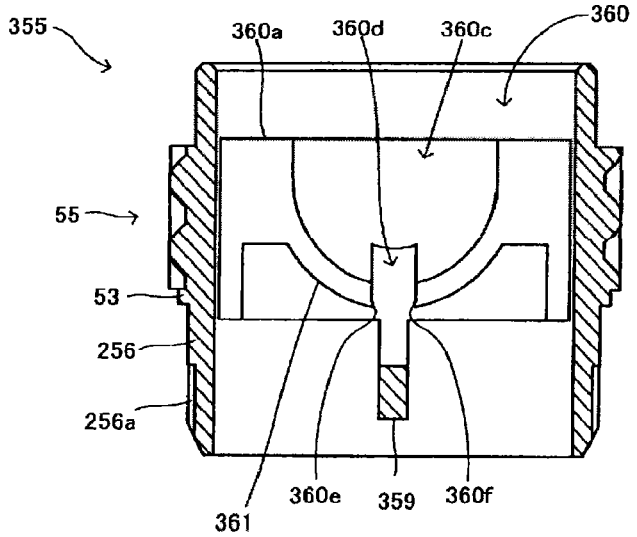
FIG. 32A is another sectional view of the main body 355 of the bearing member 351.
Figure 32B:
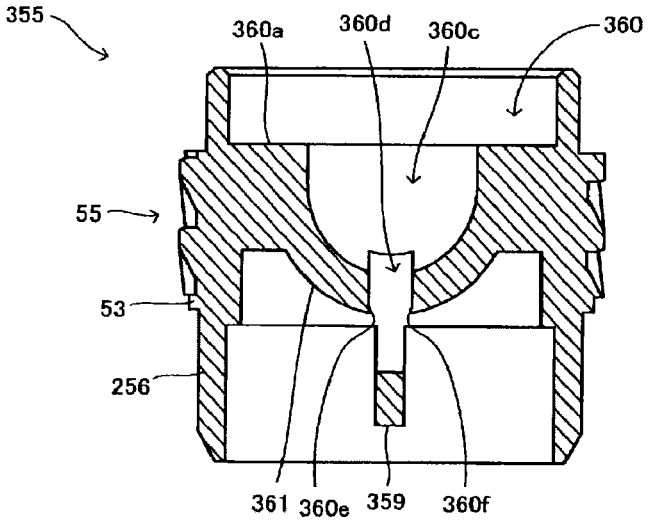
FIG. 32B is still another sectional view of the main body 355 of the bearing member 351.

FIG. 30A is a view (plan view) when the main body 355 is viewed from a side on which the intermediate member 370 is inserted. FIG. 30B is a perspective view when the main body 355 is viewed from an angle different from FIG. 29. In addition, FIG. 31 is a sectional view along the axis including a line illustrated by $C_{31}$-$C_{31}$ in FIGS. 29, 30A, and 30B. Furthermore, FIG. 32A is a sectional view along the axis including a line illustrated by $C_{32a}$-$C_{32a}$ in FIGS. 32, 30A, 30B, and 31. In addition, FIG. 32B is a sectional view along the axial direction including a line illustrated by $C_{32b}$-$C_{32b}$ in FIGS. 30A and 31.

In the aspect, as can be ascertained from FIGS. 28 to 32, the main body 355 is different from the above-described main body 255 in the aspect of a bottom portion 359 and the holding portion. Other than this, since the tubular body 256, a contact wall, and the gear portion 55, are the same as the description of the main body 255, here, the description thereof will be omitted here.

On the tubular inner side of the tubular body 256, the bottom portion 359 which extends in a shape of a rod in the diameter direction of the tubular body 256 is provided to block at least a part of the inside of the tubular body 256. Furthermore, a holding portion 360 is provided on the inner side opposite to the side which is fixed to the photoreceptor drum 11 nipping the bottom portion 359 on the inner side of the tubular body 256.

The holding portion 360 forms guide surfaces 361 and 362 which serve as intermediate member guides on the inner side of the tubular body 256. Therefore, in the holding portion 360, two protrusion portions 360*a* are disposed to face each other to protrude toward the axis of the tubular body 256 from the inner surface of the tubular body 256, and a groove 360*b* is formed between the two protrusion portions 360*a*.

An aspect of the holding portion 360 will be described in more detail.

As can be ascertained from FIGS. 30A and 30B, two protrusion portions 360*a* are disposed to face each other, and the groove 360*b* is made as a void is formed therebetween. In addition, in the protrusion portion 360*a*, a recessed portion 360*c* is formed to be hollowed out to a part of a sphere which has the center on the axis of the tubular body 256 in the protrusion portion 360*a*. A spherical surface of the recessed portion 360*c* has a shape which can receive the spherical body portion 64 of the shaft member 61. However, the recessed portion 360*c* is not necessarily a spherical surface.

Furthermore, on the bottom of the recessed portion 360*c*, a guide member insertion groove 360*d* which extends in the diameter direction orthogonal to the diameter direction of the extending tubular body 256 in which the groove 360*b* extends, is formed. A guide member insertion groove 360*d* is an aspect in which insertion of the guide member 375 of the intermediate member 370 which will be described later is possible.

In addition, as can be ascertained from FIGS. 31 and 32B, a surface is also formed on a side (that is, a side opposing the bottom portion 359 of the holding portion 360) opposite to the recessed portion 360*c* of the protrusion portion 360*a*, and the surface has a shape of an arc as can be ascertained from FIG. 18B. This surface becomes the guide surfaces 361 and 362. The guide surfaces 361 and 362 have a curved surface which is formed to be curved along the direction in which the groove 360*b* extends. The shaft member 61 swings as the guide member 375 of the intermediate member 370 slides on the guide surfaces 361 and 362. The swing will be described later.

Therefore, the guide member insertion groove 360*d* which is formed on the bottom portion of the recessed portion 360*c*, is a groove which communicates with the recessed portion 360*c* and a rear surface (a surface on which the guide surfaces 361 and 362 are present) of the holding portion 360, and makes the guide member 375 reach the guide surfaces 361 and 362.

It is preferable that the holding portion 360 which has such a shape is formed as follows.

The groove width of the groove 360*b* is not particularly limited, but it is preferable that the groove width is substantially the same as the thickness of the intermediate member 370. Accordingly, rattling of the shaft member 61 can be suppressed.

An inner surface shape of the recessed portion 360*c* is not particularly limited if the shape can receive the base end portion of the shaft member 61, but when the base end portion of the shaft member 61 is the spherical body portion 64, it is preferable that the curved surface having the same radius as that of the spherical body portion 64 is provided. Accordingly, it is also possible to prevent rattling of the shaft member 61.

It is preferable that the guide member 375 of the intermediate member 370 can be inserted into the guide member insertion groove 360*d*, and the guide member insertion groove 360*d* has the snap-fit (interference-fit of an inlet portion) structure with respect to the guide member 375. Accordingly, it is possible to prevent the intermediate member 370 from falling out of the main body 355. As the snap-fit structure, snap-fit structures 360*e* and 360*f* which are pieces that protrude from the side wall of the guide member insertion groove 360*d*, can be employed as an example.

Since the guide surfaces 361 and 362 are surfaces which guide the intermediate member 370 so that the shaft member 61 appropriately swings, and surfaces which determine the swing of the shaft member 61, it is preferable that the guide surfaces 361 and 362 have a shape of an arc in the section illustrated in FIG. 32B from the viewpoint that stabilized swing is obtained. In other words, it is preferable that the guide surfaces 361 and 362 have a shape of an arc around the center of the swing of the shaft member. Accordingly, smooth swing is possible. In addition, in the aspect, the arc of the recessed portion 360*c* is also an arc concentrically to the guide surfaces 361 and 362.

A material which configures the main body 355 is similar to that of the above-described main body 255.

Figure 33A:
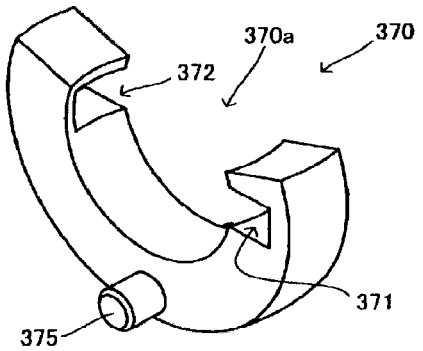
FIG. 33A is a perspective view of an intermediate member 370.
Figure 33B:
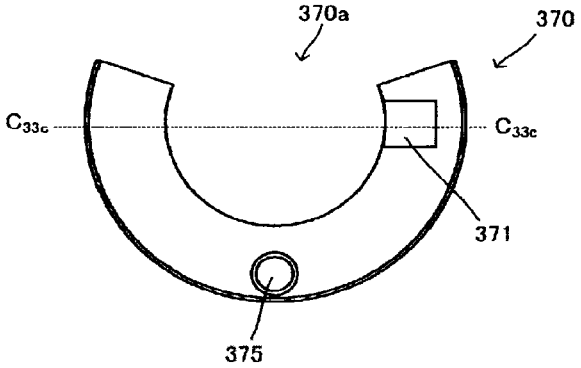
FIG. 33B is a front view of the intermediate member 370.
Figure 33C:
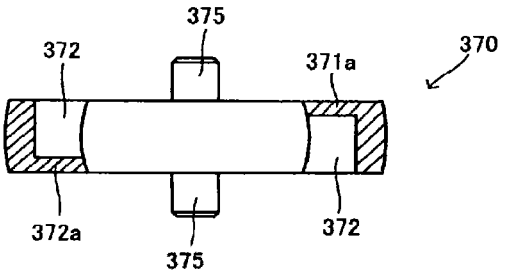
FIG. 33C is a sectional view of the intermediate member 370.

Returning to FIG. 29, the intermediate member 370 will be described. As can be ascertained from FIG. 29, the intermediate member 370 is an annular member of which a part is cut out. FIG. 33 illustrates the intermediate member 370. FIG. 33A is a perspective view, FIG. 33B is a front view, and FIG. 33C is a sectional view along a line illustrated by $C_{33c}$-$C_{33c}$ in FIG. 33B.

The intermediate member 370 has an annular shape in which a cutout 370*a* is provided.

An outer circumferential portion of the intermediate member 370 is disposed in the groove 360*b* provided in the holding portion 360 of the main body 355. Therefore, the outer diameter of the intermediate member 370 is the size by which insertion into the groove 360*b* is possible.

Meanwhile, since the base end portion of the shaft member 61 is disposed on the ring-shaped inner side of the intermediate member 370, the size and an aspect by which the base end portion is accommodated on the inner side of the intermediate member 370, may be employed. In the aspect, since the base end portion of the shaft member 61 is made as the spherical body portion 64, the inner diameter of the intermediate member 370 can be the same as the diameter of the spherical body portion 64. In addition, as can be ascertained from FIG. 33C, in the aspect, the inner circumferential surface of the intermediate member 370 is also curved in a shape of an arc in the direction (vertical direction on the paper surface of FIG. 33C) along the axis of the circle. The curve can match the curve by the diameter of the spherical body portion 64. Accordingly, the intermediate member 370 and the spherical body portion 64 can be more appropriately combined.

In addition, the size (that is, the thickness) in the axial direction of the circle of the intermediate member 370 is substantially the same as the groove width of the groove 360*b* formed in the holding portion 360 of the main body 355. Accordingly, it is possible to prevent rattling.

The cutout 370*a* of the intermediate member 370 has the size and the shape by which at least the rotating shaft 63 of the shaft member 61 can be disposed on the inner side thereof.

In the intermediate member 370, two grooves 371 and 372 which extend to the outside from the annular inner circumferential surface, are provided. The two grooves 371 and 372 are provided opposing each other along the diameter of the intermediate member 370. Each of both ends of the rotating force transmission pin 65 of the shaft member 61 is inserted into the grooves 371 and 372. Therefore, the shape and the disposition of the grooves 371 and 372 are configured so that both end portions of the rotating force transmission pin 65 are respectively inserted into the grooves 371 and 372.

In addition, in the grooves 371 and 372, it is preferable that pieces 371*a* and 372*a* remain in one direction along the axis of the circle of the intermediate member 370, and the grooves 371 and 372 do not pass through in the direction along the axis. Accordingly, when the shaft member 61 is combined with the intermediate member 370, and the rotating force is given to the shaft member 61 from the apparatus main body 2, the rotating force transmission pin 65 is hooked to the pieces 371*a* and 372*a*, and the rotating force can be appropriately transmitted to the intermediate member 370. Therefore, in consideration of rotation of the rotating force transmission pin 65, as can be ascertained from FIGS. 33A to 33C, the piece 371*a* of the groove 371 and the piece 372*a* of the groove 372 are provided on different sides in the axial direction of the intermediate member 370.

In addition, if the tip end of the rotating force transmission pin 65 extends until reaching the inside of the groove 360*b* of the holding portion 360 of the main body 355, since the tip end of the rotating force transmission pin 65 is hooked to the side wall of the groove 360*b* during the rotation, the rotating force can be transmitted, and thus, at this time, it is not necessary to provide the pieces 371*a* and 372*a*.

In addition, opening portions which oppose the pieces 371*a* and 372*a* in the grooves 371 and 372 may be slightly narrowed compared to the grooves. Specifically, the opening portion can be an opening which is slightly smaller than the diameter of the rotating force transmission pin 65. Accordingly, the rotating force transmission pin 65 which is inserted into the grooves 371 and 372 is unlikely to be fall out of the grooves 371 and 372 by the narrowed opening portion.

Furthermore, in the intermediate member 370, the guide member 375 which functions as a guided member from each of the annular front and rear surfaces along the axial direction of the circle, is provided to protrude. In the aspect, the guide member 375 is a columnar pin. A position at which the guide member 375 is disposed is not particularly limited, and as will be described later, when the intermediate member 370 is disposed in the main body 355, the guide member 375 may be disposed at a position of being capable of sliding on the guide surfaces 361 and 362. In addition, the shape of the guide member 375 is also not limited to the columnar shape of the aspect, and may be a shape have rectangular, triangular, or other shapes of the section.

A material which configures the intermediate member 370 is not particularly limited, but a resin, such as polyacetal, polycarbonate, or PPS, can be used. Here, in order to improve the rigidity of the member, the glass fiber or the carbon fiber may be mixed into the resin in accordance with the load torque. In addition, in order to make the swing of the intermediate member 370 smooth when being attached to the main body 355, sliding properties may be improved by containing at least one type of a fluororesin, polyethylene, and silicon rubber in the resin. In addition, the resin may be coated with fluororesin or lubricant.

The bearing member 351 and the shaft member 61 are combined with each other as follows, and become the end member 350. By describing the combination, an aspect in which the bearing member 351 and the shaft member 61 are provided, an aspect of the relationship between the members, and the size of the members, are further understood.

Figure 34:
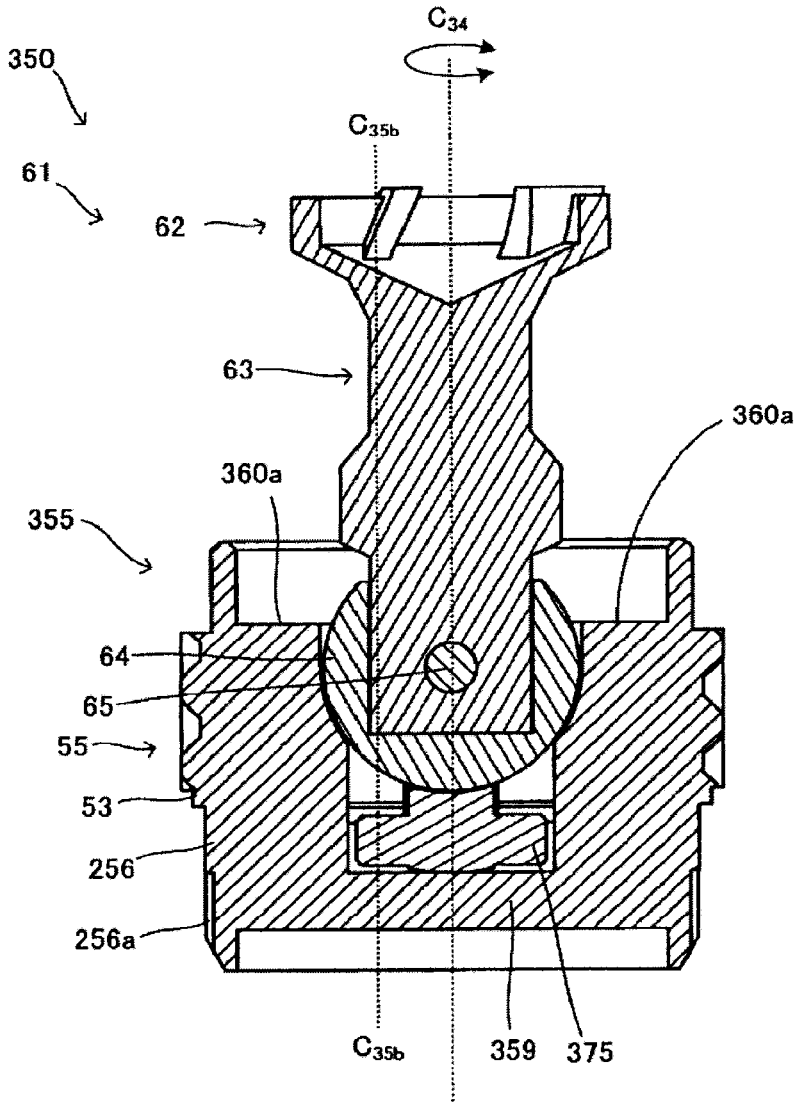
FIG. 34 is one sectional view of the end member 350.
Figure 35A:
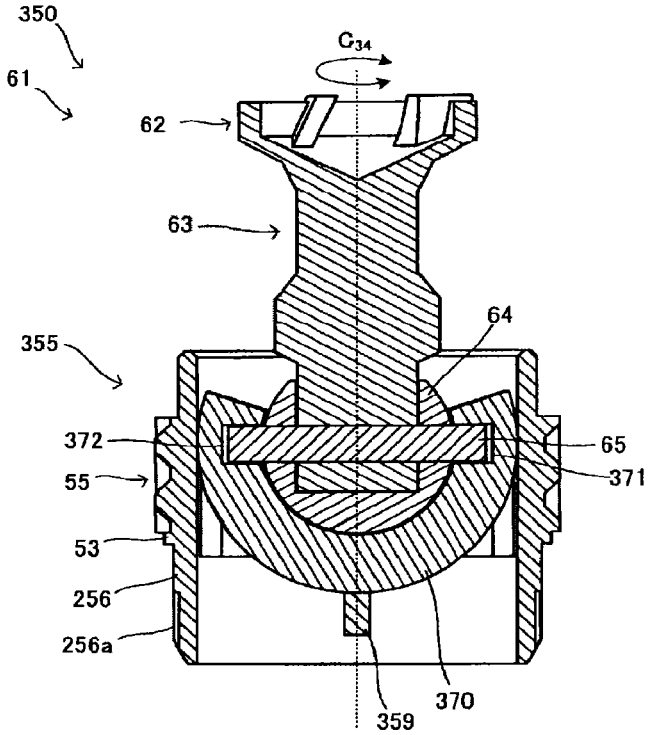
FIG. 35A is another sectional view of the end member 350.
Figure 35B:
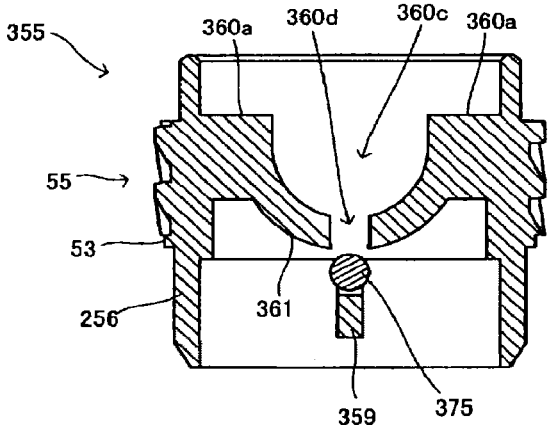
FIG. 35B is still another sectional view of the end member 350.

FIG. 34 is a sectional view of the end member 350 along a line $C_{34}$-$C_{34}$ illustrated in FIG. 28. FIG. 35A is a sectional view of the end member 350 along a line $C_{35a}$-$C_{35a}$ illustrated in FIG. 28. FIG. 35B is a view focusing on the positional relationship of the main body 355 and the guide member 375 provided in the intermediate member 370, on the section of the end member 350 along a line $C_{35b}$-$C_{35b}$ illustrated in FIG. 34. Therefore, the shaft member 61 is omitted in FIG. 35B.

Figure 36:
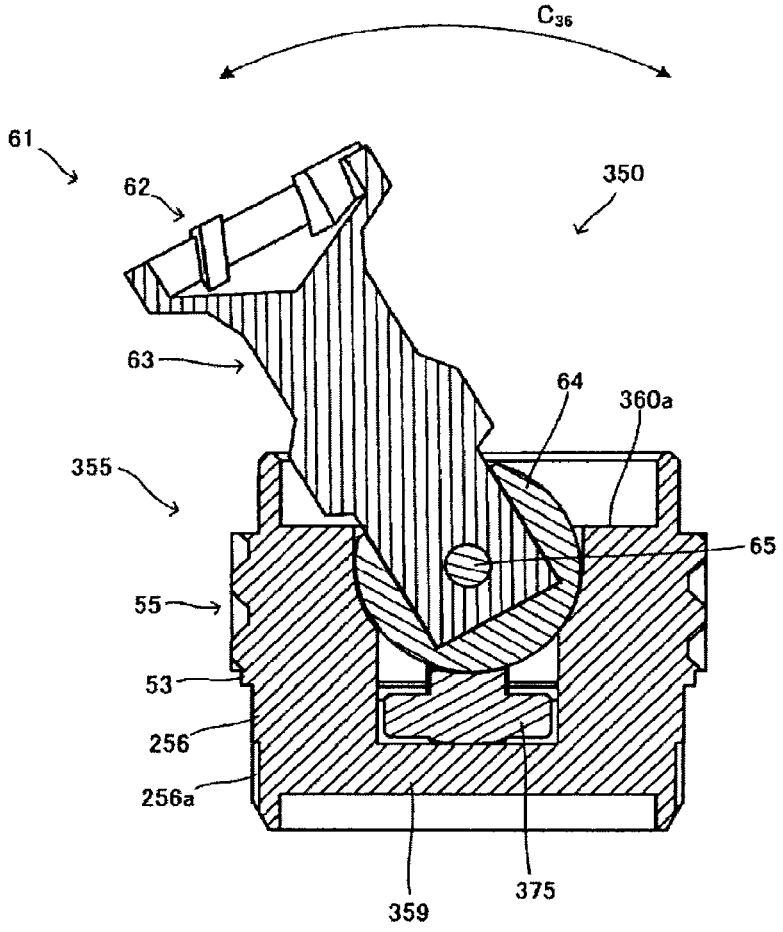
FIG. 36 is a view illustrating an example of the posture in which the shaft member 61 is inclined in one section of the end member 350.
Figure 37A:
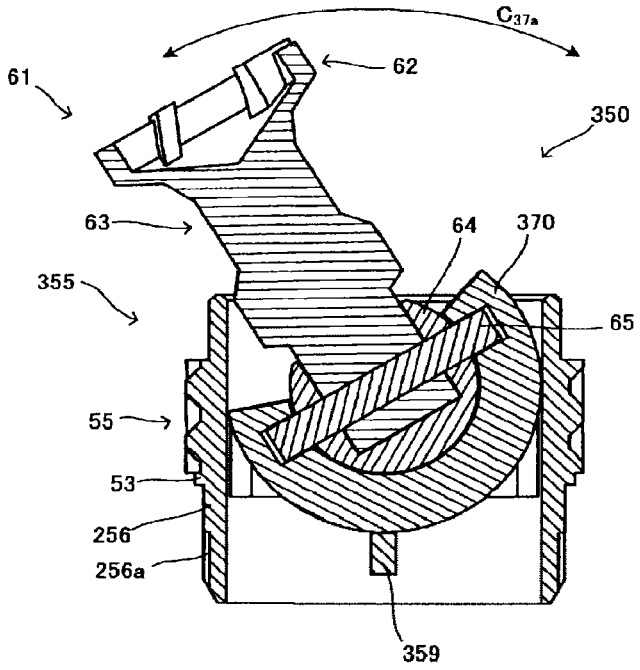
FIG. 37A is a view illustrating an example of the posture in which the shaft member 61 is inclined in another section of the end member 350.
Figure 37B:
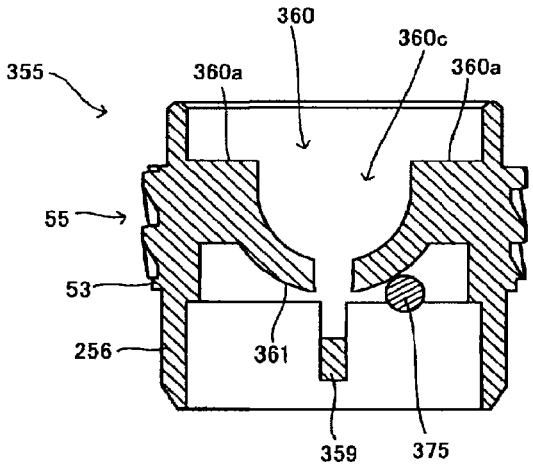
FIG. 37B is a view illustrating an example of the posture in which the shaft member 61 is inclined in still another section of the end member 350.

In addition, FIG. 36 is an example of a posture in which the shaft member 61 is inclined from the viewpoint illustrated in FIG. 34. FIG. 37A is an example of a posture in which the shaft member 61 is inclined from the viewpoint illustrated in FIG. 36A. FIG. 37B is an example of a posture in which the shaft member 61 is inclined in the posture illustrated in FIG. 36B.

As can be particularly well ascertained from FIG. 35A, the spherical body portion 64 is disposed on the annular inner side of the intermediate member 370, and the rotating force transmission pin 65 is inserted into the grooves 371 and 372 of the intermediate member 370. Accordingly, the intermediate member 370 and the shaft member 61 are combined with each other. Accordingly, the shaft member 61 can swing with respect to the intermediate member 370 around the axis of the rotating force transmission pin 65 as illustrated by an arrow $C_{36}$ in FIG. 36.

Meanwhile, as can be particularly well from FIGS. 34 and 35B, the guide member 375 of the intermediate member 370 passes through the guide member insertion groove 360*d*, reaches the bottom portion 359 side, and is disposed at a position of being capable of sliding on the guide surfaces 361 and 362. In addition, as will be described later, as the guide member 375 slides on the guide surfaces 361 and 362, the intermediate member 370 is guided, and as a result, the intermediate member 370 can rotate on the inner side of the main body 355 as illustrated by an arrow $C_{37a}$ in FIG. 37A.

In addition, as can be ascertained from FIGS. 34, 35A, and 35B, the intermediate member 370 is disposed in the groove 360*b* so that the thickness direction of the intermediate member 370 becomes the groove width direction of the groove 360*b* formed in the holding portion 360. Therefore, a part of the intermediate member 370 is disposed in the groove 360*b*, and the intermediate member 370 can move to slide in the groove 360*b*.

In this manner, in the end member 350 of the aspect, the intermediate member 370 is held not to fall out of the guide surfaces 361 and 362 formed in the main body 355, and the shaft member 61 is held not to fall out of the intermediate member 370. More specifically, the guide member 375 of the intermediate member 370 is engaged with the guide surfaces 361 and 362 of the main body 355, and the movement of the shaft member 61 in the direction of falling out of the main body 355 is regulated.

In this manner, the shaft member 61 is not directly held in the main body 355. However, the spherical body portion 64 of the shaft member 61 regulates the movement in the direction other than the direction in which the shaft member 61 falls out of the main body 355, by the recessed portion 360*c* formed in the holding portion 360 of the main body 355.

In addition, it is possible to adjust clearance (so-called "looseness") between the shaft member 61 and the main body 355, by the relative positional relationship of the guide surfaces 361 and 362 and the guide member 375, and the dimensional relationship between the spherical body portion 64 and the recessed portion 360*c*.

The assembly of the end member 350 can be performed, first, by disposing the shaft member 61 in the intermediate member 370 and by attaching the shaft member 61 to the main body 355. In this case, when the guide member 375 of the intermediate member 370 passes through the guide member insertion groove 360*d*, the assembly is possible by elastically deforming the intermediate member 370 by adding a slight force. Therefore, it is possible to simply assemble the shaft member 61 to the bearing member 351 with high productivity. In addition, since not only the assembly but also the disengagement is similarly easy, the reusing is also easily performed. In particular, at this time, when the shaft member 61 is inserted and separated, since it is not necessary to deform the shaft member 61, a concern about damage or the like is relieved. In addition, since the separation is easy, it is possible to improve workability.

In this manner, as the shaft member 61 is disposed on the inner side of the bearing member 351, the shaft member 61 can swing as illustrated in FIGS. 36, 37A, and 37B. In other words, in the viewpoint illustrated in FIG. 36, the shaft member 61 can swing around the axis of the rotating force transmission pin 65 as illustrated by an arrow $C_{36}$. Meanwhile, in the viewpoint illustrated in FIG. 37A, the shaft member 61 can swing in accordance with the rotation of the intermediate member 370 as illustrated by an arrow $C_{37a}$. At this time, the guide member 375 slides on the guide surfaces 361 and 362 as illustrated in FIG. 37B, the rotation of the intermediate member 370 is guided, and based on this, the shaft member 61 can swing.

The swing illustrated in FIG. 36 and the swing illustrated in FIG. 37A are swings in the direction orthogonal to each other.

In addition, when the driving force from the apparatus main body 2 is received, the shaft member 61 receives the rotating force around the axis as illustrated by an arrow $C_{34}$ in FIGS. 34 and 35A. At this time, both end portions of a rotating force transmission pin 65 of the shaft member 61 presses the pieces 371*a* and 372*a* (refer to FIG. 33B) of the intermediate member 370, the intermediate member 370 is hooked to the side wall of the groove 360*b* of the main body 355, and the rotating force can be transmitted to the photoreceptor drum 11.

In addition, when the tip end of the rotating force transmission pin 65 is configured to reach the inside of the groove 360*b* of the holding portion 360 of the main body 355, even in a case where the pieces 371*a* and 372*a* are not disposed, since the tip end of the rotating force transmission pin 65 is hooked to the side wall of the groove 360*b* during the rotation, at this time, the rotating force can be transmitted without pressing the intermediate member 370.

In this manner, the effects similar to those of the above-described end member 250 are also achieved by the end member 350.

The shaft member 61 rotates (swings), transmits the rotating force, and is held in the bearing member 351, by the above-described structure. After the end member 350 is assembled, the attachment of the end member 350 to the photoreceptor drum 11 is performed as the end portion on the side on which the shaft member 61 does not protrude in the end member 350 is inserted into the photoreceptor drum 11. By the end member 350, the rotating force is appropriately given to the photoreceptor drum 11 when mounting the processing cartridge 3, and it is possible to easily attach and detach the processing cartridge 3.

Figure 38A:
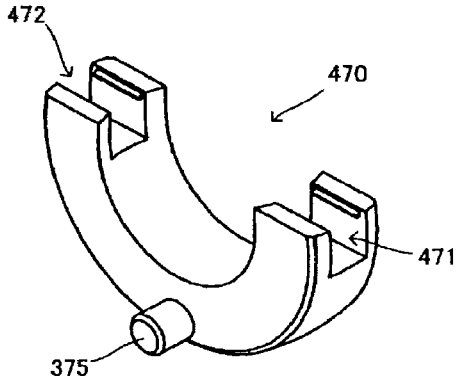
FIG. 38A is a perspective view of an intermediate member 470.

Next, a fifth aspect will be described. FIG. 38 is a view illustrating the fifth aspect, and is a view illustrating an intermediate member 470. FIG. 38A is a perspective view, FIG. 38B is a front view, and FIG. 38C is a plan view.

In the aspect, an aspect of a part at which the rotating force transmission pin 65 of the shaft member 61 is engaged in the intermediate member 470 is different from the intermediate member 370. Other parts are the same as those in the above-described end member 350, here, the intermediate member 470 will be described.

Figure 38B:
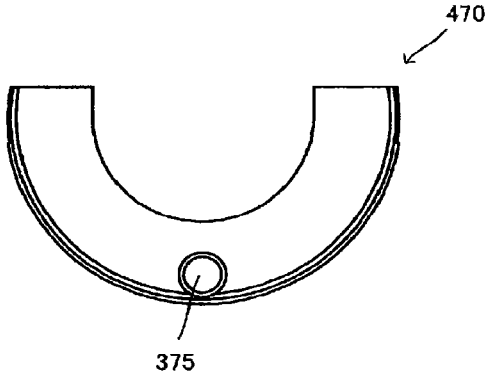
FIG. 38B is a front view of the intermediate member 470.
Figure 38C:
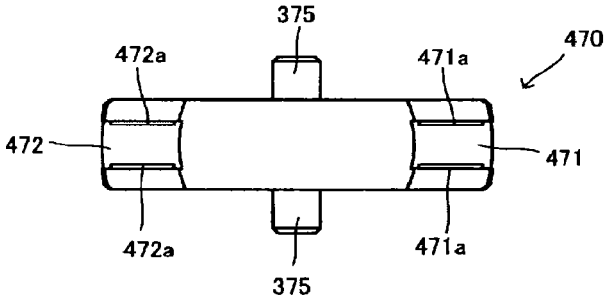
FIG. 38C is a plan view of the intermediate member 470.

As illustrated in FIG. 38B, the intermediate member 470 is formed in a half annular shape in a front view, and grooves 471 and 472 which extend in the diameter direction are provided on the end surface thereof. The groove width of the grooves 471 and 472 is substantially the same as the diameter of the rotating force transmission pin 65. In addition, in the grooves 471 and 472, snap-fit (interference-fit of the inlet portion) structures 471*a* and 262*a* are formed on the end surface side of the intermediate member 470. Accordingly, the rotating force transmission pin 95 of the shaft member 61 is engaged with the grooves 471 and 472 without falling out. FIG. 39 is a view illustrating this.

Figure 39A:
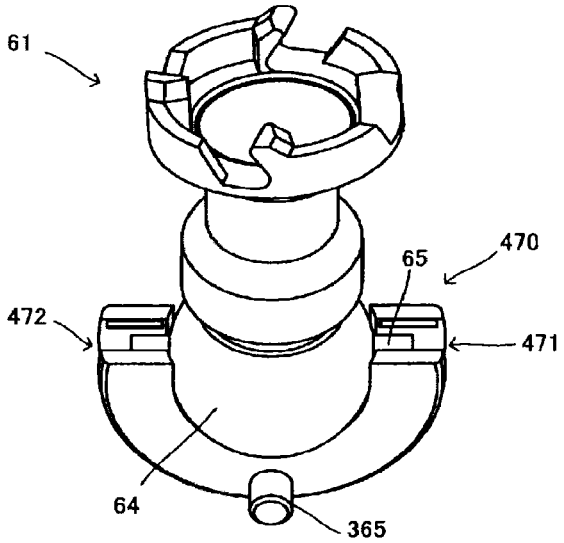
FIG. 39A is a perspective view of a posture in which the shaft member 61 is attached to the intermediate member 470.
Figure 39B:
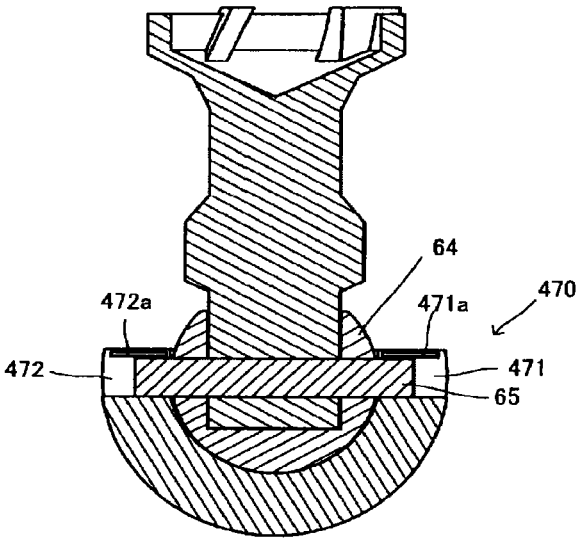
FIG. 39B is a sectional view of the posture in which the shaft member 61 is attached to the intermediate member 470.

FIG. 39A is a perspective view of a posture in which the shaft member 61 is engaged with the intermediate member 470. FIG. 39B is a sectional view along the axis of FIG. 39A. As can be ascertained from FIGS. 39A and 39B, at least a part of both end portions of the rotating force transmission pin 65 is disposed on the inner side of the grooves 471 and 472. In addition, the rotating force transmission pin 65 is configured not to fall out of the grooves 471 and 472, by the snap-fit structures 471*a* and 472*a*.

According to the intermediate member 470, it is possible to easily attach the shaft member 61 to the intermediate member 470. Accordingly, for example, when assembling the photoreceptor drum unit, the bearing member which has already mounted the intermediate member 470 on the main body is fixed to the tip portion of the photoreceptor drum 11 in advance, and then, the shaft member 61 can be mounted on the intermediate member 470 of the bearing member. According to the assembly, it is possible to finally independently attach the shaft member 61 which unstably swings, and to improve the ease of the assembly.

In addition, by adjusting the extent of a force which is required for taking out (releasing the engagement) the rotating force transmission pin 95 and a guide member 275 in the snap-fit structures 471*a* and 472*a* which regulate the falling (releasing the engagement) of the rotating force transmission pin 65, and in the snap-fit structures 360*e* and 360*f* of the guide member insertion groove 360*d* which regulates the falling (releasing the engagement) of the guide member 375, it is possible to make the intermediate member 470 remain on the main body side when taking out the shaft member 61, and to remove the intermediate member 470 from the main body together with the shaft member 61. For example, in a case where the main body 355 and the intermediate member 470 are combined and reused, when an interference-fit state of the snap-fit structures 471*a* and 472*a* is relatively weaker compared to the interference-fit of the snap-fit structures 360*e* and 360*f* of the guide member insertion groove 360*d*, since the intermediate member 470 is left behind in the main body 355, it is not necessary to separately manage the intermediate member 470 and the main body 355, and workability is improved as the reuse becomes easier. On the contrary, when only the main body 355 or only the intermediate member 470 is reused, since the number of processes of separating the intermediate member and the main body is reduced later when the intermediate member 470 is not left behind in the main body 355, the interference-fit state of the snap-fit structures 471*a* and 472*a* may be relatively stronger compared to the interference-fit of the snap-fit structures 360*e* and 360*f* of the guide member insertion groove 360*d*, and workability is improved.

Next, a sixth aspect will be described. In the sixth aspect, since an aspect of a main body 555 is different from the aspect of the above-described main body 355, and other parts are considered similar, here, the main body 355 will be described. In addition, members or parts which can be considered similar to those described above will be given the same reference numerals, and the description thereof will be omitted.

Figure 40A:
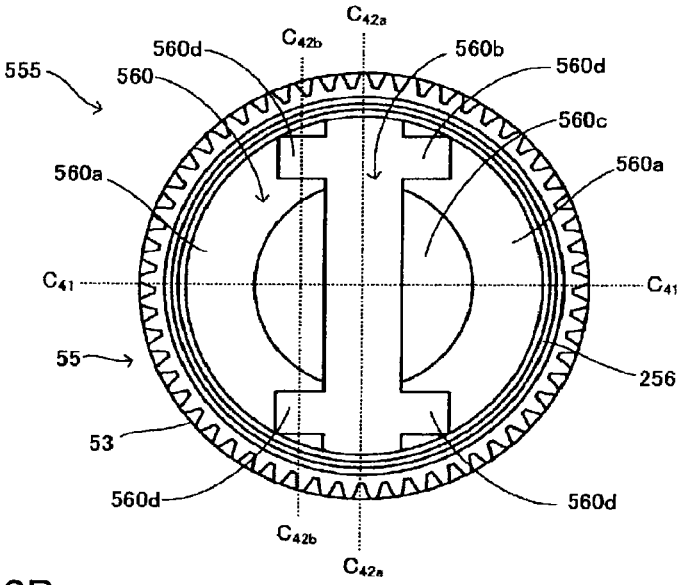
FIG. 40A is a plan view of a main body 555 of a bearing member 551.
Figure 40B:
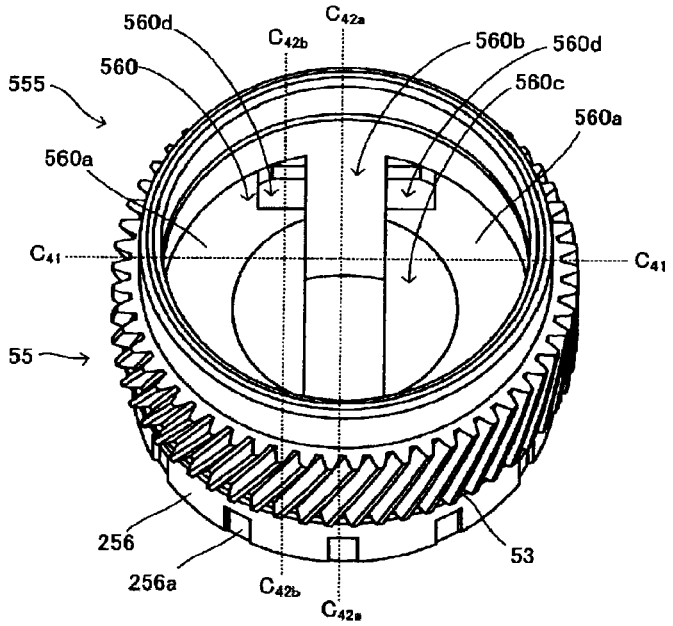
FIG. 40B is a perspective view of the main body 555 of the bearing member 551.
Figure 41:
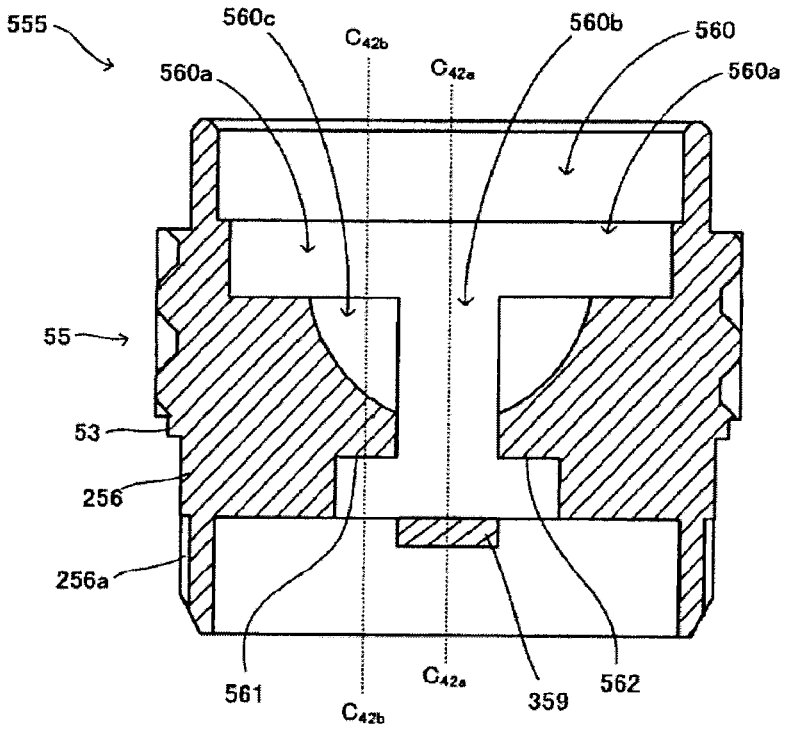
FIG. 41 is a sectional view of the main body 555 of the bearing member 551.
Figure 42A:
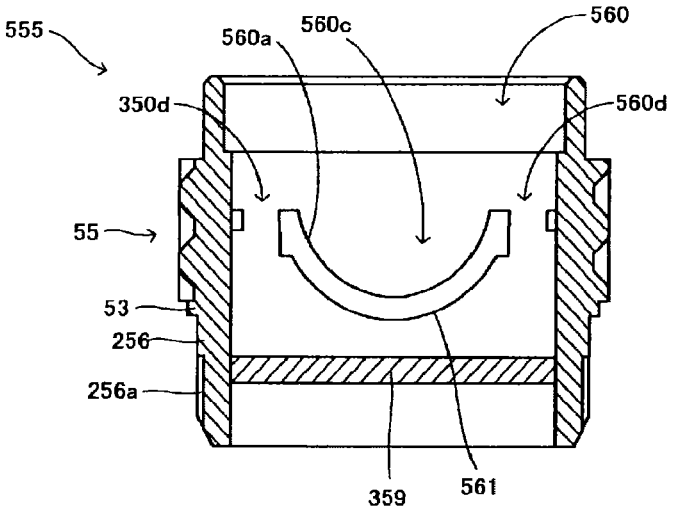
FIG. 42A is another sectional view of the main body 555 of the bearing member 551.
Figure 42B:
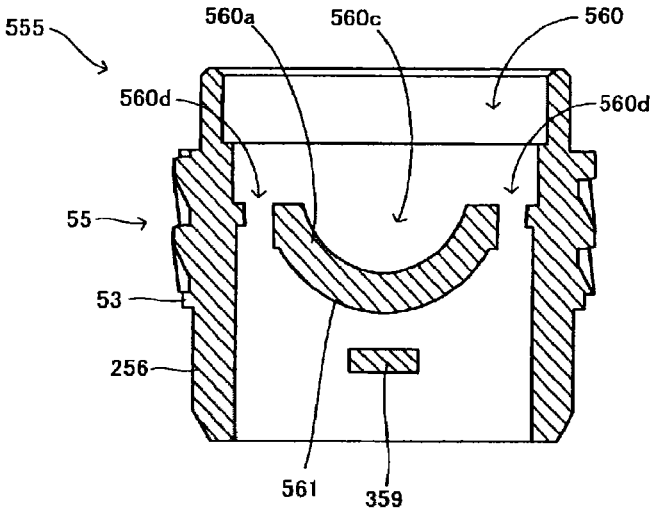
FIG. 42B is still another sectional view of the main body 555 of the bearing member 551.

FIG. 40A is a plan view when the main body 555 is viewed from a side on which the intermediate member 370 is inserted. FIG. 40B is a perspective view of the main body 555. In addition, FIG. 41 is a sectional view along the axis including a line illustrated by $C_{41}$-$C_{41}$ in FIGS. 40A and 40B. Furthermore, FIG. 42A is a sectional view along the axial direction including a line illustrated by $C_{42a}$-$C_{42a}$ in FIGS. 40A, 40B, and 41. In addition, FIG. 42B is a sectional view along the axial direction including a line illustrated by $C_{42b}$-$C_{42b}$ in FIGS. 40A, 40B, and 41.

On the tubular inner side of the tubular body 256, the bottom portion 359 which extends in a shape of a rod in the diameter direction of the tubular body 256 is provided to block at least a part of the inside of the tubular body 256. Furthermore, a holding portion 560 is provided on the inner side opposite to the side which is fixed to the photoreceptor drum 11 nipping the bottom portion 359 on the inner side of the tubular body 256.

The holding portion 560 forms guide surfaces 561 and 562 which serve as an intermediate member guide on the inner side of the tubular body 256. Therefore, in the holding portion 560, two protrusion portions 560*a* are disposed to face each other to protrude toward the axis of the tubular body 256 from the inner surface of the tubular body 256, and a groove 560*b* is formed between the two protrusion portions 560*a*.

An aspect of the holding portion 560 will be described in more detail.

As can be ascertained from FIGS. 40A and 40B, two protrusion portions 560*a* are disposed to face each other, and the groove 560*b* is made as a void is formed therebetween. In addition, in the protrusion portion 560*a*, a recessed portion 560*c* is formed to be hollowed out to a part of a sphere which has the center on the axis of the tubular body 256 in the protrusion portion 560*a*. A part of a spherical surface of the recessed portion 560*c* has a shape which can receive the spherical body portion 64 of the shaft member 61. However, the recessed portion 560*c* is not necessarily a part of a spherical surface.

In addition, on a surface opposite to the recessed portion 560*c* in the protrusion portion 560*a*, the guide surfaces 561 and 562 are formed.

Furthermore, on an end surface of the protrusion portion 560*a* in the holding portion 560, a guide member insertion groove 560*d* is provided between the tubular body 256 and the recessed portion 560*c*. The guide member insertion groove 560*d* is provided to communicate with the recessed portion 560*c* side and the guide surfaces 561 and 562 sides, and further, one end thereof is opened through the groove 560*b*. The size and the shape of the guide member insertion groove 560*d* are formed to be capable of inserting the guide member 375 of the intermediate member 370.

In the aspect, the guide member insertion grooves 560*d* are respectively provided on one side and on the other side of the groove 560*b*. However, the guide member insertion grooves 560*d* may not be necessarily provided on both sides, and may be provided only on any one side. The guide member insertion groove 360*d* is formed on the bottom of the recessed portion 360*c* in the above-described main body 355, but in the aspect, the guide member insertion groove 560*d* is provided in the end portion of the groove 560*b* in this manner. Accordingly, it is possible to eliminate the influence of a guide member insertion groove 350*d* on the movement of the intermediate member 370. In other words, when the guide member 375 of the intermediate member 370 moves along the guide surfaces 561 and 562 (refer to FIG. 41) of the holding portion 560 as will be described later, the guide member 375 smoothly moves since the guide member 375 is not hooked to the guide member insertion groove 560*d*. In addition, it is possible to prevent the shaft member 61 from unintentionally falling out even when unintentionally pulling the shaft member 61.

In addition, from the viewpoint of manufacturing the end member by disposing a mold, or the like, it is possible to provide a groove which communicates with any of the protrusion portions 560*a* in the axial direction (not illustrated). At this time, as the groove is formed to be narrower than a guide member 165, the smooth swing of the shaft member 61 is maintained.

As described above, a surface is formed on a side opposite to the recessed portion 560*c* of the protrusion portion 560*a* (that is, a side opposing the bottom portion 359 of the holding portion 560), and the surface has a shape of an arc as can be ascertained from FIG. 42B. This becomes the guide surfaces 561 and 562. The guide surfaces 561 and 562 have a curved surface which is formed to be curved along the direction in which the groove 560*b* extends. As the guide member 375 of the intermediate member 370 slides on the guide surfaces 561 and 562, the shaft member 61 swings similar to the description above.

Therefore, in the guide member insertion groove 560*d*, the recessed portion 560*c* side of the protrusion portion 560*a* and the rear surface (a surface on which the guide surfaces 561 and 562 are present) of the holding portion 560 communicate with each other, and the guide member 375 reaches the guide surfaces 561 and 562.

It is preferable that the holding portion 560 having such a shape is formed as follows.

The grove width of the groove 560*b* is not particularly limited, but it is preferable that the groove width is substantially the same as the thickness of the intermediate member 370. Accordingly, rattling of the shaft member 61 can be suppressed.

An inner surface shape of the recessed portion 560*c* is not particularly limited if the shape can receive the base end portion of the shaft member 61, but when the base end portion of the shaft member 61 is the spherical body portion 64, it is preferable that the curved surface having the same radius as that of the spherical body portion 64 is provided. Accordingly, it is also possible to prevent rattling of the shaft member 61.

It is preferable that the guide member 375 of the intermediate member 370 can be inserted into the guide member insertion groove 560*d*, and the guide member insertion groove 560*d* has the snap-fit (interference-fit of the inlet portion) structure with respect to the guide member 375.

Since the guide surfaces 561 and 562 are surfaces which determine the swing of the shaft member 61, it is preferable that the guide surfaces 561 and 562 have a shape of an arc in the section illustrated in FIG. 42B from the viewpoint that stabilized swing is obtained. In other words, it is preferable that the guide surfaces 561 and 562 have a shape of an arc around the center of the swing of the shaft member 61. Accordingly, smooth swing is possible. In addition, in the aspect, the arc of the recessed portion 560*c* is also an arc which is included in a concentric circle of a circle including the guide surfaces 561 and 562.

Figure 43:
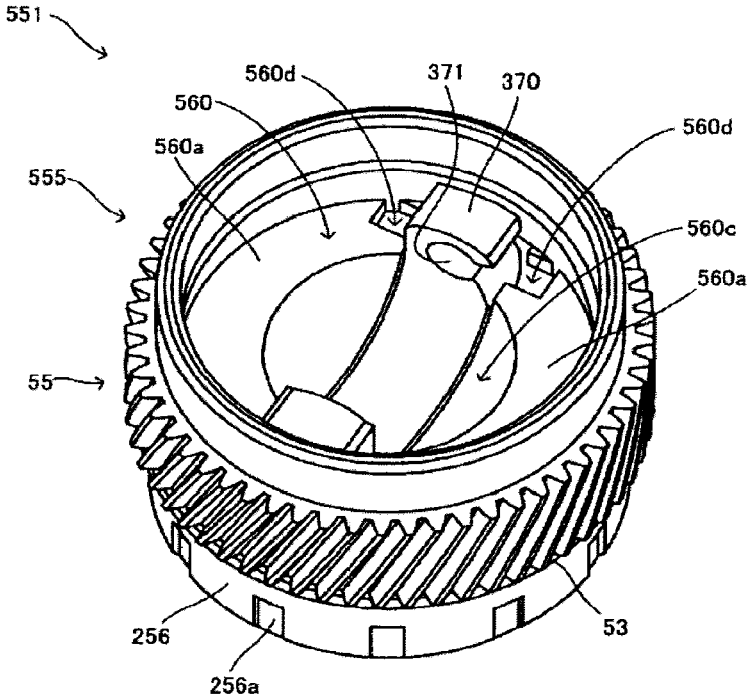
FIG. 43 is a perspective view of the bearing member 551.
Figure 44A:
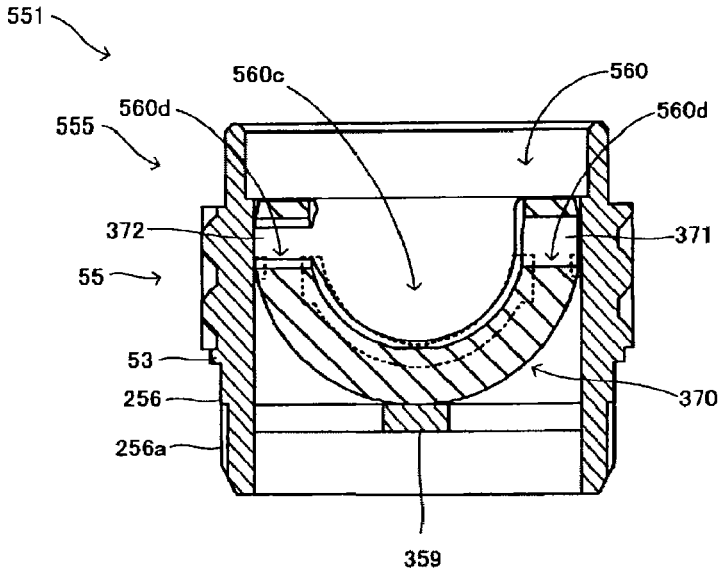
FIG. 44A is a sectional view of the bearing member 551.
Figure 44B:
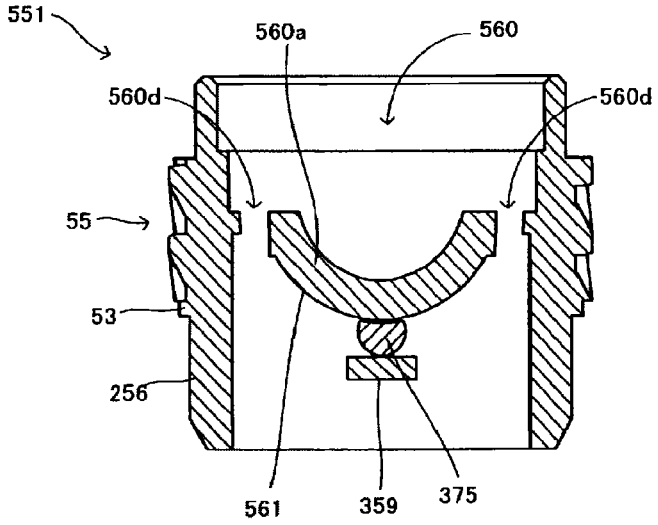
FIG. 44B is another sectional view of the bearing member 551.

FIGS. 43 and 44 illustrate a bearing member 551 which is made by combining the intermediate member 370 with the main body 555. FIG. 43 is a perspective view, FIG. 44A is a view from the same viewpoint of FIG. 42A, and FIG. 44B is a view from the same viewpoint of FIG. 42B. FIG. 43 is a view illustrating a state of the movement of the guide member 375 when the intermediate member 370 is combined with the main body 555.

Figure 45:
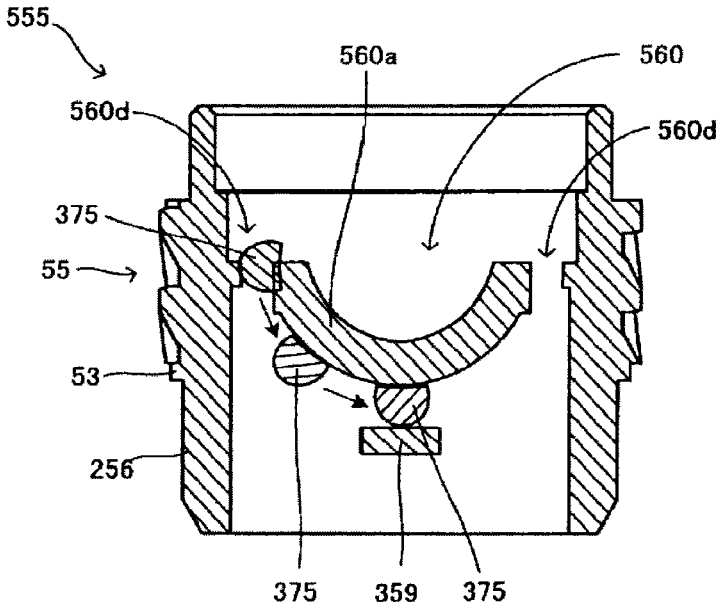
FIG. 45 is a view illustrating a scene where the intermediate member 370 is attached to the main body 555.

As can be ascertained from the drawings, in the bearing member 551, the guide member 375 of the intermediate member 370 passes through the guide member insertion groove 560*d*, reaches the bottom portion 359 side (an order illustrated by a straight line arrow in FIG. 45), and is disposed to be capable of sliding on the guide surfaces 561 and 562. In addition, similar to the above-described bearing member 551, as the guide member 375 slides on the guide surfaces 561 and 562, the intermediate member 370 is guided, and as a result, the intermediate member 370 can rotate on the inner side of the main body 555.

In addition, as can be ascertained from FIG. 43, the intermediate member 370 is disposed in the groove 560*b* so that the thickness direction of the intermediate member 370 becomes the groove width direction of the groove 560*h* formed in the holding portion 560. Therefore, a part of the intermediate member 370 is disposed in the groove 560*b*, and the intermediate member 370 can move to rotate (swing) to slide in the groove 560*b*.

Furthermore, in a bearing member 341 of the aspect, as can be ascertained from FIGS. 43 and 44A, when both ends of the intermediate member 370 have a posture of being aligned in the direction (diameter direction of the main body 555) orthogonal to the axis of the main body 555, the grooves 371 and 372 of the intermediate member 370 has a structure of being protruded and exposed from the protrusion portion 560*a* formed in the holding portion 560 of the main body 555. Therefore, in the aspect, it is possible to attach the shaft member 61 after combining the intermediate member 370 with the main body 555, and to more easily perform the assembly with excellent productivity. In addition, since removing only of the shaft member 61 also becomes easier, the reusing is also easily performed. In particular, at this time, when the shaft member 61 is inserted and separated, since it is not necessary to deform the shaft member 61, a concern about damage or the like is relieved. In addition, since the separation is easy, it is possible to improve workability.

In this manner, the end member is made as the shaft member 61 is combined with the intermediate member 370 of the bearing member 551 of the aspect. In addition, in this end member, the intermediate member 370 is held not to fall out of the guide surfaces 561 and 562 formed in the main body 555, and the shaft member 61 is held not to fall out of the intermediate member 370. Therefore, the shaft member 61 is not directly held in the main body 555. In addition, the end member which is made by combining the shaft member 61 to the bearing member 341 can also act similar to the end member 350.

Figure 46:
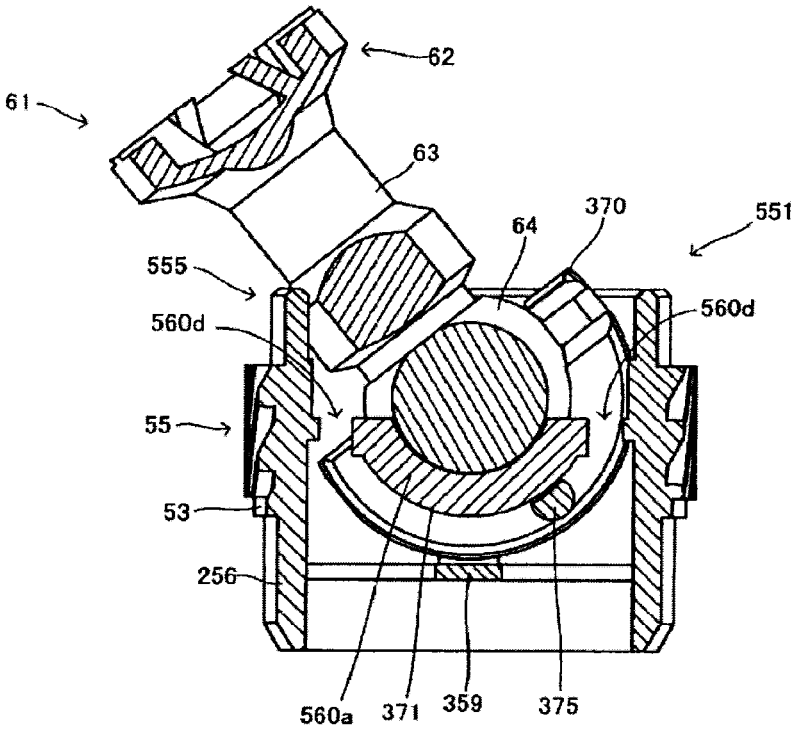
FIG. 46 is a view illustrating an inclination of the shaft member 61 and a position of a guide member 375.

FIG. 46 is a sectional view illustrating a scene where the shaft member 61 is combined with the bearing member 551, and the shaft member 61 is inclined the most. As can be ascertained from FIG. 46, even when the shaft member 61 is inclined, the shaft member 61 does not become more inclined than this, since the rotating shaft 63 of the shaft member 61 comes into contact with the main body 555 of the bearing member 551 before the guide member 375 reaches the guide member insertion groove 560*d*. Therefore, there is not a concern that the intermediate member 370 falls out of the main body 555. In addition, even when pulling the shaft member 61, or the like, since the guide member 375 does not reach the guide member insertion groove 560*d*, unintentional disengagement also does not occur.

In addition, when the guide member 375 of the intermediate member 370 moves along the guide surfaces 561 and 562 within the range of the swing of the shaft member 61, the guide member 375 smoothly moves since the guide member 375 is not hooked to the guide member insertion groove 560*d*.

Figure 47A:
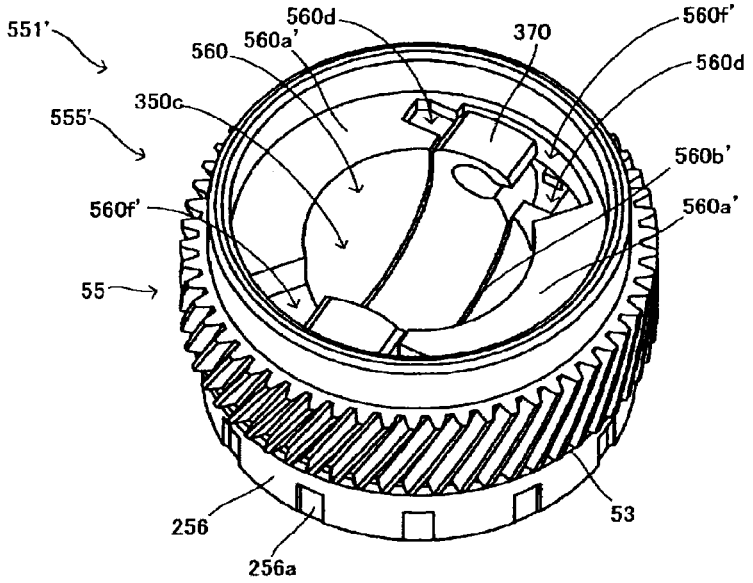
FIG. 47A is a perspective view of a bearing member 551'.
Figure 47B:
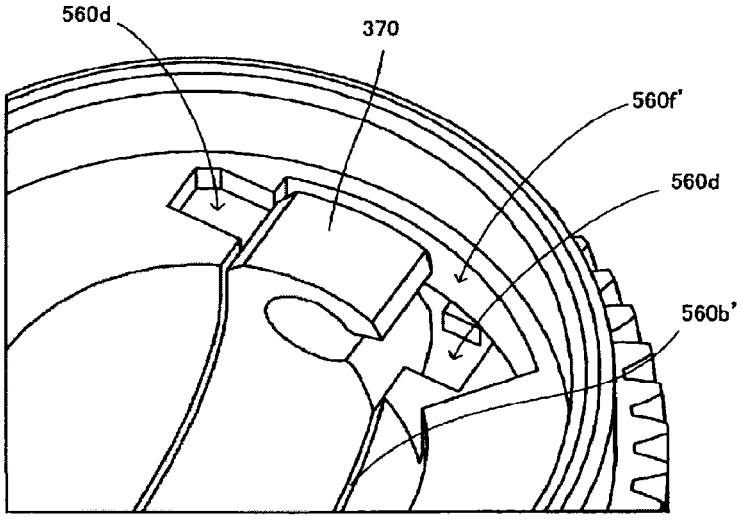
FIG. 47B is an enlarged perspective view illustrating a part of the bearing member 551'.

FIG. 47 is a view illustrating a bearing member 551' which includes a main body 555' according to a modification example of the main body 555. FIG. 47A is a perspective view of a bearing member 341'. FIG. 47B is an enlarged view illustrating a part of FIG. 47A. In the example, in a posture in which both ends of the intermediate member 370 are aligned in the direction (diameter direction of the main body 555') orthogonal to the axis of the main body 555', a protrusion portion 560*a'* extends in the direction along the axis to be hidden in a groove 560*b'* to the end portion of the intermediate member 370. However, a part of the protrusion portion 560*a'* is cut out, a space 560*f'* is formed, and the shaft member 61 passes through the grooves 371 and 372 of the intermediate member 370 from a space 350*f'*, so that the shaft member 61 can be engaged with the grooves 371 and 372 of the intermediate member 370.

Figure 48:
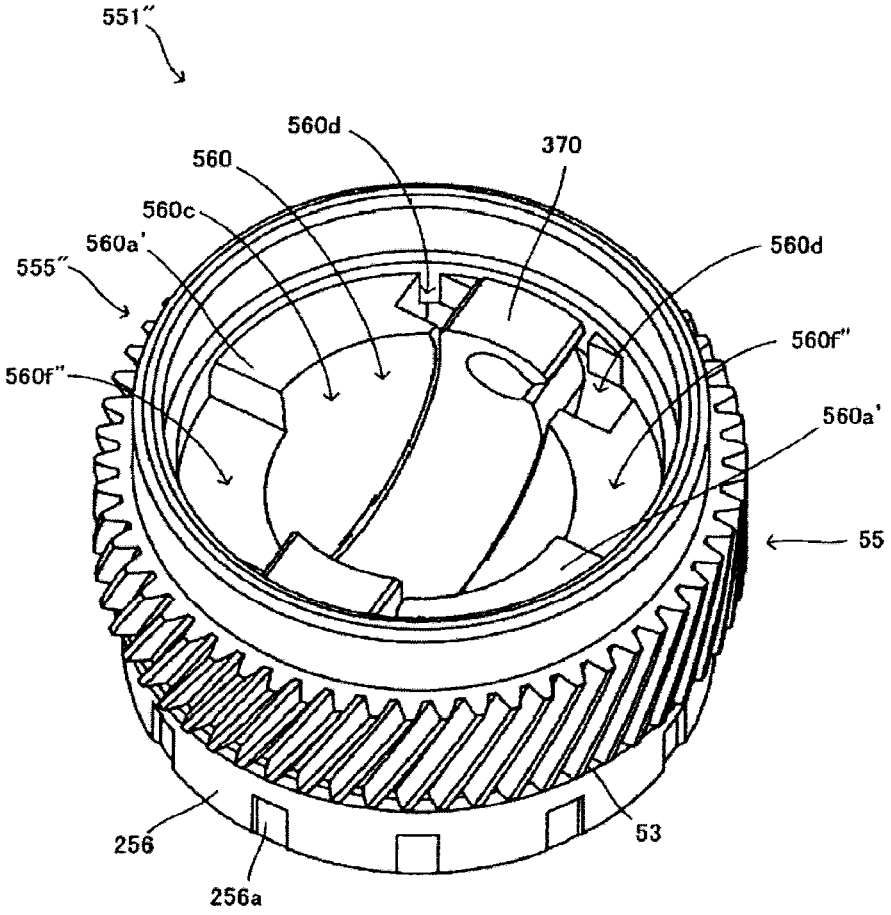
FIG. 48 is a perspective view of a bearing member 551".

FIG. 48 is a view illustrating a bearing member 341" which includes a main body 555" according to another modification example of the main body 555. FIG. 48 is a perspective view of a bearing member 341". In the example, a space 560*f'* which is greater than the space 560*f'* of the main body 555' is formed.

According to the main bodies 555' and 555", easy attachment and detachment of the shaft member 61 from the spaces 560*f'* and 560*f"* are ensured, contact portions between the intermediate member 370 and the main bodies 555' and 555" can increase on a side opposite to the spaces 560*f'* and 560*f'*, and a load during the rotation can be dispersed.

Next, a seventh aspect will be described. In the seventh aspect, a holding portion 660 of a main body 655 is different from that in the above-described sixth aspect, and a guide member 675 of an intermediate member 670 is different from that in the above-described sixth aspect. Since other parts can be considered similar, here, the description will focus on parts of the main body 655 and an intermediate member 670 different from those in the sixth aspect. In addition, here, members and parts which are considered similar to those described above will be given the same reference numerals, and the description thereof will be omitted.

Figure 49A:
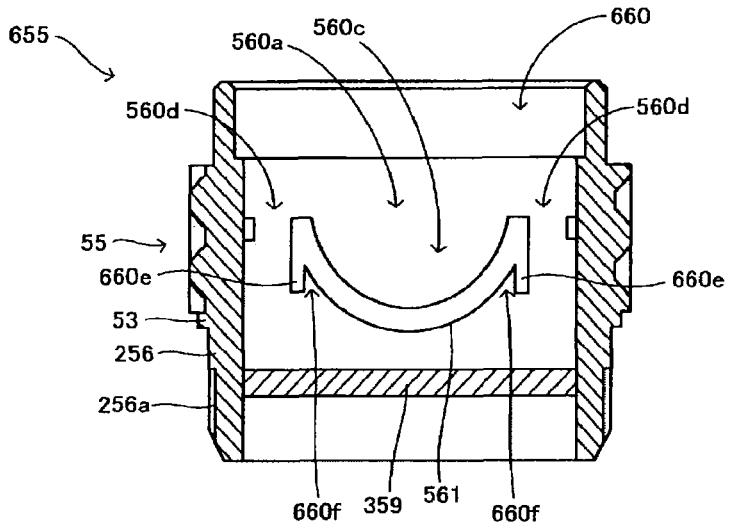
FIG. 49A is a sectional view of a main body 655.
Figure 49B:
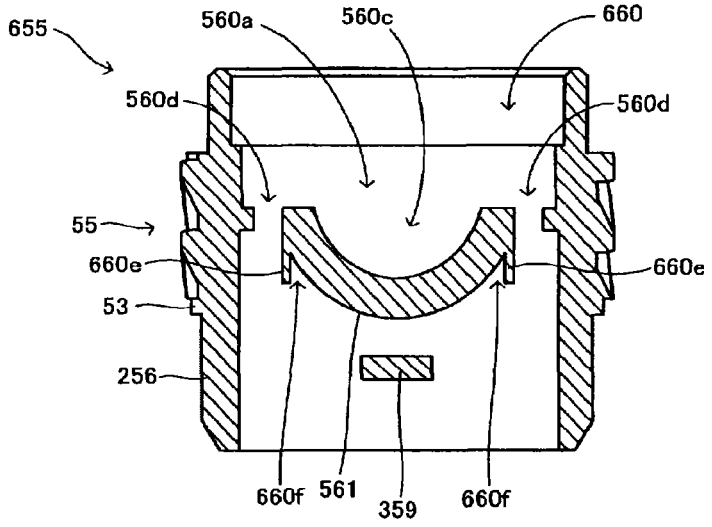
FIG. 49B is another sectional view of the main body 655.
Figure 50A:
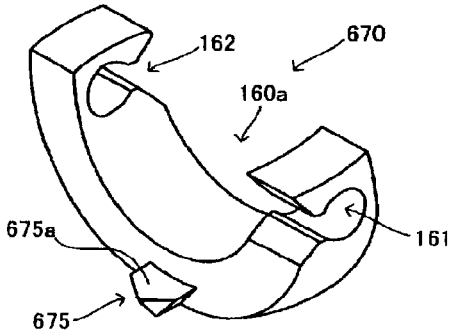
FIG. 50A is a perspective view of an intermediate member 670.
Figure 50B:
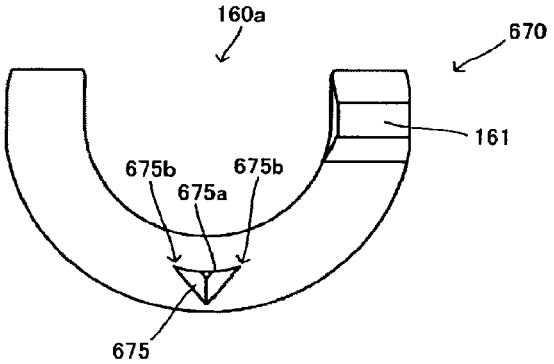
FIG. 50B is a front view of the intermediate member 670.
Figure 50C:
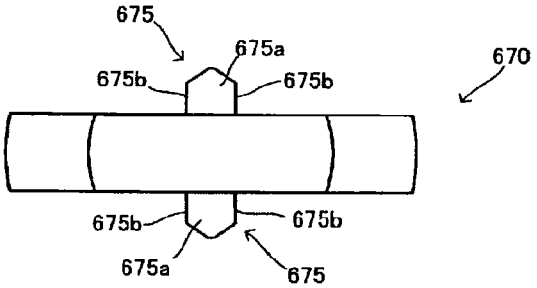
FIG. 50C is a plan view of the intermediate member 670.

FIGS. 49A and 49B are views illustrating the main body 655. FIG. 49A is a view from the same viewpoint of FIG. 42A. FIG. 49B is a view from the same viewpoint of FIG. 42B. In addition, FIG. 50A is a perspective view of the intermediate member 670. FIG. 50B is a front view of the intermediate member 670. FIG. 50C is a plan view of the intermediate member 670.

As can be ascertained from FIGS. 49A and 49B, the guide member insertion groove 560*d* is also provided in the holding portion 660 provided in the main body 655, similar to the holding portion 560. In the holding portion 660, a returning piece 660*e* which extends to the guide surfaces 561 and 562 sides (bottom portion 359 side) from an edge which is continuous to the guide surfaces 561 and 562 in the edge of the guide member insertion groove 560*d*, is disposed. Accordingly, between the returning piece 660*e* and the guide surfaces 561 and 562, internal corner portions 660*f* which are opened to the guide surfaces 561 and 562 sides, are formed. In addition, the internal corner portion 660*f* is not illustrated when the guide member insertion groove 560*d* is viewed from the recessed portion 560*c* side.

Meanwhile, as can be ascertained from FIGS. 50A to 50C, the guide member 675 (guided member) which has a different shape from the above-described intermediate member 370 is provided in the intermediate member 670. In other words, in the aspect, the guide member 675 has a shape of a substantially triangular column, and a tip end thereof is narrowed in a shape of a drill.

Therefore, in the guide member 675, a projection 675*b* which is made of triangular top points at both ends of a surface 675*a* that comes into contact with the guide surfaces 561 and 562 of the holding portion 660, is formed.

Figure 51A:
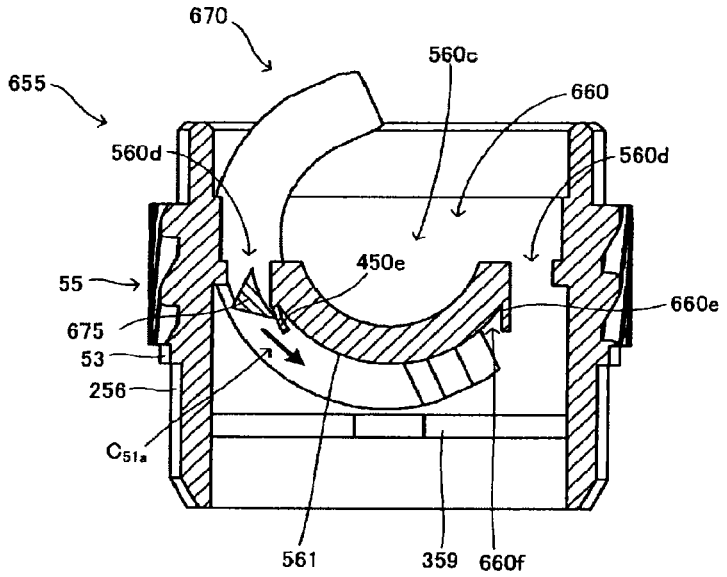
FIG. 51A is a view illustrating a scene where the intermediate member 670 is attached to the main body 655.
Figure 51B:
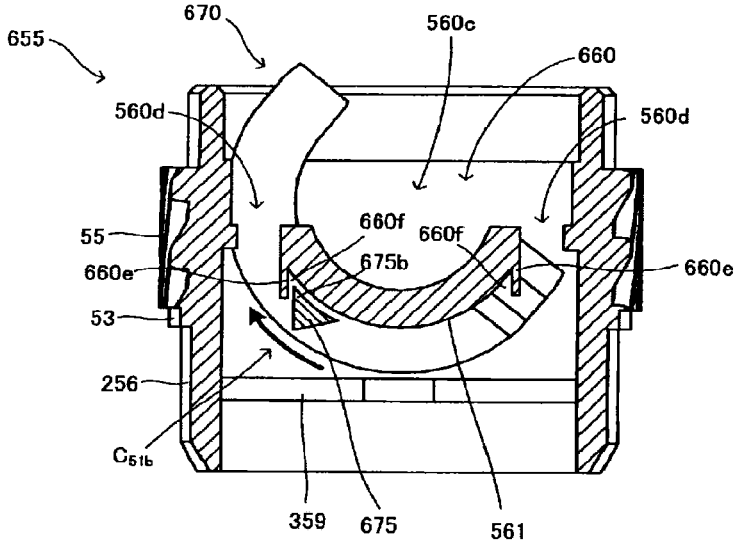
FIG. 51B is a view illustrating one scene where the intermediate member 670 swings in the main body 655.

By providing the above-described configuration, after the intermediate member 670 is combined with the main body 655, the intermediate member 670 becomes more unlikely to fall out of the main body 655. FIG. 51 is a view illustrating this. FIG. 51A is a section of a scene where the intermediate member 670 is combined with the main body 655. FIG. 51B is a section of a scene where the intermediate member 670 also swings according to the swing of the shaft member 61.

First, a scene where the intermediate member 670 is attached to the main body 655 is considered. In the scene, as illustrated by an arrow $C_{51a}$ in FIG. 51A, the guide member 675 of the intermediate member 670 passes through the guide member insertion groove 560*d* from the recessed portion 560*c* side, and is disposed on the guide surfaces 561 and 562 sides. At this time, as described above, the internal corner portion 660*f* made by the returning piece 660*e* has an orientation which does not interrupt the insertion of the guide member 675. Therefore, in general, it is possible to smoothly attach the intermediate member 670 to the main body 655.

Next, after the intermediate member 670 and the shaft member 61 are attached to the main body 655, a scene where the shaft member 61 and the intermediate member 670 swing is considered. In the scene, the guide member 675 of the intermediate member 670 moves being guided to the guide surface 561 of the main body 655 as illustrated by an arrow $C_{51b}$ in FIG. 51B. At this time, when the swing increases and the guide member 675 reaches the returning piece 660*e*, a projection 465*b* of the guide member 675 goes into the internal corner portion 660*f* formed by the guide surfaces 561 and 562 and the returning piece 660*e*. Therefore, the guide member 675 cannot move more than this, and the guide member 675 does not fall out of the guide member insertion groove 560*d*.

According to the above-described aspect, a function as the end member described above can be achieved, the intermediate member 670 and the main body 655 can be smoothly combined with each other, and further, the intermediate member 670 can be more reliably prevented from falling out of the main body 655 in an unintentional scene. For example, even in a case where transportation is performed in a state where the intermediate member 670 is combined with the main body 655, there is not a concern that the intermediate member 670 falls out due to the swing caused by the transportation.

In the aspect, a shape in which the guide member 675 of the intermediate member 670 goes into the internal corner portion 660*f* by making the guide member 675 in a shape of a triangular column as described above, is illustrated, but the shape of the guide member is not particularly limited if the movement (rotation) is regulated as the guide portion goes into the internal corner portion.

Figure 52:
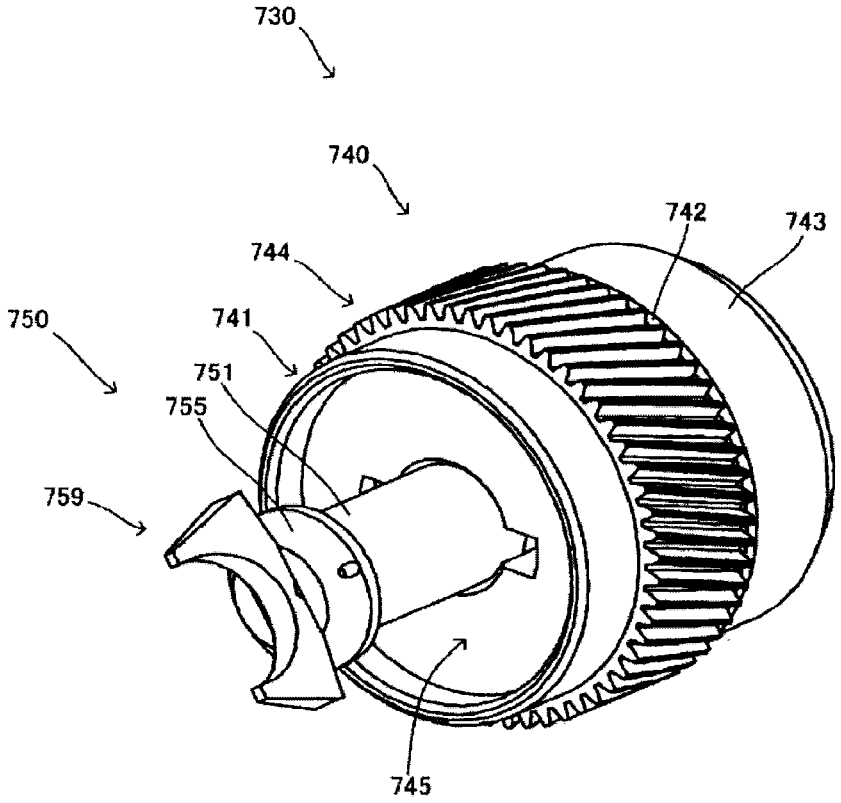
FIG. 52 is a perspective view of an end member 730.
Figure 53:
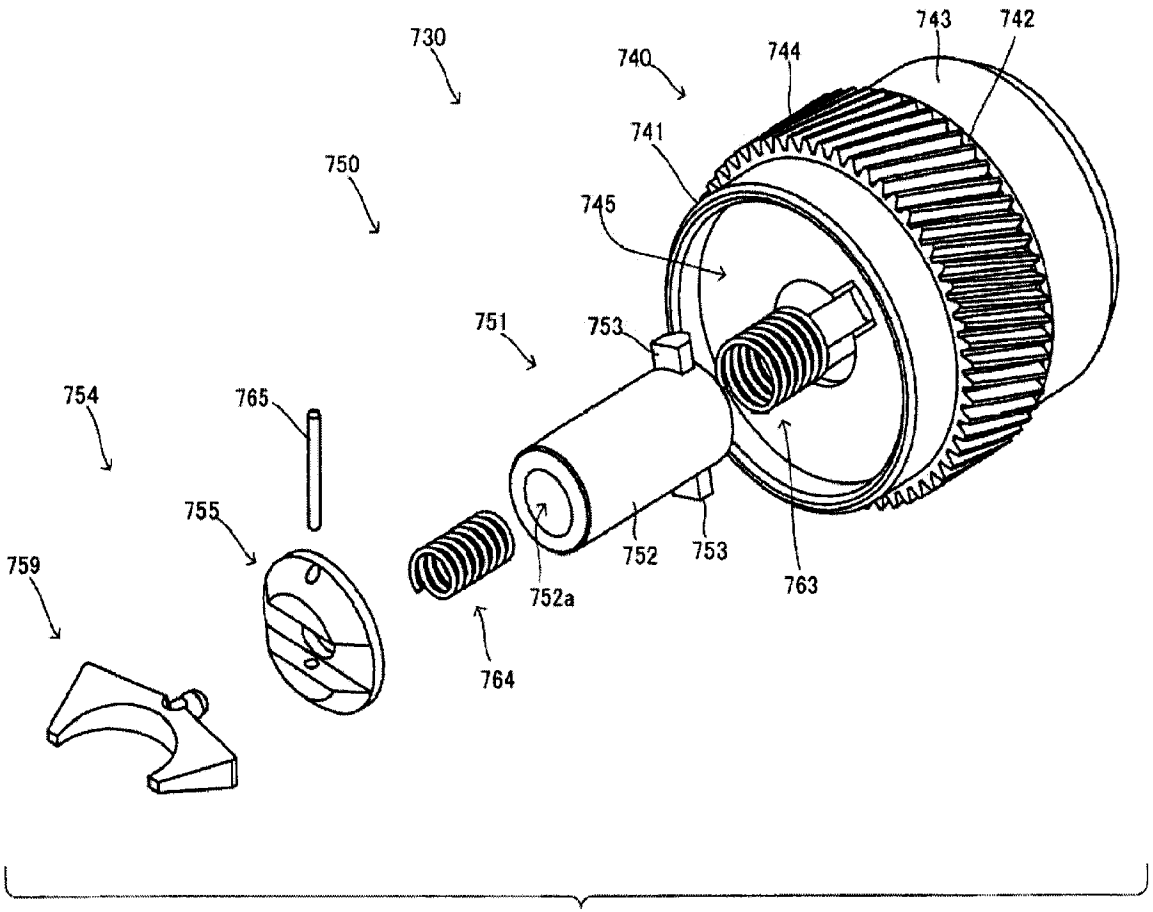
FIG. 53 is an exploded perspective view of the end member 730.

Next, an eighth aspect will be described. FIG. 52 is a perspective view of a driving side end member 730. FIG. 53 is an exploded perspective view of the driving side end member 730. In the aspect, with respect to the above-described first aspect, instead of the driving side end member 250, the driving side end member 730 is used. Here, the driving side end member 730 will be described. As can be ascertained from FIG. 52, the driving side end member 730 is provided with the bearing member 251 and the shaft member 61. Here, since the shaft member 61 can be considered the same as that in the first aspect, the same reference numeral will be given, and the description thereof will be omitted.

As can be ascertained from FIGS. 52 and 53, the driving side end member 730 is provided with a bearing member 740 and a shaft member 750.

Figure 54A:
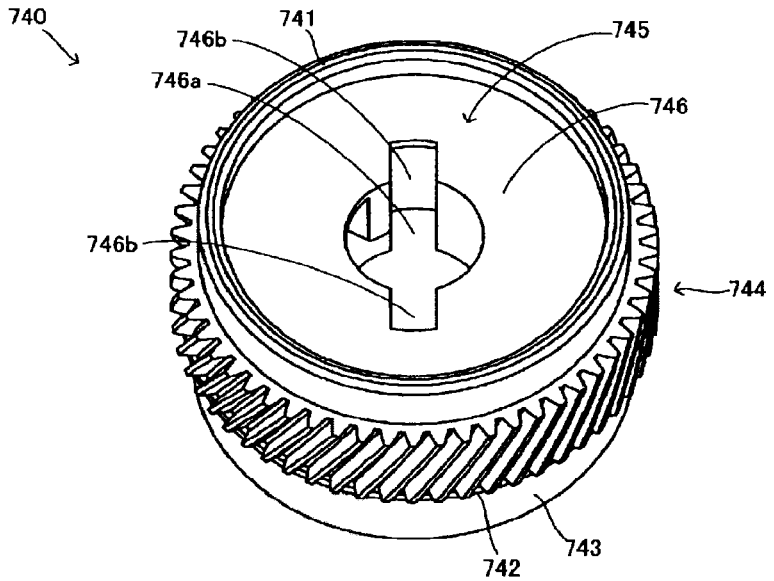
FIG. 54A is a perspective view of a bearing member 740.
Figure 54B:
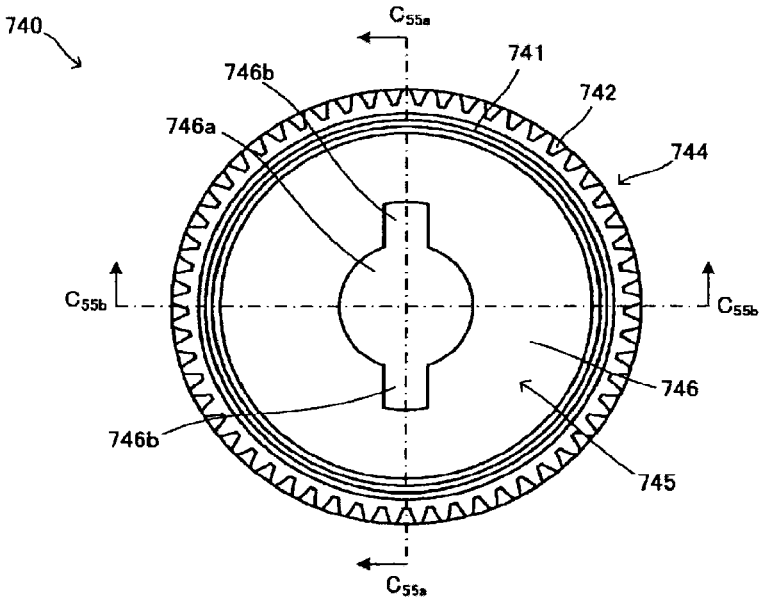
FIG. 54B is a plan view of the bearing member 740.
Figure 55A:
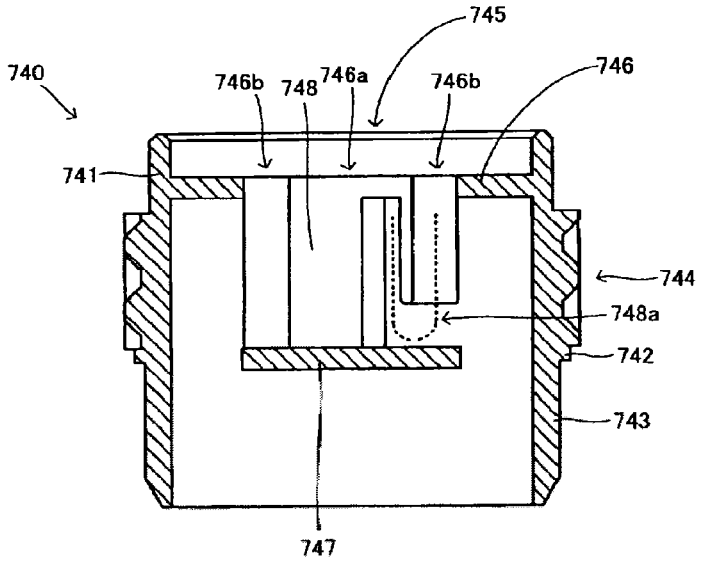
FIG. 55A is a sectional view of the bearing member 740.
Figure 55B:
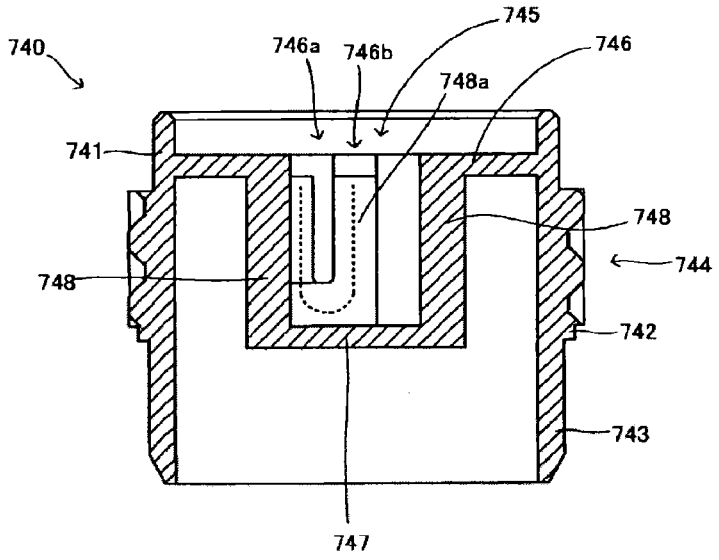
FIG. 55B is another sectional view of the bearing member 740.

The bearing member 740 is a member which is boned to the end portion of the photoreceptor drum 11 of the driving side end member 730. FIG. 54A is a perspective view of the bearing member 740. FIG. 55B is a plan view when viewed from the side on which the shaft member 750 is inserted in the bearing member 740. Furthermore, FIG. 55A is a sectional view along a line illustrated by $C_{55a}$-$C_{55a}$ in FIG. 54B. FIG. 55B is a sectional view along a line illustrated by $C_{55b}$-$C_{55b}$ in FIG. 54B. In addition, in each drawing illustrated below, sections (cross sections) are illustrated being hatched in the sectional views.

As can be ascertained from FIGS. 52 to 55, the bearing member 740 is configured to include a tubular body 741, a contact wall 742, a fitting portion 743, a gear portion 744, and a shaft member holding portion 745.

The tubular body 741 is an overall tubular member, and the contact wall 742 and the gear portion 744 are disposed on the outer circumference thereof, and the shaft member holding portion 745 is formed on the inner side of the tubular body 741.

The contact wall 742 which comes into contact with and is locked to the end surface of the photoreceptor drum 11, stands from a part of the outer circumferential surface of the tubular body 741. Accordingly, the depth of insertion of the driving side end member 730 into the photoreceptor drum 11 is regulated when the driving side end member 730 is mounted on the photoreceptor drum 11.

In addition, by nipping the contact wall 742 of the tubular body 741, the fitting portion 743 of which one side is inserted into the photoreceptor drum 11 is made. The fitting portion 743 is inserted into the photoreceptor drum 11, and is fixed to the inner surface of the photoreceptor drum 11 by the adhesive. Accordingly, the driving side end member 730 is fixed to the end portion of the photoreceptor drum 11. Therefore, the outer diameter of the fitting portion 743 is substantially the same as the inner diameter of the photoreceptor drum 11 within a range in which insertion into cylindrical inner side of the photoreceptor drum 11 is possible. A groove may be formed on the outer circumferential surface in the fitting portion 743. Accordingly, the groove is filled with the adhesive, and adhesiveness between the tubular body 741 (driving side end member 730) and the photoreceptor drum 11 is improved by an anchor effect or the like.

By nipping the contact wall 742, the gear portion 744 is formed on the outer circumferential surface of the tubular body 741 opposite to the fitting portion 743. The gear portion 744 is a gear which transmits the rotating force to another member, such as the developing roller, and in the aspect, the gear portion 55 is a helical gear. However, the type of the gear is not particularly limited, and may be a spur gear. Otherwise, both the helical gear and the spur gear may be disposed being aligned along the axial direction of the tubular body. In addition, it is not necessary to provide the gear.

The shaft member holding portion 745 is a part which is formed on the inner side of the tubular body 741, and which has a function of holding the shaft member 750 in the bearing member 740. As can be ascertained from FIGS. 54A to 57B, the shaft member holding portion 745 includes a rotating shaft holding member 746, a support member 747, and a guide wall 748.

The rotating shaft holding member 746 is a plate-like member which is formed to block the inner side of the tubular body 741, but a hole 746*a* which is coaxial to the axis of the tubular body 741 is formed. Since a rotating shaft 751 (refer to FIG. 56) penetrates the hole 746*a* as will be described later, the rotating shaft 751 has the size and the shape by which the rotating shaft 751 can penetrate. However, in order to prevent the rotating shaft 751 from falling out, a main body 752 of the rotating shaft 751 can penetrate the hole 746*a*, but cannot penetrate a part on which a projection 753 is disposed. In addition, from the viewpoint of stabilized movement of the rotating shaft 751, it is preferable that the hole 746*a* has the shape and the size which are substantially the same as the outer circumference of the main body 752 of the rotating shaft 751 within a range in which the hole 746*a* does not interrupt the movement of the rotating shaft 751 in the axial direction.

In addition, in the rotating shaft holding member 746, two slits 746*b* extend from the hole 746*a*. The two slits 746*b* are provided at symmetrical positions nipping the center of the hole 746*a*. In addition, the size and the shape of the slit 746*b* are formed so that the projection 753 of the rotating shaft 751 (refer to FIG. 56) can penetrate the slit 746*b*.

The support member 747 is a plate-like member which is provided further on the fitting portion 743 side than the rotating shaft holding member 746, and which is formed to block at least a part of the inner side of the tubular body 741. The support member 747 is formed to have the size and the shape by which a rotating shaft elastic member 763 which will be described later can be supported.

The guide wall 748 is a tubular member which extends in parallel to the axial direction of the tubular body 741 from an edge of the hole 746*a* of the rotating shaft holding member 746, and of which an end portion is connected to the support member 747. In the aspect, the sectional shape of the inner side of the guide wall 748 is the same as that of the hole 746*a*. However, as will be described later, since the main body 752 of the rotating shaft 751 is inserted into the guide wall 748, and the rotating shaft 751 moves in the axial direction, the guide wall 748 has the shape and the size in which the guide wall 748 does not interrupt the movement.

Figure 56A:
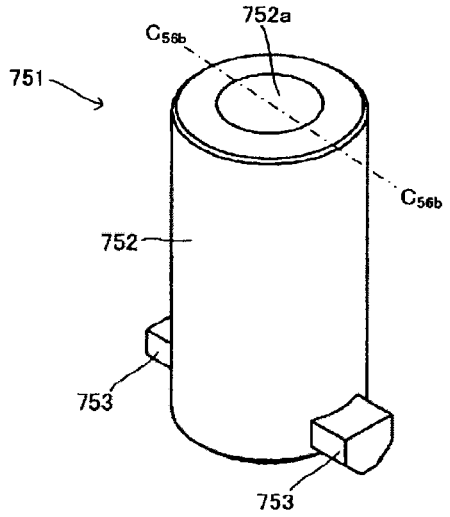
FIG. 56A is a perspective view of a rotating shaft 751.
Figure 56B:
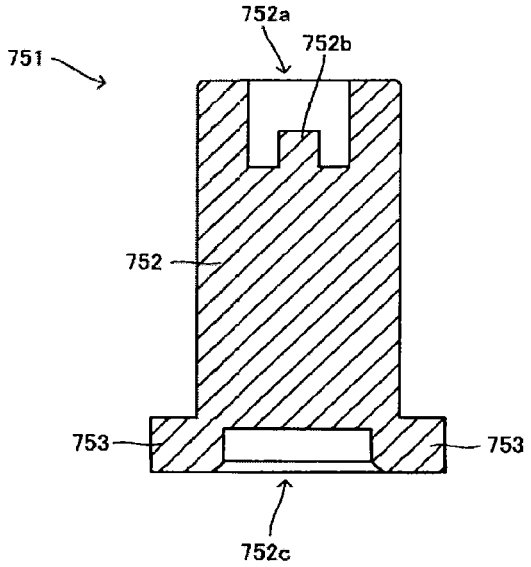
FIG. 56B is a sectional view of the rotating shaft 751.
Figure 57A:
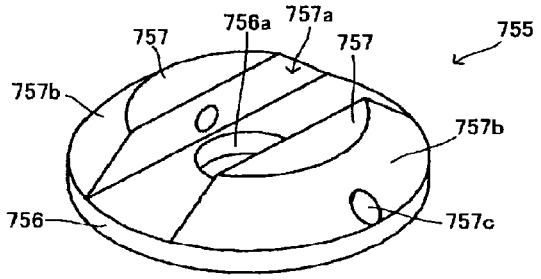
FIG. 57A is a perspective view of a tip end member 755.
Figure 57B:
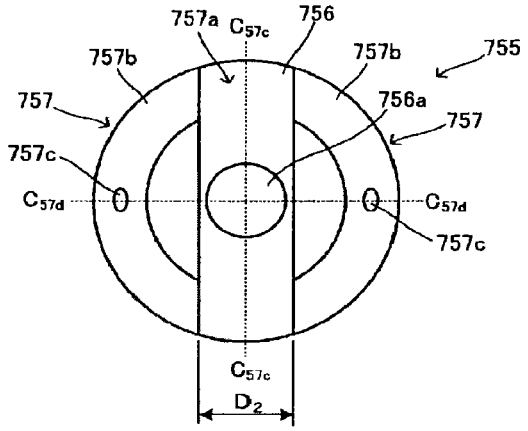
FIG. 57B is a plan view of the tip end member 755.

In addition, a slit 748*a* is formed in the guide wall 748. In FIGS. 55A and 57B, for making it easy to understand, a dotted line is illustrated along the direction in which the slit 748*a* extends. One end side of the slit 748*a* passes through the slit 746*b* of the rotating shaft holding member 746 in the longitudinal direction, the slit 748*a* extends in parallel to the axis of the tubular body 741, and the slit 748*a* reaches the support member 747. After this, the slit 748*a* extends in parallel to the axial direction similar to a U-turn, and one end portion (the other end side) of the slit 748*a* reaches the rotating shaft holding member 746. Therefore, the other end side is blocked by the rotating shaft holding member 746. The slit width of the slit 748*a* is formed so that the projection 753 of the rotating shaft 751 (refer to FIG. 56) can move in the slit 748*a*.

A material which configures the bearing member 740 is not particularly limited, but a resin, such as polyacetal, polycarbonate, or PPS, or metal can be used. Here, in order to improve the rigidity of the member in a case where the resin is used, the glass fiber or the carbon fiber may be mixed into the resin in accordance with the load torque. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

In a case of making the bearing member 740 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

Returning to FIGS. 52 and 53, the shaft member 750 of the driving side end member 730 will be described. As can be ascertained from FIG. 53, the shaft member 750 is provided with the rotating shaft 751 and a rotating force transmission member 754, and the rotating force transmission member 754 is configured to include a tip end member 755, a claw member 759, and a pin 765. Furthermore, the shaft member 750 is provided with the rotating shaft elastic member 763 and a claw member elastic member 764. Any of the rotating shaft elastic member 763 and the claw member elastic member 764 in the aspect is a coiled spring.

Hereinafter, each of the members will be described.

The rotating shaft 751 is a shaft-shape member which transmits the rotating force received by the rotating force transmission member 754 to the bearing member 740. FIG. 56A is a perspective view of the rotating shaft 751. FIG. 56B is a sectional view when cut along the axial direction including a line illustrated by $C_{56b}$-$C_{56b}$ in FIG. 56A.

As can be ascertained from FIGS. 56A and 56B, the rotating shaft 751 includes the columnar main body 752, and recessed portions 752*a* and 752*c* are respectively formed on columnar end surfaces.

The recessed portion 752*a* is a recessed portion which is formed on one end surface of the main body 752 of the rotating shaft 751, and one end side of the claw member elastic member 764 is inserted thereto. In addition, a holding projection 752*b* for fixing the claw member elastic member 764 is provided on a bottom portion of the recessed portion 752*a*. In the aspect, as will be described later, the claw member elastic member 764 is held as the holding projection 752*b* is inserted into the claw member elastic member 764.

The recessed portion 752*c* is a recessed portion which is formed on the other end surface of the main body 752 of the rotating shaft 751, that is, on an end surface opposite to the side on which the recessed portion 752*a* is formed. One end of the rotating shaft elastic member 763 is inserted into the recessed portion 752*c*, and one end of the rotating shaft elastic member 763 comes into contact with the bottom portion of the recessed portion 752*c*. Therefore, the recessed portion 752*c* is formed to have the size in which the insertion is possible.

Two projections 753 are disposed in the end portion on the side on which the recessed portion 752*c* is disposed in the outer circumferential portion of the main body 752. Two projections 753 are provided on the same line in one diameter direction of the column of the main body 752 to be opposite to each other nipping the axis of the main body 752. The two projections 753 have a function of holding the rotating shaft 751 by the bearing member 740 as will be described later, regulating the movement of the main body 752, and transmitting the rotating force of the main body 752 to the bearing member 740.

Figure 57C:
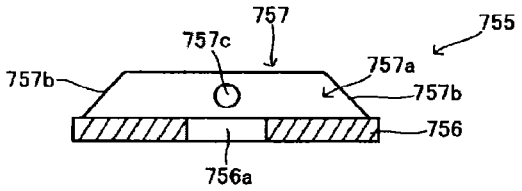
FIG. 57C is one sectional view of the tip end member 755.
Figure 57D:
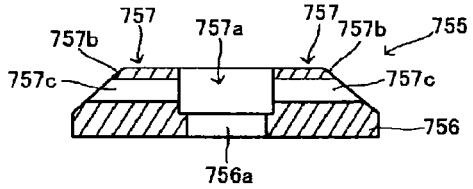
FIG. 57D is another sectional view of the tip end member 755.

Returning to FIG. 53, other members will be continuously described. The tip end member 755 is one member which configures the rotating force transmission member 754, and is a member which holds an engagement claw 760 to be swingable, and transmits the rotating force from the engagement claw 760 to the rotating shaft 751. FIG. 57A is a perspective view of the tip end member 755. FIG. 57B is a plan view of the tip end member 755 when viewed from the side on which the engagement claw 760 is disposed. FIG. 57C is a sectional view by a line illustrated by $C_{57c}$-$C_{57c}$ in FIG. 57B. FIG. 57D is a sectional view by a line illustrated by $C_{57d}$-$C_{57d}$ in FIG. 57B.

As can be ascertained from FIGS. 52, 53, and 57A to 57D, the tip end member 755 is configured to include a disk-like base portion 756 and two holding members 757 disposed on one surface of the base portion 756.

In the aspect, the base portion 756 has a shape of a disk, and a hole 756*a* which penetrates the base portion 756 in the thickness direction is formed at the center thereof.

The holding members 757 are two members which are disposed on one surface of the base portion 756, and are disposed on one side and on the other side nipping the hole 756*a* of the base portion 756 in a plan view (FIG. 57B), and being provided with a void in which the hole 756*a* is exposed. Therefore, a groove 757*a* is formed between two holding members 757, and the hole 756*a* is formed in a bottom portion of the groove 757*a*. In addition, on a side surface other than the surface on which the groove 757*a* is formed in the holding member 757, an inclined surface 757*b* is formed to approach the axis of the base portion 756 according to the separation from the base portion 756.

In addition, in the holding member 757, a hole 757*c* which passes through the center of the hole 756*a* of the base portion 756 in a plan view (FIG. 57B), and is orthogonal to the direction in which the groove 757*a* extends, is provided. As will be described later, the pin 765 is inserted into the hole 757*c*.

Figure 58A:
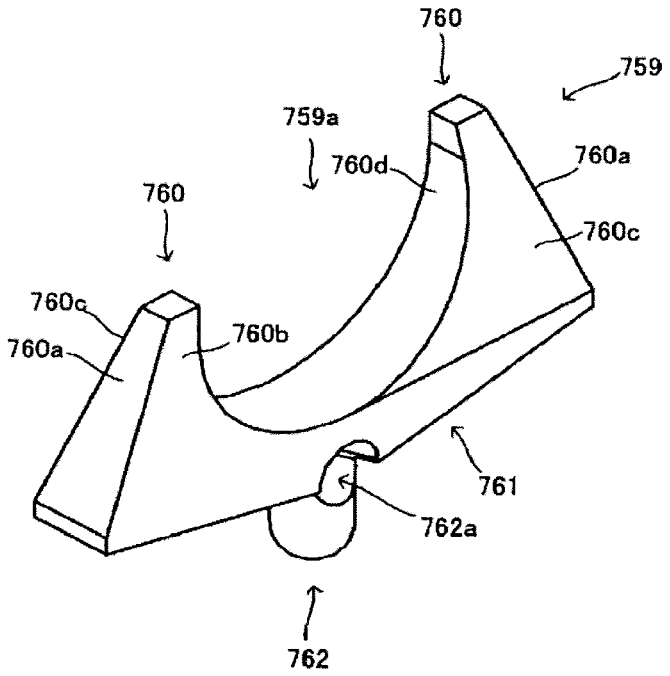
FIG. 58A is a perspective view of a claw member 759.
Figure 58B:
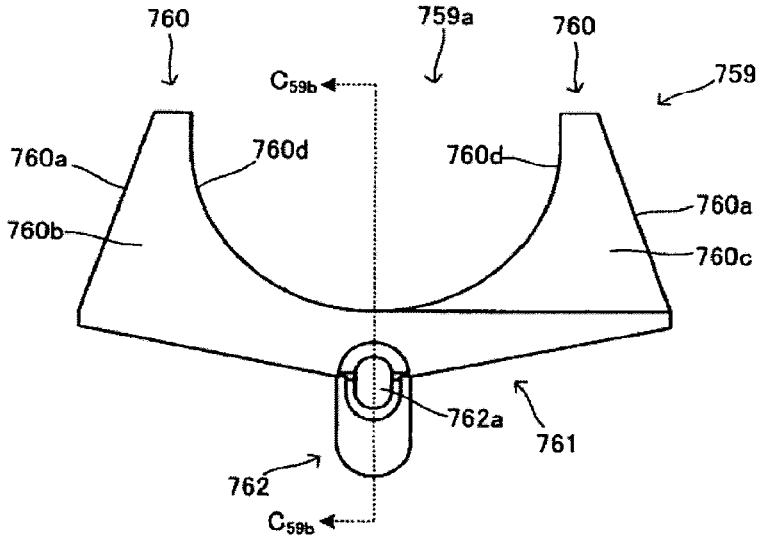
FIG. 58B is a front view of the claw member 759.
Figure 59A:
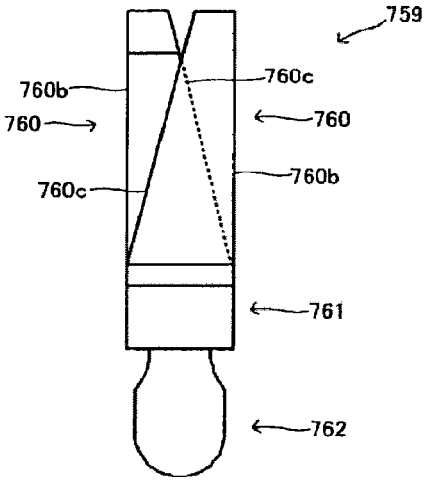
FIG. 59A is a side view of the claw member 759.
Figure 59B:
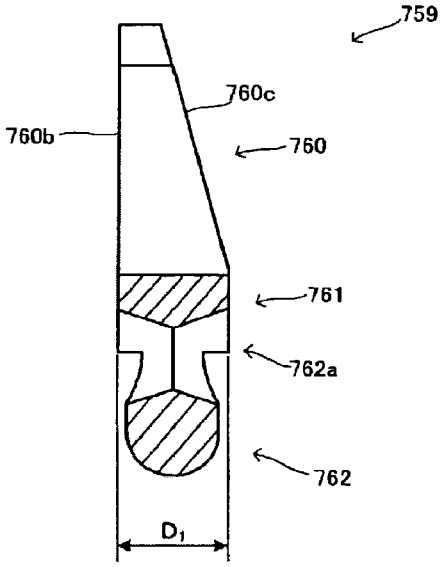
FIG. 59B is a sectional view of the claw member 759.

Returning to FIG. 53, the claw member 759 will be described. The claw member 759 is one member which configures the rotating force transmission member 754, and is a member which is engaged with the driving shaft 70 (refer to FIG. 10) provided in the apparatus main body 2, and transmits the rotating force to the tip end member 755. FIGS. 58 and 59 are views illustrating this. FIG. 58A is a perspective view of the claw member 759. FIG. 58B is a front view of the claw member 759. FIG. 59A is a side view of the claw member 759. FIG. 59B is a sectional view from the arrow direction illustrated by $C_{59b}$-$C_{59b}$ in FIG. 58B.

The claw member 759 includes two engagement claws 760 in the aspect, and a linking piece 761 which links end portions of the two engagement claws 760 to each other. In addition, on a side opposite to two engagement claws 760 of the linking piece 761, a holding projection 762 is provided at a position which is the center between the two engagement claws.

Two engagement claws 760 are members which stand in the same direction from both end portions of the linking piece 761, and an interval between two engagement claws 760 is formed so that a tip end of a driving shaft 770 enters the interval, and the driving projection 71 (refer to FIG. 10) of the driving shaft 70 is hooked to the engagement claw 760. In addition, in the aspect, two engagement claws 760 are formed to become narrower according to the separation from the linking piece 761 as can be ascertained from FIG. 58B. More specifically, opposing surfaces 760*d* which are surfaces opposing each other in two engagement claws 760, form a recessed portion 759*a* having a shape of an arc including the surface of the linking piece 761. This is a shape which corresponds to the tip end portion of the driving shaft 70 (refer to FIG. 10) of the apparatus main body. However, it is not necessary that the recessed portion 759*a* has a shape of an arc, and the opposing surface 760*d* of two engagement claws 760 may be formed to be inclined (in a tapered shape) in a shape of a straight line to be separated from each other according to the separation from the linking piece 761.

In addition, in two engagement claws 760, outer surfaces 760*a* which are surfaces opposite to the recessed portion 759*a*, are inclined surfaces (hereinafter, there is a case where the outer surface 760*a* is described as an inclined surface 760*a*) to approach each other according to the separation from the linking piece 761.

Furthermore, as can be ascertained from FIGS. 59A and 59B, on the surface where the engagement claw 760 is formed, on two surfaces 760*b* and 760*c* which link the opposing surface 760*d* and the inclined surface 760*a*, the first side surface 760*b* which is one surface is parallel to the direction in which the engagement claw 760 stands (the direction in which the axis of the rotating shaft 751 extends), and in the aspect, as the second side surface 760*c* which is the other surface is separated from the linking piece 761, the second side surface 760*c* is inclined to approach the first side surface 760*b*. in addition, in the two engagement claws 760, the first side surface 760*b* and the second side surface 760*c* are disposed on opposite sides.

The first side surface 760*b* is a surface to which the driving projection 71 of the driving shaft 70 comes into contact when the rotating force is transmitted from the apparatus main body 2. From the related viewpoint, it is necessary for the first side surface 760*b* to maintain reliable contact with the driving projection 71 when the first side surface 760*b* receives the rotating force. Therefore, it is preferable that the first side surface 760*b* is parallel to the direction (the direction in which the axis of the rotating shaft 751 extends) in which the engagement claw 760 stands similar to the aspect, or that the first side surface 760*b* has an inclined surface which is inclined in the direction in which the second side surface 760*c* is separated when approaching the tip end.

Meanwhile, in the aspect, the second side surface 760*c* has the inclined surface to approach the first side surface 760*b* as described above, but it is not necessary to provide the inclined surface.

The holding projection 762 is a projection which is disposed at a position which is the center between two engagement claws 760, on the surface opposite to the engagement claw 760 of the linking piece 761. The holding projection 762 is fixed to the claw member elastic member 764. In the aspect, the holding projection 762 is inserted and fixed to the inner side from the end portion of the claw member elastic member 764. Therefore, the holding projection 762 has the size in which the insertion into the claw member elastic member 764 is possible. In addition, in the aspect, the tip end of the holding projection 762 is formed on a hemispherical surface to make the insertion easy.

In addition, in the holding projection 762, a long hole 762*a* which penetrates the holding projection 762 is provided in the direction orthogonal to the direction in which the two engagement claws 760 are aligned. The long hole 762*a* is a long hole which is long in the standing direction of the engagement claw 760, and is short in the direction in which the two engagement claws 760 are aligned. As will be described later, the pin 765 passes through the long hole 762*a*.

The shape of the long hole 762*a* in the penetrating direction is illustrated in FIG. 59B. As can be ascertained from the drawing, the long hole 762*a* becomes the narrowest at the center in the penetrating direction, and the diameter of the long hole 762*a* expands to be inclined (to have a tapered shape) so that the hole widens when approaching both ends in the penetrating direction across the entire circumference of the long hole 762*a*. Accordingly, as will be described later, smooth swing of the claw member 759 is achieved.

Here, in the claw member 759 which will be described later, the size (thickness) of the linking piece 761 illustrated by $D_1$ in FIG. 59B, is formed to be smaller than the width of the groove 757*a* illustrated by $D_2$ in FIG. 57B, from the viewpoint that the linking piece 761 swings being disposed on the inner side of the groove 757*a* of the tip end member 755 illustrated in FIG. 59B. In addition, the holding projection 762 has the thickness in which insertion into the hole 756*a* of the tip end member 755 is possible, and the swing on the inner side of the hole 756*a* is possible.

Returning to FIG. 53, another configuration provided in the shaft member 750 will be described. The rotating shaft elastic member 763 and the claw member elastic member 764 are so-called elastic members, and are made of the coiled spring in the aspect. In addition, the pin 765 is one rod-like member which configures the rotating force transmission member 754. The dispositions and the actions of each member will be described later.

A material which configures each member of the shaft member 750 is not particularly limited, but a resin, such as polyacetal, polycarbonate, or PPS, can be used. However, in order to improve the rigidity of the member, the glass fiber or the carbon fiber may be mixed into the resin in accordance with the load torque. In addition, by inserting metal into the resin, the rigidity may further be improved, or the entire body may be made of metal. In a case of making the shaft member 750 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 750 and the claw member 759 included in the shaft member 750, may be made by bending a metal plate, or may be made by making the metal, glass, or carbon fiber infiltrate into the resin.

By combining the bearing member 740 and the shaft member 750 with each other as follows, the driving side end member 730 is made. In addition, by describing the combination, the size of each member and part, the structure, or the relationship of the sizes of the members and parts, are further understood.

Figure 60A:
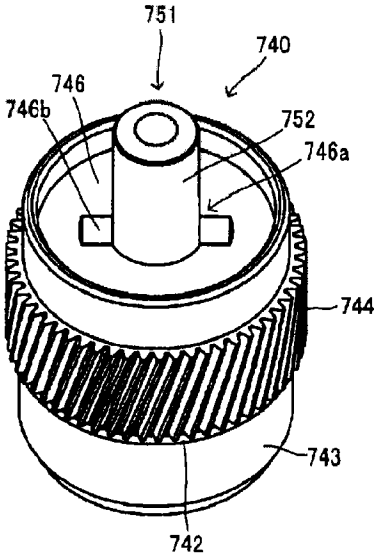
FIG. 60A is a perspective view of combination of the bearing member 740 and the rotating shaft 751.

First, a combination between the bearing member 740 and the rotating shaft 751 will be described. FIG. 60A is a sectional view in which the rotating shaft 751 is combined with the bearing member 740, FIG. 60B is a plan view thereof, and FIG. 60C is a sectional view from the arrow direction illustrated by $C_{60c}$-$C_{60c}$ in FIG. 60B.

Figure 60B:
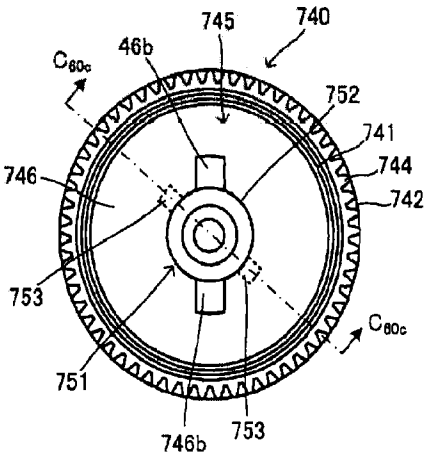
FIG. 60B is a plan view of the combination of the bearing member 740 and the rotating shaft 751.
Figure 60C:
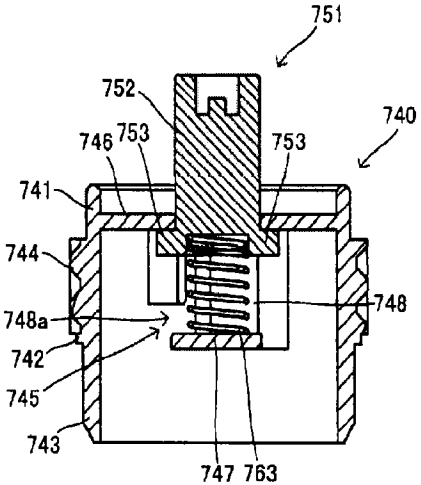
FIG. 60C is a sectional view of the combination of the bearing member 740 and the rotating shaft 751.

As can be ascertained from FIGS. 60A to 60C, the rotating shaft 751 passes through the hole 746*a* of the rotating shaft holding member 746 of the bearing member 740, an end portion on the side on which the projection 753 is disposed is included in the shaft member holding portion 745, and an end portion on an opposite side is disposed to protrude from the bearing member 740. At this time, the projection 753 is disposed in the end portion on the side blocked by the rotating shaft holding member 746 in the end portion of the slit 748*a* provided in the guide wall 748, and the rotating shaft 751 is configured not to fall out of the bearing member 740 as being hooked to the rotating shaft holding member 746.

As can be ascertained from FIG. 60C, the rotating shaft elastic member 763 is disposed between the rotating shaft 751 and the support member 747, and the rotating shaft 751 is biased in the direction in which the projection 753 is pressed to the rotating shaft holding member 746. In addition, since a side surface of the projection 753 can be hooked to a slit wall surface of the slit 748*a*, the projection 753 is hooked to the slit wall surface of the slit 748*a*, and transmits the rotating force, during the rotation of the rotating shaft 751.

The attachment of the bearing member 740 and the rotating shaft 751 can be performed by inserting the projection 753 of the rotating shaft 751 into the slit 748*a* from the slit 746*b*, and by moving the projection 753 in the slit 748*a* along a dotted line illustrated in FIGS. 55A and 55B.

Figure 61A:
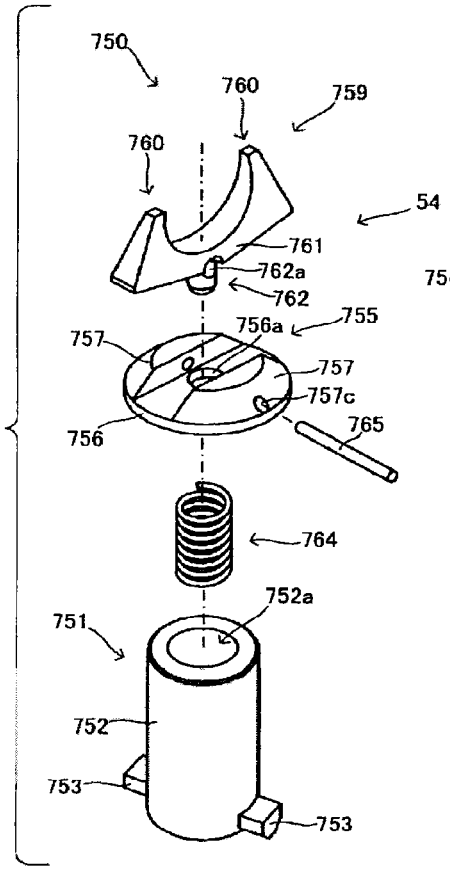
FIG. 61A is an exploded perspective view of a shaft member 750.

Next, the combination of another member to the rotating shaft 751 in the shaft member 750, will be described. FIG. 61 is a view illustrating this. FIG. 61A is an exploded perspective view, and FIG. 61B is a sectional view of the shaft member 750 in the direction along the axis.

Figure 61B:
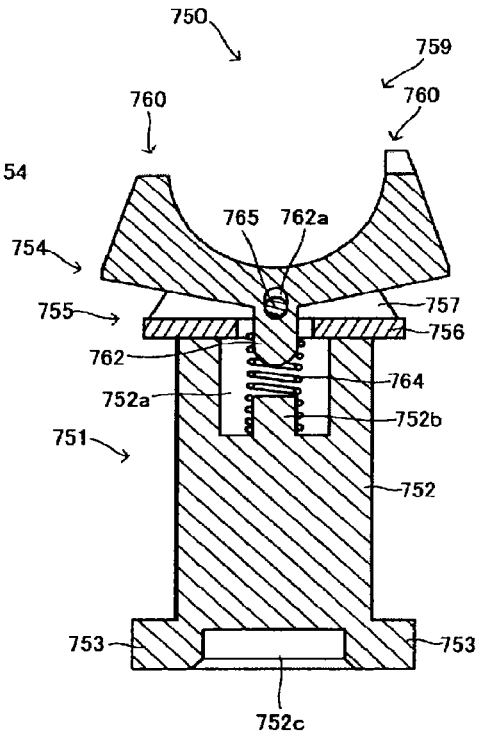
FIG. 61B is a sectional view of the shaft member 750.

As can be ascertained from FIG. 61B, the claw member elastic member 764 is disposed on the inner side of the recessed portion 752*a* of the main body 752 of the rotating shaft 751. At this time, one end of the claw member elastic member 764 is fixed to be inserted into the projection 752*b*.

As can be ascertained from FIG. 61B, the tip end member 755 is fixed to be disposed to overlap the surface of the base portion 756 of the tip end member 755, on the end surface on the side on which the recessed portion 752*a* of the rotating shaft 751 is provided. A fixing method is not particularly limited, and a known method using the adhesive or solvent can be used. The tip end member 755 and the rotating shaft 751 may be integrally formed. In addition, at this time, the axis of the main body 752 of the rotating shaft 751 and the axis (center of the hole 756*a*) of the tip end member 755, are positioned to match each other.

In addition, the holding projection 762 of the claw member 759 is inserted into the hole 756*a* of the tip end member 755, and the linking piece 761 of the claw member 759 is inserted into the groove 757*a* of the tip end member 755. At this time, the tip end of the holding projection 762 is fixed to be inserted into the claw member elastic member 764. In addition, the pin 765 passes through the hole 757*c* of the tip end member 755 and the long hole 762*a* of the claw member 759, and the claw member 759 is linked to the tip end member 755.

By the combination described above, axes of each of the bearing member 740 and the shaft member 750 are disposed to match each other.

Figure 62:
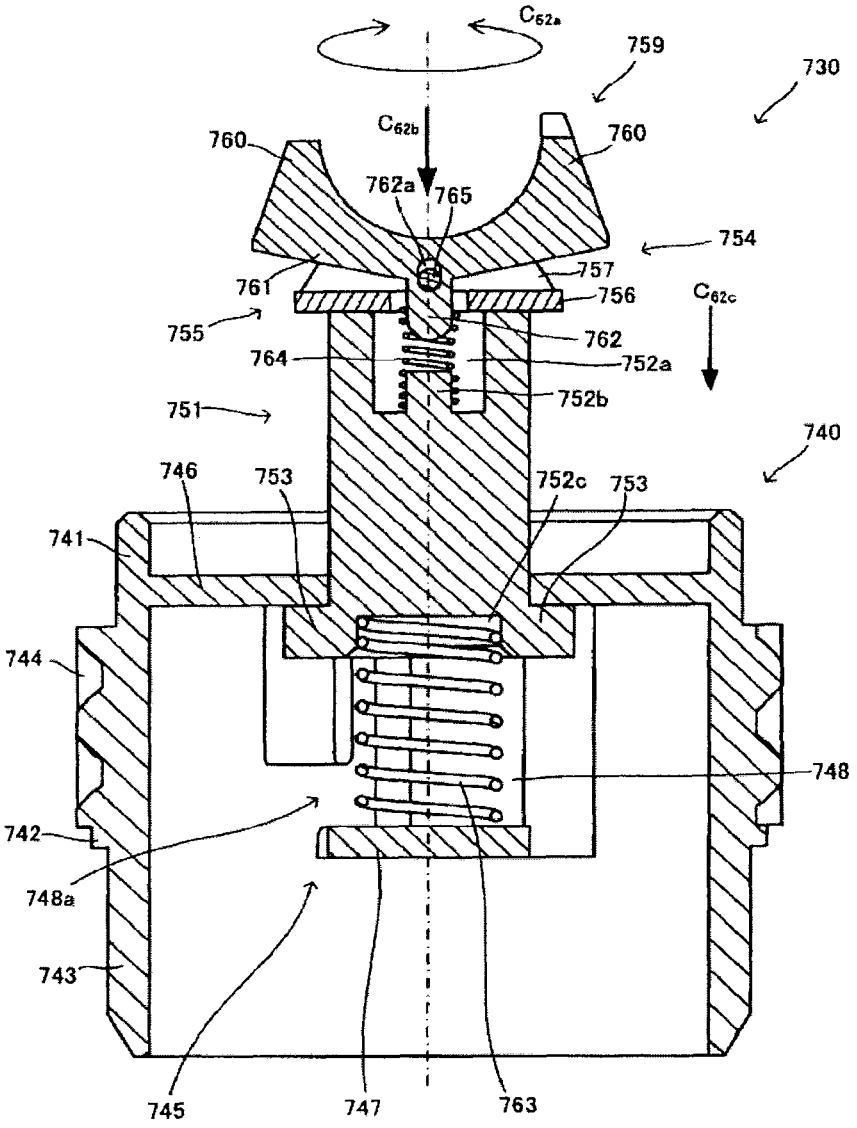
FIG. 62 is a sectional view of the end member 730.

Next, how the end member 730 combined as described above can be deformed, move, and rotate, will be described. FIG. 62 is a sectional view in the direction along the axis in one posture of the end member 730.

In the posture illustrated in FIG. 62, by the rotating shaft elastic member 763, a posture in which the entire shaft member 750 protrudes the most from the bearing member 740 within a possible range, is achieved. When any external force is not applied to the shaft member 750, the driving side end member 730 has this posture.

In this posture, as can be ascertained from FIG. 62, since the linking piece 761 of the claw member 759 is inserted into the groove 757*a* of the tip end member 755, when the rotating force is applied to the engagement claw 760 of the claw member 759 as illustrated by $C_{62a}$ in FIG. 62, the claw member 759 is hooked to the holding member 757 of the tip end member 755, or the pin 765 is hooked to the side surface of the long hole 762*a*, and the rotating force is transmitted. By any aspect, it is possible to appropriately set whether the rotating force is transmitted. In addition, the rotating force is transmitted to the rotating shaft 751, and further, the projection 753 of the rotating shaft 751 presses the slit wall of the slit 748*a*, and the rotating force is transmitted to the bearing member 740. Therefore, the entire end member 730 rotates by the rotating force received by the engagement claw 760.

In addition, as illustrated by an arrow $C_{62b}$ in FIG. 62, when a pressing force acts to the claw member 759 toward the bearing member 740 side in the axial direction, the pressing force is transmitted to the tip end member 755 and the rotating shaft 751, and the entire shaft member 750 moves in the direction of being pressed to the bearing member 740 as illustrated by $C_{62c}$ in FIG. 62 against the biasing force of the rotating shaft elastic member 763.

Figure 63A:
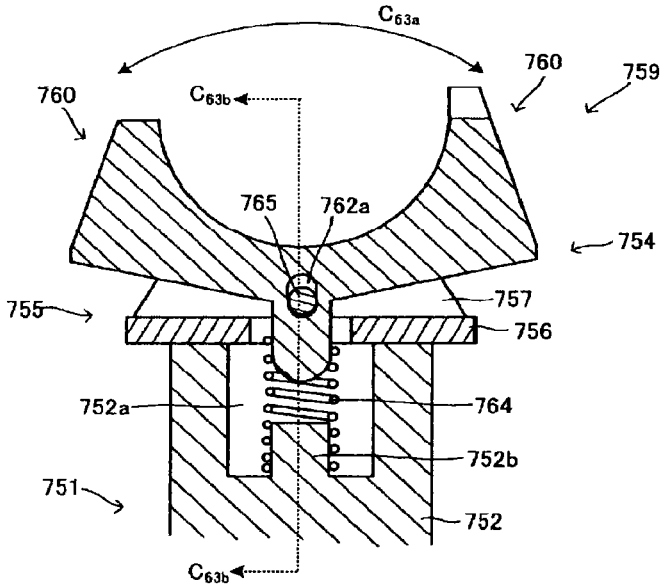
FIG. 63A is a sectional view focusing on the vicinity of a rotating force transmission member 754 in the sectional view of the end member 730.
Figure 63B:
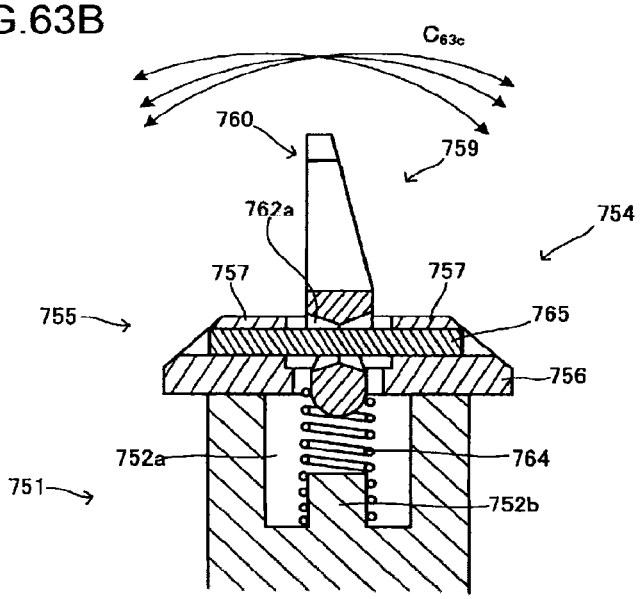
FIG. 63B is another sectional view focusing on the vicinity of the rotating force transmission member 754 in the end member 730.

FIG. 63 is an enlarged view illustrating the vicinity of the rotating force transmission member 754. FIG. 63A is a view from the same viewpoint as that of FIG. 62. FIG. 63B is a sectional view from the arrow direction by $C_{63b}$-$C_{63b}$ in FIG. 63A. When the external force is not applied, the claw member 759 holds the postures illustrated in FIGS. 62, 63A, and 63B by the claw member elastic member 764.

Meanwhile, as the external force is applied, swing around the pin 765 is possible as illustrated by an arrow $C_{63a}$ in FIG. 63A against an elastic force of the claw member elastic member 764.

Furthermore, as the external force is applied, the claw member 759 can swing in all directions other that the swing around the pin 765 as illustrated by an arrow $C_{63c}$ in FIG. 63B against the elastic force of the claw member elastic member 764. This is because the long hole 762*a* of the holding projection 762 is a long hole, and the diameter of the long hole 762*a* expands (in a tapered shape) to be inclined across the entire both end portions in the penetrating direction.

Therefore, the claw member 759 can swing in all directions around the axis. In addition, in the aspect, the claw member elastic member 764 is an aspect of a compression spring, but not being limited thereto, may be an aspect of an extension spring.

In addition, in the aspect, the pin 765 which is the shaft of the rotation of the claw member 759 is disposed on the outer side of the bearing member 740. Accordingly, since the swing of the claw member 759 is not restricted by the bearing member 740, a degree of freedom of the shape of the claw member 759 is increased, and more smooth swing is possible.

Furthermore, in the driving side end member 730 of the aspect, while the movement of the shaft member 750 in the axial direction is regulated by the rotating shaft elastic member 763, the claw member elastic member 764 controls the swing of the claw member 759, and the movement and the swing can be designed independently from each other. Therefore, from the related viewpoint, it is possible to improve the degree of freedom of design. In addition, when the swing of the claw member 759 is controlled, it is possible to compactly design since it is not necessary to have a function of regulating the movement in the axial direction, and to improve the degree of freedom of design when disposition is performed in a limited space.

Figure 64A:
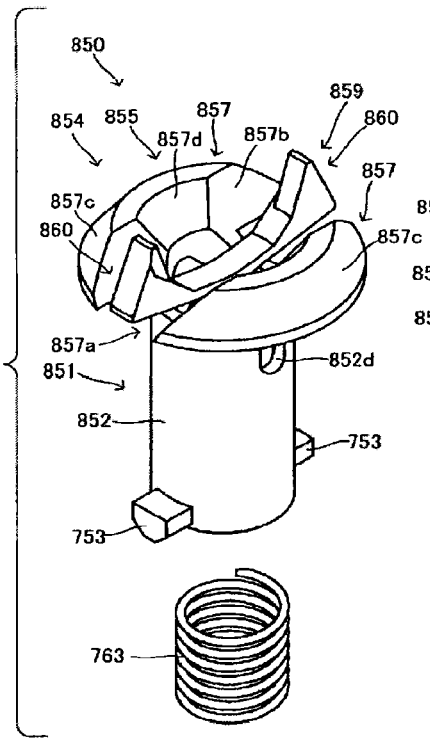
FIG. 64A is a perspective view of a shaft member 850.
Figure 64B:
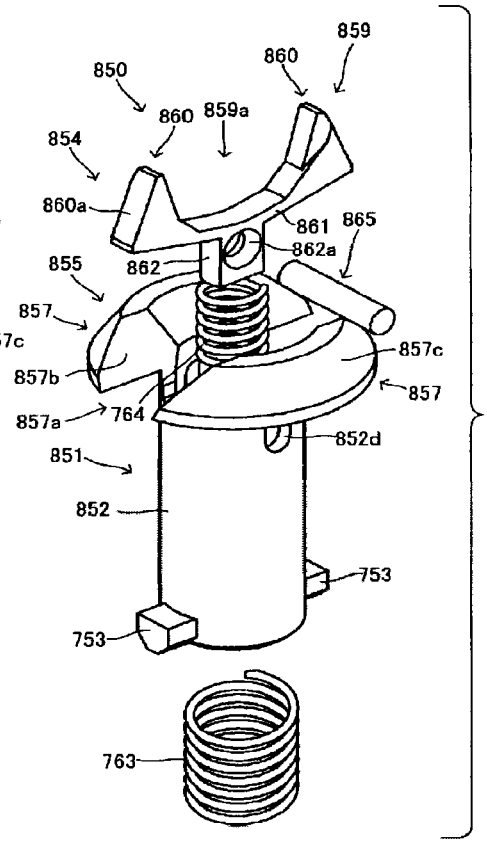
FIG. 64B is an exploded perspective view of the shaft member 850.

Next, a ninth aspect will be described. FIG. 64A is a perspective view of a shaft member 850 in a driving side end member 830 (refer to FIG. 69) included in the aspect. FIG. 64B is an exploded perspective view of the shaft member 850. The driving side end member 830 is an example in which the bearing member 740 is the same, and the shaft member 850 is employed instead of the shaft member 750, compared to the driving side end member 730 which has already been described. Therefore, the same configuration elements of the bearing member 740 will be given the same reference numerals, and the description thereof will be omitted. Hereinafter, the shaft member 850 will be described.

As can be ascertained from FIGS. 64A and 64B, the shaft member 850 is provided with a rotating shaft 851 and a rotating force transmission member 854, and the rotating force transmission member 854 is configured to include a tip end member 855, a claw member 859, and a rod-like pin 865. Furthermore, the shaft member 850 is provided with the rotating shaft elastic member 763 and the claw member elastic member 764. Any of the rotating shaft elastic member 763 and the claw member elastic member 764 of the aspect is the coiled spring, and the same reference numerals as those in the above-described eighth aspect are given.

Figure 65:
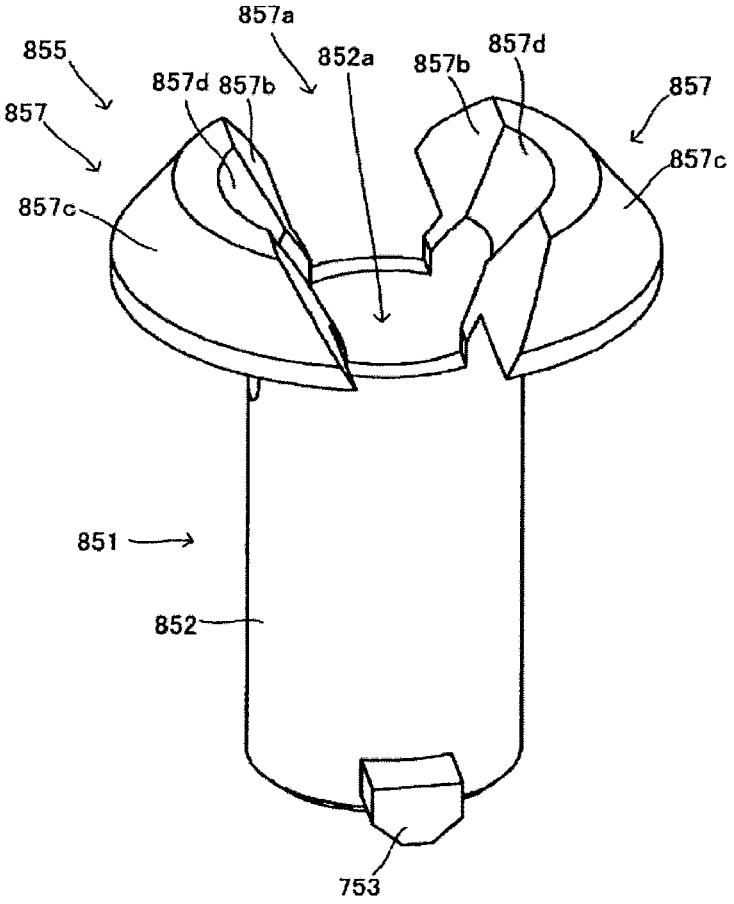
FIG. 65 is a perspective view of a rotating shaft 851 and a tip end member 855.
Figure 66A:
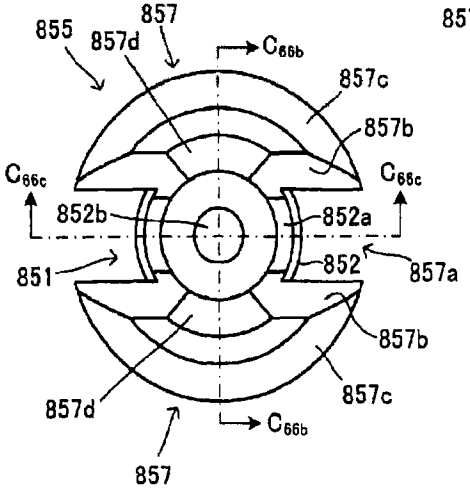
FIG. 66A is a plan view of the rotating shaft 851 and the tip end member 855.
Figure 66B:
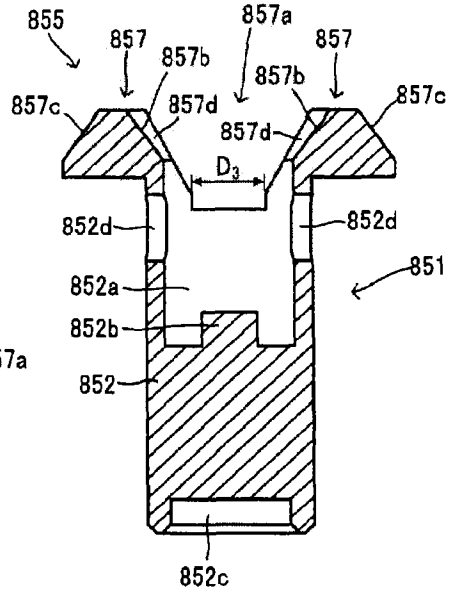
FIG. 66B is one sectional view of the rotating shaft 851 and the tip end member 855.
Figure 66C:
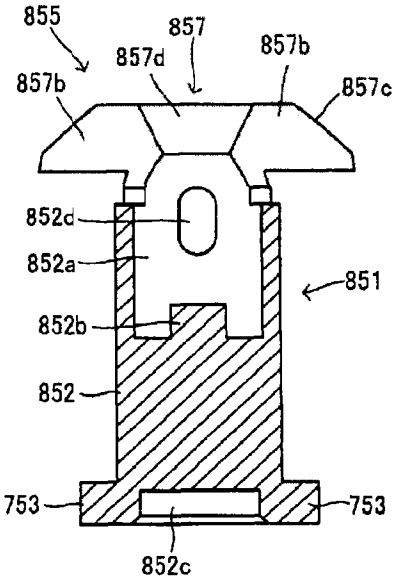
FIG. 66C is another sectional view of the rotating shaft 851 and the tip end member 855.

The rotating shaft 851 is a shaft-shape member which transmits the rotating force received by the rotating force transmission member 854 to the bearing member 740. FIG. 65 is a perspective view of the rotating shaft 851. FIG. 66A is a plan view when viewed from a side on which the tip end member 855 is disposed in the rotating shaft 851. FIG. 66B is a sectional view along the axial direction including a line illustrated by $C_{66b}$-$C_{66b}$ in FIG. 66A. FIG. 66C is a sectional view along the axial direction including a line illustrated by $C_{66c}$-$C_{66c}$ in FIG. 66A. In addition, in the aspect, since the tip end member 855 is integrally disposed in one end portion of the rotating shaft 851, and the tip end member 855 is also illustrated in the drawings.

As can be ascertained from FIGS. 65, 66A to 66C, the rotating shaft 851 includes a columnar main body 852, and recessed portions 852*a* and 852*c* are respectively formed on columnar end surfaces.

The recessed portion 852*a* is a recessed portion which is formed on one end surface of the main body 852 of the rotating shaft 851, and one end side of the claw member elastic member 764 is inserted thereto. In addition, a projection 852*b* for fixing the claw member elastic member 764 is provided on a bottom portion of the recessed portion 852*a*. In the aspect, the claw member elastic member 764 is held as the projection 852*b* is inserted into the claw member elastic member 764.

The recessed portion 852*c* is a recessed portion which is formed on the other end surface of the main body 852 of the rotating shaft 851, that is, on an end surface opposite to the side on which the recessed portion 852*a* is formed. One end of the rotating shaft elastic member 763 is inserted into the recessed portion 852*c*, and one end of the rotating shaft elastic member 763 comes into contact with the bottom of the recessed portion 852*c*. Therefore, the recessed portion 852*c* is formed to have the size in which one end of the rotating shaft elastic member 763 can be inserted.

Two projections 753 are disposed in the end portion on the side where the recessed portion 852*c* is disposed in the outer circumferential portion of the main body 852. Two projections 753 are the same as the projections 753 provided in the main body 752 of the end member 730.

In addition, in the outer circumferential portion of the main body 852, in the end portion on a side on which the recessed portion 852*a* is disposed, a long hole 852*d* which penetrates the main body 852 is disposed in the diameter direction of the main body 852. The long hole 852*d* is a long hole which is long in the axial direction of the main body 852, and is short in the circumferential direction of the main body 852. As will be described later, the pin 865 passes through the long hole 852*d*. In the aspect, the long hole is employed, but it is not necessary to employ a long hole, and a circular hole or a hole having another shape may be employed.

The tip end member 855 is one member which configures the rotating force transmission member 854, and transmits the rotating force from the claw member 859 to the rotating shaft 851. FIGS. 65 and 66A to 66C illustrate the tip end member 855.

As can be ascertained from FIGS. 64, 65, and 66A to 66C, the tip end member 855 in the aspect is configured to include two holding members 857 which are disposed on the end surface on the recessed portion 852*a* side of the main body 852 of the rotating shaft 851.

The holding members 857 are two members which are disposed on an end surface on the recessed portion 852*a* side of the main body 852 of the rotating shaft 851, and are disposed to include a predetermined void 857*a* nipping the axis of the main body 852 of the rotating shaft 851. Therefore, the recessed portion 852*a* of the main body 852 communicates with the inside and the outside via the void 857*a*.

In addition, surfaces 857*b* and 857*d* which form a side wall of the void 857*a* of a holding member 857, are inclined surfaces (tapered surfaces) to be separated from each other as being separated from the rotating shaft 851. Here, among the surfaces 857*b* and 857*d*, the surfaces 857*b* are planes which are disposed at each of both ends in the direction in which the void 857*a* extends, and the surfaces 857*d* are curved surfaces which are disposed between two surfaces 857*b* and have a shape of an arc in the aspect.

Figure 69:
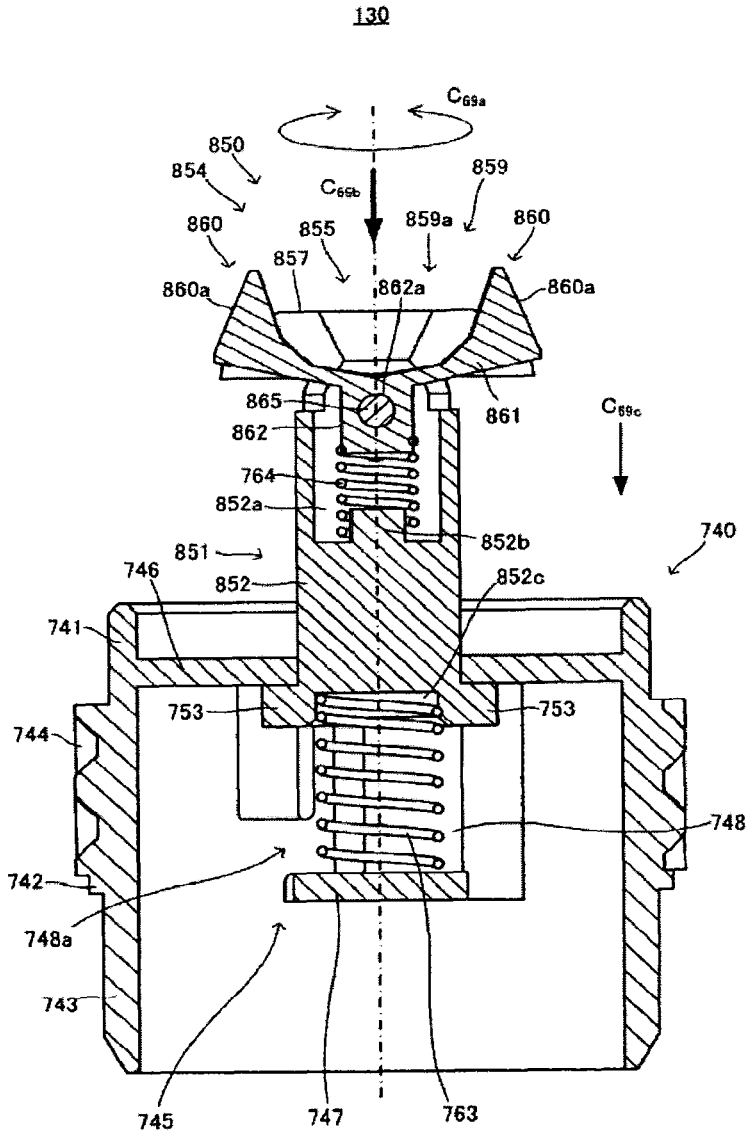
Figure 70A:
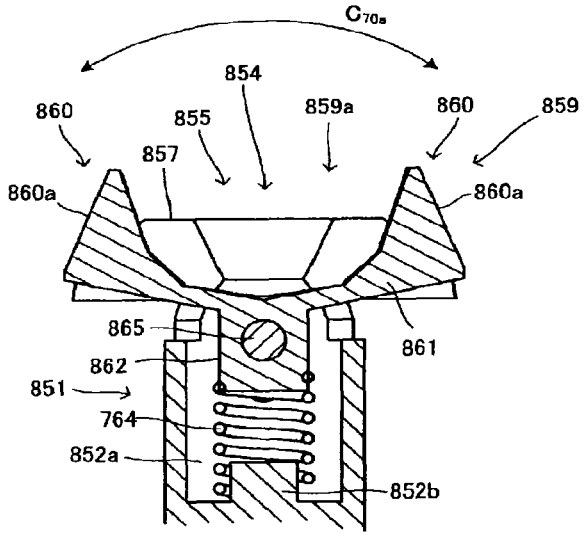
Figure 70B:
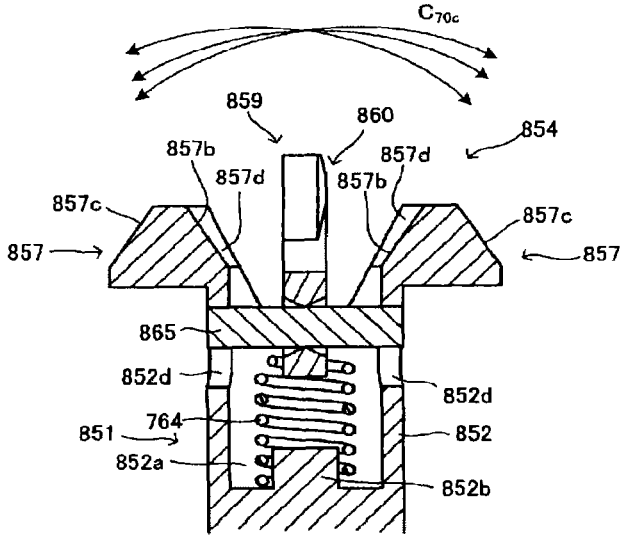

In this manner, as the surfaces 857*b* and 857*d* are inclined surfaces, swing of the claw member 859 is unlikely to be interrupted, and is smoothly performed (refer to FIG. 70B). Furthermore, from the posture in which the driving shaft 70 of the apparatus main body 2 is engaged with the shaft member 850, since the tip end of the shaft portion of the driving shaft 70 slides on the surfaces 857*b* and 857*d* when disengaging the driving shaft 70, and a component of force which presses the shaft member 850 in the axial direction is generated, the shaft member 850 can be moved in the axial direction (direction illustrated by an arrow $C_{69c}$ of FIG. 69). Accordingly, smooth disengagement of the driving shaft 70 can be performed.

Meanwhile, as a side surface (inclined surface, tapered surface) 857*c* other than a surface on which the void 857*a* is formed in the holding member 857 is separated from the rotating shaft 851, the inclined surface (tapered surface) 857*c* is formed to approach the axis of the rotating shaft 851. The inclined surface 857*c* acts similar to the inclined surface 757*b* of the holding member 757 which has already been described.

Figure 67A:
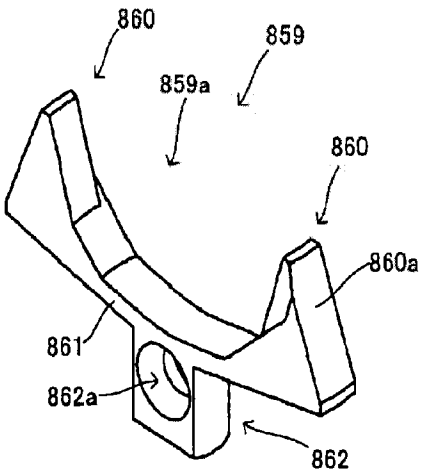
FIG. 67A is a perspective view of a claw member 859.
Figure 67B:
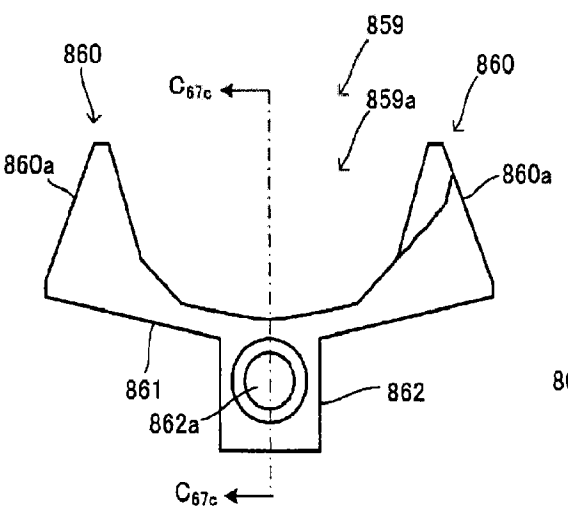
FIG. 67B is a front view of the claw member 859.
Figure 67C:
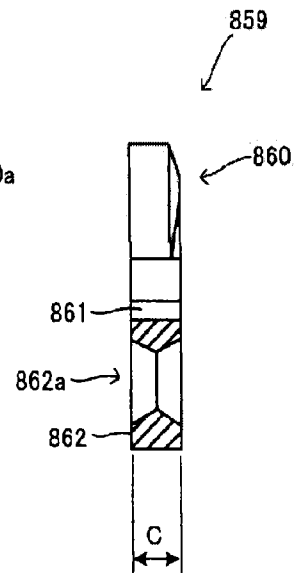
FIG. 67C is a sectional view of the claw member 859.

Returning to FIG. 64, the claw member 859 will be described. The claw member 859 is one member which configures the rotating force transmission member 854, and is a member which is engaged with the driving shaft 70 provided in the apparatus main body 2, and transmits the rotating force to the tip end member 855. FIG. 67 is a view illustrating this. FIG. 67A is a perspective view of the claw member 859. FIG. 67B is a front view of the claw member 859. FIG. 67C is a sectional view from the arrow direction illustrated by $C_{67c}$-$C_{67c}$ in FIG. 67B.

The claw member 859 includes two engagement claws 860, and a linking piece 861 which links end portions of the two engagement claws 860 to each other. In addition, on a side opposite to two engagement claws 860 of the linking piece 861, a holding projection 862 is provided at a position which is the center between the two engagement claws.

Two engagement claws 860 are members which stand in the same direction from both end portions of the linking piece 861, and an interval between two engagement claws 860 is formed so that a tip end of the shaft portion of the driving shaft 70 enters the interval, and the driving projection 71 of the driving shaft 70 is hooked to the engagement claw 860. In addition, in the aspect, two engagement claws 860 are formed to become narrower according to the separation from the linking piece 861 as can be ascertained from FIG. 67B. More specifically, an opposing surface of two engagement claws 860 includes a surface of the linking piece 861, and a recessed portion 859*a* is formed. In the aspect, an opposing surface of two engagement claws 860 is formed in an inclined shape (tapered shape) to be separated according to the separation from the linking piece 861.

In addition, in two engagement claws 860, the surfaces which are opposite to the recessed portion 859*a* are inclined surfaces 860*a* to approach each other according to the separation from the linking piece 861. The inclined surface 860*a* acts similar to the inclined surface 760*a* of the engagement claw 760 which has already been described.

The holding projection 862 is a project which is disposed at a position which is the center between two engagement claws 860, on a surface opposite to the engagement claw 860 of the linking piece 861. The holding projection 862 is fixed to the claw member elastic member 764. In the aspect, since the holding projection 862 is inserted and fixed to the inner side from the end portion of the claw member elastic member 764, the holding projection 862 has the size by which insertion into the claw member elastic member 764 is possible.

In addition, in the holding projection 862, holes 862*a* which penetrate the holding projection 762 are provided in the direction in which two engagement claws 860 are aligned, is provided. As will be described later, the pin 865 passes through the hole 862*a*.

A shape of the hole 862*a* in the penetrating direction is illustrated in FIG. 67C. As can be ascertained from the drawing, the hole 862*a* is the narrowest at the center in the penetrating direction, and the diameter of the hole expands (in a tapered shape) to be inclined so that the hole expands when approaching both ends in the penetrating direction across the entire circumference of the hole 862*a*. Accordingly, smooth swing of the claw member 859 is achieved.

Here, in the claw member 859 which will be described later, the size (thickness) of the linking piece 861 illustrated by C in FIG. 67C, is formed to be smaller than the narrowest width of the void 857*a* illustrated by $D_3$ in FIG. 66B, from the viewpoint that the linking piece 861 swings being disposed on the inner side of the void 857*a* of the tip end member 855 illustrated in FIG. 66B. In addition, the holding projection 862 is also formed to penetrate the void 857*a*.

By combining the bearing member 740 and the shaft member 850 with each other as follows, the end member 830 is made. In addition, by describing the combination, the size of each member and part, the structure, or the relationship of the sizes of the members and parts, are further understood. Here, since the combination between the bearing member 740 and the rotating shaft 851 is the same as that in the example of the end member 730 which has already been described, the description thereof will be omitted.

Figure 68A:
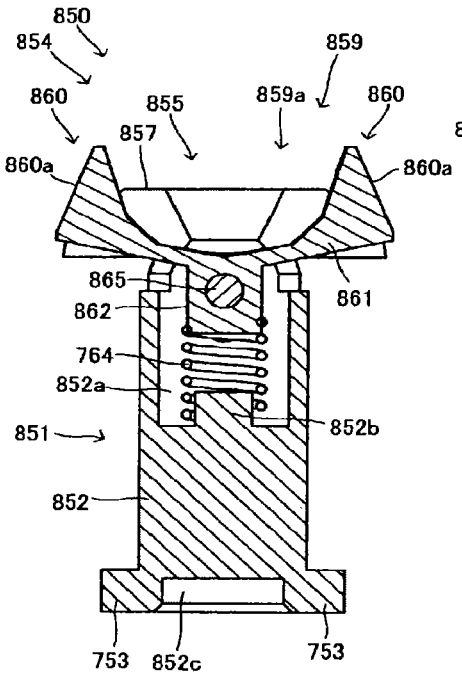
FIG. 68A is one sectional view of the shaft member 850.
Figure 68B:
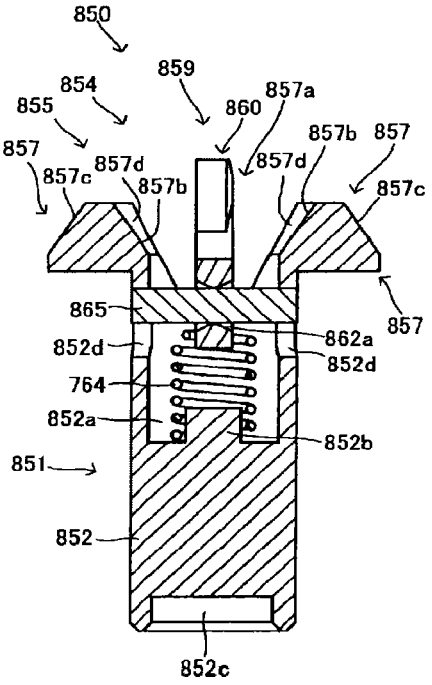
FIG. 68B is another sectional view of the shaft member 850.

The combination of the members with respect to the rotating shaft 851 in the shaft member 850 will be described. FIG. 68 is a view illustrating this. FIG. 68A is a sectional view along the axis of the shaft member 850 in the direction orthogonal to the axis of the pin 865. FIG. 68B is a sectional view along the axis of the shaft member 850 in the direction along the axis of the pin 865.

As can be ascertained from FIGS. 64A, 64B, 64A, and 68B, in the aspect, the claw member elastic member 764 is disposed on the inner side of the recessed portion 852*a* of the main body 852 of the rotating shaft 851. At this time, one end of the claw member elastic member 764 is fixed to be inserted into the projection 852*b*.

In the aspect, the tip end member 855 is integrally formed on the end surface on the side on which the recessed portion 852*a* of the rotating shaft 851 is provided. However, the end surface is not necessarily integrated, may be formed separately and be bonded by adhering, welding, and other mechanical methods.

In addition, the holding projection 862 of the claw member 859 is inserted into the recessed portion 852*a* of the rotating shaft 851 through the void 857*a* between the holding members 857 of the tip end member 855, and the linking piece 861 of the claw member 859 is disposed in the void 857*a* of the tip end member 855. In addition, as the pin 865 passes through the long hole 852*d* of the rotating shaft 851 and the hole 862*a* of the holding projection 862, the claw member 859 is linked to the rotating shaft 851.

By the combination described above, axes of each of the bearing member 740 and the shaft member 850 are disposed to match each other.

Next, how the end member 830 combined as described above can be deformed, move, and rotate, will be described. FIG. 69 is a sectional view along the axis in one posture of the end member 830 of the aspect.

In the posture illustrated in FIG. 69, by the rotating shaft elastic member 763, a posture in which the entire shaft member 850 protrudes the most from the bearing member 740 within a possible range, is achieved. When any external force is not applied to the shaft member 850, the driving side end member 830 has this posture.

In this posture, as can be ascertained from FIG. 69, since the linking piece 861 of the claw member 859 is disposed on the inner side of the void 857*a* of the tip end member 855, when the rotating force is applied to the engagement claw 860 of the claw member 859 as illustrated by Co. in FIG. 69, the claw member 859 is hooked to the holding member 857 of the tip end member 855, or the pin 865 is hooked to the side surface of the hole 862*a*, and the rotating force is transmitted. By any aspect, it is possible to appropriately set whether the rotating force is transmitted. In addition, the rotating force is transmitted to the rotating shaft 851, and further, the projection 753 of the rotating shaft 851 presses the wall of the slit 748*a*, and the rotating force is transmitted to the bearing member 740. Therefore, the entire end member 830 rotates by the rotating force received by the engagement claw 860.

In addition, as illustrated by an arrow $C_{69b}$ in FIG. 69, when the pressing force acts to the claw member 859 toward the bearing member 740 side in the axial direction, the pressing force is transmitted to the tip end member 855 and the rotating shaft 851, and the entire shaft member 850 moves in the direction of being pressed to the bearing member 740 as illustrated by $C_{69c}$ in FIG. 69 against the biasing force of the rotating shaft elastic member 763.

FIG. 70 is an enlarged view illustrating the vicinity of the rotating force transmission member 854. FIG. 70A is a view from the same viewpoint as that of FIG. 68A. FIG. 70B is a view from the same viewpoint as that of FIG. 68B. When the external force is not applied, the claw member 859 holds a basic posture illustrated in FIGS. 70A and 70B by the claw member elastic member 764.

Meanwhile, as the external force is applied, swing around the pin 865 is possible as illustrated by an arrow $C_{70a}$ in FIG. 70A against an elastic force of the claw member elastic member 764.

Furthermore, as the external force is applied, the claw member 859 can swing in all directions other that the swing around the pin 865 as illustrated by an arrow $C_{70c}$ in FIG. 70B against the elastic force of the claw member elastic member 764. This is because the diameter of the hole 862*a* of the holding projection 862 expands (in a tapered shape) to be inclined in both end portions in the penetrating direction.

Therefore, the claw member 859 can swing in all directions around the axis. In addition, in the aspect, the claw member elastic member 764 may be an aspect of a compression spring, but not being limited thereto, may be an aspect of an extension spring.

As described above, since the end member 830 can swing and move similar to the above-described driving side end member 730, the end member 830 acts similar to the end member 730, and the effects are achieved. In addition, in the aspect, since the surfaces 857*b* and 857*d* which form the void 857*a* in the holding member 857 are inclined surfaces (tapered surfaces) as described above, the swing of the claw member 859 illustrated in FIG. 70B is unlikely to be interrupted, and is smoothly performed. Furthermore, from the posture in which the driving shaft 70 of the apparatus main body 2 is engaged with the shaft member 850, since the tip end of the shaft portion of the driving shaft 70 slides on the surfaces 857*b* and 857*d* when disengaging the driving shaft 70, and the component of force which presses the shaft member 850 in the axial direction is generated, the shaft member 850 can be moved in the axial direction in the direction illustrated by the arrow $C_{69c}$ in FIG. 69. Accordingly, smooth disengagement of the driving shaft 70 can be performed.

Figure 71:
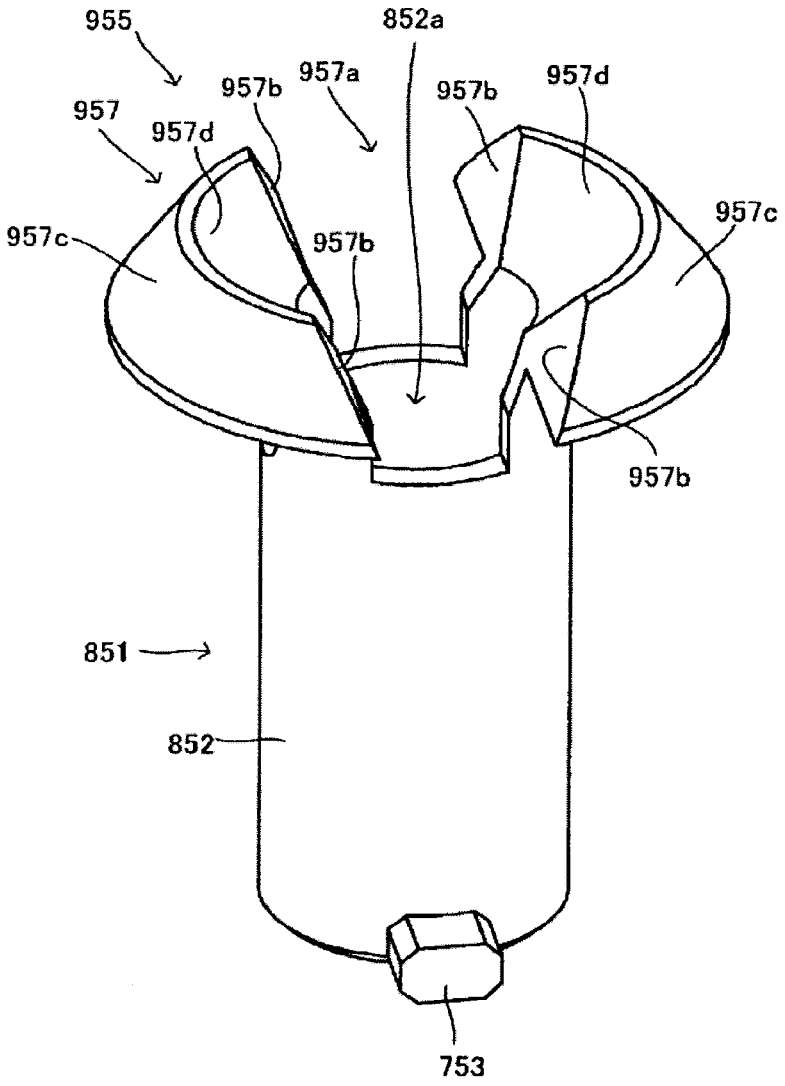

Next, a tenth aspect will be described. FIG. 71 is a view illustrating the tenth aspect. FIG. 71 is a view from the same viewpoint as that of FIG. 65, and is an outer appearance perspective view of the rotating shaft 851 and the tip end member 955 disposed in the rotating shaft 851. The aspect is an example in which the tip end member 955 is employed instead of the tip end member 855 of the driving side end member 830 which has already been described. Here, an aspect of the tip end member 955 will be described. Since the aspect regarding other parts is the same, the same reference numerals will be given, and the description thereof will be omitted.

The tip end member 955 in the aspect, is configured to include two holding members 957 which are disposed on the end surface of the recessed portion 852*a* side of the main body 852 of the rotating shaft 851.

The holding members 957 are two members which are disposed on the end surface of the recessed portion 852*a* side of the main body 852 of the rotating shaft 851, and are disposed to include a predetermined void 957*a* nipping the axis of the main body 852 of the rotating shaft 851. Therefore, the recessed portion 852*a* of the main body 852 communicates with the inside and the outside via the void 957*a*.

In addition, surfaces 957*b* and 957*d* which form a side wall of the void 957*a* of a holding member 957, are inclined surfaces (tapered surfaces) to be separated from each other as being separated from the rotating shaft 851. Here, among the surfaces 957*b* and 957*d*, the surfaces 957*b* are planes which are disposed at each of both ends in the direction in which the void 957*a* extends, and the surfaces 957*d* are curved surfaces which are disposed between two surfaces 957*b* and have a shape of an arc in the aspect. In addition, in the aspect, the surface 957*d* is configured to have an area which is greater than that of the surface 857*d* provided in the tip end member 855 of the above-described ninth.

Meanwhile, a side surface other than a surface on which the void 957*a* of the holding member 957 is formed is separated from the rotating shaft 851, and an inclined surface 957*c* (tapered surface) is formed to approach the axis of the rotating shaft 851. The inclined surface 957*c* acts similar to the inclined surface 757*b* of the holding member 757 which has already been described.

Even the end member provided with the tip end member 955 acts similar to the driving side end member 830.

Figure 72A:
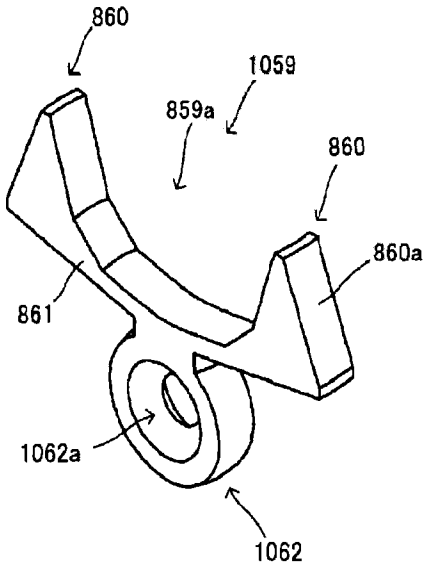
Figure 72B:
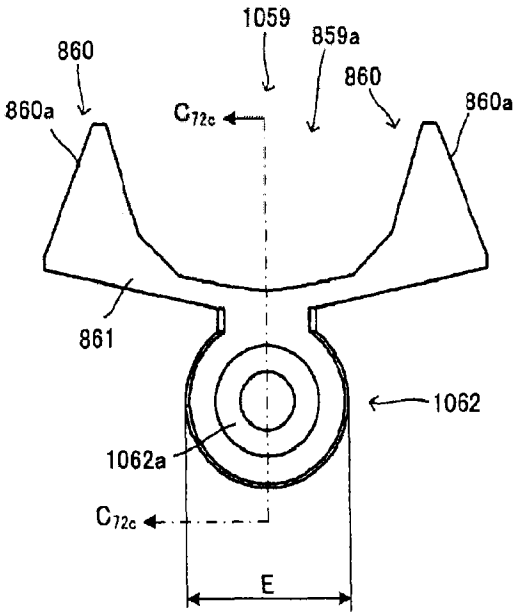
Figure 72C:
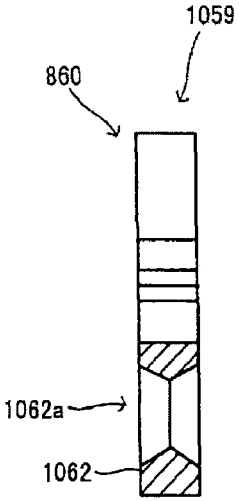
Figure 73A:
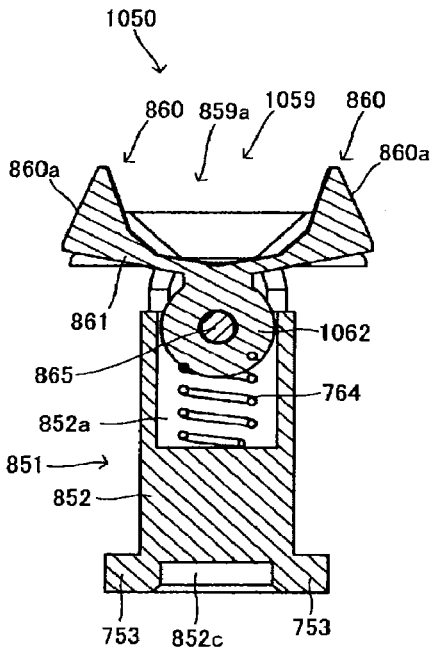
Figure 73B:
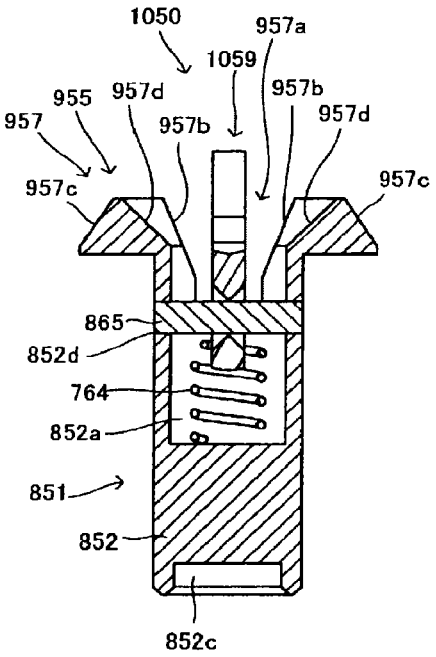

Next, an eleventh aspect will be described. FIGS. 72 and 73 are views illustrating the eleventh aspect. FIG. 72 is a view from the same viewpoint as that of FIG. 67. FIG. 72A is a perspective view of a claw member 1059. FIG. 72B is a front view of the claw member 1059. FIG. 72C is a sectional view from the arrow direction illustrated by $C_{72c}$-$C_{72c}$ in FIG. 72B. In addition, FIG. 73 is a sectional view of a shaft member 1050. FIG. 73A is a sectional view along the axial direction of the shaft member 1050 in the direction orthogonal to the axis of the pin 865. FIG. 73B is a sectional view along the axial direction of the shaft member 1050 in the direction along the axis of the pin 865.

In the aspect, the shaft member 1050 includes the rotating shaft 851, the tip end member 955, the claw member 1059, the claw member elastic member 764, the rotating shaft elastic member 763 (not illustrated in FIGS. 73A and 73B), and the pin 865. Here, since the aspect is similar to the aspect which has already been described except the claw member 1059, the same reference numeral will be given, and the description thereof will be omitted.

The claw member 1059 includes two engagement claws 860, and the linking piece 861 which links end portions of the two engagement claws 860 to each other. In addition, on a side opposite to two engagement claws 860 of the linking piece 861, a holding projection 1062 is provided at a position which is the center between the two engagement claws. Here, since the engagement claw 860 and the linking piece 861 are the same as those in the claw member 859, here, the same reference numeral will be given, and the description thereof will be omitted.

In the aspect, the holding projection 1062 is a projection which is disposed at a position which is the center between two engagement claws 860, on the surface opposite to the engagement claw 860 of the linking piece 861. The holding projection 1062 of the aspect is a plate-like member of an aspect obtained by cutting the spherical body so as to have the same thickness as that of the linking piece 861. Therefore, the circular outer circumference of the holding projection 1062 is a part of the spherical surface. In addition, the width (outer diameter of the holding projection 1062) of the holding projection 1062 illustrated by E in FIG. 72B is substantially the same as or slightly smaller than the diameter of the recessed portion 852*a* of the rotating shaft 851.

The holding projection 1062 is fixed to one end of the claw member elastic member 764. A fixing method is not particularly limited, but, for example, it is possible to provide a hole or a groove for fixing the claw member elastic member 764 to the holding projection 1062, and to fix the end portion of the holding projection 1062 here.

In addition, in the holding projection 1062, a hole 1062*a* which penetrates the holding projection 1062 in the direction orthogonal to the direction in which the two engagement claws 860 are aligned, is provided. The pin 865 passes through the hole 1062*a*.

A shape of the hole 1062*a* in the penetrating direction is illustrated in FIG. 72C. As can be ascertained from the drawing, the hole 1062*a* is the narrowest at the center in the penetrating direction, and the diameter of the hole expands to be inclined (tapered) so that the hole expands when approaching both ends in the penetrating direction across the entire circumference of the hole 1062*a*. Accordingly, smooth swing of the claw member 1059 is achieved.

The shaft member 1050 which includes the above-described claw member 1059 is configured as follows. In addition, as the shaft member 1050 is combined with the bearing member 740, the end member of the aspect is made. In addition, by describing the combination, the size of each member and part, the structure, or the relationship of the sizes of the members and parts, are further understood.

The combination of the members with respect to the rotating shaft 851 in the shaft member 1050 will be described. As can be ascertained from FIGS. 72, 73A, and 73B, in the aspect, the claw member elastic member 764 is disposed on the inner side of the recessed portion 852*a* of the main body 852 of the rotating shaft 851. At this time, one end of the claw member elastic member 764 is fixed to the bottom portion of the recessed portion 852*a*.

In addition, the holding projection 1062 of the claw member 1059 is inserted into the recessed portion 852*a* of the rotating shaft 851 through the void 957*a* between the holding members 857 of the tip end member 855, and the linking piece 861 of the claw member 1059 is disposed in the void 957*a* of the tip end member 955. In addition, as the pin 865 passes through the hole 852*d* (in the aspect, not a long hole, but a circular hole is preferable) of the rotating shaft 851 and the hole 1062*a* of the holding projection 1062, the claw member 1059 is linked to the rotating shaft 851. At this time, the holding projection 1062 is fixed to the end portion of the claw member elastic member 764.

Here, the claw member elastic member 764 may be any of the compression spring and the extension spring. In the aspect, an aspect of the compression spring is illustrated. However, since the extension spring is likely to maintain the claw member 1059 in the basic posture (posture illustrated in FIGS. 73A and 73B), it is preferable to use the extension spring.

By the combination described above, axes of each of the bearing member 740 and the shaft member 1050 are disposed to match each other.

According to the end member made by combining the bearing member 740 and the shaft member 1050 with each other, it is possible to transmit the rotating force according to the example in FIG. 69, and to move in the axial direction of the shaft member 1050, the claw member 1059 can swing according to the example in FIGS. 70A and 70B, and the end member acts similar to the end member of each of the above-described aspects. In addition, in the aspect, by an aspect of the holding projection 1062, since the holding projection 1062 is unlikely to move in the recessed portion 852*a* of the rotating shaft 851, the movement of the claw member 1059 in the direction orthogonal to the axis of the rotating shaft 851 is regulated, and the basic posture is likely to be maintained. In addition, since the outer circumferential surface of the holding projection 1062 is formed by a part of the spherical surface, the smooth swing is performed.

Figure 74A:
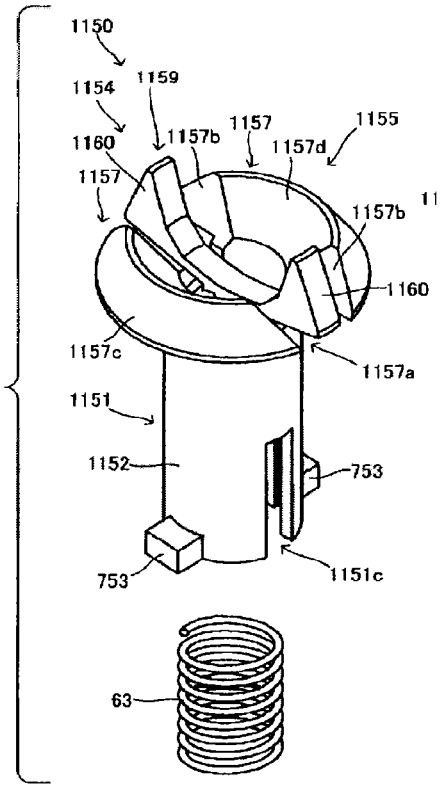
Figure 74B:
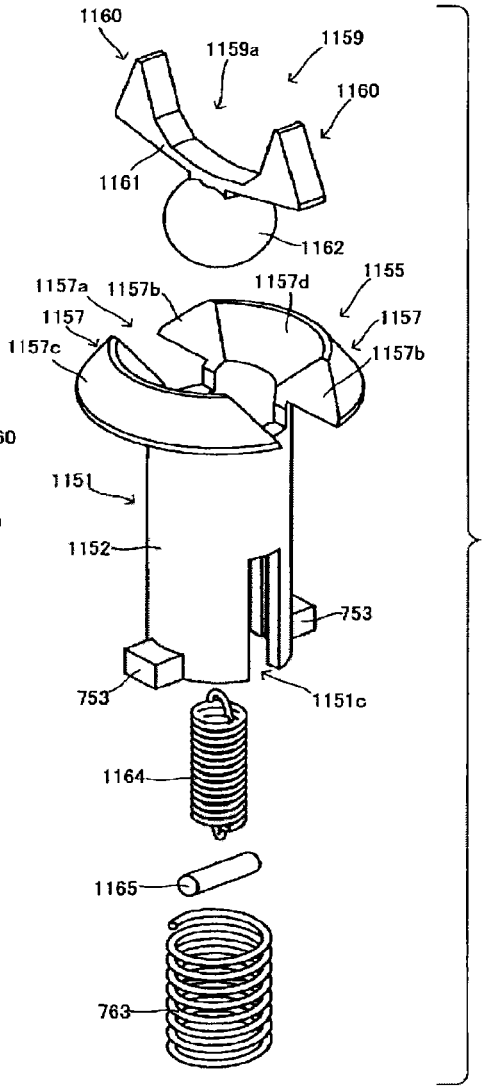

Next, a twelfth aspect will be described. FIG. 74 is a view illustrating the twelfth aspect. FIG. 74A is a perspective view of a shaft member 1150 of an end member 1130 (refer to FIG. 79) included in the twelfth aspect. FIG. 74B is an exploded perspective view of the shaft member 1150. The end member 1130 included in the aspect has the same bearing member as the bearing member 740 with respect to the end member 730 which has already been described, and is an example in which the shaft member 1150 is employed instead of the shaft member 750. Therefore, the configuration of the bearing member 740 will be given the same reference numerals, and the description thereof will be omitted. Hereinafter, the shaft member 1150 will be described.

As can be ascertained from FIGS. 74A and 74B, the shaft member 1150 is provided with a rotating shaft 1151 and a rotating force transmission member 1154, and the rotating force transmission member 1154 is configured to include a tip end member 1155 and a claw member 1159. Furthermore, the shaft member 1150 is provided with the rotating shaft elastic member 763, a claw member elastic member 1164, and a pin 1165. Any of the rotating shaft elastic member 763 and the claw member elastic member 1164 of the aspect is the coiled spring.

Figure 75:
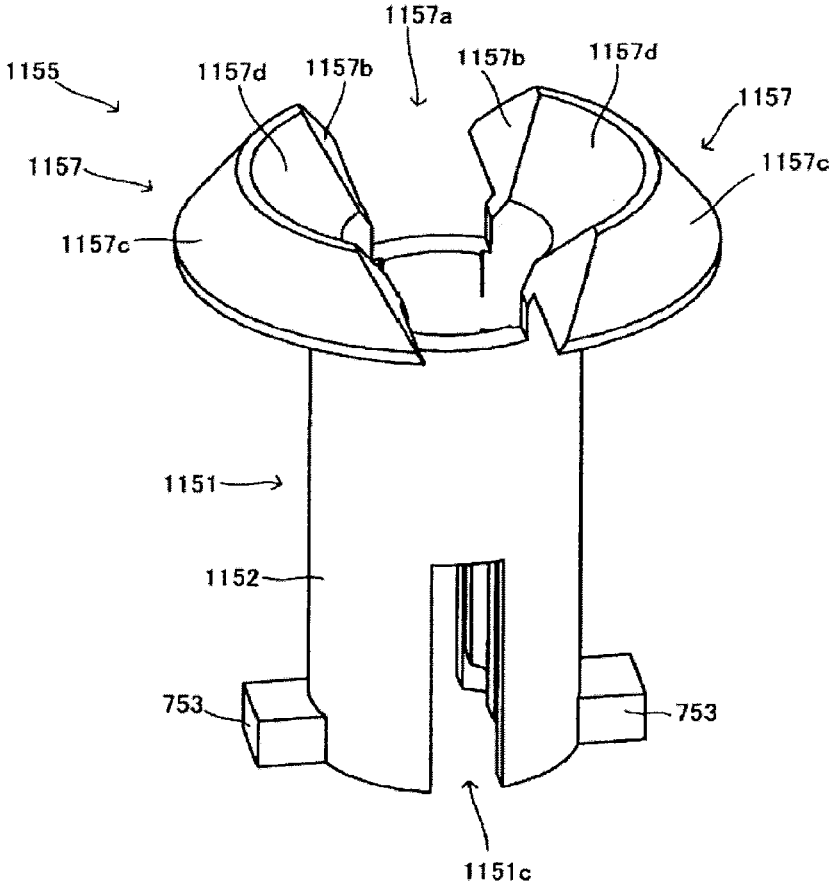

The rotating shaft 1151 is a shaft-shape member which transmits the rotating force received by the rotating force transmission member 1154 to the bearing member 740. FIG. 75 is a perspective view of the rotating shaft 1151. FIG. 76A is a plan view when viewed from a side on which the tip end member 1155 is disposed in the rotating shaft 1151. FIG. 76B is a sectional view along the axial direction including a line illustrated by $C_{76b}$-$C_{76b}$ in FIG. 76A. FIG. 76C is a sectional view along the axial direction including a line illustrated by $C_{76c}$-$C_{76c}$ in FIG. 76A. In addition, in the aspect, since the tip end member 1155 is integrally disposed in one end portion of the rotating shaft 1151, the tip end member 1155 is also illustrated in the drawings.

As can be ascertained from FIGS. 75, 76A to 76C, the rotating shaft 1151 includes a cylindrical main body 1152. As can be ascertained from FIGS. 76B and 76C, on the cylindrical inner side, three spaces 1151*a*, 1151*b*, and 1151*d* which have different inner diameters from each other are aligned in the axial direction. The space 1151*a* is provided in the end portion on the side on which the tip end member 1155 is disposed in the main body 1152, the space 1151*d* is provided in the opposite end portion, and the space 1151*b* is disposed to pass through both spaces 1151*a* and 1151*d*. In the aspect, since the inner diameter of the space 1151*b* is the smallest, a step is generated based on a difference in inner diameters, in a linking portion between the space 1151*a* and the space 1151*b*, and in a linking portion between the space 1151*d* and the space 1151*b*, respectively.

In addition, as can be ascertained from FIG. 76C, the space 1151*a* is provided with an undercut portion 1151*e* which is a part inclined in the direction of slightly nipping an opening in an opening portion on the end surface side of the rotating shaft 1151. The undercut portion 1151*e* functions as a so-called snap-fit projected portion which is formed so that a holding projection 1162 (refer to FIG. 77) which is a sphere of the claw member 1159 which will be described later, does not fall out of the space 1151*a*. Therefore, the opening portion of the space 1151*a* is formed to be narrower than the diameter of the holding projection 1162. In the aspect, the undercut portion 1151*e* is formed of the inclined surface, but instead of this, an aspect in which a projection protrudes may be employed.

Two projections 753 are disposed in the end portion on the side where the space 1151*d* is disposed in the outer circumferential portion of the main body 1152. Two projections 753 are the same as the projections 753 provided in the main body 752 of the end member 730 which has already been described.

In addition, in the tubular wall portion of the main body 1152, in the end portion on a side on which the space 1151*d* is disposed, a slit 1151*c* which extends in the axial direction between two projections 753 and penetrates the inside and the outside of the main body 1152, is provided. In the slit 1151*c*, an end portion on one side in the direction in which the slit extends is opened on an end surface of the main body 1152, and the end portion opposite to the opening reaches the middle part of the space 1151*b*.

The tip end member 1155 is one member which configures the rotating force transmission member 1154, and transmits the rotating force from the claw member 1159 to the rotating shaft 1151. FIGS. 75 and 76A to 76C illustrate the shape of the tip end member 1155.

As can be ascertained from FIGS. 74, 75, and 76A to 76C, the tip end member 1155 in the aspect is configured to include two holding members 1157 which are provided on the end surface on which the space 1151*a* of the main body 1152 of the rotating shaft 1151 is disposed.

The holding members 1157 are two members which are provided on an end surface on the side on which the space

1151*a* of the main body 1152 of the rotating shaft 1151 is disposed, and are disposed to have a predetermined void 1157*a* nipping the axis of the main body 1152 of the rotating shaft 1151. Therefore, the space 1151*a* of the main body 1152 communicates with the inside and the outside via the void 1157*a*.

In addition, surfaces 1157*b* and 1157*d* which form a side wall of the void 1157*a* of a holding member 1157, are inclined surfaces (tapered surfaces) to be separated from each other as being separated from the rotating shaft 1151. Here, among the surfaces 1157*b* and 1157*d*, the surfaces 1157*b* are planes which are disposed at each of both ends in the direction in which the void 1157*a* extends, and the surfaces 1157*d* are curved surfaces which are disposed between two surfaces 1157*b* and have a shape of an arc in the aspect. In the aspect, similar to the holding member 957 (refer to FIG. 71) which has already been described, the surface 1157*d* is formed to be large.

In this manner, as the surfaces 1157*b* and 1157*d* are inclined surfaces, as will be described later, swing of the claw member 1159 is unlikely to be interrupted, and is smoothly performed (refer to FIG. 80B). Furthermore, from the posture in which the driving shaft 70 of the apparatus main body 2 is engaged with the shaft member 1150, since the tip end of the shaft portion of the driving shaft 70 slides on the surfaces 1157*b* and 1157*d* when disengaging the driving shaft 70, and the component of force which presses the shaft member 850 in the axial direction is generated, the shaft member 1150 can be moved in the axial direction (direction illustrated by an arrow $C_{79c}$ of FIG. 79). Accordingly, smooth engagement of the driving shaft 70 can be performed.

Meanwhile, as a side surface other than a surface on which the void 1157*a* is formed in the holding member 1157 is separated from the rotating shaft 1151, the inclined surface (tapered surface) 1157*c* is formed to approach the axis of the rotating shaft 1151. The inclined surface 1157*c* acts similar to the inclined surface 757*b* of the holding member 757 which has already been described.

Returning to FIG. 74, the claw member 1159 will be described. The claw member 1159 is one member which configures the rotating force transmission member 1154, and is a member which is engaged with the driving shaft 70 provided in the apparatus main body 2, and transmits the rotating force to the tip end member 1155. FIG. 77 is a view illustrating this. FIG. 77A is a perspective view of the claw member 1159. FIG. 77B is another perspective view of the claw member 1159 when viewed from a side opposite to FIG. 77A. FIG. 77C is a front view of the claw member 1159.

The claw member 1159 includes two engagement claws 1160, and a linking piece 1161 which links end portions of the two engagement claws 1160 to each other. In addition, on a side opposite to two engagement claws 1160 of the linking piece 1161, a holding projection 1162 is provided at a position which is the center between the two engagement claws.

Two engagement claws 1160 are members which stand in the same direction from both end portions of the linking piece 1161, and an interval between two engagement claws 1160 is formed so that a tip end of the shaft portion of the driving shaft 70 enters the interval, and the driving projection 71 of the driving shaft 70 is hooked to the engagement claw 1160. In addition, in the aspect, two engagement claws 1160 are formed to become narrower according to the separation from the linking piece 1161 as can be ascertained from FIG. 77C. More specifically, an opposing surface of two engagement claws 1160 includes a surface of the linking piece 1161, and a recessed portion 1159*a* is formed. In the aspect, an opposing surface of two engagement claws 1160 is formed in an inclined shape (tapered shape) to be separated according to the separation from the linking piece 1161.

In addition, in two engagement claws 1160, the surface which is opposite to the recessed portion 1159*a* are inclined surfaces 1160*a* to approach each other according to the separation from the linking piece 1161. The inclined surface 1160*a* acts similar to the inclined surface 760*a* of the engagement claw 760 which has already been described.

The holding projection 1162 is a projection which is disposed at a position which is the center between two engagement claws 1160, on the surface opposite to the engagement claw 1160 of the linking piece 1161. The holding projection 1162 of the aspect is a spherical member. In addition, as can be ascertained from FIG. 77B, a hole 1162*a* is formed at a part opposite to the side on which the linking piece 1161 is disposed in the holding projection 1162. As will be described later, the claw member elastic member 1164 is fixed to the hole 1162*a*.

Here, in the claw member 1159, the size (thickness) of the linking piece 1161 illustrated by F in FIG. 77A, is formed to be smaller than the narrowest part of the void 1157*a*, from the viewpoint that the linking piece 1161 swings being disposed on the inner side of the void 1157*a* of the tip end member 1155. In addition, in the holding projection 1162, the spherical diameter is smaller than the void 1157*a*, and is substantially the same as or slightly smaller than the inner diameter of the space 1151*a* formed in the main body 1152 of the rotating shaft 1151. However, as described above, the undercut portion 1151*e* (or a projection) is formed in the opening portion on the side on which the holding projection 1162 is inserted in the space 1151*a* of the rotating shaft 1151, and functions as a falling prevention member. Therefore, the spherical diameter of the holding projection 1162 is greater than the opening portion in which the undercut portion 1151*e* is formed.

By combining the bearing member 740 and the shaft member 1150 with each other as follows, the end member 1130 (refer to FIG. 79) is made. In addition, by describing the combination, the size of each member and part, the structure, or the relationship of the sizes of the members and parts, are further understood. Here, since the combination between the bearing member 740 and the rotating shaft 1151 is the same as that in the example of the end member 730, the description thereof will be omitted.

The combination of the members with respect to the rotating shaft 1151 in the shaft member 1150 will be described. FIG. 78 is a view illustrating this. FIG. 78A is a sectional view along the axis of the shaft member 1150 in the direction in which the engagement claws 1160 are aligned. FIG. 78B is a sectional view along the axis of the shaft member 1150 in the direction orthogonal thereto.

As can be ascertained from FIGS. 74A, 74B, 78A, and 78B, in the aspect, the claw member elastic member 1164 is disposed in the space 1151*b* of the main body 1152 of the rotating shaft 1151. At this time, in the claw member elastic member 1164, the pin 1165 is attached to an end portion on the space 1151*d* side, and the pin 1165 is hooked to the step which is formed by the space 1151*b* and the space 1151*d* in the main body 1152. Accordingly, the claw member elastic member 1164 is held on the inner side of the main body 1152. In addition, when the end portion of the claw member elastic member 1164 and the pin 1165 are attached to each other, it is possible to insert a tool into the main body 1152 from the slit 1151*c* for appropriately fixing the end portion of the claw member elastic member 1164 to the pin 1165, and the assembly is easily performed. Here, the claw member elastic member 1164 may be any of the compression spring and the extension spring, but in the aspect, an aspect of the extension spring is illustrated. Since the extension spring is likely to maintain the claw member 1159 in the basic posture (posture illustrated in FIGS. 78A and 78B), it is preferable to use the extension spring.

Meanwhile, the claw member 1159 is inserted from the side on which the tip end member 1155 is disposed, in the main body 1152 of the rotating shaft 1151. In other words, the holding projection 1162 of the claw member 1159 is inserted into the space 1151*a* of the rotating shaft 1151 through the void 1157*a* between the holding members 1157 of the tip end member 1155, and the linking piece 1161 of the claw member 1159 is disposed in the void 1157*a* of the tip end member 1155. In addition, the holding projection 1162 of the claw member 1159 is fixed to one end of the claw member elastic member 1164 by the hole 1162*a* provided here. At this time, since the undercut portion 1151*e* is formed in the opening portion of the space 1151*a*, by slightly pushing the claw member 1159, the holding projection 1162 is disposed in the space 1151*a*. When the holding projection 1162 enters the space 1151*a*, the holding projection 1162 does not fall out of the space 1151*a* by the undercut portion 1151*e* in a normal use.

By the combination described above, axes of each of the bearing member 740 and the shaft member 1150 are disposed to match each other.

Next, how the end member 1130 combined as described above can be deformed, move, and rotate, will be described. FIG. 79 is a sectional view along the axis in one posture of the end member 1130 of the aspect.

In the posture illustrated in FIG. 79, by the biasing force of the rotating shaft elastic member 763, a posture in which the entire shaft member 1150 protrudes the most from the bearing member 740 within a possible range, is achieved. When any external force is not applied to the shaft member 1150, the end member 1130 has this posture.

In this posture, as can be ascertained from FIG. 79, since the linking piece 1161 of the claw member 1159 is disposed on the inner side of the void 1157*a* of the tip end member 1155, when the rotating force is applied to the engagement claw 1160 of the claw member 1159 as illustrated by $C_{79a}$ in FIG. 79, the claw member 1159 is hooked to the holding member 1157 of the tip end member 1155, and the rotating force is transmitted. In addition, the rotating force is transmitted to the rotating shaft 1151, and further, the projection 753 of the rotating shaft 1151 presses the slit wall of the slit 748*a*, and the rotating force is transmitted to the bearing member 740. Therefore, the entire end member 1130 rotates by the rotating force received by the engagement claw 1160.

In addition, as illustrated by an arrow $C_{79b}$ in FIG. 79, when the pressing force acts toward the bearing member 740 side in the axial direction in the claw member 1159, the claw member 1159 presses the tip end member 1155, and further, this is transmitted to the rotating shaft 1151, the entire shaft member 1150 moves in the direction of being pressed to the bearing member 740 as illustrated by $C_{79c}$ in FIG. 79 against the biasing force of the rotating shaft elastic member 763.

FIG. 80 is an enlarged view illustrating the vicinity of the rotating force transmission member 1154. FIG. 80A is a view from the same viewpoint as that of FIG. 78A. FIG. 80B is a view from the same viewpoint as that of FIG. 78B. When the external force is not applied, the claw member 1159 holds a basic posture illustrated in FIGS. 80A and 80B by the claw member elastic member 1164.

Meanwhile, as the external force is applied, swing around the spherical holding projection 1162 is possible as illustrated by an arrow $C_{80a}$ in FIG. 80A against the elastic force of the claw member elastic member 1164. At this time, since the holding projection 1162 is spherical, and the diameter of the holding projection 1162 is substantially the same as the inner diameter of the space 1151*a* in which the holding projection 1162 is disposed, rattling is suppressed and smooth swing is possible.

Furthermore, as the external force is applied, the claw member 1159 can swing in all directions other that the swing around the spherical holding projection 1162 as illustrated by an arrow $C_{80c}$ in FIG. 80B against the elastic force of the claw member elastic member 1164. At this time, when the holding projection 1162 is spherical, since the diameter of the holding projection 1162 is formed to be substantially the same as the inner diameter of the space 1151*a* in which the holding projection 1162 is disposed, rattling is suppressed and smooth swing is possible.

Therefore, the claw member 1159 can swing in all directions around the axis.

As described above, since the end member 1130 can swing and move similar to the above-described driving side end member 730, the end member 1130 acts similar to the end member 730, and the effects are achieved.

In addition, in the aspect, since the holding projection 1162 is formed in a spherical shape, rattling is suppressed and smooth swing is possible.

Next, a thirteenth aspect will be described. FIG. 81 is a view illustrating the thirteenth aspect. FIG. 81A is a perspective view of a shaft member 1250 in an end member 1230 (refer to FIG. 85) included in the thirteenth aspect. FIG. 81B is an exploded perspective view of the shaft member 1250. The aspect is an example in which the end member 1230 included in the aspect is the same as the bearing member 740 of the driving side end member 730 which has already been described, and the shaft member 1250 is employed instead of the shaft member 750. Therefore, regarding the configuration of the bearing member 740, the same reference numerals will be given, and the description thereof will be omitted. Hereinafter, the shaft member 1250 will be described.

As can be illustrated in FIGS. 81A and 81B, the shaft member 1250 is provided with a rotating shaft 1251 and a rotating force transmission member 1254, and in the aspect, the rotating force transmission member 1254 is configured of a claw member 1259. Furthermore, the shaft member 1250 is provided with the rotating shaft elastic member 763, the claw member elastic member 1164, and a pin 1165. The rotating shaft elastic member 763, the claw member elastic member 1164, and the pin 1165, are the same as those in the shaft member 1150 described in the twelfth aspect.

The rotating shaft 1251 is a shaft-shape member which transmits the rotating force received by the rotating force transmission member 1254 to the bearing member 740. FIG. 82A is a perspective view of the rotating shaft 1251. FIG. 82B is a plan view when viewed from a side on which the claw member 1259 is disposed in the rotating shaft 1151. FIG. 82C is a sectional view along the axial direction including a line illustrated by $C_{82c}$-$C_{82c}$ in FIG. 82B.

As can be ascertained from FIGS. 82A to 82C, the rotating shaft 1251 includes a cylindrical main body 1252. As illustrated in FIG. 82C, on the cylindrical inner side, three spaces 1251*a*, 1251*b*, and 1251*d* which have different inner diameters from each other are aligned in the axial direction.

The space 1251*a* is provided in the end portion on the side on which the claw member 1259 is disposed in the main body 1252, the space 1251*d* is provided in the opposite end portion, and the space 1251*b* is disposed to pass through both spaces 1251*a* and 1251*d*. In the aspect, since the inner diameter of the space 1251*b* is the smallest, a step is generated based on a difference in inner diameters, in a linking portion between the space 1251*a* and the space 1251*b*, and in a linking portion between the space 1251*d* and the space 1251*b*, respectively.

In addition, as can be ascertained from FIGS. 82B and 82C, the space 1251*a* is provided with an undercut portion 1251*e* which is a part inclined in the direction of slightly nipping the opening in an opening portion on the end surface side of the rotating shaft 1251. The undercut portion 1251*e* functions as a so-called snap-fit projected portion formed so that a holding projection 1262 (refer to FIG. 83) which is a sphere of the claw member 1259 which will be described later, does not fall out of the space 1251*a*. Therefore, the opening portion of the space 1251*a* is formed to be narrower than the diameter of the holding projection 1262. In the aspect, the undercut portion 1251*e* is formed of the inclined surface, but instead of this, an aspect in which a projection protrudes may be employed.

Two projections 753 are disposed in the end portion on the side where the space 1251*d* is disposed in the outer circumferential portion of the main body 1252. Two projections 753 are the same as the projections 753 provided in the main body 752 of the end member 730 which has already been described.

In addition, in the tubular wall portion of the main body 1252, in the end portion on a side on which the space 1251*d* is disposed, a slit 1251*c* which extends in the axial direction between two projections 753 and penetrates the inside and the outside of the main body 1252, is provided. In the slit 1251*c*, an end portion on one side in the direction in which the slit extends is opened on an end surface of the main body 1252, and the end portion opposite to the opening reaches the middle part of the space 1251*b*.

Furthermore, in the tubular wall portion of the main body 1252, two slits 1251*f* nip the axis and are disposed to face each other in the end portion on the side on which the space 1251*a* is disposed. The slit 1251*f* is a slit which extends in the axial direction of the main body 1252, and penetrates the inside and the outside of the main body 1252, the end portion on one side in the direction in which the slit 1251*f* extends is opened on the end surface of the main body 1252, and the end portion opposite to the opening has already reached the end portion in the axial direction of the space 1251*a*.

Returning to FIGS. 81A and 81B, the claw member 1259 will be described. The claw member 1259 is a member which configures the rotating force transmission member 1254, and is a member which is engaged with the driving shaft 70 provided in the apparatus main body 2, and transmits the rotating force to the rotating shaft 1251. FIG. 83 is a view illustrating this. FIG. 83A is a perspective view of the claw member 1259. FIG. 83B is another perspective view of the claw member 1259 when viewed from the side opposite to FIG. 83A. FIG. 83C is a front view of the claw member 1259.

The claw member 1259 includes two engagement claws 1260, and a disk-like linking piece 1261 which includes, and the disk-like linking piece 1261 which links end portions of the two engagement claws 1260 to each other. In addition, on a side opposite to the engagement claws 1260 of the linking piece 1261, a holding projection 1262 is provided at the center of the disk-like linking piece 1261.

Two engagement claws 1260 are members which stand in the same direction from an edge of a surface on one side of the disk-like linking piece 1261, and forms a wall curved in a shape of an arc. Therefore, a container-like recessed portion 1259*a* which is surrounded by considering the linking piece 1261 as a bottom portion and two engagement claws 1260 as walls, is formed. In addition, a void 1259*b* is formed between end portions of two engagement claws 1260. The tip end of the shaft portion of the driving shaft 70 enters the recessed portion 1259*a*, and the shape by which the driving projection 71 of the driving shaft 70 can be disposed in the void 1259*b*, is formed.

In addition, in the aspect, two engagement claws 1260 are inclined to be separated from each other according to the separation from the linking piece 1261 with respect to the surface (inner surface) on the recessed portion 1259*a* side, and are formed so that the diameter becomes greater according to the separation from the linking piece 1261. Meanwhile, in two engagement claws 1260, the outer circumferential surface which is opposite to the recessed portion 1259*a* are inclined surfaces 1260*a* to approach each other according to the separation from the linking piece 1261. The inclined surface 1260*a* acts similar to the inclined surface 760*a* of the engagement claw 760 which has already been described.

On the surface opposite to the engagement claw 1260 in the linking piece 1261, the holding projection 1262 is a projection which is disposed at a position which is the center of the disk-like linking piece 1261. In the aspect, the holding projection 1262 is a spherical member. In addition, two regulation projections 1263 protrude from a surface of the holding projection 1262 on one diameter of a sphere in the holding projection 1262. It is preferable that the diameter of the sphere in which the regulation projection 1263 is in parallel (in the aspect) in the direction which is orthogonal to the axis of the end member 1230 and in which two voids 1259*b* are aligned, or in the direction orthogonal to the direction in which the voids 1259*b* are aligned. The regulation projection 1263 is disposed on the inner side of the slit 1251*f* of the above-described rotating shaft 1251.

In addition, as can be ascertained from FIG. 83B, a hole 1262*a* is formed at a part opposite to the side on which the linking piece 1261 is disposed in the holding projection 1262. As will be described later, a claw member elastic member 1264 is fixed to the hole 1262*a*.

Here, as will be described later, the diameter of the sphere of the holding projection 1262 of the claw member 1259 is substantially the same as or slightly smaller than the inner diameter of the space 1251*a* formed in the main body 1252 of the rotating shaft 1251. However, as described above, the undercut portion 1251*e* (or a projection) is formed in the opening portion on the side on which the holding projection 1262 is inserted in the space 1251*a* of the rotating shaft 1251, and functions as a falling prevention member. Therefore, the spherical diameter of the holding projection 1262 is greater than the opening portion in which the undercut portion 1251*e* is formed.

By combining the bearing member 740 and the shaft member 1250 with each other as follows, the end member 1230 is made. In addition, by describing the combination, the size of each member and part, the structure, or the relationship of the sizes of the members and parts, are further understood. Here, since the combination between the bearing member 740 and the rotating shaft 1251 is the same as that in the example of the end member 730, the description thereof will be omitted.

The combination of the members with respect to the rotating shaft 1251 in the shaft member 1250 will be described. FIG. 84 is a view illustrating this. FIG. 84A is a sectional view along the axis of the shaft member 1250 in the direction in which the engagement claws 1260 are aligned, in a section orthogonal to the diameter direction of the holding projection 1262 including two regulation projections 1263. FIG. 84B is a sectional view along the axis of the shaft member 1250 in the direction in which the voids 1259*b* are aligned, in the section along the diameter direction of the holding projection 1262 including two regulation projections 1263.

As can be ascertained from FIGS. 81A, 81B, 84A, and 84B, in the aspect, the claw member elastic member 1164 is disposed in the space 1251*b* of the main body 1252 of the rotating shaft 1251. At this time, in the claw member elastic member 1164, the pin 1165 is attached to the end portion on the space 1251*d* side, and the pin 1165 is hooked to the step which is formed by the space 1151*b* and the space 1151*d* in the main body 1252. Accordingly, the claw member elastic member 1164 is held on the inner side of the main body 1252. In addition, when the end portion of the claw member elastic member 1164 and the pin 1165 are attached to each other, it is possible to insert a tool into the main body 1252 from the slit 1251*c* for appropriately fixing the end portion of the claw member elastic member 1164 to the pin 1165, and the assembly is easily performed. Here, the claw member elastic member 1164 may be any of the compression spring and the extension spring. In the aspect, an aspect of the extension spring is illustrated. Since the extension spring is likely to maintain the claw member 1259 in the basic posture (posture illustrated in FIGS. 84A and 84B), it is preferable to use the extension spring.

Meanwhile, the claw member 1259 is inserted from the side on which the space 1251*a* is disposed, in the main body 1252 of the rotating shaft 1251. In other words, the holding projection 1262 of the claw member 1259 is inserted into the space 1251*a* of the rotating shaft 1251. At this time, the regulation projection 1263 is disposed on the inner side of the slit 1251*f* of the main body 1252. In addition, the holding projection 1162 of the claw member 1259 is fixed to one end of the claw member elastic member 1164 by the hole 1262*a* provided here. At this time, since the undercut portion 1251*e* is formed in the opening portion of the space 1251*a*, by slightly pushing the claw member 1259, the holding projection 1262 is disposed in the rotating shaft 1251. When the holding projection 1162 enters the space 1251*a*, the holding projection 1262 does not fall out of the space 1251*a* by the undercut portion 1251*e* in a normal use.

By the combination described above, axes of each of the bearing member 740 and the shaft member 1250 are disposed to match each other.

Next, how the end member 1230 can be deformed, move, and rotate, will be described. FIG. 85 is a sectional view along the axis in one posture of the end member 1230 of the aspect.

In the posture illustrated in FIG. 85, by the biasing force of the rotating shaft elastic member 763, a posture in which the entire shaft member 1250 protrudes the most from the bearing member 740 within a possible range, is achieved. When any external force is not applied to the shaft member 1250, the end member 1230 has this basic posture.

In this posture, as can be ascertained from FIG. 85, since the regulation projection 1263 of the claw member 1259 is disposed on the inner side of the slit 1251*f* of the rotating shaft 1251, when the rotating force is applied to the engagement claw 1260 of the claw member 1259 as illustrated by $C_{85a}$ in FIG. 85, the regulation projection 1263 of the claw member 1259 is hooked to the side surface of the slit 1251*f* of the rotating shaft 1251, and the rotating force is transmitted. In addition, the projection 753 of the rotating shaft 1251 presses the slit wall of the slit 748*a*, and the rotating force is transmitted to the bearing member 740. Therefore, the entire end member 1230 rotates by the rotating force received by the engagement claw 1260.

In addition, as illustrated by an arrow $C_{85b}$ in FIG. 85, when the pressing force acts toward the bearing member 740 side in the axial direction in the claw member 1259, the claw member 1259 presses the rotating shaft 1251, and the entire shaft member 1250 moves in the direction of being pressed to the bearing member 740 as illustrated by $C_{85c}$ in FIG. 85 against the biasing force of the rotating shaft elastic member 763.

FIG. 86 is a view illustrating the vicinity of the rotating force transmission member 1254. FIG. 86A is a view from the same viewpoint as that of FIG. 84A. FIG. 86B is a view from the same viewpoint as that of FIG. 84B. When the external force is not applied, the claw member 1259 holds a basic posture illustrated in FIGS. 86A and 86B by the claw member elastic member 1164.

Meanwhile, as the external force is applied, the claw member 1259 swings around the axis of the regulation projection 1263 as illustrated by an arrow $C_{86a}$ in FIG. 86A against the elastic force of the claw member elastic member 1164. At this time, since the regulation projection 1263 is disposed in the slit of the rotating shaft 1251, rattling is suppressed and smooth swing is possible.

Furthermore, as the external force is applied, the claw member 1259 can also swing around the spherical holding projection 1262 on the surface on which the regulation projection 1263 moves within the slit 1251*f*, as illustrated by an arrow $C_{86b}$ in FIG. 86B against the elastic force of the claw member elastic member 1164. At this time, since the holding projection 1262 is spherical, and the diameter of the holding projection 1262 is formed to be substantially the same as the inner diameter of the space 1251*a* in which the holding projection 1262 is disposed, rattling is suppressed and smooth swing is possible.

Therefore, the claw member 1259 can swing in all directions.

Next, a fourteenth aspect will be described. FIG. 87 is an exploded perspective view of an end member 1330 included in the fourteenth aspect. FIG. 88 is an exploded perspective view along the axis of the end member 1330. The end member 1330 is provided with a bearing member 1340 and a shaft member 1350.

The bearing member 1340 is a member which is bonded to the end portion of the photoreceptor drum 11 in the end member 1330. FIG. 89 is a perspective view of a main body 1341 of the bearing member 1340. FIG. 88 is a sectional view in the axial direction of the bearing member 1340.

The bearing member 1340 includes the main body 1341 and a rotating shaft holding member 1346, and as can be ascertained from FIGS. 87 to 89, the main body 1341 includes the tubular body 741, the fitting portion 743, the gear portion 744, and a shaft member holding portion 1345.

Since the tubular body 741, the fitting portion 743, and the gear portion 744 are similar to those of the above-described end member 730, the same reference numerals will be given, and the description thereof will be omitted.

The shaft member holding portion 1345 is a part which is formed on the inner side of the tubular body 741, and which has a function of holding the shaft member 1350 in the bearing member 1340. As can be ascertained from FIGS. 87 to 88, the shaft member holding portion 1345 includes the rotating shaft holding member 1346, a support member 1347, and a guide wall 1348.

The rotating shaft holding member 1346 is a plate-like member which is formed to block the inner side of the tubular body 741, but is formed in a shape of a lid which is attachable to and detachable from the main body 1341 in the aspect. FIG. 90A is one perspective view of the rotating shaft holding member 1346. FIG. 90B is a perspective view when viewed from a surface side opposite to FIG. 90A.

In the rotating shaft holding member 1346, a hole 1346*a* which is coaxial to the axis of the tubular body 741 is formed in a posture of being mounted on the main body 1341. Since the hole 1346*a* penetrates a rotating shaft 1351 as will be described later, the rotating shaft 1351 has the size and the shape by which the rotating shaft 1351 can penetrate. However, in order to prevent the rotating shaft 1351 from falling out, the hole 1346*a* can penetrate a main body 1352 of the rotating shaft 1351, but cannot penetrate a part on which a projection 1353 is disposed. In addition, from the viewpoint of stabilized movement of the rotating shaft 1351, it is preferable that the hole 1346*a* has the shape and the size which are substantially the same as the outer circumference of the main body 1352 of the rotating shaft 1351 within a range in which the hole 1346*a* does not interrupt the movement of the rotating shaft 1351 in the axial direction.

In addition, in the aspect, since the rotating shaft holding member 1346 is an aspect which is attachable to and detachable from the main body 1341, a claw 1346*b* which is engaged with the main body 1341 is provided. However, the aspect for attaching the rotating shaft holding member to the main body is not limited thereto, and adhering by the adhesive, or fusion by heat or ultrasonic wave, can be employed.

The support member 1347 is a plate-like member which is provided further on the fitting portion 743 side than the rotating shaft holding member 1346, and is formed to block at least a part of the inner side of the tubular body 741. The support member 1347 is formed in the size and the shape by which at least the rotating shaft elastic member 763 which will be described later can be supported. In addition, in the support member 1347 in the aspect, a hole 1347*a* through which an elastic member holding projection 1353*a* provided in the rotating shaft 1351 penetrates, is formed.

The guide wall 1348 is a tubular member which extends in parallel to the axial direction of the tubular body 741 on the side opposite to the fitting portion 743 from the support member 1347. In the aspect, the sectional shape of a space 1348*a* which is formed on the inner side surrounded by the guide wall 1348, is substantially triangular (top point takes R in a shape of an arc) as can be ascertained from FIG. 89, and is substantially the same as the shape of the projection 1353 of the rotating shaft 1351. Therefore, the space 1348*a* surrounded by the guide wall 1348 has a shape of a triangular prism which considers the direction along the axis of the bearing member 1340 as the height direction.

A material which configures the bearing member 1340 is not particularly limited, but it is possible to use a material similar to that of the above-described bearing member 740.

Returning to FIGS. 87 and 88, the shaft member 1350 of the end member 1330 will be described. As can be ascertained from FIG. 88, the shaft member 1350 is provided with the rotating shaft 1351 and a rotating force transmission member 1354, and the rotating force transmission member 1354 is configured to include a tip end member 1355 and a claw member 1359. In the aspect, the tip end member 1355 and the claw member 1359 are integrally formed.

Furthermore, the shaft member 1350 is provided with the rotating shaft elastic member 763 and the claw member elastic member 764. Any of the rotating shaft elastic member 763 and the claw member elastic member 764 in the aspect is a coiled spring.

Hereinafter, each of the members will be described.

The rotating shaft 1351 is a shaft-shape member which transmits the rotating force received by the rotating force transmission member 1354 to the bearing member 1340. FIG. 91A is a perspective view of the rotating shaft 1351. FIG. 91B is a plan view of the rotating shaft when viewed from the direction illustrated by $L_1$ in FIG. 91A. In addition, FIG. 88 is a sectional view in the axial direction of the rotating shaft 1351.

As can be ascertained from FIGS. 88, 91A, and 91B, the rotating shaft 1351 includes the cylindrical main body 1352, and cutouts 1352*a* at two locations at a predetermined width in the direction along the axis from the end portion on one side in the direction along the axis, in the cylindrical wall portion. In the aspect, the cutout 1352*a* is rectangular in a side view, and the width thereof is the size having 90° of a center angle in a plan view as illustrated by $L_2$ in FIG. 91B. Therefore, in the aspect, two cutouts 1352*a* which have the width which is the size having 90° of the center angle, are provided to face each other nipping the axis. In addition, the size in the direction along the axis of the cutout 1352*a* illustrated by $L_3$ in FIG. 91A, is a substantial half of the length in the direction along the axis of the main body 1352 in the aspect. Accordingly, a projected portion 1352*b* which is the rest of a wall portion of the main body 1352 is formed between two cutouts 1352*a*.

One end side of the claw member elastic member 764 is inserted into the tubular inner side of the main body 1352.

Among the end portions of the main body 1352, in the end portion opposite to the end portion on a side on which the cutout 1352*a* and the projected portion 1352*b* are formed, the projection 1353 is disposed. As can be ascertained from FIG. 91B, in the projection 1353, in a plan view of the rotating shaft 1351, a part which protrudes toward the outside from the main body 1352 is formed. In the aspect, the projection 1353 is a substantially triangular (top point takes R in a shape of an arc) plate-like member, and is substantially the same as the sectional view of the space 1348*a* surrounded by the guide wall 1348 of the above-described bearing member 1340 (refer to FIG. 89). In addition, the thickness of the projection 1353 illustrated by $L_4$ in FIG. 91A, is thinner than the length in the direction along the axis of the guide wall 1348. Accordingly, when the projection 1353 is disposed in the space surrounded by the guide wall 1348, movement in the direction along the axis of the rotating shaft 1351 is possible, and the rotating force is transmitted to the bearing member 1340 from the rotating shaft 1351 with respect to the rotation around the axis.

Furthermore, in the aspect, in the projection 1353, on the surface opposite to the side on which the main body 1352 is disposed, the columnar elastic member holding projection 1353*a* extends. As will be described later, the elastic member holding projection 1353*a* penetrates the inner side of the rotating shaft elastic member 763, and further, a tip end thereof passes through the hole 1347*a* of the support member 1347. Accordingly, stability of the movement in the direction along the axis of the rotating shaft 1351 is improved.

It is preferable that the axis of the above-described main body 1352, the center of gravity of the projection 1353, and the axis of the elastic member holding projection 1353*a*, are disposed coaxially.

Returning to FIGS. 87 and 88, other members will be continuously described. In the aspect, the rotating force transmission member 1354 is integrally configured with the tip end member 1355 and the claw member 1359. The tip end member 1355 is a member which holds an engagement claw 1360 (in the aspect, the claw member 1359 is configured only of the engagement claw 1360) to be swingable, and transmits the rotating force from the engagement claw 1360 to the rotating shaft 1351. FIG. 92A is a perspective view of the rotating force transmission member 1354. FIG. 92B is a bottom view of the rotating force transmission member 1354 when viewed from the side opposite to the side on which the engagement claw 1360 is disposed. In addition, FIG. 88 is a sectional view along the axis of the rotating force transmission member 1354.

As can be ascertained from the drawings, the tip end member 1355 is configured to include a disk-like base portion 1356 and a rotating shaft linking portion 1357 which extends on one surface of the base portion 1356.

In the aspect, the base portion 1356 has a shape of a disk, and a recessed portion 1356*a* is provided at the center of the surface opposite to the rotating shaft linking portion 1357 on the plate surface. A tip end part of the above-described driving shaft 70 is disposed in the recessed portion 1356*a*.

In addition, on the outer circumferential surface of the base portion 1356, an inclined surface 1356*b* is formed so that the diameter becomes smaller according to the separation from the rotating shaft linking portion 1357. The inclined surface acts similar to the inclined surface 757*b* of the above-described holding member 757.

The rotating shaft linking portion 1357 is a cylindrical part which extends from the surface opposite to the recessed portion 1356*a* in the base portion 1356, and the center shaft of the base portion 1356 and the axis of the rotating shaft linking portion 1357 are formed coaxially. In addition, the rotating shaft linking portion 1357 is provided with cutouts 1357*a* at two locations at a predetermined width in the direction along the axis from the end portion on the side opposite to the base portion 1356, in the cylindrical wall portion. In the aspect, the cutout 1357*a* is rectangular in a side view, and the width thereof is the size having 90° of a center angle in a plan view as illustrated by $L_5$ in FIG. 92B. Therefore, in the aspect, two cutouts 1357*a* which have the width which is the size having 90° of the center angle, are provided to face each other nipping the axis. In addition, the size in the direction along the axis of the cutout 1357*a* illustrated by $L_6$ in FIG. 92A, is the same as the size ($L_3$ in FIG. 91A) of the cutout 1352*a* provided in the main body 1352 of the above-described rotating shaft 1351 in the aspect. Accordingly, a projected portion 1357*b* which is the rest of a wall portion of the rotating shaft linking portion 1357 is formed between two cutouts 1357*a*.

One end side of the claw member elastic member 764 is inserted into the tubular inner side of the rotating shaft linking portion 1357.

In addition, as will be described later, as the projected portion 1352*b* of the main body 1352 of the above-described rotating shaft 1351 is inserted into the cutout 1357*a* of the rotating shaft linking portion 1357, and the projected portion 1357*b* of the rotating shaft linking portion 1357 is inserted into the cutout 1352*a* provided in the main body 1352 of the rotating shaft 1351, the rotating shaft linking portion 1357 and the rotating shaft 1351 are linked to each other. Therefore, the outer diameter and the inner diameter of both cylinders can be linked to each other in this manner.

The claw member 1359 is a member which is engaged with the driving shaft 70 provided in the apparatus main body 2, and transmits the rotating force to the tip end member 1355.

In the aspect, the claw member 1359 is made of two engagement claws 1360, and the engagement claw 1360 is disposed on the surface opposite to the side on which the rotating shaft linking portion 1357 is disposed in the base portion 1356 of the tip end member 1355. Two engagement claws 1360 are provided to face the outer edge portion on the surface of the base portion 1356, and the recessed portion 1356*a* provided in the base portion 1356 between two engagement claws 1360 is positioned.

In addition, in the engagement claw 1360, the surface which is continuous to the inclined surface 1356*b* of the base portion 1356, is an inclined surface 1360*a* which is inclined to extend the inclined surface 1356*b*. The inclined surface 1360*a* acts similar to the inclined surface (outer surface 760*a*) of the above-described engagement claw 760.

Returning to FIGS. 87 and 88, other configuration elements provided in the shaft member 1350 will be illustrated. The rotating shaft elastic member 763 and the claw member elastic member 764 are so-called elastic members, and are made of the coiled spring in the aspect. In addition, the dispositions and the actions of each member will be described later.

A material which configures each member of the shaft member 1350 is not particularly limited, but a material similar to the above-described shaft member 750 can be used.

By combining the bearing member 1340 and the shaft member 1350 with each other as follows, the end member 1330 is made. In addition, by describing the combination, the size of each member and part, the structure, or the relationship of the sizes of the members and parts, are further understood. FIG. 93 is sectional view along axis of the shaft member 1350.

As can be ascertained from FIG. 93, in a posture in which the rotating shaft holding member 1346 is mounted in the main body 1341 in the bearing member 1340, the rotating shaft 1351 passes through the hole 1346*a* of the rotating shaft holding member 1346 of the bearing member 1340, the end portion on the side on which the projection 1353 is disposed is included on the inner side of the shaft member holding portion 1345, the end portion on the opposite side is disposed to protrude from the bearing member 1340. At this time, since the projection 1353 is disposed in the space surrounded by the guide wall 1348, and cannot pass through the hole 1346*a*, the projection 1353 is hooked to the rotating shaft holding member 1346, the rotating shaft 1351 is configured not to fall out of the bearing member 1340.

In addition, at this time, the elastic member holding projection 1353*a* of the rotating shaft 1351 passes through the inner side of the rotating shaft elastic member 763, and the tip end thereof is disposed to penetrate the hole 1347*a* of the support member 1347. Accordingly, the rotating shaft elastic member 763 is disposed between the projection 1353 and the support member 1347, and the rotating shaft 1351 is biased in the direction of in which the projection 1353 is pressed to the rotating shaft holding member 1346. In addition, as the elastic member holding projection 1353*a* passes through the hole 1347*a*, stability of the movement in the direction along the axis of the rotating shaft 1351 is improved.

In addition, since the projection 1353 and the guide wall 1348 are substantially triangular as described above, the projection 1353 presses the guide wall 1348 and transmits the rotating force during the rotation around the axis of the rotating shaft 1351.

Meanwhile, one end of the claw member elastic member 764 is inserted and fixed to the tubular inner side of the main body 1352 of the rotating shaft 1351.

The tip end member 1355 is disposed so that the rotating shaft linking portion 1357 abuts against the main body 1352 of the rotating shaft 1351. At this time, the projected portion 1352*b* of the main body 1352 of the above-described rotating shaft 1351 is inserted into the inner side of the cutout 1357*a* of the rotating shaft linking portion 1357, the projected portion 1357*b* of the rotating shaft linking portion 1357 is inserted into the cutout 1352*a* provided in the main body 1352 of the rotating shaft 1351. Accordingly, the rotating shaft linking portion 1357 and the rotating shaft 1351 are linked to each other, and the rotation driving force around the axis can be transmitted. At this time, the other end of the claw member elastic member 764 is disposed on the tubular inner side of the rotating shaft linking portion 1357, and is fixed thereto.

By the combination described above, axes of each of the bearing member 1340 and the shaft member 1350 are disposed to match each other.

Next, how the end member 1330 combined as described above, can be deformed, move, and rotate, will be described. FIG. 94 illustrates a posture when the end member 1330 is deformed from the same viewpoint as that of FIG. 93.

In the posture illustrated in FIG. 93, by the rotating shaft elastic member 763, a posture in which the entire shaft member 1350 protrudes the most from the bearing member 1340 within a possible range, is achieved. When any external force is not applied to the shaft member 1350, the end member 1330 has this basic posture.

In this posture, when the rotating force is applied to the engagement claw 1360 of the claw member 1359 as illustrated by an arrow $C_{93a}$ in FIG. 93, the rotating force is transmitted to the tip end member 1355 in which the claw member 1359 is integrally formed. In addition, the rotating force is transmitted to the rotating shaft 1351, and further, the projection 1353 of the rotating shaft 1351 presses the guide wall 1348, and the rotating force is transmitted to the bearing member 1340. Therefore, the entire end member 1330 rotates by the rotating force received by the engagement claw 1360.

In addition, as illustrated by an arrow $C_{93b}$ in FIG. 93, when the pressing force acts toward the bearing member 1340 side in the axial direction in the claw member 1359, the pressing force is transmitted to the tip end member 1355 and the rotating shaft 1351, and the entire shaft member 1350 moves in the direction in which the bearing member 1340 is pushed as illustrated by $C_{93c}$ in FIG. 93 against the biasing force of the rotating shaft elastic member 763.

Meanwhile, as the external force which is equal to or greater than a predetermined force is applied to the rotating force transmission member 1354 from the direction which is different from the axial direction, the rotating force transmission member 1354 is deformed to swing as illustrated in FIG. 94 against the elastic force of the claw member elastic member 764. This is because the rotating shaft linking portion 1357 is in the above-described linked state where the rotating shaft linking portion 1357 and the main body 1352 are linked to each other.

As described above, since the end member 1330 also swings and moves similar to the end member 730 which has been already described, the end member 730 similarly acts, and the effects are achieved.

In addition, returning from the posture illustrated in FIG. 94 to the posture illustrated in FIG. 93, may be manually performed, or may be performed by the elastic force of the claw member elastic member 764.

Next, a fifteenth aspect will be described. FIG. 95 is a perspective view of the end member 1430 included in the aspect. FIG. 96 is an exploded perspective view of the end member 1430. Since the configuration elements except the end member 1430 can be considered similar to those in the first aspect, here, the end member 1430 will be described. As can be ascertained from FIGS. 95 and 96, the end member 1430 is provided with the bearing member 1440 and the shaft member 1450.

The bearing member 1440 is a member which is bonded to the end portion of the photoreceptor drum 11 in the end member 1430. FIG. 97A is a perspective view of the bearing member 1440. FIG. 97B is a plan view when viewed from the side on which the shaft member 1450 is inserted in the bearing member 1440. Furthermore, FIG. 98A is a sectional view along a line illustrated by $C_{98a}$-$C_{98a}$ in FIG. 97B. FIG. 98B is a sectional view along a line illustrated by $C_{98b}$-$C_{98b}$ in FIG. 97B. In addition, in each drawing which will be illustrated below, sections (cross sections) are illustrated being hatched in the sectional views.

As can be ascertained from FIGS. 95 to 98, the bearing member 1440 is configured to include a tubular body 1441, a contact wall 1442, a fitting portion 1443, a gear portion 1444, and a shaft member holding portion 1445.

The tubular body 1441 is an overall cylindrical member, and the contact wall 1442 and the gear portion 1444 are disposed on the outer side thereof, and the shaft member holding portion 1445 is formed on the inner side thereof.

The contact wall 1442 which comes into contact with and is locked to the end surface of the photoreceptor drum 11 from a part of the outer circumferential surface of the tubular body 1441, stands. Accordingly, the depth of insertion of the end member 1430 into the photoreceptor drum 11 is regulated in a posture in which the end member 1430 is mounted on the photoreceptor drum 11.

In addition, by nipping the contact wall 1442 of the tubular body 1441, the fitting portion 1443 of which one side is inserted into the photoreceptor drum 11 is made. The fitting portion 1443 is inserted into the photoreceptor drum 11, and is fixed to the inner surface of the photoreceptor drum 11 by the adhesive. Accordingly, the end member 1430 is fixed to the end portion of the photoreceptor drum 11. Therefore, the outer diameter of the fitting portion 1443 is substantially the same as the inner diameter of the photoreceptor drum 11 within a range in which insertion into cylindrical shape of the photoreceptor drum 11 is possible. A groove may be formed on the outer circumferential surface in the fitting portion 1443. Accordingly, the groove is filled with the adhesive, and adhesiveness between the tubular body 1441 (end member 1430) and the photoreceptor drum 11 is improved by an anchor effect or the like.

The gear portion 1444 is formed on the outer circumferential surface of the tubular body 1441 on the side opposite to the fitting portion 1443 nipping the contact wall 1442. The gear portion 1444 is a gear which transmits the rotating force to another member, such as the developing roller, and in the aspect, the gear portion 1444 is a helical gear. However, the type of the gear is not particularly limited, and may be a spur gear. Otherwise, both the helical gear and the spur gear may be disposed being aligned along the axial direction of the tubular body. In addition, it is not necessary to provide the gear.

The shaft member holding portion 1445 is a part which is formed on the inner side of the tubular body 1441, and which has a function of holding the shaft member 1450 in the bearing member 1440. As can be ascertained from FIGS. 97A to 98B, the shaft member holding portion 1445 includes a rotating shaft holding member 1446, a support member 1447, and a guide wall 1448.

The rotating shaft holding member 1446 is a plate-like member which is formed to block the inner side of the tubular body 1441, but a hole 1446*a* which is coaxial to the axis of the tubular body 1441 is formed. Since a rotating shaft 1451 (refer to FIG. 99) penetrates the hole 1446*a* as will be described later, the rotating shaft 1451 has the size and the shape by which the rotating shaft 1451 can penetrate. However, in order to prevent the rotating shaft 1451 from falling out, only a main body 1452 of the rotating shaft 1451 can penetrate the hole 1446*a*, but cannot penetrate a part on which a projection 1453 is disposed. From the viewpoint of stabilized movement of the rotating shaft 1451, it is preferable that the hole 1446*a* has the shape and the size which are substantially the same as the outer circumference of the main body 1452 of the rotating shaft 1451 within a range in which the hole 1446*a* does not interrupt the movement of the rotating shaft 1451 in the axial direction.

In addition, in the rotating shaft holding member 1446, two slits 1446*b* extend from the hole 1446*a*. The two slits 1446*b* are provided at symmetrical positions nipping the axis of the hole 1446*a*. In addition, the size and the shape of the slit 11446*b* are formed so that the projection 1453 of the rotating shaft 1451 (refer to FIG. 99) can penetrate the slit 1446*b*.

The support member 1447 is a plate-like member which is provided further on the fitting portion 1443 side than the rotating shaft holding member 1446, and which is formed to block at least a part of the inner side of the tubular body 1441. The support member 1447 is formed to have the size by which a rotating shaft elastic member 1463 which will be described later can be supported.

The guide wall 1448 is a tubular member which extends in parallel to the axial direction of the tubular body 1441 from an edge of the hole 1446*a* of the rotating shaft holding member 1446, and of which an end portion is connected to the support member 1447. In the aspect, the sectional shape of the inner side of the guide wall 1448 is the same as that of the hole 1446*a*. However, as will be described later, since the main body 1452 of the rotating shaft 1451 is inserted into the guide wall 1448, and the rotating shaft 1451 moves in the axial direction, the guide wall 1448 has the shape and the size in which the movement is possible.

In addition, a slit 1448*a* is formed in the guide wall 1448. In FIGS. 98A and 98B, for making it easy to understand, the direction in which the slit 1448*a* extends is illustrated by a dotted line. One end side of the slit 1448*a* passes through the slit 1446*b* of the rotating shaft holding member 1446 in the longitudinal direction, the slit 1448*a* extends in parallel to the axis of the tubular body 1441, and reaches the support member 1447. After this, the slit 1448*a* extends in parallel to the axial direction similar to a U-turn, and one end portion (the other end side) of the slit 1448*a* reaches the rotating shaft holding member 1446. Therefore, the other end side is blocked by the rotating shaft holding member 46. The slit width of the slit 1448*a* is formed so that the projection 1453 of the rotating shaft 1451 (refer to FIG. 99) can move in the slit 1448*a*.

A material which configures the bearing member 1440 is not particularly limited, but a resin, such as polyacetal, polycarbonate, or PPS, or metal can be used. Here, in order to improve the rigidity of the member in a case where the resin is used, the glass fiber or the carbon fiber may be mixed into the resin in accordance with the load torque. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

In a case of making the bearing member 1440 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

Returning to FIGS. D1 and 96, the shaft member 1450 of the end member 1430 will be described. As can be ascertained from FIG. 96, the shaft member 1450 is provided with the rotating shaft 1451, a rotating force receiving member 1455, and a regulating member 1459. Furthermore, the shaft member 1450 is provided with the rotating shaft elastic member 1463, a regulating member elastic member 1464, and the pin 1465. Any of the rotating shaft elastic member 1463 and the claw member elastic member 1464 in the aspect is a coiled spring.

Hereinafter, each of the members will be described.

The rotating shaft 1451 is a shaft-shape member which functions as a rotating force transmission portion that transmits the rotating force received by the rotating force receiving member 1455 to the bearing member 1440. FIG. 99A is a perspective view of the rotating shaft 1451. FIG. 99B is a sectional view in the axial direction including a line illustrated by $C_{99b}$-$C_{99b}$ in FIG. 99A.

As can be ascertained from FIGS. 99A and 99B, the rotating shaft 1451 includes the cylindrical main body 1452, and a partition portion 1452*a* is provided to close the inner portion, in the cylindrical inner portion. Therefore, on the inner side of the main body 1452, recessed portions 1452*b* and 1452*c* are formed on one side and on the other side nipping the partition portion 1452*a* on the inner side of the main body 1452.

Two projections 1453 are disposed on the outer side in one end portion of the main body 1452. Two projections 1453 are provided on the same line in one diameter direction of the cylinder of the main body 1452 on the opposite side nipping the axis. The two projections 1453 hold the rotating shaft 1451 in the bearing member 1440 as will be describe later, and hves a function of regulating the movement of the main body 1452.

In addition, in the rotating shaft 1451, two holes 1452*d*, which are orthogonal to the axis of the cylinder, are disposed in one diameter direction of the cylinder, and penetrate the inside and the outside, are formed. As will be described later, the pin 1465 (refer to FIG. 96) passes through the hole 1452*d*, holds the regulating member 1459, and regulates the movement of the regulating member 1459.

Furthermore, on the end surface of the main body 1452, on the end surface (end surface which is formed on the side opposite to the projection 1453 side) on the recessed portion 1452*b* side, a circular rail projection 1454 which protrudes in the direction (direction parallel to the axis) in which the cylinder extends to border the opening portion of the recessed portion 1452*b*, is provided. The rail projection 1454 functions as a rail which guides the rotation of the rotating force receiving member 1455 as will be described later.

Here, one example of the rotating shaft 1451 will be described, but if the rotating shaft can achieve a function of operating as will be described later, the shape is not limited to the rotating shaft 1451. For example, as the rotating shaft elastic member 1463 and the regulating member elastic member 1464 are formed as a two-staged spring, the partition portion 1452*a* of the rotating shaft 1451 is not necessary. In addition, since the rotation around the axis of the rotating force receiving member 1455 is basically ensured by the regulating member 1459 as will be described later, it is not necessary to provide the rail projection 1454.

When the end member 1430 is in a predetermined posture, the rotating force receiving member 1455 is a member which receives the rotation driving force from the apparatus main body 2, and transmits the driving force to the rotating shaft 1451. FIG. 100A is a perspective view of the rotating force receiving member 1455. FIG. 100B is a plan view of the rotating force receiving member 1455 when viewed from the direction illustrated by an arrow $C_{100b}$ in FIG. 100A. FIG. 100C is a sectional view by a line illustrated by $C_{100c}$-$C_{100c}$ in FIG. 100B.

As can be ascertained from FIGS. 95, 96, and 100A to 100C, the rotating force receiving member 1455 is configured to include two engaging members 1458 which stand from a cylindrical base portion 1456 and one end portion of the cylindrical base portion 1456.

The base portion 1456 is cylindrical, and a circular piece 1456*a* is provided so that the opening portion is narrowed in the opening portion on one end side. On the surface opposite to the base portion 1456 of the piece 1456*a*, a guide 1456*b* which is a circular hollow is formed. The guide 1456*b* is loaded on the rail projection 1454 (refer to FIG. 99B) of the above-described rotating shaft 1451, and guides the rotation of the base portion 1456.

In addition, two projections 1457 are provided to face each other on the surface on the inner side of the base portion 1456 of the piece 1456*a*. Here, an example in which two projections 1457 are provided is illustrated, but at least two projections may be provided, and three or more projections may be provided. In addition, it is preferable that the projections are provided at an equivalent interval around the axis.

In addition, it is not necessary to provide the guide 1456*b* which is described in the rail projection 1454.

Two engaging members 1458 are disposed in the end portion opposite to the side on which the piece 1456*a* of the base portion 1456 is provided, are separated from the axis of the base portion 1456 at the same distance, and are disposed at symmetrical positions nipping the axis. The interval between two engaging members 1458 is formed to be substantially the same as or slightly greater than the diameter of the shaft portion of the driving shaft 70 which will be described later. The interval between the two engaging members 1458 is configured so that the tip end portion of the driving projection 71 is hooked to the engaging member 1458 in a posture in which the shaft portion of the driving shaft 70 is disposed between two engaging members 1458.

The regulating member 1459 is a member which switches a state where the engaging member 1458 of the rotating force receiving member 1455 can transmit the driving force from the driving shaft 70 to the bearing member 1440, and a state where the driving force cannot be transmitted and the rotation is performed freely. In other words, a posture in which the engaging member 1458 can be engaged with the driving shaft 70 and transmit the rotating force, and a posture in which the engagement is regulated (not engaged) and rotting force cannot be transmitted, are switched.

FIG. 101A is a perspective view of the regulating member 1459. FIG. 101B is a front view of the regulating member 1459. FIG. 101C is a side view of the regulating member 1459.

As can be ascertained from FIGS. 101A to 101C, the regulating member 1459 includes a columnar regulation shaft 1460, and a long hole 1460*a* which penetrates in the direction orthogonal to the axis of the regulation shaft 1460, and is a hole long in the axial direction, is provided here.

In addition, a contact portion 1461 which is formed to be thicker than the regulation shaft 1460 is provided on one end side of the regulation shaft 1460. As can be ascertained from FIGS. 10B and 10C, the contact portion 1461 has an inclined surface 1461*a* to be the thickest on the regulation shaft 1460 side, and to become narrower according to the separation from the regulation shaft 1460.

Furthermore, in the end portion of the regulation shaft 1460, two projections 1462 are disposed in the outer circumferential portion on the side on which the contact portion 1461 is disposed. Two projections 1462 are disposed on the opposite side nipping the axis in the column of the regulation shaft 1460, and are provided on one line in one diameter direction. As will be described later, two projections 1462 regulate the rotating force receiving member 1455. In addition, in the aspect, two projections 1462 are illustrated, but at least two projections may be disposed, or three or more projections may be disposed.

Returning to FIG. 96, other configuration elements provided in the shaft member 1450 will be described. The rotating shaft elastic member 1463 and the claw member elastic member 1464 are so-called elastic members, and are made of the coiled spring in the aspect. In addition, the pin 1465 is a rod-like member. The dispositions and the actions of each member will be described later.

A material which configures each member of the shaft member 1450 is not particularly limited, but a resin, such as polyacetal, polycarbonate, or PPS, can be used. However, in order to improve the rigidity of the member, the glass fiber or the carbon fiber may be mixed into the resin in accordance with the load torque. In addition, by inserting metal into the resin, the rigidity may further be improved, or the entire body may be made of metal. In a case of making the shaft member 1450 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 1450 and any member included in the shaft member 1450, may be made by bending a metal plate, or may be made by making the metal, glass, or carbon fiber infiltrate into the resin.

By combining the bearing member 1440 and the shaft member 1450 with each other as follows, the end member 1430 is made. In addition, by describing the combination, the size of each member and part, the structure, or the relationship of the sizes of the members and parts, are further understood.

First, a combination between the bearing member 1440 and the rotating shaft 1451 will be described. FIG. 102A is a perspective view in which the rotating shaft 1451 is combined with the bearing member 1440, FIG. 102B is a plan view, and FIG. 102C is a sectional view from the arrow direction illustrated by $C_{102c}$-$C_{102c}$ in FIG. 102B.

As can be ascertained from FIGS. 102A to 102C, the rotating shaft 1451 passes through the hole 1446*a* of the rotating shaft holding member 1446 of the bearing member 1440, an end portion on the side on which the projection 1453 is disposed is on the inner side of the shaft member holding portion 1445, and the end portion on the opposite side is disposed to protrude from the bearing member 1440. At this time, the projection 1453 is disposed in the end portion on the side blocked by the rotating shaft holding member 1446 in the end portion of the slit 1448*a* provided in the guide wall 1448, and the rotating shaft 1451 is configured not to fall out of the bearing member 1440 as being hooked to the rotating shaft holding member 1446.

In addition, as can be ascertained from FIG. 102C, the rotating shaft elastic member 1463 is disposed between the rotating shaft 1451 and the support member 1447, the rotating shaft 1451 is biased in the direction in which the projection 1453 is pressed to the rotating shaft holding member 1446.

The attachment of the bearing member 1440 and the rotating shaft 1451 can be performed by inserting the projection 1453 of the rotating shaft 1451 into the slit 1448*a* from the slit 1446*b*, and by moving the projection 1453 in the slit 1448*a* along a dotted line illustrated in FIGS. 98A and 98B.

Next, the combination of another member to the rotating shaft 1451 in the shaft member 1450, will be described. FIG. 103 is a view illustrating this. FIG. 103A is an exploded perspective view, and FIG. 103B is a sectional view of the shaft member 1450 in the direction along the axis.

As can be ascertained from FIG. 103B, the regulating member elastic member 1464 is disposed on the inner side of the recessed portion 1452*b* of the main body 1452 of the rotating shaft 1451. Therefore, one end portion of the regulating member elastic member 1464 is supported by the partition portion 1452*a* of the main body 1452.

Meanwhile, in the regulating member 1459, an end portion on the side on which the contact portion 1461 is not disposed in the regulation shaft 1460, passes through the base portion 1456 of the rotating force receiving member 1455, and further is inserted into the recessed portion 1452*b* of the main body 1452 of the rotating shaft 1451. Accordingly, the rotating force receiving member 1455 is disposed on the end surface opposite to the projection 1453 in the main body 1452 of the rotating shaft 1451. At this time, the engaging member 1458 of the rotating force receiving member 1455 is disposed to protrude to the side opposite to the rotating shaft 1451, and the guide 1456*b* of the rotating force receiving member 1455 is disposed to overlap the rail projection 1454 which is disposed on the end surface of the main body 1452 of the rotating shaft 1451.

In addition, one end of the regulating member 1459 is inserted into the recessed portion 1452*b* formed in the main body 1452 of the rotating shaft 1451, and the end surface of the regulating member 1459 comes into contact with the other end portion of the regulating member elastic member 1464. Accordingly, the regulating member 1459 is biased in the direction of being protruded from the main body 1452. In addition, the other end (that is, an end portion on the side on which the contact portion 1461 is disposed) of the regulating member 1459 and the contact portion 1461 are disposed on the inner side of the base portion 1456 and the rotating force receiving member 1455, and between two engaging members 1458.

Furthermore, the pin 1465 passes through a long hole 1459*a* provided in the regulation shaft 1460 of the regulating member 1459, and both ends of the pin 1465 are disposed to cross over two holes 1452*d* of the rotating shaft 1451. Accordingly, the regulating member 1459 is regulated not to fall out of the main body 1452 of the rotating shaft 1451 against the biasing force of the regulating member elastic member 1464.

By the combination described above, axes of each of the bearing member 1440 and the shaft member 1450 are disposed to match each other.

Next, how the end member 1430 combined as described above can be deformed, move, and rotate, will be described. FIG. 104 is a sectional view in the direction along the axis in one posture of the end member 1430.

In the posture illustrated in FIG. 104, by the rotating shaft elastic member 1463, a posture in which the entire shaft member 1450 protrudes the most from the bearing member 1440 within a possible range, is achieved, and by the regulating member elastic member 1464, a posture in which the regulating member 1459 protrudes the most from the main body 1452, is achieved. When any external force is not applied to the shaft member 1450, the end member 1430 has this posture.

In this posture, as can be ascertained from FIG. 104, the projection 1457 of the rotating force receiving member 1455 and the projection 1462 of the regulating member 1459, are present at a different position separated in the axial direction when viewed in the sectional direction of FIG. 104 (in a front view). Therefore, in this posture, the engaging member 1458 of the rotating force receiving member 1455 freely rotates as illustrated by an arrow $C_{104a}$ in FIG. 104. In other words, in this posture, the engaging member 1458 relatively freely rotates with respect to the bearing member 1440 and the regulating member 1459 without being regulated.

In addition, the rotation is performed while the rail projection 1454 of the rotating shaft 1451 is guided by the guide 1456*b* of the rotating force receiving member 1455. Therefore, in this posture, even when the rotating force is transmitted to the rotating force receiving member 1455, only the rotating force receiving member 1455 rotates, and the rotating force is not transmitted to other members, and a posture in which the engaging member 1458 is not engaged is achieved.

In addition, in this posture, as can be ascertained from an arrow $C_{104b}$ in FIG. 104, when the engaging member 1458 of the rotating force receiving member 1455 is pressed to the bearing member 1440 side in the axial direction, the force is transmitted to the shaft member 1450, and the shaft member 1450 can be moved in the direction of being pressed to the bearing member 1440 as illustrated in an arrow $C_{104c}$ in FIG. 104 against the biasing force of the rotating shaft elastic member 1463.

Next, from the posture illustrated in FIG. 104, a posture in which the regulating member 1459 is moved to be pushed to the main body 1452 side of the rotating shaft 1451, will be described. FIG. 105 is a view from the same viewpoint as that of FIG. 104 in the posture. FIG. 106 is an end surface of a part illustrated by $C_{106}$-$C_{106}$ in FIG. 105.

In this posture, as illustrated by $C_{105b}$ in FIG. 105, the regulating member 1459 moves to be pushed to the main body 1452 of the rotating shaft 1451 against the biasing force of the regulating member elastic member 1464. Then, the projection 1462 of the regulating member 1459 is in a posture of getting into a track of the rotation of the projection 1457 of the rotating force receiving member 1455. Accordingly, in this posture, the rotation of the engaging member 1458 of the rotating force receiving member 1455 is relatively regulated with respect to the bearing member 1440 and the regulating member 1459, and the rotation cannot be freely performed. For example, as illustrated in FIG. 106, when the rotating force receiving member 1455 rotates, and following this, the projection 1457 rotates, the projection 1462 of the regulating member 1459 is engaged at any part. Therefore, in the posture of being engaged in this manner, when the rotation driving force is applied to the regulating member 1459 as illustrated by $C_{105a}$ in FIG. 105, the engaged regulating member 1459, the rotating shaft 1451 which is engaged with the regulating member 1459 by the pin 1465, and the bearing member 1440 which is engaged with the projection 1453 of the rotating shaft 1451, rotate in the same manner. In other words, the rotation driving force transmitted to the rotating force receiving member 1455 is transmitted to the entire end member 1430.

In addition, from this posture, if the regulating member 1459 is pressed in the direction illustrated by an arrow $C_{105b}$ in FIG. 105, the force is transmitted to the rotating shaft 1451, and the shaft member 1450 can be moved in the direction of being pushed to the bearing member 1440 as illustrated by $C_{105c}$ in FIG. 105 against the biasing force of the rotating shaft elastic member 1463.

Next, a sixteenth aspect will be described. FIG. 107 is a perspective view of an end member 1530 in the sixteenth aspect. FIG. 108 is an exploded perspective view of the end member 1530. Since the sixteenth aspect is the same as the above-described fifteenth aspect except the end member 1530, the description thereof will be omitted here. In addition, in the end member 1530, the same parts as those of the above-described end member 1430 will be given the same reference numerals, and the description thereof will be omitted.

The end member 1530 is also provided with a bearing member 1540 and a shaft member 1550.

The bearing member 1540 is a member which is bonded to the end portion of the photoreceptor drum 11 in the end member 1530. FIG. 109A is a perspective view of the bearing member 1540. FIG. 109B is a plan view when viewed from a side on which the shaft member 1550 is inserted, in the bearing member 1540. Furthermore, FIG. 110A is a sectional view along a line illustrated by $C_{110a}$-$C_{110a}$ in FIG. 109B. FIG. 110B is a sectional view along a line illustrated by $C_{110b}$-$C_{110b}$ in FIG. 109B.

As can be ascertained from FIGS. 107 to 110, the bearing member 1540 is configured to include the tubular body 1441, the contact wall 1442, the fitting portion 1443, the gear portion 1444, and a shaft member holding portion 1545.

The shaft member holding portion 1545 is a part which is formed on the inner side of the tubular body 1441, and which has a function of holding the shaft member 1550 in the bearing member 1540. As can be ascertained from FIGS. 109A to 110B, the shaft member holding portion 1545 includes a rotating shaft holding member 1546, a rotating shaft support member 1547, and a regulating member support member 1548.

The rotating shaft holding member 1546 is a plate-like member which is formed to block the inner side of the tubular body 1441, but a hole 1546*a* which is coaxial to the axis of the tubular body 1441 is formed. Since a rotating shaft 1551 penetrates the hole 1546*a* as will be described later, the rotating shaft 1551 (refer to FIG. 111) has the size and the shape by which the rotating shaft 1551 can penetrate. However, in order to prevent the rotating shaft 1551 from falling out, only a main body 1552 of the rotating shaft 1551 can penetrate the hole 1546*a*, but cannot penetrate a part on which an outer projection 1553 is disposed. From the viewpoint of stabilized movement of the rotating shaft 1551, it is preferable that the hole 1546*a* has the shape and the size which are substantially the same as the outer circumference of the main body 1552 of the rotating shaft 1551 within a range in which the hole 1546*a* does not interrupt the movement of the rotating shaft 1551 in the axial direction.

In addition, in the rotating shaft holding member 1546, two slits 1546*b* extend from the hole 1546*a*. The two slits 1546*b* are provided at symmetrical positions nipping the axis of the hole 1546*a*. In addition, the size and the shape of the slit 1546*b* are formed so that the outer projection 1553 of the rotating shaft 1551 (refer to FIG. 111) can penetrate the slit 1546*b*.

The rotating shaft support member 1547 is a member which is provided further on the fitting portion 1443 side than the rotating shaft holding member 1546, and which is formed to block at least a part of the inner side of the tubular body 1441. As illustrated in FIG. 110B, the support member 1547 is provided with a hole 1547*a* or a void through which a first regulation shaft 1560 of a regulating member 1559 (refer to FIG. 112) penetrates by considering the axis of the tubular body 1441 as a center. Furthermore, the rotating shaft support member 1547 is formed to be capable of holding at least a rotating shaft elastic member 1563.

In addition, as can be ascertained from FIG. 110A, in the rotating shaft support member 1547, a groove 1547*b* which extends in parallel to the axial direction of the tubular body 1441 is provided. An end portion on the rotating shaft holding member 1546 side of the groove 1547*b* is blocked, and the groove 1547*b* is opened in the circumferential direction of the tubular body 1441 on the regulating member support member 1548 side which is on the opposite side thereof. The groove 1547*b* is disposed so that a projection 1562 of the regulating member 1559 (refer to FIG. 112) can move on the inner side thereof.

The regulating member support member 1548 is a member which is provided further on the fitting portion 1443 side than the rotating shaft support member 1547, and is formed to block at least a part of the inner side of the tubular body 1441. The regulating member support member 1548 is formed to have the size by which at least a regulating member elastic member 1564 which will be described later can be held.

Returning to FIGS. 107 and 108, the shaft member 1550 of the end member 1530 will be described. As can be ascertained from FIG. 108, the shaft member 1550 is provided with the rotating shaft 1551, a rotating force receiving member 1555, the regulating member 1559, the rotating shaft elastic member 1563, and the regulating member elastic member 1564. Any of the rotating shaft elastic member 1563 and the regulating member elastic member 1564 in the aspect is a coiled spring.

Hereinafter, each of the members will be described.

FIG. 111A is a perspective view of the rotating shaft 1551. FIG. 111B is a sectional view in the axial direction including a line illustrated by $C_{111b}$-$C_{111b}$ in FIG. 111A. FIG. 111C is a sectional view in the axial direction including a line illustrated by $C_{111c}$-$C_{111c}$ in FIG. 111A.

As can be ascertained from FIGS. 111A to 111C, the rotating shaft 1551 includes the cylindrical main body 1552.

In addition, two outer projections 1553 are disposed on the outer side in one end portion of the main body 1552. Two outer projections 1553 are provided on the same line in one diameter direction of the cylinder of the main body 1552. The two outer projections 1553 have a function of holding the main body 1552 by the bearing member 1540 as will be described later, and regulating the movement of the main body 1552.

In addition, in the main body 1552, two inner projections 1554 are provided on the cylindrical inner surface of the end portion which is the same as the tip end provided with the outer projection 1553.

The rotating force receiving member 1555 is a member which receives the rotation driving force from the apparatus main body 2 and transmits the driving force to the main body 1552 when the end member 1430 has a predetermined posture. As can be ascertained from FIGS. 111A to 111C, the rotating force receiving member 1555 in the aspect is disposed in the end portion opposite to the side on which the outer projection 1553 is disposed in the main body 1552, and includes a cylindrical base portion 1556 and two engaging members 1558 which stand from one end portion of the base portion 1556.

The base portion 1556 is cylindrical, and the outer diameter and the inner diameter thereof is formed to be greater than the main body 1552. The outer circumferential portion of the base portion 1556 has an inclined surface 1556*a* of which the diameter becomes smaller according to the separation from the main body 1552 in the axial direction. Accordingly, the driving shaft 70 can smoothly slide in the outer circumferential portion. Meanwhile, on the contrary, the inner circumferential portion of the base portion 1556 is inclined so that the diameter becomes greater according to the separation from the main body 1552 in the axial direction. Accordingly, the tip end of the driving shaft 70 can be stably stored.

Two engaging members 1558 are provided in the end portion opposite to the side on which the rotating shaft 1551 is disposed in the base portion 1556, are separated at the same distance from the axis of the base portion 1556, and are disposed at symmetrical positions nipping the axis. The interval between the two engaging members 1558 is configured to be substantially the same or slightly greater than the diameter of the shaft portion of the driving shaft 70. The interval between two engaging members 1558 is configured so that the driving projection 71 is hooked to the engaging member 1558, in a posture in which the shaft portion of the driving shaft 70 is disposed between two engaging members 1558.

The regulating member 1559 switches a state where the engaging member 1558 of the rotating force receiving member 1555 can be engaged with the driving shaft 70, and transmit the driving force to the bearing member 1440, and a state where the members are not engaged, the driving force cannot be transmitted, and the rotation is freely performed. FIG. 112A is a perspective view of the regulating member 1559. FIG. 112B is a perspective view from another angle of the regulating member 1559.

As can be ascertained from FIGS. 112A and 112B, the regulating member 1559 includes the columnar first regulation shaft 1560 and a columnar second regulation shaft 1561 of which the outer diameter is greater than that of the first regulation shaft 1560, and has a structure in which two shafts are aligned coaxially and ends thereof are linked to each other.

In the first regulation shaft 1560, in the end portion opposite to the side on which the second regulation shaft 1561 is disposed, two projections 1562 are disposed. Two projections 1562 are provided on the same line in one diameter direction of the column of the first regulation shaft 1560. The two projections 1562 have a function of holding the regulating member 1559 in the bearing member 1540 as will be described later, and regulating the movement of the regulating member 1559.

In the second regulation shaft 1561, an end portion opposite to the side on which the first regulation shaft 1560 is disposed is a contact portion 1561*a*, and an inclined surface is formed. In addition, in the end portion in which the first regulation shaft 1560 is disposed in the second regulation shaft 1561, a regulation grooves 1561*b* which are two grooves opened to the first regulation shaft 1560 side, is provided. The two regulation grooves 1561*b* are formed on the opposite side nipping the axis of the second regulation shaft 1561.

By combining the bearing member 1540 and the shaft member 1550 with each other as follows, the end member 1530 is made. FIG. 113 is a sectional view along the axial direction of the end member 1530 in one posture. In addition, by describing the combination, the size of each member and part, the structure, or the relationship of the sizes of the members and parts, are further understood.

As can be ascertained from FIGS. 108 to 113, in the shaft member 1550, the regulating member 1559 is inserted into the main body 1552 of the rotating shaft 1551. At this time, the second regulation shaft 1561 is stored in the main body 1552, and the end portion on the projection 1562 side of the first regulation shaft 1560 is disposed to protrude from the side (that is, the outer projection 1553 and the inner projection 1554 side) opposite to the rotating force receiving member 1555. In addition, in the posture of FIG. 113, the inner projection 1554 of the rotating shaft 1551 is disposed in the regulation groove 1561*b* of the regulating member 1559.

The rotating shaft 1551 and the regulating member 1559 which are combined in this manner, are held in the bearing member 1540 as follows. In other words, the rotating shaft 1551 passes through the hole 1546*a* of the rotating shaft holding member 1546 of the bearing member 1540, the end portion on the side on which the outer projection 1553 is disposed on the inner side of the shaft member holding portion 1545, and the end portion on the opposite side is disposed to protrude from the bearing member 1540. At this time, as the outer projection 1553 is hooked to the rotating shaft holding member 1546, the rotating shaft 1551 is configured not to fall out of the bearing member 1540.

In addition, as can be ascertained from FIG. 113, the rotating shaft elastic member 1563 is disposed between the rotating shaft 1551 and the rotating shaft support member 1547, and the rotating shaft 1551 is biased in the direction of falling out of the bearing member 1540. At this time, the first regulation shaft 1560 of the regulating member 1559 passes through the inside of the rotating shaft elastic member 1563.

The attachment of the bearing member 1540 and the rotating shaft 1551 may be performed as the outer projection 1553 of the rotating shaft 1551 is inserted into the bearing member 1540 from the slit 1546*b* of the rotating shaft holding member 1546, and the rotating shaft 1551 is rotated around the axis.

Meanwhile, in the regulating member 1559, the first regulation shaft 1560 passes through the hole 1547*a* (refer to FIG. 110B) of the 1547. In addition, the projection 1562 is stored on the inner side of the groove 1547*b* (refer to FIG. 110A). Accordingly, while the regulating member 1559 can move in the axial direction, falling out of the bearing member 1540 is prevented.

In addition, as can be ascertained from FIG. 113, the regulating member elastic member 1564 is disposed between the regulating member 1559 and the regulating member support member 1548, and the regulating member 1559 is biased in the direction of falling out of the bearing member 1540.

The attachment of the bearing member 1540 and the regulating member 1559 may be performed when the projection 1562 of the regulating member 1559 is inserted into the groove 1547*b* from the opening portion of the groove 1547*b* of the rotating shaft support member 1547.

In the posture of the end member 1530 combined as described above, as the rotating shaft 1551 and the rotating force receiving member 1555 disposed thereon, are biased in the direction of falling out of the bearing member 1540 by the rotating shaft elastic member 1563, and the outer projection 1553 is engaged with the shaft member holding portion 1545 of the bearing member 1540, the rotating force receiving member 1555 does not fall out and is held. Meanwhile, as the regulating member 1559 is biased in the direction of falling out of the bearing member 1540 by the regulating member elastic member 1564, and the projection 1562 is engaged with the shaft member holding portion 1545 of the bearing member 1540, the regulating member 1559 does not fall out and is held.

In addition, in the posture illustrated in FIG. 113, since the inner projection 1554 of the rotating shaft 1551 enters the regulation groove 1561*b* of the regulating member 1559, the rotation of the rotating shaft 1551 and the rotating force receiving member 1555 which is disposed in the rotating shaft 1551 around the axis, is regulated.

By the combination described above, axes of each of the bearing member 1540 and the shaft member 1550 are disposed to match each other.

Next, how the end member 1530 combined as described above can be deformed, move, and rotate, will be described. FIGS. 114 and 115 are sectional views in the direction along the axis in two postures of the end member 1530.

FIG. 114 illustrates the posture in which the rotating shaft 1551 (rotating force receiving member 1555) moves to be pushed to the bearing member 1540 side against the biasing force of the rotating shaft elastic member 1563, as illustrated by an arrow $C_{114a}$ in FIG. 114, from the posture illustrated in FIG. 113. Accordingly, as can be ascertained from FIG. 114, since the rotating shaft 1551 moves in the axial direction, the inner projection 1554 of the rotating shaft 1551 is disengaged from the regulation groove 1561*b* of the regulating member 1559, and the engagement of the inner projection 1554 and the regulation groove 1561*b* is released. Therefore, as illustrated by an arrow $C_{114b}$ in FIG. 114, the rotating shaft 1551 and the rotating force receiving member 1555 (engaging member 1558) disposed in the rotating shaft 1551, freely rotate. In other words, in this posture, the rotation of the engaging member 1558 is not relatively regulated with respect to the bearing member 1540 and the regulating member 1559, and is freely performed.

FIG. 115 illustrates a posture in which the regulating member 1559 moves to be pushed to the bearing member 1540 side against the biasing force of the regulating member elastic member 1564 as illustrated by an arrow $C_{115a}$ in FIG. 115, further from the posture illustrated in FIG. 114. Accordingly, as can be ascertained from FIG. 115, since the regulating member 1559 moves in the axial direction, the inner projection 1554 of the rotating shaft 1551 gets into the regulation groove 1561*b* of the regulating member 1559 again, and the inner projection 1554 and the regulation groove 1561*b* are engaged with each other. Therefore, in this posture, the rotation of the engaging member 1558 is relatively regulated with respect to the bearing member 1540 and the regulating member 1559, and for example, when the rotating force is applied as illustrated by an arrow $C_{115b}$ in the rotating force receiving member 1555, the rotating force is transmitted to the rotating shaft 1551, the regulating member 1559, and the bearing member 1540, and finally, the end member 1530 (photoreceptor drum unit) rotates around the axis.

In this manner, in the posture in which the processing cartridge provided with the end member 1530 is mounted on the apparatus main body, the driving shaft 70 and the rotating force receiving member 1555 provided in the shaft member 1550 of the end member 1530 are engaged with each other, and the rotating force is transmitted.

Next, a seventeenth aspect will be described. FIG. 116A is a perspective view in one posture of an end member 1630 in the seventeenth aspect. FIG. 116B is a perspective view in another posture of the end member 1630. In addition, FIG. 117 is an exploded perspective view of the end member 1630. Since the seventeenth aspect is the same as the above-described fifteenth aspect except the end member 1630, the description thereof will be omitted here. In addition, in the end member 1630, the same parts as those of the above-described end member 1430 will be given the same reference numerals, and the description thereof will be omitted.

The end member 1630 is provided with a bearing member 1640 and a shaft member 1650.

The bearing member 1640 is a member which is bonded to the end portion of the photoreceptor drum 11 in the end member 1630. FIG. 118A is a perspective view of the bearing member 1640. FIG. 118B is a plan view when viewed from a side on which the shaft member 1650 is inserted, in the bearing portion 240.

As can be ascertained from FIGS. 116 to 118, the bearing member 1640 is configured to include the tubular body 1441, the contact wall 1442, the fitting portion 1443, the gear portion 1444, and a shaft member holding portion 1645.

The shaft member holding portion 1645 is a part which is formed on the inner side of the tubular body 1441, and which has a function of holding the shaft member 1650 in the bearing member 1640. In the aspect, as can be ascertained from FIGS. 118A to 118B, the shaft member holding portion 1645 is configured to include a bottom plate 1646 and a holding tube body 1647.

The bottom plate 1646 is a plate-like member which is disposed to block at least a part of the inner side of the tubular body 1441.

Meanwhile, the holding tube body 1647 is a tubular member which stands on the surface opposite to the fitting portion 1443 side on the surface of the bottom plate 1646, and the axis thereof is provided to match the axis of the tubular body 1441. The holding tube body 1647 holds the shaft member 1650 as a part of the shaft member 1650 is inserted into the holding tube body 1647.

Returning to FIGS. 116 and 117, the shaft member 1650 of the end member 1630 will be described. As can be ascertained from FIG. 117, the shaft member 1650 is configured to include a rotating shaft 1651, a rotating force receiving member 1652, a regulating member 1660, a pin 1664, and an elastic member 1665. Here, the pin 1664 is a rod-like member. In addition, the elastic member 1665 of the aspect is a coiled spring.

FIG. 119 is an enlarged exploded perspective view illustrating members except the pin 1664. FIG. 117 illustrates each of the members with reference to FIG. 119.

The rotating shaft 1651 is a cylindrical member. The outer diameter of the rotating shaft 1651 has the size by which insertion into the holding tube body 1647 provided in the shaft member holding portion 1645 of the above-described bearing member 1640 is possible.

The rotating force receiving member 1652 is a member which receives the rotation driving force from the apparatus main body 2 and transmits the driving force to the rotating shaft 1651, when the end member 1630 is in the predetermined posture. In the aspect, the rotating force receiving member 1652 is disposed in the end portion on one side (a side which is not inserted into the holding tube body 1647) in the rotating shaft 1651, and is configured to include a cylindrical base portion 1653 and a plate-like engaging member 1656.

The base portion 1653 is a cylindrical member, and is disposed coaxially to the rotating shaft 1651 in the end portion on one side (a side which is not inserted into the holding tube body 1647) in the rotating shaft 1651. The outer circumference and the inner circumference of the base portion 1653 are formed to be greater than the outer circumference and the inner circumference of the rotating shaft 1651.

In the base portion 1653, two engaging member storage grooves 1654 which are grooves formed substantially in parallel nipping the axis, are provided. In the aspect, two engaging member storage grooves 1654 are provided in parallel to the positions having the same distance from the axis nipping the axis, and extend to be at a twisted position with respect to the axis.

In addition, in the base portion 1653, a hole 1653*a* is provided to be along the diameter of the base portion, and to penetrate in the direction orthogonal to the direction in which the two engaging member storage grooves 1654 extend. In the aspect, four holes 1653*a* are formed.

The overall engaging member 1656 has a shape of a plate, and is formed to have the size to be stored in the groove of the above-described engaging member storage groove 1654. A through hole 1656*a* is provided in the engaging member, and nipping the through hole 1656*a*, one part becomes an engaging portion 1657, and the other part becomes an operated portion 1658. Although not particularly limited, it is preferable that the engaging portion 1657 is longer than the operated portion 1658. In addition, the tip end of the engaging portion 1657 may be curved. Accordingly, stable engagement with the driving projection 71 of the driving shaft 70 is possible.

The regulating member 1660 is configured to include a regulation shaft 1661, a contact portion 1662, and an operation portion 1663.

The regulation shaft 1661 is a columnar member, and a shape thereof has the size by which insertion into the cylindrical inner side of the rotating shaft 1651 is possible. In addition, in the regulation shaft 1661, a slit 1661*a* which penetrates the regulation shaft 1661 in the diameter direction, and extends in the axial direction by a predetermined size, is formed.

On an end surface of the regulation shaft 1661, the contact portion 1662 is a member of a part (truncated cone) of a cone provided coaxially on the side which is not inserted into the rotating shaft 1651, and has the size in which the diameter is greater than that of the regulation shaft 1661 in the bottom portion. Therefore, a side surface of the contact portion 1662 becomes an inclined surface 1662*a*.

Two operation portions 1663 are rod-like members which extend in the direction of being separated from the axis, and are disposed similar to the engaging member 1656. As will be described later, the operation portion 1663 is formed at a position or length at which the operated portion 1658 of the engaging member 1656 can be pressed in the direction parallel to the axial direction.

By combining each member as follows, the end member 1630 is made. In addition, by describing the combination, the size of each member and part, the structure, or the relationship of the sizes of the members and parts, are further understood.

First, the shaft member 1650 will be described. FIG. 120 is an enlarged outer appearance perspective view illustrating a part of the rotating force receiving member 1652 and the regulating member 1660 of one posture in a scene where each member is combined. In addition, In FIG. 120 and FIG. 121 which will be described later, for making it easy to understand, only the engaging member 1656 is illustrated being hatched.

As can be ascertained from FIGS. 116, 117, 119, and 120, the elastic member 1665 is inserted into the cylindrical inner side of the rotating shaft 1651, and further, an end portion on the side on which the contact portion 1662 is not disposed in the regulation shaft 1661 of the regulating member 1660, is also inserted. Accordingly, the regulating member 1660 is biased in the direction of falling out of the rotating shaft 1651 by the biasing force of the elastic member 1665.

Meanwhile, the engaging member 1656 is disposed in the engaging member storage groove 1654 provided in the base portion 1653 of the rotating force receiving member 1652. At this time, the hole 1653*a* provided in the base portion 1653, and the hole 1656*a* provided in the engaging member 1656, are aligned on one straight line. In addition, the slit 1661*a* provided in the regulation shaft 1661 of the regulating member 1660 is disposed to be included in this one straight line. In addition, in this manner, the pin 1664 is inserted to pass through the hole 1653*a*, the through hole 1656*a*, and the slit 1661*a* which are arranged on this one straight line. Accordingly, the posture illustrated in FIG. 120 can be achieved.

In addition, at this time, the operation portion 1663 of the regulating member 1660 is disposed to overlap the operated portion 258 which is formed in the engaging member 1656 of the rotating force receiving member 1652.

In addition, as can be ascertained from FIG. 117 or the like, the attachment of the bearing member 1640 of the shaft member 1650 may be performed when the end portion on the side on which the rotating force receiving member 1652 is not disposed is inserted and bonded to the holding tube body 1647 of the bearing member 1640, in the rotating shaft 1651.

The end member 1630 combined as described above, can take an aspect in FIG. 120 as one posture. In other words, the engaging member 1656 is in a posture of being disposed to lie across the inner side of the engaging member storage groove 1654.

Meanwhile, as illustrated by $C_{120}$ in FIG. 120, when pressing the regulating member 1660 to the bearing member 1640 side (the downward direction of the paper surface of FIG. 120), the operation portion 1663 is also moved downward, and the operated portion 1658 of the engaging member 1656 is moved downward. Then, since the engaging member 1656 rotates around the pin 1664, as illustrated in FIG. 121, the engaging members 1656 stand to approach each other in parallel in the axial direction.

In other words, the end member 1630 can switch a posture (protruded posture) in which the engaging member 1656 stands, and an inclined posture (sunken posture).

In this manner, in the posture in which the processing cartridge provided with the end member 1630 is mounted on the apparatus main body, the driving shaft 70 and the rotating force receiving member 1652 provided in the shaft member 1650 of the end member 1630 are engaged with each other, and the rotating force is transmitted.

Next, an eighteenth aspect will be described. FIG. 122 is an exploded perspective view of a tip end part of a shaft member 1750, in the end member 1730. FIG. 123 is a section along the axis of the end member 1730. The end member 1730 of the aspect is provided with the bearing member 1640 which is the same aspect as the above-described end member 1630, and the shaft member 1750 is employed in the bearing member 1640. Here, the shaft member 1750 will be described.

As can be ascertained from FIG. 122, the shaft member 1750 is configured to include a rotating shaft 1751, a rotating force receiving member 1752, and a regulating member 1760.

The rotating shaft 1751 is a cylindrical member. The outer diameter thereof can be the size by which insertion into the holding tube body 1647 (refer to FIG. 118A) provided in the shaft member holding portion 245 of the above-described bearing member 1640 is possible. In the aspect, an end portion on one side (a side opposite to the side which is inserted into the holding tube body 1647, and a side opposite to the fitting portion 1443) in the end portion of the rotating shaft 1751, is configured to function as a part of the rotating force receiving member 1752. The aspect will be described in detail by the rotating force receiving member 1752.

The rotating force receiving member 1752 is a member which receives the rotation driving force from the apparatus main body 2 and transmits the driving force to the rotating shaft 1751 when the end member 1730 is in a predetermined posture. In the aspect, the rotating force receiving member 1752 is disposed in an end portion on one side (the side opposite to the side which is inserted into the holding tube body 1647, the side opposite to the fitting portion 1443) in the rotating shaft 1751, and is configured to include a base portion 1753, an engaging member 1754, and a pin 1755.

The base portion 1753 is a part which links the engaging member 1754 to the rotating shaft 1751 via the pin 1755, and in the aspect, the base portion 1753 is formed in the end portion on one side of the rotating shaft 1751, and a part (tip end portion) of the rotating shaft 1751 serves as the base portion 1753.

In the base portion 1753, a recessed portion 1753*a* is formed along the axis from the end surface on one side of the rotating shaft 1751, and in the bottom portion, as can be ascertained from FIG. 123, a projection 1753*b* is provided. In addition, in the base portion 1753, two slits 1753*c* which have a depth by which the side surface of the rotating shaft 1751 and the recessed portion 1753*a* communicate with each other by considering the direction along the axial direction from the end surface on one side of the rotating shaft 1751 as the length direction, in the base portion 1753. In the aspect, two slits 1753*c* are disposed at a position by 180° around the axis to be on one diameter of the rotating shaft 1751.

Furthermore, in the base portion 1753, holes 1753*d* and 1753*e* which extend in the width direction of the slit 1753*c* and penetrates the base portion 1753, are formed. The hole 1753*d* and the hole 1753*e* are disposed to be aligned in the length direction of the slit 1753*c*, and the hole 1753*d* is on a side close to the end portion on one side of the rotating shaft 1751.

The engaging member 1754 is a rod-like member, and is bent at one location in the aspect. In addition, in one end portion, a through hole 1754*a* which intersects the direction in which the engaging member 1754 extends is provided.

The pin 1755 is a round rod-like member.

The regulating member 1760 is configured to include a regulation shaft 1761, an operation member 1762, an elastic member 1763, and a pin 1764.

The regulation shaft 1761 is a columnar member, and a shape thereof has the size by which insertion into the inner side of the recessed portion 1753*a* provided in the base portion 1753 is possible. In addition, in the regulation shaft 1761, a slit 1761*a* which penetrates the regulation shaft 1761 in the diameter direction, and extends in the axial direction by a predetermined size, is formed. In the end portion of the regulation shaft 1761, the end portion on the side which is not inserted into the base portion 1753 is a part (truncated cone) of a cone, and an inclined surface 1761*b* is formed. In addition, in the end portion of the regulation shaft 1761, a projection 1761*c* is provided on the side opposite to the inclined surface 1761*b*.

Two operation members 1762 are rod-like members, and are disposed similar to the engaging member 1754. The operation member 1762 is provided with a through hole 1762*a* which is orthogonal to the length direction in the vicinity of the center in the length direction. The elastic member 1763 is formed by a coiled spring in the aspect. In addition, the pin 1764 is a round rod-like member.

By combining each member as follows, the end member 1730 is made. In addition, by describing the combination, the size of each member and part, the structure, or the relationship of the sizes of the members and parts, are further understood.

As can be ascertained from FIGS. 122 to 123, the elastic member 363 is inserted into the recessed portion 1753*a* formed in the base portion 1753, and further, an end portion on the side on which the projection 1761*c* is provided in the regulation shaft 1761 of the regulating member 1760, is also inserted. One end of the elastic member 1763 is inserted and fixed to the projection 1753*b* in the recessed portion, and the other end of the elastic member 1763 is inserted and fixed to the projection 1761*c* of the regulation shaft 1761. Accordingly, the regulation shaft 1761 is biased in the direction of falling out of the rotating shaft 1751 by the biasing force of the elastic member 1763.

As can be ascertained from FIG. 123, one end side of the operation member 1762 is inserted into the slit 1761*a* of the regulation shaft 1761 from the slit 1753*c*. in addition, the pin 1764 is disposed to pass through the hole 1753*e* and the hole 1762*a*. Accordingly, the operation member 1762 can rotate around the pin 1764. At this time, in the posture in which the external force is not applied, the operation member 1762 is disposed to extend in the direction orthogonal to the axis of the regulation shaft 1761.

Meanwhile, one end side of the engaging member 1754 is disposed in the slit 1761*a*, and the pin 1755 is disposed to pass through the hole 1753*d* and the hole 1754*a*. Accordingly, the engaging member 1754 can rotate around the pin 1755. At this time, in the posture in which the external force is not applied, the engaging member 1754 extends in the direction orthogonal to the axis of the regulation shaft 1761, and is positioned to overlap the tip end side of the regulation shaft 1761 rather than the operation member 1762. In addition, the engaging member 1754 is disposed to come into contact with the tip end on the side which is not inserted into the slit 1761*a* of the operation member 1762.

In addition, as can be ascertained from FIG. 117 or the like, the attachment of the bearing member 1640 of the shaft member 1750 may be performed when the end portion on the side on which the rotating force receiving member 1752 is not disposed is inserted and bonded to the holding tube body 1647 of the bearing member 1640, in the rotating shaft 1751.

The end member 1730 combined as described above, can take an aspect similar to FIG. 123 as one posture. In other words, the engaging member 1756 is in a posture of being disposed to lie in the radial direction of the rotating shaft 1751.

Meanwhile, as illustrated by $C_{123}$ in FIG. 123, when pressing the regulation shaft 1761 of the regulating member 1760 to the bearing member 1640 side (the downward direction of the paper surface of FIG. 123), the regulation shaft 1761 is moved to the bearing member 1640 side, and the end portion which is inserted into the slit 1761*a* of the regulation shaft 1761 is also pressed in the same direction in the operation member 1762. Then, the operation member 1762 rotates around the pin 1764, and the end portion on the opposite side moves to the side opposite to the bearing member 1640. Accordingly, since the end portion on the opposite side presses the engaging member 1754, and the engaging member 1754 rotates around the pin 1755, as illustrated in FIG. 124, the engaging members 1754 stand to approach each other in parallel in the axial direction.

In other words, the end member 1730 can also switch a posture (protruded posture) in which the engaging member 1754 stands, and an inclined posture (sunken posture). Accordingly, the end member 1730 can also similarly act in accordance with the example of the end member 1630.

In the aspect, an example in which one type of operation portion directly presses the engaging member is illustrated, but not being limited thereto, and an aspect in which the members are interlocked via the plural types of operation portions, and finally, the operation portion which is the closest to the engaging member presses the engaging member, may be employed. In addition, the operation portion and the engaging member may be integrated without being distinguished from each other.

Next, a nineteenth aspect will be described. FIG. 125A is a front view of an end member 1830. FIG. 125B is a front view illustrating a cut-out part of the end member 1830. FIG. 126 is a perspective view illustrating a cut-out part of the end member 1830. FIG. 127 is a sectional view from the arrow direction illustrated by $C_{127}$-$C_{127}$ in FIG. 125A. The end member 1830 of the aspect includes a bearing member 1840 and a shaft member 1850.

The bearing member 1840 is a member which is bonded to the end portion of the photoreceptor drum 11 in the end member 1830. FIG. 128 is a perspective view of the bearing member 1840.

As can be ascertained from FIGS. 125 to 128, the bearing member 1840 is configured to include the tubular body 1441, the contact wall 1442, the fitting portion 1443, the gear portion 1444, and a shaft member holding portion 1845.

The shaft member holding portion 1845 is a part which is formed on the inner side of the tubular body 1441, and has a function of holding the shaft member 1850 in the bearing member 1840. In the aspect, as can be ascertained from FIGS. 127 and 128, the shaft member holding portion 1845 is configured to include a bottom plate 1846, a holding tube body 1847, and a holding groove 1848.

The bottom plate 1846 is a plate-like member which is disposed to block at least a part of the inner side of the tubular body 1441.

The holding tube body 1847 is a cylindrical member having a bottom provided at a axis part of the tubular body 1441 in the bottom plate 1846. The holding tube body 1847 is provided coaxially to the tubular body 1441, is opened to the side opposite to the fitting portion 1443, and is configured to have the bottom on the fitting portion 1443 side.

The holding groove 1848 is a member which protrudes from the inner surface of the tubular body 1441, and here, a groove 1848*a* is formed. As can be ascertained from FIG. 128, the groove 1848*a* is a groove which considers the direction parallel to the axial direction of the tubular body 1441 as the depth direction, the diameter direction of the tubular body 1441 as the length direction, and the inner circumferential direction of the tubular body 1441 is the width direction, and is opened on the side opposite to the fitting portion 1443, and on a surface which faces the axis. An opening portion on the side opposite to the fitting portion 1443 has a so-called snap-fit structure in which the groove width becomes narrow. As can be ascertained from FIG. 127, two holding grooves 1848 are provided, and two holding grooves 1848 are respectively disposed on one side and on the other side nipping the axis on one diameter of the tubular body 1441.

As can be ascertained from FIGS. 125 to 127, the shaft member 1850 is configured to include a rotating force receiving member 1852 and a regulating member 1860.

The rotating force receiving member 1852 receives the rotation driving force from the apparatus main body 2 and transmits the driving force to the bearing member 1840 when the end member 1830 is in a predetermined posture. In the aspect, the rotating force receiving member 1852 is configured to include two engaging members 1854 and a crank shaft 1855.

The engaging member 1854 is a rod-like member, and is a part which is engaged with and disengaged from the driving shaft 70 of the apparatus main body 2. FIG. 129 is a perspective view of the engaging member 1854. The engaging member 1854 is an overall rod-like member, but is provided with a claw portion 1854*a* which is bent in one end portion thereof. It is preferable that the claw portion 1854*a* has a reverse tapered shape or a shape of a hook. Accordingly, it is possible to more stably transmit the rotation. In the aspect, an inclined portion 1854*b* is provided so that a tip end of the claw portion 1854*a* becomes tapered.

A slit 1854*c* is provided to pass through the crank shaft 1855, in the other end portion in the engaging member 1854. The slit 1854*c* is a slit which has the longitudinal direction in the direction orthogonal to the direction in which the engaging member 1854 extends, and this is substantially the same direction as the direction in which the claw portion 1854*a* is bent.

The crank shaft 1855 is a member which holds the engaging member 1854 in the bearing member 1840, and makes the engaging member 1854 associate with the posture of the regulating member 1860. FIG. 130 is a perspective view of the crank shaft 1855. The crank shaft 1855 is similar to a so-called known crank shaft, and has a shape in which the rod-like member is bent. More specifically, a center protrusion portion 1855*a* in which the center part in the axial direction protrudes with respect to the axis (illustrated by $C_{130}$ in FIG. 130) that connects both end parts to one side, is provided, and end portion protrusion portions 1855*b* which protrude to the side opposite to the center protrusion portion 1855*a* are provided between the center protrusion portion 1855*a* and both ends.

The regulating member 1860 is configured to include a regulation shaft 1861 and an elastic member 1863.

The regulation shaft 1861 is a columnar member. FIG. 131 is an outer appearance perspective view of the regulation shaft 1861. One end portion of the regulation shaft 1861 is a part (truncated cone) of a cone, and an inclined surface 1861*a* is formed. Accordingly, the pressing force from the driving shaft 70 is converted to the pressing force in the longitudinal direction of a shape of a rod of the regulation shaft 1861, and more smooth attachment to and detachment from the driving shaft 70 are possible. In addition, in the end portion of the regulation shaft 1861, a slit 1861*b* which passes through the crank shaft 1855 on the side opposite to the inclined surface 1861*a*. The slit 1861*b* extends in the direction orthogonal to the axis of the regulation shaft 1861.

The elastic member 1863 is a coined spring.

By combining each member as follows, the end member 1830 is made. In addition, by describing the combination, the size of each member and part, the structure, or the relationship of the sizes of the members and parts, are further understood.

As can be ascertained from FIGS. 125 to 127, each of both ends of the crank shaft 1855 is held in the holding groove 1848 disposed on the inner side of the tubular body 1441, and the crank shaft 1855 is held across two holding grooves 1848 to be rotatable around the axis (line illustrated by $C_{130}$ in FIG. 130).

At this time, the center protrusion portion 1855*a* of the crank shaft 1855 passes through the slit 1861*b* of the regulation shaft 1861. In addition, the end portion on the inclined surface 1861*a* side of the regulation shaft 1861 protrudes to the side opposite to the fitting portion 1443 of the tubular body 1441. In addition, the elastic member 1863 is disposed between the end portion on the slit 1861*b* of the regulation shaft 1861 and the holding tube body 1847 of the bearing member 1840, and the regulation shaft 1861 is biased in the direction opposite to the fitting portion 1443.

Meanwhile, the slit 1854*c* of the engaging member 1854 passes through each of two end portion protrusion portions 1855*b* of the crank shaft 1855. In addition, the claw portion 1854*a* side of the engaging member 1854 protrudes in the direction opposite to the fitting portion 1443 of the tubular body 1441.

The end member 1830 combined as described above can take an aspect similar to FIG. 127 as one posture. In other words, the regulation shaft 1861 protrudes by the biasing force of the elastic member 1863, and the engaging member 1854 retracts to the fitting portion 1443 side by an action of the crank shaft 1855.

Meanwhile, as illustrated by $C_{127}$ in FIG. 127, when pressing the regulation shaft 1861 to the fitting portion 1443 side (the downward direction of the paper surface of FIG. 127), the regulation shaft 1861 is moved to the fitting portion 1443 side. Accordingly, as illustrated in FIG. 132, by the action of the crank shaft 1855, the engaging member 1854 protrudes to the side opposite to the fitting portion 1443.

In other words, the end member 1830 can also switch a posture in which the engaging member 1854 protrudes, and a sunken (retracted) posture. Accordingly, the end member 1830 can also similarly act in accordance with the example of the end member 1630.

In the end members of each of the above-described aspects, in any case, by the posture of the regulating member, an aspect in which the engaging member is not engaged with the driving shaft (the engaging member idles in the end members 1430 and 1530, the engaging member is inclined in the end members 1630 and 1730, and the engaging member retracts in the end member 1830) can be achieved. In addition, the engaging member is engaged with the driving shaft when it is necessary to transmit the rotating force from the driving shaft. Accordingly, it is possible to remarkably reduce the interruption of the engagement due to unnecessary interference in the process of the engagement of the driving shaft and the engaging member, and to perform smooth engagement.

In particular, considering that the driving shaft is engaged in a state where the shaft member is finally pressed, when a mechanism which operates as the driving shaft presses the regulating member is employed, since the mechanism is performed mechanically and automatically in a normal process of mounting the processing cartridge, convenience is also improved without additional operations.

Next, a twentieth aspect will be described. FIG. 133 is a perspective view of an end member 1930 included in the aspect. FIG. 134 is an exploded perspective view of the end member 1930. Since the configuration elements except the end member 1930 are considered similar to those in the first aspect, here, the end member 1930 will be described. As can be ascertained from FIGS. 133 and 134, the end member 1930 is provided with a bearing member 1940 and a shaft member 1950.

The bearing member 1940 is a member which is bonded to the end portion of the photoreceptor drum 11 in the end member 1930. FIG. 135A is a perspective view of the bearing member 1940. FIG. 135B is a front view of the bearing member 1940. FIG. 135C is a plan view when viewed from a side on which the shaft member 1950 is disposed, in the bearing member 1940. Furthermore, FIG. 136A is an end surface view along a line illustrated by $C_{136a}$-$C_{136a}$ in FIG. 135B. In other words, FIG. 136A illustrates an end surface when the bearing member 1940 is cut on a surface orthogonal to the axis of the bearing member 1940. FIG. 136B is a sectional view along a line illustrated by $C_{136b}$-$C_{136b}$ in FIG. 135C. In other words, FIG. 136B includes the axis of the bearing member 1940, and is a sectional view of the bearing member 1940 in the direction along the axis.

In addition, in each drawing which will be described below, the end surfaces (sectional surfaces) in the sectional view are illustrated being hatched.

As can be ascertained from FIGS. 133 to 136, the bearing member 1940 is configured to include a tubular body 1941, a contact wall 1942, a fitting portion 1943, a gear portion 1944, and a shaft member holding portion 1945.

The tubular body 1941 is an overall cylindrical member, the contact wall 1942 and the gear portion 1944 are disposed on the outer side thereof, and the shaft member holding portion 1945 is formed on the inner side thereof. In addition, at least at a part at which the shaft member holding portion 1945 is provided on the inner side of the tubular body 1941, the inner diameter of the tubular body 1941 is substantially the same as the outer diameter of a rotating shaft 1951 to an extent that the rotating shaft 1951 (refer to FIG. 137) of the shaft member 1950 which will be described later can smoothly move in the axial direction and rotate around the axis.

The contact wall 1942 which comes into contact with and is locked to the end surface of the photoreceptor drum 11, stands from a part of the outer circumferential surface of the tubular body 1941. Accordingly, in a posture in which the end member 1930 is mounted on the photoreceptor drum 11, the depth of insertion of the end member 1930 into the photoreceptor drum 11 is regulated.

In addition, one side of the tubular body 1941 nipping the contact wall 1942, becomes the fitting portion 1943 which is inserted into the photoreceptor drum 11. The fitting portion 1943 is inserted into the photoreceptor drum 11, and is fixed to the inner surface of the photoreceptor drum 11 by the adhesive. Accordingly, the end member 1930 is fixed to the end portion of the photoreceptor drum 11. Therefore, the outer diameter of the fitting portion 1943 is substantially the same as the inner diameter of the photoreceptor drum 11, within a range in which the insertion into the cylindrical inner side of the photoreceptor drum 11 is possible. A groove may be formed on the outer circumferential surface in the fitting portion 1943. Accordingly, the groove is filled with the adhesive, and adhesiveness between the tubular body 1941 (end member 1930) and the photoreceptor drum 11 is improved by an anchor effect or the like.

The gear portion 1944 is formed on the outer circumferential surface of the tubular body 1941 on the side opposite to the fitting portion 1943 nipping the contact wall 1942. The gear portion 1944 is a gear which transmits the rotating force to another member, such as the developing roller unit, and in the aspect, the gear portion 1944 is a helical gear. However, the type of the gear is not particularly limited, and may be a spur gear. Otherwise, both the helical gear and the spur gear may be disposed being aligned along the axial direction of the tubular body. In addition, it is not necessary to provide the gear.

The shaft member holding portion 1945 is a part which is formed on the inner side of the tubular body 1941, and which has a function of ensuring a predetermined operation of the shaft member 1950, and holding the shaft member 1950 in the bearing member 1940, and functions as one of means for moving and rotating a rotating force receiving member 1958 which will be described later. The shaft member holding portion 1945 includes a bottom plate (lid member) 1946 illustrated in FIGS. 134 and 136B, and a spiral groove 1947 illustrated in FIGS. 136A and 136B.

The bottom plate 1946 is a disk-like member, and is disposed to block and partition the inner side of the tubular body 1941. Accordingly, the shaft member 1950 is supported. The attachment of the bottom plate 1946 to the tubular body 1941 can be performed by adhering or welding. In addition, the tubular body 1941 and the bottom plate 1946 may be integrally formed.

The spiral grooves 1947 are a plurality of spiral grooves formed on the inner surface of the tubular body 1941, and as illustrated by $L_7$ in FIG. 136A, the depth direction is formed in a radial shape (radial direction) around the axis of the tubular body 1941. Meanwhile, the longitudinal direction of the spiral groove 1947 is the direction along the axis of the tubular body 1941 as illustrated in FIG. 136B, and one end side and the other side are twisted to be deviated in the direction along the inner circumference of the tubular body 1941, and are formed in a spiral shape. In addition, as illustrated by $L_8$ in FIG. 136A, the width direction of the spiral groove 1947 is formed to be substantially the same as the diameter of a pin 1967 to the extent that the end portion of the pin 1967 of the shaft member 1950 which will be described later is inserted, and the end portion of the pin 1967 can smoothly move in the groove.

In addition, one end of the spiral groove 1947 in the longitudinal direction is blocked by the bottom plate 1946, and the other end opposite thereto is blocked without reaching the end surface of the tubular body 1941.

In addition, as a standard which illustrates the extent of twisting of the spiral groove 1947, "torsion" can be defined. In other words, the "torsion" is defined from the distance (size illustrated by $L_9$ in FIG. 136) between the spiral grooves in the axial direction, and a total torsion angle which is an angle by which the spiral groove is twisted in the circumferential direction around the axis in the distance, and is expressed by the following equation.

Torsion (°/mm)=total torsion angle (°)/distance between the spiral grooves in the axial direction (mm)

Furthermore, at least one pair of spiral grooves 1947 are provided to face each other nipping the axis of the tubular body 1941. In the aspect, an example in which four pairs, that is, a total of eight spiral grooves 1947 are formed, is employed, but one pair, that is, two spiral grooves may be formed. Meanwhile, two, three, five or more pairs of spiral grooves may be provided. When the spiral groove is injection-molded, the injection molding is performed by the releasing while rotating the mold after the injection of the material.

A material which configures the bearing member 1940 is not particularly limited, but a resin, such as polyacetal, polycarbonate, or PPS, or metal can be used. Here, in order to improve the rigidity of the member in a case where the resin is used, the glass fiber or the carbon fiber may be mixed into the resin in accordance with the load torque. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

In a case of making the bearing member 1940 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

Returning to FIGS. 133 and 134, the shaft member 1950 of the end member 1930 will be described. As can be ascertained from FIG. 134, the shaft member 1950 is provided with the rotating shaft 1951 and a tip end member 1955. Furthermore, the shaft member 1950 is provided with a tip end member elastic member 1965, a rotating shaft elastic member 1966, and the pin 1967. Any of the tip end member elastic member 1965 and the rotating shaft elastic member 1966 in the aspect is a coiled spring.

Hereinafter, each of the members will be described.

The rotating shaft 1951 is a rotating force transmission portion which transmits the rotating force received by the tip end member 1955 to the bearing member 1940, and is a shaft-shape member which functions as means for moving and rotating the rotating force receiving member 1958. FIG. 137A is a perspective view of the rotating shaft 1951. FIG. 137B is a sectional view in the axial direction cut by a line illustrated by $C_{137b}$-$C_{137b}$ in FIG. 137A.

As can be ascertained from FIGS. 137A and 137B, the rotating shaft 1951 is cylindrical. The cylindrical inner side has the size by which the tip end member elastic member 1965 can be inserted. In the rotating shaft 1951, a lid portion 1951*a* is provided in one end portion, and an opening portion 1951*b* narrowed with respect to the inner diameter of the cylinder is provided in the lid portion 1951*a*. In addition, in the aspect, the opening portion 1951*b* is rectangular. However, the shape of the opening portion is not limited to the rectangular shape, and a shape in which a shaft 1957 (refer to FIG. 134) of the tip end member 1955 inserted thereto does not idle, and is hooked to the opening portion

1951*b* of the rotating shaft 1951, and the rotating force can be transmitted, may be employed. Therefore, a shape other than a circular shape can be employed. Means thereof is not particularly limited if the rotating shaft 1951 is interlocked to the rotation of the tip end member 1955 while the movement of the tip end member 1955 in the axial direction is possible, and for example, an additional portion, such as a pin, may be used.

In addition, in the rotating shaft 1951, two pin through holes 1951*c*, which are orthogonal to the axis of the cylinder, are provided in one diameter direction of the cylinder, and penetrate the inside and the outside of the cylinder, are formed in the end portion opposite to the end portion in which the lid portion 1951*a* is disposed. The pin 1967 (refer to FIG. 134) passes through the pin through hole 1951*c*, as will be described later.

The tip end member 1955 is a member which receives the rotation driving force from the apparatus main body 2 and transmits the driving force to the rotating shaft 1951. FIG. 138A is a perspective view of the tip end member 1955. FIG. 138B is a sectional view in the axial direction of the tip end member 1955 cut by a line illustrated by $C_{138a}$-$C_{138a}$ in FIG. 138A. FIG. 139A is a view which is enlarged focusing on the part of the rotating force receiving member 1958 in FIG. 138A. FIG. 139B is a view which is enlarged focusing on the part of the rotating force receiving member 1958 in FIG. 138B.

As can be ascertained from FIGS. 138A and 138B, the tip end member 1955 is configured to include the shaft 1957, a holding member 1956, and the rotating force receiving member 1958.

The shaft 1957 is a pillar-like member, and is a quadrangular prism having a rectangular section in the aspect. A sectional shape of the shaft 1957 is formed to be substantially the same as or slightly smaller than the opening portion 1951*b* of the above-described rotating shaft 1951.

The holding member 1956 is a plate-like member which is disposed in one end portion of the shaft 1957. The holding member 1956 and the shaft 1957 are disposed in an aspect in which one surface of the holding member 1956 overlaps one end surface of the holding member 1956. Both the holding member 1956 and the shaft 1957 may be formed separately and be adhered and welded to each other, or may be integrally formed.

As illustrated in FIGS. 138A and 138B, the holding member 1956 is formed to be greater than the shaft 1957 in the direction orthogonal to the axial direction. The size and the shape are configured to be stored on the inner side of the above-described rotating shaft 1951, and not to pass through the opening portion 1951*b*. Accordingly, it is possible to hold the tip end member 1955 in the rotating shaft 1951. In the aspect, an outer shape of the holding member 1956 is substantially the same aspect (that is, a circular shape) as the sectional shape of the inner side of the rotating shaft 1951.

The rotating force receiving member 1958 is disposed in the end portion opposite to the holding member 1956 of the shaft 1957, and is configured to include two engaging members 1960 which stand from a cylindrical receiving member 1959 and one end surface of the receiving member 1959. The shaft 1957 and the rotating force receiving member 1958 may be formed separately and be adhered and welded to each other, or may be integrally formed.

The receiving member 1959 is disposed coaxially to the shaft 1957 by a member which considers a column provided in the end portion opposite to the holding member 1956 of the end portion of the shaft 1957, as a base body.

The receiving member 1959 has an inclined surface 1959*c* which is inclined in the direction along the axial direction in the outer circumferential portion thereof. As illustrated in FIGS. 138B and 139B, the inclined surface 1959*c* is an inclination of which the diameter becomes smaller when approaching the engaging member 1960 side, and an end portion thereof is connected to an end surface (edge portion 59*d*) provided with the engaging member 1960 in the receiving member 1959.

Furthermore, in the receiving member 1959, a recessed portion 1959*a* is formed on a surface on a side on which the engaging member 1960 is formed. The recessed portion 1959*a* is formed so that the tip end portion of the driving shaft 70 which will be described later enters here, and accordingly, the axis of the shaft member 1950 (end member 1930) and the axis of the driving shaft 70 match each other. In addition, it is preferable that a bottom surface 59*b* of the recessed portion 1959*a* is a smoothly inclined surface or a bent surface from the viewpoint of smooth engagement to and disengagement from the driving shaft 70. From the related viewpoint, it is preferable that the recessed portion 1959*a* becomes a part of a spherical surface in which the axis portion is considered as the deepest portion.

Two engaging members 1960 are projection-like member, are disposed in the outer circumferential end portion on the surface opposite to the side which is connected to the shaft 1957 in the receiving member 1959, and are separated from the axis of the receiving member 1959 at the same distance. Both engaging members 1960 are disposed at symmetrical positions nipping the axis. The interval between two engaging members 1960 is formed to be substantially the same as or slightly greater than the diameter of a shaft portion 72 of the driving shaft 70. In addition, as can be ascertained with reference to FIG. 144A, the interval between two engaging members 1960 is configured so that the driving projection 71 is hooked to the engaging member 1960, in a posture in which the shaft portion 72 of the driving shaft 70 is disposed between two engaging members 1960.

Here, the engaging members 1960 are configured as a pair of two engaging members 1960. In the aspect, an example in which one pair of engaging members 1960 is disposed is described, but two pairs (four members), three pairs (six members), or more pairs of engaging members may be provided.

The engaging member 1960 has a shape illustrated in FIGS. 138A and 139B, but the shape of the surface which forms the engaging member 1960 is as follows. A surface 1960*a* which becomes an outer circumferential side of the receiving member 1959 on the surface of the engaging member 1960, is the surface 1960*a* which is continuous to the inclined surface 1959*c* formed on the outer circumference of the receiving member 1959. Therefore, the surface 1960*a* is inclined or bent when approaching the axis according to the separation from the recessed portion 1959*a*.

A surface 1960*b* which faces the recessed portion 1959*a* side on the surface of the engaging member 1960, is the surface 1960*b* which is continuous to the 1959*b* of the recessed portion 1959*a*. Therefore, the surface 1960*b* is inclined or bent when being separated from the axis according to the separation from the recessed portion 1959*a*.

A surface 1960*c* which is one surface which faces the receiving member 1959 in the circumferential direction on the surface of the engaging member 1960 is inclined or bent in the direction in which a normal line (for example, a line illustrated by N in FIG. 139B) is separated from the receiving member 1959 at any part.

A surface 1960*e* which is the other one surface that is a surface opposite to the surface 1960*c* on the surface of the engaging member 1960, and faces the receiving member 1959 in the circumferential direction, has an inclined or bent surface to form a recessed portion 1960*d*. Therefore, the recessed portion 1960*d* is a recessed portion which is recessed in the circumferential direction of the receiving member 1959. A part of the driving projection 71 of the driving shaft 70 on the inner side of the recessed portion 1960*d* enters the recessed portion 1960*d*, and the recessed portion 1960*d* is formed to have the size by which the driving projection 71 is engaged with the engaging member 1960.

Here, in two engaging members 1960, in the circumferential direction of the receiving member 1959, the surfaces 1960*e* of one engaging member 1960 are aligned to face the surfaces 1960*c* of the other engaging member 1960. In addition, the recessed portion 1960*d* is formed to be recessed in the rotational direction in which the driving force is transmitted, in the engaging member 1960. Accordingly, as will be described later, it is possible to appropriately engage the driving projection 71 of the driving shaft 70.

Returning to FIG. 134, other configuration elements provided in the shaft member 1950 will be described. The tip end member elastic member 1965 and the rotating shaft elastic member 1966 are so-called elastic members, and any of the tip end member elastic member 1965 and the rotating shaft elastic member 1966 functions as means for moving and rotating the rotating force receiving member 1958. In the aspect, both are the coiled springs. In addition, the pin 1967 is the means which moves and rotates the rotating force receiving member 1958, and is a rod-like member which functions as a projection that moves on the inner side of the spiral groove 1947. The dispositions and the actions of each member will be described later.

A material which configures each member of the shaft member 1950 is not particularly limited, but various types of resin or metal can be used.

In a case of making the shaft member 1950 by the resin, for example, polyacetal, polycarbonate, polyphenylene sulfide (PPS), polyamide imide (PAD, polyetherether keton (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber or the carbon fiber may be mixed into the resin in accordance with the load torque. In addition, by inserting metal into the resin, the rigidity may further be improved.

Meanwhile, in a case of making the shaft member 1950 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 1950 and any member included in the shaft member 1950, may be made by bending a metal plate, or may be made by making the metal, glass, or carbon fiber infiltrate into the resin.

By combining the bearing member 1940 and the shaft member 1950 with each other as follows, the end member 1930 is made. In addition, by describing the combination, the size of each member and part, the structure, or the relationship of the sizes of the members and parts, are further understood. FIG. 140 is a sectional view in the axial direction of the end member 1930. FIG. 141A is a sectional view of the end member 1930 along a line illustrated by $C_{141a}$-$C_{141a}$ in FIG. 140. FIG. 141B is a sectional view of the end member 1930 by a line illustrated by $C_{141b}$-$C_{141b}$ in FIG. 141A. However, in FIGS. 141A and 141B, for making it easy to understand, regarding the shaft member 1950, only the pin 1967 is illustrated.

As can be ascertained from FIG. 140, the shaft 1957 of the tip end member 1955 passes through the opening portion 1951*b* of the rotating shaft 1951. At this time, the holding member 1956 of the tip end member 1955 is included on the inner side of the rotating shaft 1951, and the rotating force receiving member 1958 of the tip end member 1955 is disposed to protrude from the rotating shaft 1951.

Meanwhile, the pin 1967 passes to cross over the two pin through holes 1951*c* of the rotating shaft 1951. At this time, both ends of the pin 1967 respectively protrude from the side surface of the rotating shaft 1951, and function as projections.

In addition, the tip end member elastic member 1965 is disposed between the holding member 1956 of the tip end member 1955 and the pin 1967 on the inner side of the rotating shaft 1951. Therefore, one side of the tip end member elastic member 1965 comes into contact with the holding member 1956, and the other side thereof comes into contact with the pin 1967. Accordingly, the tip end member 1955 is biased in the direction in which the tip end member elastic member 1965 biases the tip end member 1955 and makes the tip end member 1955 protrude from the rotating shaft 1951. However, since the holding member 1956 cannot pass through the opening portion 1951*b* of the rotating shaft 1951, the tip end member 1955 is held in a state of being biased without falling out of the rotating shaft 1951.

In this manner, in the rotating shaft 1951 combined by the tip end member 1955, the tip end member elastic member 1965, and the pin 1967, the side on which the tip end member 1955 is not disposed is inserted toward the bottom plate 1946 side of the shaft member holding portion 1945 formed on the inner side of the bearing member 1940. At this time, as illustrated in FIGS. 141A and 141B, the end portion of the pin 1967 protruded from the side surface of the rotating shaft 1951 is inserted into the spiral groove 1947 formed in the shaft member holding portion 1945 of the bearing member 1940.

In addition, as can be ascertained from FIG. 140, on the inner side of the bearing member 1940, the rotating shaft elastic member 1966 is disposed between the rotating shaft 1951 and the bottom plate 1946. Therefore, one side of the rotating shaft elastic member 1966 comes into contact with the rotating shaft 1951, and the other side of the rotating shaft elastic member 1966 comes into contact with the bottom plate 1946. Accordingly, the rotating shaft 1951 is biased in the direction in which the rotating shaft elastic member 1966 biases the rotating shaft 1951 and makes the rotating shaft 1951 including the tip end member 1955 protrude from the bearing member 1940. However, since the tip end of the pin 1967 is inserted into the spiral groove 1947 of the bearing member 1940, and both ends of the spiral groove 1947 are blocked as described above, the rotating shaft 1951 is held in a state of being biased without falling out of the bearing member 1940.

Above, in the posture in which each member is combined, the axes of the bearing member 1940, the rotating shaft 1951, and the tip end member 1955 match each other.

Next, how the end member 1930 can be deformed, move, and rotate, will be described. FIG. 142 is a perspective view in one posture of the end member 1930.

In the postures illustrated in FIGS. 140 to 142, the entire shaft member 1950 is in a posture of being protruded the most from the bearing member 1940 within a possible range, by the tip end member elastic member 1965 and the rotating shaft elastic member 1966. When any external force is not applied to the shaft member 1950, the end member 1930 is in this posture.

From this posture, as illustrated by $C_{140a}$ in FIGS. 140 and 142, when the rotating force around the axis is applied to the rotating force receiving member 1958 of the tip end member 1955, following this, the shaft 1957 rotates. Since the shaft 1957 and the opening portion 1951*b* of the rotating shaft 1951 do not idle, the rotating force is transmitted to the rotating shaft 1951, and as illustrated by an arrow $C_{140b}$ in FIGS. 140 and 142, the rotating shaft 1951 also rotates.

When the rotating shaft 1951 rotates in this manner, the pin 1967 also rotates. Then, firstly, the pin 1967 presses the side wall of the spiral groove 1947, transmits the rotation to the bearing member 1940, and as illustrated by an arrow $C_{140c}$ in FIGS. 140 and 142, the bearing member 1940 rotates. Accordingly, the photoreceptor drum 11 attached to the bearing member 1940 also rotates around the axis.

Secondly, since the tip end of the pin 1967 is inserted into the spiral groove 1947, when the rotating shaft 1951 rotates, as illustrated by an arrow $C_{141c}$ in FIG. 141B, the pin 1967 also moves in the axial direction. Accordingly, the rotating shaft 1951 to which the pin 1967 is attached, and the tip end member 1955 attached thereto, also move against the biasing force of the rotating shaft elastic member 1966 as illustrated by an arrow $C_{140d}$ in FIGS. 140 and 142, or in the biasing direction.

Therefore, in the end member 1930, according to the rotation of the rotating force receiving member 1958, the rotation around the axis of the end member 1930 and the movement of the rotating shaft 1951 and the tip end member 1955 in the direction along the axis, are also performed.

In addition to the description above, the end member 1930 can be deformed as follows. FIG. 143 is a view illustrating this. FIG. 143 is a view from the same viewpoint as that of FIG. 140. In other words, in the end member 1930, when the force is applied to the rotating force receiving member 1958 of the tip end member 1955 in the axial direction, other members are not deformed as illustrated by an arrow $C_{143}$ in FIG. 143, and only the tip end member 1955 moves in the axial direction.

In the above-described end member 1930, the fitting portion 1943 of the end member 1930 is inserted and adhered to one end portion of the photoreceptor drum 11 (refer to FIGS. 144A and 145). In addition, the non-driving side end member 20 is disposed in the other end portion of the photoreceptor drum 11, and the photoreceptor drum unit can be made.

In the posture in which the processing cartridge 3 is mounted on the apparatus main body 2, the driving shaft 70 and the rotating force receiving member 1958 provided in the shaft member 1950 of the end member 1930, are engaged with each other, and the rotating force is transmitted. FIG. 144A is a perspective view of a scene where the rotating force receiving member 1958 of the end member 1930 is engaged with the driving shaft 70. In addition, FIG. 144B is an enlarged view illustrating a scene of the engagement. Furthermore, FIG. 145 is a sectional view along the axial direction.

As can be ascertained from FIGS. 144A, 144B, and 145, in the posture in which the driving shaft 70 and the rotating force receiving member 1958 are engaged with each other, the axis of the driving shaft 70 and the axis of the shaft member 1950 are disposed to abut against each other to match each other. At this time, the tip end of the shaft portion 72 of the driving shaft 70 gets into between two engaging members 1960 of the rotating force receiving member 1958, and is disposed on the inner side of the recessed portion 1959*a* of the receiving member 1959.

In addition, the driving projection 71 of the driving shaft 70 is engaged to be hooked to the engaging member 1960 of the rotating force receiving member 1958 from the side surface. At this time, the driving projection 71 gets into the inner side of the recessed portion 1960*d* of the engaging member 1960.

In this posture, as illustrated in by an arrow $C_{144b}$ in FIG. 144B, when the driving shaft 70 rotates in the rotating force transmitting direction, the driving projection 71 enters the recessed portion 1960*d* of the engaging member 1960, and is hooked to the engaging member 1960, and the rotating force is transmitted as illustrated by an arrow $C_{144c}$ in FIG. 144B. At this time, the rotating shaft 1951 moves in the direction illustrated by $C_{144d}$ in FIG. 144B by the actions of the spiral groove 1947 of the bearing member 1940 and the pin 1967. However, since the driving projection 71 of the driving shaft 70 gets into and is engaged with the recessed portion 1960*d* of the engaging member 1960 of the rotating force receiving member 1958, the engagement of the driving projection 71 and the recessed portion 1960*d* is not released, and stable linking is maintained. A force which moves in the direction illustrated by an arrow $C_{144d}$ is a force which pulls the driving shaft 70, and the force acts to further stabilize the rotation.

However, at this time, the pulling force by the spiral groove 1947 is weaker than the force by which the engaging member 1960 is engaged with the driving shaft 70. More specifically, it is preferable to configure as follows.

As schematically illustrated in FIG. 145, it is preferable that the following established expression in a pulling force by the engaging member illustrated by P, a biasing force of the rotating shaft elastic member illustrated by Q, and a force in the axial direction by the spiral groove illustrated by R, is the condition of the rotation driving.

$$R \leq P+Q$$

Here, P is a force which moves in the direction of approaching the driving shaft of the apparatus main body during the driving rotation by the shape of the engaging member of the tip end member, Q is a force which is generated by the rotating force elastic member, and moves in the direction of approaching the driving shaft of the apparatus main body, and R is a force which is generated by the spiral groove of the main body during the rotation driving, and is moved in the direction of separating the rotating shaft from the driving shaft of the apparatus main body.

Next, a modification example of the aspect will be described. The processing cartridge 3 is smoothly attachable to and detachable from the apparatus main body 2. Meanwhile, furthermore, the following configuration is possible for making more smooth attachment and detachment possible. FIG. 146 is a schematic view illustrating an idea on the assumption of first to third modification examples. FIG. 146A is a schematic view of the posture which corresponds to FIG. 144A in a view of a state where the rotating force is transmitted to an end member 1930' of the processing cartridge from a driving shaft 70' of the apparatus main body. FIG. 146B is a schematic view of a scene where the end member 1930' of the processing cartridge is disengaged from the driving shaft 70' of the apparatus main body.

In FIG. 146A, in a posture in which a driving projection 71' of the driving shaft 70' is engaged with two engaging members 1960' of the end member 1930', the driving projection 71' rotates as illustrated by an arrow $C_{146a}$ around the axis of the driving shaft 70'. In addition, the rotating force transmitted to the engaging member 1960' rotates a shaft 51', and further, rotates a pin 1967' around the axis of a rotating shaft 1951'. Both ends of the pin 1967' are inserted into a spiral groove 1947' of a bearing member 1940'. Here, in the aspect, in the engaging member 1960', an inclined surface which is inclined in the direction in which the engaging member 1960' is unlikely to be disengaged from the driving shaft 70', the driving projection 71' comes into contact with the inclined surface, and the rotating force is transmitted.

In the posture illustrated in FIG. 146A, a force which is illustrated by F in FIG. 146A acts on the engaging member 1960' from the driving projection 71' by the rotation of the driving shaft 70', and at this time, as described above, since the engaging member 1960' is in contact with the driving projection 71' on the inclined surface, a component of force acts upward on the paper surface as illustrated by Fa. Since the same components of force Fa are generated in each of two engaging members 1960', when the components of force are combined, 2·Fa is obtained.

Meanwhile, the pin 1967' presses a side wall of the spiral groove 1947' by the transmitted rotating force, by a force illustrated by G in FIG. 146A. However, since the side wall of the spiral groove 1947' is an inclined surface which is inclined with respect to the direction along the axis of the end member 1930', a component of force acts downward on the paper surface as illustrated by Ga. The component of force Ga is a force in the orientation opposite to the above-described component of force Fa. Since the same components of force Ga are generated at each of both ends of the pin 1967', when the components of force are combined, 2·Ga is obtained.

In a scene of FIG. 146A, from the viewpoint that the rotating force is stably transmitted, since it is necessary that the engaging member 1960' and the driving shaft 70' are not disengaged from each other, 2·Fa>2·Ga, that is, the following is preferable.

$$Fa>Ga \quad (1)$$

Meanwhile, in FIG. 146B, in a posture in which the driving projection 71' of the driving shaft 70' is engaged with two engaging members 1960' of the end member 1930', the end member 1930' is moved in the direction of the arrow $C_{146b}$. Then, it is possible to assume that the force F is applied to one of two engaging members 1960'. In addition, accordingly, the pin 1967' is considered to rotate in the direction of the arrow $C_{146c}$ around the axis of the shaft 51'.

Then, in the posture illustrated in FIG. 146B, the force acts as illustrated by F in FIG. 146B with respect to the engaging member 1960' from the driving projection 71', and at this time, as described above, since the engaging member 1960' is in contact with the driving projection 71' on the inclined surface, the component of force acts upward on the paper surface as illustrated by Fa. Since the component of force Fa is generated in one engaging member 1960', the total force is also Fa.

Meanwhile, the pin 1967' presses the side wall of the spiral groove 1947' of the bearing member 1940' by the transmitted rotating force, but since the force at this time is a half of that in a case of FIG. 146A, the pin 1967' presses the side wall by a force of G/2. In addition, since the side wall of the spiral groove 1947' is an inclined surface, the component of force acts downward on the paper surface as illustrated by Ga/2. In other words, the component of force Ga/2 is a force in the orientation opposite to the above-described Fa. Since the components of force Ga/2 are generated at both ends of the pin 1967', when the components of force are combined, Ga is obtained.

In the scene of FIG. 146B, from the viewpoint that the end member 1930' and the driving shaft 70' are easily disengaged from each other, the following is preferable.

$$Fa<Ga \quad (2)$$

Here, when comparing the expression (1) and the expression (2), preferable force relationships are opposite to each other. Accordingly, there is a concern that it is difficult to achieve both ensuring the smooth rotating force transmission and more simple attachment and detachment of the processing cartridge. Meanwhile, for example, it is possible to solve the problem by the following aspect.

FIG. 147 is a view illustrating a first modification example. FIG. 147 is a sectional view along the axial direction illustrating a part of a receiving member 2059 provided in the modification example. FIG. 10B is a corresponding view. Parts other than the receiving member 2059 correspond to the description of the end member 1930 of the first aspect. In addition, in FIG. 147, parts which are the same as those of the receiving member 1959 are given the same reference numerals.

In the aspect, a recessed portion 2059*a* is formed on the end surface on the side on which the engaging member 1960 is formed in the receiving member 2059. The recessed portion 2059*a* is formed so that the tip end portion of the driving shaft 70 enters here. In addition, as can be ascertained from FIG. 147, a side surface 159*b* of a recessed portion 159*a* is inclined to be widened to the opening side, and further, a projected portion 2059*c* is provided.

The receiving member 2059 acts as follows. FIG. 148 is a scene where the receiving member 2059 is engaged with the driving shaft 70. FIG. 148A illustrates a posture in which the rotating force is transmitted. FIG. 148B illustrates a posture in which the rotating force is transmitted, and a scene where the driving shaft 70 is disengaged from the receiving member 2059.

In the posture in which the rotating force is transmitted, as illustrated in FIG. 148A, the receiving member 2059 and the driving shaft 70 are engaged with each other as usual, the rotating force is transmitted. At this time, it is possible to configure to satisfy the above-described expression (1).

Meanwhile, in a scene where the receiving member 2059 (that is, the processing cartridge) is disengaged from the driving shaft 70, as illustrated in FIG. 148B, when the processing cartridge is moved, the tip end portion of the driving shaft 70 slides on a surface of a projected portion 159*c*. At this time, since the projected portion 2059*c* is projected, as illustrated by H in FIG. 148B, a large force which is generated in the same direction as that of Ga in the axial direction. Therefore, in the modification example, instead of the expression (2), an expression (3) can be employed.

$$Fa-H<Ga \quad (3)$$

According to this, it is possible to establish both the expression (1) and the expression (3), and to more reliably ensure the stabilized transmission of the rotation driving force and smooth disengagement of the processing cartridge from the driving shaft 70.

FIG. 149 is a view illustrating a second modification example. FIG. 149 is a perspective view illustrating a part of the receiving member 2159 provided in the modification example. Parts other than the receiving member 2159 corresponds to the description of the end member 1930 of the above-described first aspect. In addition, in FIG. 149, the same parts as those in the receiving member 1959 are given the same reference numerals.

In the aspect, a recessed portion 2159*a* is formed on the end surface on the side on which the engaging member 1960 of the receiving member 2159 is formed. The recessed portion 2159*a* is formed so that the tip end portion of the driving shaft 70 enters. In addition, on the side surface of the recessed portion 2159*a*, as can be ascertained from FIG. 149, a spiral groove 2159*b* which extends in a radial shape when viewed from the axis, and is formed to be curved in the circumferential direction around the axis, is provided.

The receiving member 2159 acts as follows. FIGS. 150 151, and 152 are scenes where the receiving member 2159 is engaged with the driving shaft 70. FIG. 150A is a posture in which the rotating force is transmitted. FIGS. 150B and 151 are scenes where the driving shaft 70 is disengaged from the receiving member 2159. FIG. 152 is a view illustrating a force generated in the disengaged scene. FIG. 152 is a schematic view in accordance with FIG. 146B.

In the scene where the rotating force is transmitted, as illustrated in FIG. 150A, the receiving member 2159 and the driving shaft 70 are engaged with each other as usual, and the rotating force is transmitted. At this time, it is possible to configure to satisfy the above-described expression (1).

Meanwhile, in the scene where the receiving member 2159 (that is, processing cartridge) is disengaged from the driving shaft 70, as illustrated in FIGS. 150B and 151, when the processing cartridge is moved, the tip end portion of the driving shaft 70 slides on the spiral groove 2159*b*. Accordingly, as illustrated by J in FIG. 151, the rotating force is generated. The J is generated at a part different from the engaging member 1960' as illustrated in FIG. 152, the rotating shaft 1951' is rotated, and further, the pin 1967' is rotated around the axis of the rotating shaft 1951'. In addition, the pin 1967' presses the side wall of the spiral groove 1947' of the bearing member 1940' by the transmitted rotating force, but the force at this time presses the side wall by a force of J/2 as illustrated in FIG. 152. In addition, since the side wall of the spiral groove 1947' is the inclined surface, the component of force acts downward on the paper surface as illustrated by Ja/2. In other words, the component of force Ja/2 is a force in the orientation opposite to the above-described Fa. Since the components of force Ja/2 are generated at both ends of the pin 1967', when the components of force are combined, Ja is obtained. The Ja is a force which acts in the same orientation as Ga illustrated in FIG. 146B. Therefore, in the modification example, in addition to the relationship of F and G generated by the engaging member 1960 as illustrated in FIG. 146B, the above-described force acts based on the J, and instead of the expression (2), an expression (4) can be employed.

$$Fa<Ga+Ja \quad (4)$$

According to the modification example, it is possible to establish both the expression (1) and the expression (4), and to more reliably ensure the stabilized transmission of the rotation driving force and the smooth disengagement of the processing cartridge from the driving shaft 70. In addition, since it is preferable that the driving shaft is likely to operate along the spiral groove for generating J more efficiently, it is preferable that the friction of both members is higher. Therefore, the spiral groove may be made by rubber (urethane rubber or the like), and may be made by rubber coating.

FIGS. 153 and 154 illustrate a view illustrating a third modification example. According to this, while the preferable force relationships are opposite to each other when comparing the above-described expressions (1) and (2), it is possible to solve a concern that it is difficult to achieve both ensuring the smooth transmission of the rotating force and more simple attachment and detachment of the processing cartridge. In addition, in the modification example, since a basic shape can be configured to be the same as that of the end member 1930, the reference numeral is the same as that of the end member 1930.

In other words, in the process of the above-described disengagement, based on the elastic deformation of the rotating shaft 1951 and/or the tip end member 1955, or clearance between the members, as the rotating force receiving member 1958 is slightly inclined, the engaging member 1960 is more likely to be disengaged from the driving shaft 70, and more smooth disengagement is possible. Specifically, FIGS. 153 and 154 are views illustrating this. FIGS. 153A and 154A are sectional views illustrating a posture in which the end member 1930 is engaged with the driving shaft 70, and the rotating force is transmitted. FIG. 153B is a view illustrating an example in which the rotating shaft 1951 and the tip end member 1955 are inclined. FIG. 154B is a view illustrating an example in which the tip end member 1955 is inclined.

According to the example of FIG. 153B, from the posture illustrated in FIG. 153A, when the processing cartridge is moved as illustrated by an arrow $C_{153}$ in FIG. 153B, the tip end member 1955 is hooked to the driving shaft 70, and the rotating shaft 1951, the tip end member 1955, and the pin 1967 are inclined as a whole by an angle of $\theta_1$ with respect to the axis. In this manner, in order to make it possible to incline the rotating shaft 1951, the tip end member 1955, and the pin 1967, a method for providing a predetermined void between the outer circumference of the rotating shaft 1951 and a part to which the rotating shaft 1951 of the bearing member 1940 is inserted, can be employed as an example.

According to the example of FIG. 154B, from the posture illustrated in FIG. 154A, when the processing cartridge is moved as illustrated by an arrow $C_{154}$ in FIG. 154B, the tip end member 1955 is hooked to the driving shaft 70, and the tip end member 1955 is inclined by an angle of $\theta_2$ with respect to the axis. In this manner, in order to make it possible to incline the tip end member 1955, for example, a method for providing a predetermined void between the outer circumference of the shaft 1957 of the tip end member 1955 and the opening portion 1951*b* which is a part to which the shaft 1957 of the rotating shaft 1951 is inserted, can be employed as an example.

According to the end member of the aspect, as illustrated in FIGS. 153A and 154A, by the inclination $\theta_1$, the inclination $\theta_2$, or the inclination $\theta_1+\theta_2$ which is a sum of both inclinations, the receiving member 1959 and the driving shaft 70 are engaged with each other as usual in the scene where the rotating force is transmitted, and the rotating force is transmitted. At this time, it is possible to configure to satisfy the above-described expression (1).

Meanwhile, in the scene where the end member 1930 (that is, the processing cartridge) is disengaged from the driving shaft 70, as the processing cartridge is moved as illustrated in FIGS. 153B and 154B, as described above, the receiving member 1959 is inclined. Then, the component of force Fa illustrated by FIG. 146B is smaller than the extent of the inclination. Specifically, when a coefficient which is determined by the extent of the inclination is $0<x<1$, the component of force which is smaller than the inclination can be expressed by x·Fa. Therefore, in this case, instead of the expression (2), the expression (3) can be employed.

$$xFa<Ga \quad (3)$$

According to this, it is possible to establish both the expression (1) and the expression (3), and to more reliably ensure the stabilized transmission of the rotation driving force and the smooth disengagement of the processing cartridge from the driving shaft 70.

Specifically, it is preferable that the angle of the inclination is greater than 0° and equal to or smaller than 10° (illustrated by $\theta_1$ and $\theta_2$ in FIGS. 153B and 154B) with respect to the axis of the fixing member 30. When the angle is 0°, the inclination is not made. In addition, when the angle is greater than 10°, the allowed inclination is extremely large, and as illustrated in FIGS. 153A and 154A, there is a concern that rattling or the like is generated even in the posture in which the rotating force is transmitted as usual, and a possibility of interrupting the stabilized rotation increases. It is more preferable that the angle of inclination is greater than 0° equal to or smaller than 5°.

In addition, the inclination may be allowed to be the same in all directions with respect to the axis, or only the inclination in the specific direction may be allowed. A specific aspect for allowing the inclination in the specific direction is not particularly limited, but for example, the inclination can be performed as a hole which regulates the inclination of the shaft member 1950 is formed to be long in the direction in which the inclination is allowed.

Next, a twenty first aspect will be described. FIG. 155 is an exploded perspective view of an end member 2230 included in the twenty first aspect. FIG. 156 is an exploded sectional view along the axial direction of the end member 2230. The end member 2230 is provided with a bearing member 2240 and a shaft member 2250.

The bearing member 2240 is a member which is bonded to the end portion of the photoreceptor drum 11 in the end member 2230. FIG. 157A is a perspective view of a main body 2241 of the bearing member 2240. FIG. 157B is a plan view of the main body 2241.

The bearing member 2240 includes the main body 2241 and a lid member 2242, and as can be ascertained from FIGS. 155 and 157, the main body 2241 is configured to include the tubular body 1941, the fitting portion 1943, the gear portion 1944, and a shaft member holding portion 2245.

The tubular body 1941, the fitting portion 1943, and the gear portion 1944 are similar to those in the end member 1930, the same reference numerals will be given, and the description thereof will be omitted.

The shaft member holding portion 2245 is a part which is formed on the inner side of the tubular body 1941, and which has a function of ensuring a predetermined operation of the shaft member 2250, and holding the shaft member 2250 in the bearing member 2240, and functions as one of means for moving and rotating the rotating force receiving member 1958. The shaft member holding portion 2245 includes a bottom plate 2246 and a spiral portion 2247 which is a space in which the section is twisted in the axial direction.

The bottom plate 2246 is a disk-like member, and is disposed to block and partition at least a part of the inner side of the tubular body 1941. Accordingly, the shaft member 2250 is supported. In the aspect, a hole 2246*a* is formed in the center portion thereof. The attachment of the bottom plate 2246 to the tubular body 1941 can be performed by adhering or welding. In addition, the tubular body 1941 and the bottom plate 2246 may be integrally formed.

The spiral groove 2247 is a space formed on the inner surface of the tubular body 1941, and as can be ascertained from FIGS. 156 and 157B, in the aspect, a section which is orthogonal to the axial direction is substantially triangular, the section is formed to gradually rotate around the axis along the axial direction, and becomes a shape of a so-called twisted triangular prism (in FIG. 157B, an opening edge of the spiral portion is illustrated by a solid line, and an example of a section in the depth in the axial direction is illustrated by a dotted line).

In addition, one end of the spiral portion 2247 in the longitudinal direction blocks a part thereof by the bottom plate 2246, and the other end opposite thereto blocks a part thereof by the lid member 2242.

The lid member 2242 is a disk-like member which is disposed on the side opposite to the bottom plate 2246 nipping the shaft member holding portion 2245, and is provided with a hole 2242*a* at the center thereof. In the aspect, a claw 2242*b* is provided, is engaged with the main body 2241, and is fixed in a so-called snap-fit manner. However, means of fixing the lid is not limited thereto, and the adhesive or welding by heat or ultrasound wave can be used as another means.

A material which configures each member of the bearing member 2240 is not particularly limited, but various types of resin or metal can be used.

In a case of making the bearing member 2240 by the resin, for example, polyacetal, polycarbonate, polyphenylene sulfide (PPS), polyamide imide (PAD, polyetherether keton (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

Meanwhile, in a case of making the bearing member 2240 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the bearing member 2240 and any member included in the bearing member 2240, may be made by bending a metal plate, or may be made by making the metal, glass, or carbon fiber infiltrate into the resin.

As can be ascertained from FIGS. 155 and 156, the shaft member 2250 is provided with a rotating shaft 2251 and a tip end member 2255. Furthermore, the shaft member 2250 is provided with a tip end member elastic member 2265, a rotating shaft elastic member 2266, and a pin 2267. Any of the tip end member elastic member 2265 and the rotating shaft elastic member 2266 in the aspect is a coiled spring.

Hereinafter, each of the members will be described.

The rotating shaft 2251 is a rotating force transmission portion which transmits the rotating force received by the tip end member 2255 to the bearing member 2240, and is a shaft-shape member which functions as means for moving and rotating the rotating force receiving member 1958. FIG. 158 is a perspective view of the rotating shaft 2251.

As can be ascertained from FIGS. 155, 156, and 158, in the rotating shaft 2251, a cylindrical member 2252 and a columnar member 2253 are coaxially linked to each other. The inner side of the cylinder has the size by which the tip end member elastic member 2265 can be inserted. In the rotating shaft 2251, two long holes 2251*a* which penetrate in the direction orthogonal to the axial direction are formed at the cylindrical parts. Two long holes 2251*a* are disposed on one diameter of the cylindrical member 2252. In addition, the long hole 2251*a* considers the axial direction as the longitudinal direction.

In addition, in the outer circumferential portion of the rotating shaft 2251, at a boundary part between the cylindrical member 2252 and the columnar member 2253, a spiral pillar-like portion 2254 which is twisted corresponding to the shape of the above-described spiral portion 2247, is provided.

The tip end member 2255 is a member which receives the rotation driving force from the apparatus main body 2 and transmits the driving force to the rotating shaft 2251. As can be ascertained from FIGS. 155 and 156, the tip end member 2255 is configured to include a shaft 2257 and the rotating force receiving member 1958.

The shaft 2257 is a pillar-like member, and is a column in the aspect. In addition, in the shaft 2257, a hole 2257*a* which penetrates in the direction orthogonal to the axis is formed.

Since the rotating force receiving member 1958 is similar to the above-described end member 1930, the description thereof will be omitted.

Returning to FIG. 155, another configuration provided in the shaft member 2250 will be described. The tip end member elastic member 2265 and the rotating shaft elastic member 2266 are so-called elastic members, and any of the tip end member elastic member 2265 and the rotating shaft elastic member 2266 functions as means for moving and rotating the rotating force receiving member 1958. In the aspect, both are the coiled springs. In addition, the pin 2267 is the means for holding the tip end member 2255 to be movable in the rotating shaft 2251.

A material which configures each member of the shaft member 2250 is not particularly limited, but various types of resin or metal can be used.

In a case of making the shaft member 2250 by the resin, for example, polyacetal, polycarbonate, polyphenylene sulfide (PPS), polyamide imide (PAI), polyetherether keton (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved.

Meanwhile, in a case of making the shaft member 2250 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 2250 and any member included in the shaft member 2250, may be made by bending a metal plate, or may be made by making the metal, glass, or carbon fiber infiltrate into the resin.

By combining the bearing member 2240 and the shaft member 2250 with each other as follows, the end member 2230 is made. In addition, by describing the combination, the size of each member and part, the structure, or the relationship of the sizes of the members and parts, are further understood.

As can be ascertained from FIG. 156, the shaft 2257 of the tip end member 2255 is disposed on the inner side of the cylindrical member 2252 of the rotating shaft 2251, and the pin 2267 passes through the long hole 2251*a* of the rotating shaft 2251 and the hole 2257*a* of the tip end member 2255. Accordingly, the tip end member 2255 is held in the rotating shaft 2251. At this time, the tip end member elastic member 2265 is disposed on the inner side of the cylindrical member 2252, and accordingly, the tip end member 2255 is biased in the projecting direction from the rotating shaft 2251.

In this manner, in the rotating shaft 2251 combined by the tip end member 2255, the tip end member elastic member 2265, and the pin 2267, the columnar member 2253 which is on the side on which the tip end member 2255 is not disposed is inserted toward the bottom plate 2246 side of the shaft member holding portion 2245 formed on the inner side of the main body 2241 of the bearing member 2240. At this time, the spiral pillar-like portion 2254 of the rotating shaft 2251 is disposed on the inner side of the spiral portion 2247 of the shaft member holding portion 2245. In addition, the columnar member 2253 passes through the hole 2246*a* of the bottom plate 2246. In addition, the rotating shaft elastic member 2266 is disposed between the bottom plate 2246 and the pillar-like portion 2254, and biases the rotating shaft 2251 toward the tip end member 2255 side.

In addition, the lid member 2242 is disposed, and the rotating shaft 2251 is held in the bearing member 2240. At this time, since the cylindrical member 2252 in the rotating shaft 2251 is disposed in the hole 2242*a* of the lid member 2242, and the spiral pillar-like portion 2254 cannot pass through the hole 2242*a*, the spiral pillar-like portion 2254 is held on the inner side of the bearing member 2240, and the rotating shaft 2251 is held in a state of being biased without falling out of the bearing member 2240.

Above, in the posture in which each member is combined, the axes of the bearing member 2240, the rotating shaft 2251, and the tip end member 2255 match each other.

According to the above-described end member 2230, the relationship between the spiral portion 2247 and the spiral pillar-like portion 2254 acts in accordance with the example of the relationship between the spiral groove 1947 and the pin 1967 in the end member 1930, and the end member 2230 can also operate similar to the end member 1930.

An end member 2230' according to a modification example will be described in FIGS. 159 and 160. FIG. 159 is an exploded perspective view of a bearing member 2240' included in the end member 2230'. FIG. 160A is a sectional view along the axial direction of the end member 2230'. FIG. 160B is a perspective view along the axial direction illustrating a scene where the shaft member 2250 is inclined.

In the modification example, the bearing member 2240' is employed instead of the bearing member 2240. In the bearing member, as can be ascertained from FIG. 159, a hole 2246'*a* of a bottom plate 2246' which is provided in a main body 2241' is a long hole. Furthermore, a hole 2242'*a* of a lid member 2242' is also a long hole. The longitudinal directions of two holes 2246'*a* and 2242'*a* are the same direction.

Accordingly, as can be ascertained from FIGS. 160A and 160B, the shaft member 2250 (rotating shaft 2251) which is inserted into the holes 2246'*a* and 2242'*a* allows an inclination of the holes 2246'*a* and 2242'*a* in the longitudinal direction, and the inclination in the short direction is regulated.

At this time, since the hole 2242'*a* mainly regulates the inclination of the shaft member 2250 (rotating shaft 2251), the sizes of the holes 2242'*a* and 2246'*a* in the longitudinal direction may be the same. In addition, the hole 2246'*a* may not be a long hole, and may be a large circular hole.

In this manner, it is possible to control the inclination direction as necessary, and to set more appropriate inclination.

FIG. 161 is an exploded perspective view of one member of an end member 2230" according to the another modification example. For making it easy to understand, FIG. 161 illustrates only a main body 2241" of a bearing member 2240" and a rotating shaft 2251" of a shaft member 2250". Since other members are similar to the members described above, the description thereof will be omitted.

In the modification example, a spiral pillar-like portion 2254" is formed of a helical gear, and a spiral portion 2247" is formed of an internal gear. Even in this aspect, the pillar-like portion 2254" acts in accordance with an example of a relationship between the spiral portion 2247 and the spiral pillar-like portion 2254 in the end member 2230, and the same operation as that of the end member 1930 is possible.

In the helical gear and the internal gear, the number of teeth is not particularly limited, and can be appropriately adjusted.

In addition to the example, a so-called gear shape, such as a spur gear or the like of which the thickness is thin is employed instead of the helical gear in the pillar-like portion 2254", and a spiral portion in which a gear-like teeth can move in the groove can be configured instead of the spiral portion 2247". At this time, regarding the aspect of the spiral portion, the rotation and the movement in the axial direction of the shaft member can be regulated depending on the degree of twist per 1 mm along the axial direction. In addition, in addition to the gear-like teeth or the like, a projection-like part, such as a pin, can be formed and employed.

Even in this example, by forming the rotating force receiving member to be inclined, the member can be inclined with respect to the axial direction.

Next, a twenty second aspect will be described. FIG. 162 is a view illustrating the twenty second aspect, and is a perspective view of the end member 2330. In the end member 2330, the same configuration elements as those of the end member 1930 will be given the same reference numerals as those of the end member 1930, and the description thereof will be omitted. The end member 2330 is provided with a bearing member 2340 and a shaft member 2350. FIG. 163 is an exploded perspective view of the end member 2330.

The bearing member 2340 is a member which is bonded to the end portion of the photoreceptor drum 11 in the end member 2330. FIG. 164 is a sectional view along the axial direction of the bearing member 2340.

As can be ascertained from FIGS. 162 to 164, the bearing member 2340 is configured to include the tubular body 1941, the contact wall 1942, the fitting portion 1943, the gear portion 1944, and a shaft member holding portion 2345.

The shaft member holding portion 2345 is a part which is formed on the inner side of the tubular body 1941, and which has a function of ensuring a predetermined operation of the shaft member 2350, and holding the shaft member 2350 in the bearing member 2340, and functions as one of means for moving and rotating the rotating force receiving member 1958. The shaft member holding portion 2345 includes the lid member (bottom plate) 1946 and a straight line groove 2347.

The straight line grooves 2347 are a plurality of straight line-like grooves formed on the inner surface of the tubular body 1941, and the depth direction thereof is formed in a radial shape (radial direction) around the axis of the tubular body 1941 similar to that of the spiral groove 1947. Meanwhile, the longitudinal direction of the straight line groove 2347 is parallel to the axis of the tubular body 1941. In addition, the width direction of the straight line groove 2347 is formed to be substantially the same as the diameter of the pin 1967 to the extent that the end portion of the pin 1967 is inserted similar to the above-described spiral groove 1947, and the end portion of the pin 1967 can smoothly move in the groove.

In addition, one end of the straight line groove 2347 in the longitudinal direction is blocked by the bottom plate 1946, and the other end opposite thereto is blocked without reaching the end surface of the tubular body 1941.

Furthermore, a plurality of straight line grooves 2347 are provided as at least one opposing pair nipping the axis of the tubular body 1941. Therefore, two or more pairs may be provided.

Next, the shaft member 2350 of the end member 2330 will be described. As can be ascertained from FIG. 37, the shaft member 2350 is provided with a rotating shaft 2351 and a tip end member 2355. Furthermore, the shaft member 2350 is provided with the tip end member elastic member 1965, the rotating shaft elastic member 1966, and the pin 1967. Any of the tip end member elastic member 1965 and the rotating shaft elastic member 1966 in the aspect is a coiled spring.

The rotating shaft 2351 is a rotating force transmission portion which transmits the rotating force received by the tip end member 2355 to the bearing member 2340, and is a shaft-shape member which functions as means for moving and rotating the rotating force receiving member 1958. FIG. 165A is a perspective view of the rotating shaft 2351. FIG. 165B is a sectional view cut in the axial direction by a line illustrated by $C_{165b}$-$C_{165b}$ in FIG. 165A.

As can be ascertained from FIGS. 165A and 165B, the rotating shaft 2351 is cylindrical. The inner side of the cylinder has the size by which the tip end member elastic member 1965 can be inserted. In the rotating shaft 2351, a lid portion 2351*a* is provided in one end portion, and a narrowed opening portion 2351*b* is formed in the lid portion 2351*a*. In addition, in the aspect, the opening portion 2351*b* is circular.

In addition, in the rotating shaft 2351, two pin through holes 1951*c*, which are orthogonal to the axis of the cylinder, are provided in one diameter direction of the cylinder, and penetrate the inside and the outside of the cylinder, are formed in the end portion opposite to the end portion in which the lid portion 2351*a* is disposed. The pin 1967 (refer to FIG. 163) passes through the pin through hole 1951*c*, as will be described later.

Furthermore, in the aspect, a plurality of spiral grooves 2352 are formed on the inner surface of the cylinder of the rotating shaft 2351. The spiral groove 2352 is a spiral groove, the depth direction thereof is formed in a radial shape (radial direction) around the axis of the rotating shaft 2351 similar to that of the above-described spiral groove 1947. Meanwhile, the longitudinal direction of the spiral groove 2352 is the direction along the axis of the rotating shaft 2351, and one end side and the other side are twisted to be deviated in the direction along the inner circumference of the rotating shaft 2351, and are formed in a spiral shape. In addition, the width direction of the spiral groove 2352 is formed to be substantially the same as the diameter of the projection 2356 to the extent that the end portion of the projection 2356 of the tip end member 2355 which will be described later is inserted similar to the above-described spiral groove 1947, and the end portion of the projection 2356 can smoothly move in the groove.

In addition, one end of the spiral groove 2352 in the longitudinal direction is blocked by the lid portion 2351*a*.

Furthermore, the plurality of spiral grooves 2352 are provided as at least one opposing pair nipping the axis of the rotating shaft 2351. In the aspect, an example in which three pairs, that is, a total of six spiral grooves 2352 are formed, is employed, but one pair, that is, a total of two spiral grooves may be formed. Meanwhile, two pairs or four or more pairs of spiral grooves may be provided. When the spiral groove is injection-molded, the injection molding is performed by the releasing while rotating the mold after the injection of the material.

The tip end member 2355 is a member which receives the rotation driving force from the apparatus main body 2 and transmits the driving force to the rotating shaft 2351. FIG. 166 is a perspective view of the tip end member 2355.

As can be ascertained from FIG. 166, the tip end member 2355 is configured to include a shaft 2357, the projection 2356, and the rotating force receiving member 1958.

The shaft 2357 is a pillar-like member, and is a column in the aspect. The sectional shape thereof is the same as or slightly smaller than the opening portion 2351*b* of the above-described rotating shaft 2351.

The projections 2356 are two projections which are provided on the side opposite to the side on which the rotating force receiving member 1958 is disposed in the shaft 2357, and protrude from the side surface of the shaft 2357. Two projections 2356 are disposed at symmetrical positions nipping the axis of the shaft 2357.

By combining the bearing member 2340 and the shaft member 2350 with each other as follows, the end member 2330 is made. In addition, by describing the combination, the size of each member and part, the structure, or the relationship of the sizes of the members and parts, are further understood. FIG. 167 is a sectional view in the axial direction of the end member 2330. FIG. 168A is an end surface view of the end member 2330 along a line illustrated by $C_{168a}$-$C_{168a}$ in FIG. 167. FIG. 168B is a sectional view in the axial direction of the rotating shaft 2351, and is a view illustrating the relationship between the rotating shaft 2351 and the projection 2356.

As can be ascertained from FIG. 167, the shaft 2357 of the tip end member 2355 passes through the opening portion 2351*b* of the rotating shaft 2351. At this time, the projection 2356 of the tip end member 2355 is included on the inner side of the rotating shaft 2351, and the rotating force receiving member 1958 of the tip end member 2355 is disposed to protrude from the rotating shaft 2351. In addition, as can be ascertained from FIGS. 168A and 168B, the projection 2356 of the tip end member 2355 is disposed in the spiral groove 2352 of the rotating shaft 2351.

Meanwhile, the pin 1967 passes to cross over the two pin through holes 1951*c* of the rotating shaft 2351. At this time, both ends of the pin 1967 respectively protrude from the side surface of the rotating shaft 2351, and function as projections.

In addition, the tip end member elastic member 1965 is disposed between the shaft 2357 of the tip end member 2355 and the pin 1967 on the inner side of the rotating shaft 2351. Therefore, one side of the tip end member elastic member 1965 comes into contact with the shaft 2357, and the other side thereof comes into contact with the pin 1967. Accordingly, the tip end member 2355 is biased in the direction in which the tip end member elastic member 1965 biases the tip end member 2355 and makes the tip end member 2355 protrude from the rotating shaft 2351. However, since the projection 2356 cannot pass through the opening portion 2351*b* of the rotating shaft 2351, the tip end member 2355 is held in a state of being biased without falling out of the rotating shaft 2351.

In this manner, in the rotating shaft 2351 combined by the tip end member 2355, the tip end member elastic member 1965, and the pin 1967, the side on which the tip end member 2355 is not disposed is inserted toward the lid member 1946 side of the shaft member holding portion 2345 formed on the inner side of the bearing member 2340. At this time, as illustrated in FIG. 167, the end portion of the pin 1967 protruded from the side surface of the rotating shaft 2351 is inserted into the straight line groove 2347 formed in the shaft member holding portion 2345 of the bearing member 2340.

In addition, as can be ascertained from FIG. 167, on the inner side of the bearing member 2340, the rotating shaft elastic member 1966 is disposed between the rotating shaft 2351 and the lid member 1946. Therefore, one side of the rotating shaft elastic member 1966 comes into contact with the rotating shaft 2351, and the other side of the rotating shaft elastic member 1966 comes into contact with the lid member 1946. Accordingly, the rotating shaft 2351 is biased in the direction in which the rotating shaft elastic member 1966 biases the rotating shaft 2351 and makes the rotating shaft 2351 including the tip end member 2355 protrude from the bearing member 2340. However, since the tip end of the pin 1967 is inserted into the straight line groove 2347 of the bearing member 2340, and both ends of the straight line groove 2347 are blocked as described above, the rotating shaft 2351 is held in a state of being biased without falling out of the bearing member 2340.

Above, in the posture in which each member is combined, the axes of the bearing member 2340, the rotating shaft 2351, and the tip end member 2355 match each other.

Next, how the end member 2330 can be deformed, move, and rotate, will be described.

In the postures illustrated in FIG. 167, the entire shaft member 2350 is in a posture of being protruded the most from the bearing member 2340 within a possible range, by the tip end member elastic member 1965 and the rotating shaft elastic member 1966. When any external force is not applied to the shaft member 2350, the end member 2330 is in this posture.

From this posture, as illustrated by $C_{167a}$ in FIG. 167, when the rotating force around the axis is applied to the rotating force receiving member 1958 of the tip end member 2355, following this, the shaft 2357 rotates, and further, the projection 2356 also rotates around the axis. Accordingly, since the projection 2356 is engaged with the side surface of the spiral groove 2352, the side surface is pressed, and as illustrated by an arrow $C_{167b}$ in FIG. 167, the rotating shaft 2351 also rotates. Furthermore, in the rotating shaft 2351, the pin 1967 is engaged with the straight line groove 2347 of the bearing member 2340, as illustrated by an arrow $C_{167c}$ in FIG. 167, the bearing member 2440 also rotates. Therefore, the end member 2330 rotates around the axis.

Meanwhile, when the tip end member 2355 rotates as illustrated by an arrow $C_{167a}$ in FIG. 167, since the projection 2356 moves in the spiral groove 2352 as illustrated by a straight line arrow in FIG. 168B, a force which moves the tip end member 2355 in the axial direction is also generated, and the tip end member 2355 also moves in the axial direction as illustrated by an arrow $C_{167d}$ in FIG. 167.

In addition to the description above, the end member 2330 can also be deformed as follows. FIG. 169 is a view illustrating this. In other words, in the end member 2330, when the force is applied in the axial direction to the rotating force receiving member 1958 of the tip end member 2355 as illustrated by an arrow $C_{169a}$ in FIG. 169, when the projection 2456 of the tip end member 2355 moves in the spiral groove 2352, the tip end member 2355 rotates around the axis as illustrated by an arrow $C_{169b}$ in FIG. 169, and the rotating shaft 2351 moves in the axial direction as illustrated by an arrow $C_{169c}$ in FIG. 169.

According to the movement and the rotation by the end member 2330, similar effects to those of the end member 1930 are achieved.

In addition, even in the aspect, as the rotating force receiving member is formed to be inclined, and the above-described expressions (1) and (3) are satisfied, an aspect in which more stabilized transmission of the rotating force and the smooth disengagement from the driving shaft are possible, can be employed.

Next, a twenty third aspect will be described. FIG. 170 is an exploded perspective view of an end member 2430 included in the twenty third aspect. FIG. 171 is an exploded sectional view along the axial direction of the end member 2430. FIG. 172 is a sectional view along the axial direction of the end member 2430 in which each member is combined. The end member 2430 is provided with a bearing member 2440 and a shaft member 2450.

The bearing member 2440 is a member which is bonded to the end portion of the photoreceptor drum 11 in the end member 2430. The bearing member 2440 includes a main body 2441 and a lid member 2442, and the main body 2441 is configured to include the tubular body 1941, the fitting portion 1943, the gear portion 1944, and a shaft member holding portion 2445.

Since the tubular body 1941, the fitting portion 1943, and the gear portion 1944 are similar to those in the above-described end member 1930, the same reference numerals will be given, and the description thereof will be omitted.

The shaft member holding portion 2445 is a part which is formed on the inner side of the tubular body 1941, and which has a function of ensuring a predetermined operation of the shaft member 2450, and holding the shaft member 2450 in the bearing member 2440, and functions as one of means for moving and rotating the rotating force receiving member 1958. The shaft member holding portion 2445 includes a bottom plate 2446 and a spiral groove 2447 which functions as a spiral portion.

The bottom plate 2446 is a disk-like member, and is disposed to block and partition at least a part of the inner side of the tubular body 1941. Accordingly, a rotating shaft elastic member 2466 is supported. In the aspect, a hole 2446*a* is formed in the center portion thereof, a columnar member 2453 of a rotating shaft 2451 is inserted into the hole 2446*a*, and the inclination of the rotating shaft 2451 is regulated.

The attachment of the bottom plate 2446 to the tubular body 1941 can be performed by adhering or welding. In addition, the tubular body 1941 and the bottom plate 2446 may be integrally formed.

The spiral grooves 2447 are a plurality of spiral grooves which function as a part formed in a spiral shape, and are formed on the inner surface of the tubular body 1941, and can be formed in accordance with the spiral groove 1947 according to the same idea as that of the spiral groove 1947 of the above-described end member 1930. One end of the spiral groove 2447 in the longitudinal direction is blocked by the bottom plate 2446, and the other end opposite thereto is blocked by the lid member 2442.

The lid member 2442 is a disk-like member which is disposed on the side opposite to the bottom plate 2446 nipping the shaft member holding portion 2445, and the hole 2442*a* is formed at the center thereof. In the aspect, a claw 2442*b* is provided, is engaged with the main body 2441, and is fixed in a so-called snap-fit manner. However, means of fixing the lid member is not limited thereto, and the adhesive or welding by heat or ultrasound wave can be used as another means.

A material which configures each member of the bearing member 2440 is not particularly limited, but various types of resin or metal can be used.

In a case of making the bearing member 2440 by the resin, for example, polyacetal, polycarbonate, polyphenylene sulfide (PPS), polyamide imide (PAI), polyetherether keton (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

Meanwhile, in a case of making the bearing member 2440 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the bearing member 2440 and any member included in the bearing member 2440, may be made by bending a metal plate, or may be made by making the metal, glass, or carbon fiber infiltrate into the resin.

The shaft member 2450 is provided with the rotating shaft 2451 and a tip end member 2455. Furthermore, the shaft member 2450 is provided with a tip end member elastic member 2465, the rotating shaft elastic member 2466, a pin 2467 and a pin 2468. Any of the tip end member elastic member 2465 and the rotating shaft elastic member 2466 in the aspect is a coiled spring.

Hereinafter, each of the members will be described.

The rotating shaft 2451 is a rotating force transmission portion which transmits the rotating force received by the tip end member 2455 to the bearing member 2440, and is a shaft-shape member which functions as means for moving and rotating the rotating force receiving member 1958.

In the rotating shaft 2451, a cylindrical member 2452 and the columnar member 2453 are coaxially linked to each other. The inner side of the cylinder has the size by which a shaft 2457 of the tip end member 2455 and the tip end member elastic member 2465 can be inserted. In the rotating shaft 2451, two long holes 2451*a* which penetrate in the direction orthogonal to the axial direction are formed at the cylindrical parts. Two long holes 2451*a* are disposed on one diameter of the cylindrical member 2452.

In addition, in the rotating shaft 2451, a hole 2451*b* which penetrates in the direction orthogonal to the axial direction is formed in the end portion on the columnar member 2453 side in the end portion in the axial direction of the cylindrical member 2452. Two holes 2451*a* are disposed on one diameter of the cylindrical member 2452.

The tip end member 2455 is a member which receives the rotation driving force from the apparatus main body 2 and transmits the driving force to the rotating shaft 2451. The tip end member 2455 is configured to include the shaft 2457 and a rotating force receiving member 248.

The shaft 2457 is a pillar-like member, and is a column in the aspect. In addition, in the shaft 2457, a long hole 2457*a* which penetrates in the direction orthogonal to the axis is formed. The longitudinal direction of the long hole 2457*a* is the direction along the axis. In addition, in the aspect, the end portion opposite to the rotating force receiving member 1958 in the shaft 2457 is formed to be narrow.

Since the rotating force receiving member 1958 is similar to the above-described end member 1930, the description thereof will be omitted.

The tip end member elastic member 2465 and the rotating shaft elastic member 2466 are so-called elastic members, and any of the tip end member elastic member 2465 and the rotating shaft elastic member 2466 functions as means for moving and rotating the rotating force receiving member 1958. In the aspect, the tip end member elastic member 2465 and the rotating shaft elastic member 2466 are coiled springs. In addition, a pin 2467 is means for holding the tip end member 2455 to be movable along the axial direction in the rotating shaft 2451. In addition, the pin 2468 is means for holding the rotating shaft 2451 in the bearing member 2440, moving and rotating along the spiral groove 2447, and moving and rotating the rotating shaft 2451.

A material which configures each member of the shaft member 2450 is not particularly limited, but various types of resin or metal can be used.

In a case of making the shaft member 2450 by the resin, for example, polyacetal, polycarbonate, polyphenylene sulfide (PPS), polyamide imide (PAD, polyetherether keton (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved.

Meanwhile, in a case of making the shaft member 2450 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 2450 and any member included in the shaft member 2450, may be made by bending a metal plate, or may be made by making the metal, glass, or carbon fiber infiltrate into the resin.

By combining the bearing member 2440 and the shaft member 2450 with each other as follows, the end member 2430 is made. In addition, by describing the combination, the size of each member and part, the structure, or the relationship of the sizes of the members and parts, are further understood.

As can be ascertained from FIG. 172, the shaft 2457 of the tip end member 2455 is disposed on the inner side of the cylindrical member 2452 of the rotating shaft 2451, and the pin 2467 passes through the long hole 2451*a* of the rotating shaft 2451 and the long hole 2457*a* of the tip end member 2455. Accordingly, the tip end member 2455 is held in the rotating shaft 2451. At this time, the tip end member elastic member 2465 is disposed on the inner side of the cylindrical member 2452, and accordingly, the tip end member 2455 is biased in the projecting direction from the rotating shaft 2451.

In this manner, in the rotating shaft 2451 combined by the tip end member 2455, the tip end member elastic member 2465, and the pin 2467, the columnar member 2453 which is on the side on which the tip end member 2455 is not disposed is inserted toward the bottom plate 2446 side of the shaft member holding portion 2445 formed on the inner side of the main body 2441 of the bearing member 2440. At this time, the pin 2468 is inserted into the hole 2451*b* of the rotating shaft 2451, and each of both ends of the pin 2468 is disposed to protrude from the side surface of the rotating shaft 2451. In addition, the protruded end portion of the pin 2468 is disposed in the groove of the spiral groove 2447 of the bearing member 2440. In addition, the columnar member 2453 passes through the hole 2446*a* of the bottom plate 2446. In addition, the rotating shaft elastic member 2466 is disposed between the bottom plate 2446 and the columnar member 2453, and the rotating shaft 2451 is biased toward the tip end member 2455 side.

In addition, the lid member 2442 is disposed, and the rotating shaft 2451 is held in the bearing member 2440. At this time, since the cylindrical member 2452 in the rotating shaft 2451 is disposed in a hole 2442*a* of the lid member 2442, and the pin 2468 cannot pass through the hole 2442*a*, the rotating shaft 2451 is held in a state of being biased without falling out of the bearing member 2440.

Above, in the posture in which each member is combined, the axes of the bearing member 2440, the rotating shaft 2451, and the tip end member 2455 match each other.

According to the above-described end member 2430, the relationship between the spiral groove 2447 and the pin 2468 acts in accordance with the example of the relationship between the spiral groove 1947 and the pin 1967 in the end member 1930, and the end member 2430 can also operate similar to the end member 1930. In addition, the tip end member 2455 can move in the axial direction with respect to the rotating shaft 2451 regardless of the rotation of the shaft member 2450.

In addition, even in the aspect, as the rotating force receiving member is formed to be inclined, and the above-described expressions (1) and (3) are satisfied, an aspect in which more stabilized transmission of the rotating force and the smooth disengagement from the driving shaft are possible, can be employed.

FIG. 173 is an exploded perspective view of an end member 2430' which is a modification example of the end member 2430. In the end member 2430', instead of the tip end member 2455 of the end member 2430, a tip end member 2455' is employed. Here, the tip end member 2455' will be described. FIG. 174 is a perspective view of the tip end member 2455'. Other parts are the same as the end member 2430.

As can be ascertained from FIGS. 173 and 174, the tip end member 2455' has an aspect in which one long plate is formed to be folded, and functions as the rotating force receiving member. The shape is as follows. The tip end member 2455' includes two base plates 2455'*a* in which plate surfaces on one side are disposed substantially in parallel at a predetermined interval, and end portions on one side of two base plates 2455'*a* are linked to each other by a linking plate 2455'*b*. Interval expansion plates 2455'*c* which are plate-like members that extend in the direction of being separated, are disposed from each of the end portions (other end portions) opposite to the side which is linked by the linking plate 2455'*b* of two base plates 2455'*a*. In addition, an engaging plate 2455'*d* which functions as an engaging member that extends in the direction of being separated from the base plate 2455'*a*, is disposed from the tip end of the interval expansion plate 2455'*c*. Therefore, two engaging plates 2455'*d* are substantially parallel at a predetermined interval so that the plate surfaces thereof oppose each other.

Here, in the engaging plate 2455'*d*, a hollow 2455'*e* is provided at least in one end portion in the plate width direction. Here, the driving projection 71 of the above-described driving shaft 70 is disposed to bump into the hollow 2455'*e*. Therefore, two hollows 2455'*e* are disposed on the opposite side in the plate width direction. In addition, the interval of two engaging plate 2455'*d* is the interval by which the tip end of the shaft portion 72 of the driving shaft 70 can get into.

The tip end member 2455' is formed of a material having excellent elasticity. For example, stainless steel or phosphor bronze can be employed. In addition, the metal maximizes an elastic limit by low sound annealing (tempering treatment), and can improve spring properties.

FIG. 175 is a sectional view along the axis of the end member 2430'. As can be ascertained from FIG. 175, in the aspect, as the pin 2467 is inserted into between two base plates 2455'*a* of the tip end member 2455', the pin 2467 is held in the cylindrical member 2452.

According to the end member 2430', in addition to the effects similar to the above-described end member 2430, as illustrated in FIG. 176, the engaging plate 2455'*d* is elastically deformed and smoothly disengaged when being disengaged from the driving shaft 70. In addition, when the rotating force is transmitted in a state where the driving shaft 70 is engaged with the end member 2430', as illustrated by Fk in FIG. 174, since the rotating force is transmitted in the plate width direction of the engaging plate 2455'*d*, the rotating force is appropriately transmitted without largely deforming the engaging plate 2455'*d*.

Any of the end members having the spiral groove described above can perform both the operation (for example, refer to FIG. 140) in which the shaft member moves in the axial direction as the shaft member rotates around the axis, and an operation (for example, refer to FIG. 143) in which the rotating force receiving member moves in the axial direction regardless of the rotation, by the action of the part formed in a spiral shape. Regarding this, only the "operation in which the shaft member moves in the axial direction as the shaft member rotates around the axis" may be performed by the action of the part formed in a spiral shape, but from the viewpoint of more smooth attachment and detachment of the processing cartridge, the "operation in which the rotating force receiving member moves in the axial direction regardless of the rotation" may be added as an auxiliary operation. Therefore, in the aspect having the spiral groove, only the "operation in which the shaft member moves in the axial direction as the shaft member rotates around the axis" may be performed. In addition, when the "operation in which the rotating force receiving member moves in the axial direction regardless of the rotation" is also employed, it is preferable that a force (for example, an elastic force of the tip end member elastic member) by the means which is provided for performing the operation, is weaker than a force (for example, an elastic force of a rotating shaft elastic member 66) by the means which is provided for performing the "operation in which the shaft member moves in the axial direction as the shaft member rotates around the axis".

Here, next, an example of an aspect which is configured only of the "operation in which the shaft member moves in the axial direction as the shaft member rotates around the axis" will be described.

FIGS. 177, 178, and 179 are views illustrating an end member 2430" according to another modification example of the end member 2430 of the above-described twenty third aspect. FIG. 177 is an exploded perspective view of the end member 2430". FIG. 178 is an exploded sectional view along the axial direction of the end member 2430". FIG. 179 is a sectional view along the axial direction of the end member 2430" in which each member is combined. In the end member 2430", a shaft member 2450" is employed instead of the shaft member 2450 of the end member 2430. The bearing member 2440 is the same as the bearing member 2440 of the end member 2430.

The shaft member 2450" is formed to be integrated with a rotating shaft 2451" and a tip end member 2455", and is not provided with the tip end member elastic member 2465. Therefore, the rotating shaft 2451" and the tip end member 2455" cannot relatively move, and move and rotate integrally all the time. Parts except this are the same as the shaft member 2450. Therefore, in the example, the "operation in which the rotating force receiving member moves in the axial direction regardless of the rotation" cannot be performed, and the shaft member 2450" becomes an end member only for performing the "operation in which the shaft member moves in the axial direction as the shaft member rotates around the axis" by the actions of the spiral groove 2447 and the pin 2468.

By the end member 2430", since the relationship between the spiral groove 2447 and the pin 2468 can also act in accordance with the relationship between the spiral groove 1947 and the pin 1967 in the end member 1930, the transmission of the rotating force equivalent to that in the related art can be performed, and more smooth attachment to and detachment from the apparatus main body can be performed.

In addition, even in the aspect, as the rotating force receiving member is formed to be inclined, and the above-described expressions (1) and (3) are satisfied, as an aspect in which more stabilized transmission of the rotating force and the smooth disengagement from the driving shaft are possible, can be employed.

Next, a twenty fourth aspect will be described. FIG. 180 is an outer appearance perspective view of a photoreceptor drum unit 2510. FIG. 180A is an outer appearance view of the photoreceptor drum unit 2510 in which a driving side end member 2550 is illustrated in front. FIG. 180B is an outer appearance perspective view of a photoreceptor drum unit 110 in which a non-driving side end member 2520 is illustrated in front. As can be ascertained from FIGS. 180A and 181B, the photoreceptor drum unit 2510 is provided with the photoreceptor drum 11, the non-driving side end member 2520, and the driving side end member 2550.

In the aspect, aspects of the non-driving side end member 2520, the driving side end member 2550, and a driving shaft 2570 (refer to FIG. 183) of the apparatus main body 2, are different from the above-described non-driving side end member 20, the driving side end member 50, and the driving shaft 70 of the apparatus main body 2. Since parts except this are similar to those in the above-described first aspect, and the description thereof will be omitted.

The non-driving side end member 2520 is an aspect in which the earth plate 40 is excluded from the above-described non-driving side end member 20. As will be described later, in the example, the earth plate 40 is provided on the driving side end member 50 side. Therefore, since the non-driving side end member 2520 is similar to the non-driving side end member 20 except the earth plate 40, here, the description thereof will be omitted.

The driving side end member 2550 is an end member which is disposed in the end portion on the side on which the driving shaft 2570 of the apparatus main body 2 is engaged, on the side opposite to the non-driving side end member 2520, in the end portion in the direction along the axial direction of the photoreceptor drum 11. FIG. 181 is an outer appearance perspective view of the driving side end member 2550. FIG. 181A is an outer appearance perspective view in which the bearing portion 2556 is illustrated in front. On the contrary, FIG. 181B is an outer appearance perspective view in which a fitting portion 2554 is illustrated in front. In addition, FIG. 182A is a front view of the driving side end member 2550 when viewed from the bearing portion 2556 side. FIG. 182B is a sectional view along a line illustrated by $C_{182b}$-$C_{182b}$ in FIG. 182A.

The driving side end member 2550 is provided with a main body 2551 and conductive means 2561.

As can be ascertained from FIGS. 181A, 181B, 182A, and 182B, the main body 2551 is configured to include a tubular body 2552, a contact wall 2553, the fitting portion 2554, a gear portion 2555, and the bearing portion 2556.

The tubular body 2552 is an overall tubular member in which unevenness is formed on the outer circumferential surface as necessary. The contact wall 2553 which comes into contact with and locks to the end surface of the photoreceptor drum 11, stands from a part of the outer circumferential surface of the tubular body 2552. Accordingly, in a posture in which the driving side end member 2550 is mounted on the photoreceptor drum 11, the depth of insertion of the driving side end member 2550 into the photoreceptor drum 11 is regulated.

By nipping the contact wall 2553 of the tubular body 2552, the fitting portion 2554 of which one side is inserted into the photoreceptor drum 11 is made. The fitting portion 2554 is inserted into the photoreceptor drum 11, and is fixed to the inner surface of the photoreceptor drum 11 by the adhesive. Accordingly, the driving side end member 2550 is fixed to the end portion of the photoreceptor drum 11. Therefore, the outer diameter of the fitting portion 2554 is substantially the same as the inner diameter of the photoreceptor drum 11 within a range in which insertion into cylindrical shape of the photoreceptor drum 11 is possible.

A groove 2554*a* may be formed on the outer circumferential surface in the fitting portion 2554. Accordingly, the groove 2554*a* is filled with the adhesive, and adhesiveness between the main body 2551 (driving side end member 2550) and the photoreceptor drum 11 is improved by an anchor effect or the like.

By nipping the contact wall 2553, the gear portion 2555 is formed on the outer circumferential surface of the tubular body 2552 on the side opposite to the fitting portion 2554. The gear portion 2555 is a gear which transmits the rotating force to another member, such as the developing roller, and in the aspect, a helical gear and a spur gear are disposed to be aligned in the shaft direction. However, the type of the gear is not particularly limited, and may be any of the helical gear and the spur gear. In addition, it is not necessary to provide the gear.

Furthermore, the outer circumference of the end portion opposite to the side which becomes the fitting portion 2554 in the end portion of the tubular body 2552 in the axial direction, is formed in a shape that can function as the bearing portion 2556. The bearing portion 2556 is a part which is engaged with a recessed portion 2571 provided in the driving shaft 2570 which will be described later in the apparatus main body 2, and has a function of transmitting the rotating force from the driving shaft 2570 to the driving side end member 2550. In addition, when the processing cartridge 3 is attached to and detached from the apparatus main body 2, the bearing portion 2556 is configured to be disengaged from the recessed portion 2571 of the driving shaft 2570. The bearing portion 2556 of the aspect specifically has the following shape.

As can be ascertained from FIGS. 181A and 181B, an outer circumferential shape of the bearing portion 2556 is a hexagon on the section orthogonal to the direction in which the axis extends. In addition, the bearing portion 2556 does not have a so-called twisted shape in the axial direction, and does not have a part which becomes an undercut. In other words, when the bearing portion 2556 is viewed from an original side end portion (fitting portion 2554 side) of the bearing portion 2556 in the axial direction (when the bearing portion 2556 is viewed from a rear surface side opposite to FIG. 182A), a shape in which parts other than the bearing portion 2556 are not seen, is obtained.

Accordingly, when forming the driving side end member 2550 including the bearing portion 2556, filling and releasing properties of a material with respect to the mold become excellent, and productivity is improved. In addition, since rotating mechanism, such as a stainless core or core, is not necessary in the mold, it is possible to simplify the configuration of the mold itself. In addition, the triangular section of the driving shaft 2570 which will be described later is appropriately engaged with the recessed portion 2571 formed to be continuously twisted, the rotating force is transmitted, and the attachment and detachment thereof also become easy.

Here, since the main body 2551 is cylindrical as described above, one hole 2551*a* which penetrates the inner side thereof is formed, and penetrates in the direction along the axis. The diameter of the hole 2551*a* is the size by which the end portion (refer to FIG. 183) of a main body side earth member 2572 of the driving shaft 2570 which will be described later can be inserted.

It is preferable that the main body 2551 is formed of a crystalline resin. In case of the crystalline resin, when performing injection molding by using a mold, molding processing properties are excellent since a flow is excellent, and even when cooling is not performed until reaching the glass transition point, releasing is possible by crystallizing and fixing. Therefore, it is possible to remarkably improve productivity. In addition, the crystalline resin has excellent heat resistance, solvent resistance, oil resistance, grease resistance, friction and wear resistance, and sliding properties, and is preferable as a material which is employed in the end member from the viewpoint of the rigidity and hardness.

Examples of the crystalline resin include polyethylene, polypropylene, polyamide, polyacetal, polyethylene telephthalate, polybutylene terephthalate, methyl pentene, polyphenylene sulfide, polyetherether ketone, polytetrafluoroethylene, and nylon.

Among these, from the viewpoint of molding processing properties, a polyacetal-based resin is preferable.

In addition, from the viewpoint of improving the strength, the glass fiber or the carbon fiber may be filled.

The conductive means 2561 is means which electrically connects the photoreceptor drum 11 and the apparatus main body 2, and is provided with a coil spring 2562, a conductive rod 2563, and an earth plate 2564.

The coil spring 2562 functions as a conductive material which is elastically deformed. Specifically, in the aspect, the coil spring 2562 is a coiled spring in which one rod material is formed to be wound in a spiral shape. As the coil spring 2562 includes a conductive material which is inserted into the hole 2551*a*, the coil spring 2562 is formed to be conductible. Therefore, it is preferable that the coil spring 2562 is formed of metal, such as steel or copper.

The conductive rod 2563 is a conductive rod-like member, and has the thickness to be stored on the inner side of the hole 2551*a*. The conductive rod 2563 has the length by which one end of the conductive rod 2563 comes into contact with the coil spring 2562, and the other end thereof reaches the vicinity of the opening portion opposite to the side on which the earth plate 2564 is disposed in the hole 2551*a*. The conductive rod 2563 can be formed of steel or copper.

Here, in the conductive rod 2563, means (falling prevention) which regulates the movement in the direction in which the conductive rod 2563 falls out at a predetermined position, in order to prevent the conductive rod 2563 from unnecessarily moving to the apparatus main body side. As an example of this, a configuration in which a part of the hole 2551*a* becomes narrow, or a projection is provided in the outer circumferential portion of the conductive rod 2563 for hooking, is employed.

The earth plate 2564 is a conductive disk-like member, and a protrusion portion 2564*a* is formed to be in contact with the inner surface of the photoreceptor drum 11 from the outer circumferential portion. The earth plate 2564 is similar to a known earth plate, a structure for this is not particularly limited, and a known shape can be employed.

By combining the main body 2551 and the conductive means 2561 with each other, the driving side end member 2550 is made. In other words, as illustrating in FIG. 182B, the earth plate 2564 is disposed on an end surface of the fitting portion 2554 of the main body 2551 so that a surface thereof overlaps the end surface, and is fixed by a standoff. The coil spring 2562 is inserted into the hole 2551*a* formed in the main body 2551. At this time, the end portion disposed on the fitting portion 2554 side in the end portion of the coil spring 2562 comes into contact with the earth plate 2564. In the coil spring 2562, the conductive rod 2563 is disposed on the side opposite to the side which comes into contact with the earth plate 2564, the conductive rod 2563 is inserted into the hole 2551*a*, and one end of the conductive rod 2563 is inserted into and comes into contact with the end portion of the coil spring 2562.

The outer tube portion 22 of the non-driving side end member 2520 is inserted into one end portion of the photoreceptor drum 11 until coming into contact with the contact wall 25, the fitting portion 2554 of the driving side end member 2550 is inserted into the other end portion of the photoreceptor drum 11 until coming into contact with the contact wall 2553, and the photoreceptor drum unit 2510 is made as illustrated in FIGS. 180A and 180B. At this time, the protrusion portion 2564*a* of the earth plate 2564 comes into contact with the inner surface of the photoreceptor drum 11.

Next, a posture of the photoreceptor drum unit 2510 in a posture in which the processing cartridge 3 including the photoreceptor drum unit 2510 is mounted on the image forming apparatus, will be described.

Here, the driving shaft 2570 of the apparatus main body 2 will be described. It is possible to use a known configuration in other parts. FIG. 183 illustrates an end portion on a side which is engaged with the bearing portion 2556, in the driving shaft 2570 which is provided in the apparatus main body 2, and applies the rotation driving force to the photoreceptor drum unit 2510. FIG. 183A is a perspective view, and FIG. 183B is a front view. In FIGS. 183A and 183B, a part of the recessed portion 2571 is projected and illustrated by a dotted line. The end portion opposite to the driving shaft 2570 is directly and indirectly linked to a driving source of the apparatus main body 2.

As can be ascertained from FIGS. 183A and 183B, the recessed portion 2571 is provided in the end portion of the driving shaft 2570. The recessed portion 2571 is a hole which has a section having a shape of substantially equilateral triangle, and has a shape in which the shape is twisted around the center by a predetermined angle when approaching in the depth direction of the shaft direction from the end surface of the driving shaft 2570. There is an example in which the twisting direction is the clockwise direction, and an example in which the twisting direction is the counterclockwise direction, according to the rotation transmitting direction.

In addition, in the driving shaft 2570, the conductive rod-shaped main body side earth member 2572 is disposed along the rotation shaft of the driving shaft 2570. As illustrated in FIGS. 183A and 183B, one end side of the main body side earth member 2572 protrudes to stand from the bottom of the recessed portion 2571. Meanwhile, the other end side of the main body side earth member 2572 protrudes from the end portion on the opposite side of the driving shaft 2570, and is in contact with the earth member of the apparatus main body 2.

As can be ascertained from FIG. 183B, when the recessed portion 2571 is projected and viewed from a front surface in the axial direction, a triangle (illustrated by a solid line) which is formed in the opening of the recessed portion 2571, and a triangle (illustrated by a dotted line) which is formed on the bottom of the recessed portion 2571, are seen as two triangles which are rotated around the shaft and overlap each other. In addition, here, an example in which the section of the recessed portion 2571 is a triangle, is described, but a polygon which is made by slightly cutting the top point of the triangle while considering the triangle as a reference may be employed.

FIG. 184 is a sectional view of the photoreceptor drum unit 2510 and the vicinity thereof in the processing cartridge 3, in a scene where the processing cartridge 3 including the photoreceptor drum unit 2510 is mounted on the apparatus main body 2. FIG. 184 is a sectional view along the axial direction of the photoreceptor drum unit 2510.

As can be ascertained from FIG. 184, in the driving side end member 2550, the bearing portion 2556 is inserted into the recessed portion 2571 of the driving shaft 2570. FIG. 185 is a view when a posture of the insertion is viewed from the shaft direction. In this manner, at least three top portions of the hexagonal outer circumference of the bearing portion 2556 come into contact with triangular sides of the recessed portion 2571, and are connected to be capable of transmitting the rotating force. In addition, the rotation force is transmitted to the driving side end member 2550, and the photoreceptor drum 11 is rotated. In accordance with this time, the non-driving side end member 2520 also rotates.

In addition, the tip end of the main body side earth member 2572 is inserted into two holes 2551*a* of the driving side end member 2550, and comes into contact with the tip end of the conductive rod 2563. Accordingly, the photoreceptor drum 11, the earth plate 2564, the coil spring 2562, the conductive rod 2563, and the main body side earth member 2572 are electrically connected, and the apparatus main body 2 becomes conductive from the photoreceptor drum 11.

At this time, the coil spring 2562 is disposed between the conductive rod 2563 and the earth plate 2564, a change or pressure in the axial direction of the main body side earth member 2572 is absorbed by the coil spring 2562, and the earth plate 2564 is prevented from being strongly pressed. Accordingly, a defect that the earth plate 2564 is disengaged from the main body 2551 can be prevented.

Meanwhile, as can be ascertained from FIG. 184, the support shaft member 3*b* which extends from the inner surface of the housing 3*a* of the processing cartridge 3 passes through the hole 32*a* provided in the bottom portion 32 of the cap member 31 in the non-driving side end member 2520, and is inserted into the inner tube portion 23 of the flange member 21. Accordingly, the hole 32*a* and the inner tube portion 23 function as bearings, and support the photoreceptor drum unit 2510 to be rotatable. In addition, the outer surface of the bottom portion 32 of the cap member 31 comes into contact with the inner surface of the housing 3*a* to overlap. At this time, in order to reduce the friction between the outer surface of the bottom portion 32 and the housing 3*a*, here, lubricating oil may be coated, or friction prevention sheet (for example, a Teflon sheet (registered trademark), a nylon sheet, a felt sheet, or a PET sheet) may be nipped. Instead of this, the cap member 31 may be formed of a material having high sliding properties (for example, Teflon sheet (registered trademark)).

According to this, since the non-driving side end member 2520 has the biasing force which presses the photoreceptor drum unit 2510 to the driving shaft 2570 side, and is extendable and contractable, it is possible to press the driving side end member 2550 to the driving shaft 2570 side, and to appropriately insert and engage the bearing portion 2556 with the recessed portion 2571 of the driving shaft 2570. In addition, since a range in which the cap member 31 is extendable and contractable may be employed, conditions for dimension accuracy is relieved.

Therefore, without providing another regulating member, it is possible to simply position the photoreceptor drum in the shaft direction to appropriately transmit the rotating force only by the end member (2520, 2550).

This application is based upon and claims the benefit of priority from Japanese Patent Application No. 2013-238840; filed Nov. 19, 2013; the contents of which are incorporated herein by reference.

According to the aspects of the present invention, in the end member pair which is respectively disposed in the end portions of the photoreceptor drum, the end member on one side has a biasing force and is extendable and contractable in the axial direction. Therefore, when the photoreceptor drum unit is configured, the length thereof can be easily and finely adjusted. Accordingly, the positional relationship between the end member on the other side and the driving shaft of the apparatus main body becomes appropriate by the biasing force, and defects, such as idling, can be prevented. In addition, according to this, since it is not necessary to strictly regulate the movement of the photoreceptor drum in the axial direction, when assembling the processing cartridge, it is not necessary to provide a regulation part which does not have enough dimension, and to improve precision of the member. Accordingly, the management becomes easy, and productivity is improved.

In addition, since it is possible to allow a difference in the length of the photoreceptor drum in a range where the end member extends and contracts, it is possible to use common components of the photoreceptor drum unit, and reduction in costs can be expected by inventory reduction.

REFERENCE SIGNS LIST

1: IMAGE FORMING APPARATUS
2: IMAGE FORMING APPARATUS MAIN BODY
3: PROCESSING CARTRIDGE
10, 2510: PHOTORECEPTOR DRUM UNIT
11: PHOTORECEPTOR DRUM
20, 2520: END MEMBER (ONE END MEMBER, NON-DRIVING SIDE END MEMBER)
21: FLANGE MEMBER
31: CAP MEMBER
41: ELASTIC MEMBER
50, 2550: END MEMBER (THE OTHER END MEMBER, DRIVING SIDE END MEMBER)

What is claimed is:

1. A processing cartridge to be attached to and detached from an image forming apparatus main body, the processing cartridge comprising:

a housing; and a photoreceptor drum unit which is disposed in the housing and held in the housing, wherein the photoreceptor drum unit includes:

a cylindrical photoreceptor drum; and two end members which are respectively disposed at both ends of the photoreceptor drum in an axial direction, wherein one of the end members is provided with an elastic member, is biased in the axial direction, and is extendable and contractable, wherein the other of the end members is provided with a cylindrical bearing member and a shaft member held in the bearing member, wherein the one of the end members and the other of the end members each come into contact with respective inner side surfaces of the housing that face in a direction of the photoreceptor drum, and wherein the one of the end members and the other of the end members do not come into contact with the housing on surfaces facing a photoreceptor drum side.

2. The processing cartridge according to claim 1, wherein the other of the end members is held so that the shaft member swings with respect to the bearing member.

3. The processing cartridge according to claim 1, wherein the shaft member of the other of the end members includes:

a rotating shaft which moves in an axial direction of the bearing member, and a rotating force receiving member which is disposed in one end portion of the rotating shaft, swings with respect to an axis of the rotating shaft, and is provided with an engagement claw which is to be engaged with a driving shaft of the image forming apparatus main body.

4. The processing cartridge according to claim 1, wherein the shaft member of the other of the end members includes:

a rotating shaft, a rotating force receiving member which is disposed in one end portion of the rotating shaft, and is provided with an engaging member to be engaged with a driving shaft of the image forming apparatus main body, and a regulating member which is engaged with or disengaged from the rotating shaft or the rotating force receiving member by pressing, and configured to switch a posture in which the engaging member is engaged with the driving shaft and a posture of not being engaged.

5. The processing cartridge according to claim 1, wherein the shaft member of the other of the end members includes:

a shaft-shape rotating shaft which is disposed coaxially to the bearing member, and moves in the axial direction according to a rotation around an axis with respect to the bearing member, and a tip end member which is disposed coaxially to the rotating shaft, and in which a rotating force receiving member provided with an engaging member to be engaged with a driving shaft of the image forming apparatus main body is disposed at a tip end, and wherein a rotating force around the axis is transmitted to the rotating force receiving member, the rotating shaft, and the bearing member, in order.

6. The processing cartridge according to claim 1, wherein the shaft member of the other of the end members includes:

a shaft-shape rotating shaft which is disposed coaxially to the bearing member, and moves in the axial direction according to a rotation around an axis with respect to the bearing member, and a tip end member which is disposed coaxially to the rotating shaft, and in which a rotating force receiving member provided with an engaging member to be engaged with a driving shaft of the image forming apparatus main body is disposed at a tip end, and wherein a rotating force around the axis is transmitted to the rotating force receiving member, the rotating shaft, and the bearing member, in order, and the rotating force receiving member moves to be inclined with respect to the axis.

7. The processing cartridge according to claim 1, wherein the cylindrical bearing member of the two end members includes a bearing member surface on the drum side that faces a direction of the photoreceptor drum and a bearing member surface on a non-drum side that faces opposite to the photoreceptor drum, the housing of the cartridge includes a housing surface on the drum side that faces a direction of the photoreceptor drum and a housing surface on a non-drum side that faces opposite to the photoreceptor drum, the bearing member surface on the drum side does not come into contact with the housing surface on the non-drum side, and the bearing member surface on the non-drum side comes into contact with the housing surface on the drum side.

8. A photoreceptor drum unit comprising:

a cylindrical photoreceptor drum; and two end members which are respectively disposed at both ends of the photoreceptor drum in an axial direction, wherein one of the end members is provided with an elastic member, is biased in the axial direction, and is extendable and contractable, wherein the other of the end members is provided with a cylindrical bearing member and a shaft member held in the bearing member, and wherein a gear is formed in an outer circumferential portion of the bearing member of the other of the end members, wherein an outer diameter of the bearing member is equal to or smaller than an outer diameter of the photoreceptor drum except a part at which the gear is formed, and wherein the shaft member of the other of the end members includes a rotating shaft which moves in the axial direction of the bearing member.

9. The photoreceptor drum unit according to claim 8, wherein the other of the end members is held so that the shaft member swings with respect to the bearing member.

10. The photoreceptor drum unit according to claim 8, wherein the shaft member of the other of the end members includes:

a rotating force receiving member which is disposed in one end portion of the rotating shaft, swings with respect to the axis of the rotating shaft, and is provided with an engagement claw which is to be engaged with a driving shaft of an image forming apparatus main body.

11. The photoreceptor drum unit according to claim 8, wherein the shaft member of the other of the end members includes:

a rotating force receiving member which is disposed in one end portion of the rotating shaft, and is provided with an engaging member which is to be engaged with a driving shaft of an image forming apparatus main body; and a regulating member which is engaged with or disengaged from the rotating shaft or the rotating force receiving member by pressing, and switches a posture in which the engaging member is engaged with the driving shaft, and a posture of not being engaged.

12. The photoreceptor drum unit according to claim 8, wherein the shaft member of the other of the end members includes:

a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of an image forming apparatus main body is disposed at a tip end, and wherein a rotating force around the axis is transmitted to the rotating force receiving member, the rotating shaft, and the bearing member, in order.

13. The photoreceptor drum unit according to claim 8, wherein the shaft member of the other of the end members includes:

a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of an image forming apparatus main body is disposed at a tip end, and wherein a rotating force around the axis is transmitted to the rotating force receiving member, the rotating shaft, and the bearing member, in order, and the rotating force receiving member moves to be inclined with respect to the axis.

14. An end member pair which is disposed in an end portion of a photoreceptor drum, the end member pair comprising:

one end member that is provided with an elastic member, is biased, and is extendable and contractable;

an other end member that is provided with a cylindrical bearing member and a shaft member held in the bearing member, wherein a gear is formed in an outer circumferential portion of the bearing member, and an outer diameter of the bearing member is formed to be the largest at a part where the gear is formed, and wherein the shaft member of the other end member includes a rotating shaft which moves in the axial direction of the bearing member.

15. The end member pair according to claim 14, wherein the other end member is held so that the shaft member swings with respect to the bearing member.

16. The end member pair according to claim 14, wherein the shaft member of the other end member includes:

a rotating force receiving member which is disposed in one end portion of the rotating shaft, swings with respect to an axis of the rotating shaft, and is provided with an engagement claw which is to be engaged with a driving shaft of an image forming apparatus main body.

17. The end member pair according to claim 14, wherein the shaft member of the other end member includes:

a rotating force receiving member which is disposed in one end portion of the rotating shaft, and is provided with an engaging member which is to be engaged with a driving shaft of an image forming apparatus main body; and a regulating member which is engaged with or disengaged from the rotating shaft or the rotating force receiving member by pressing, and switches a posture in which the engaging member is engaged with the driving shaft, and a posture of not being engaged.

18. The end member pair according to claim 14, wherein the shaft member of the other end member includes:

a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of an image forming apparatus main body is disposed at a tip end, and wherein a rotating force around the axis is transmitted to the rotating force receiving member, the rotating shaft, and the bearing member, in order.

19. The end member pair according to claim 14, wherein the shaft member of the other end member includes:

a shaft-shape rotating shaft which is disposed coaxially to the bearing member, and moves in the axial direction according to a rotation around an axis with respect to the bearing member; and a tip end member which is disposed coaxially to the rotating shaft, and in which a rotating force receiving member provided with an engaging member to be engaged with a driving shaft of an image forming apparatus main body is disposed at a tip end, and wherein a rotating force around the axis is transmitted to the rotating force receiving member, the rotating shaft, and the bearing member, in order, and the rotating force receiving member moves to be inclined with respect to the axis.

* * * * *